US006116035A

United States Patent [19]

Tanaka et al.

[11] Patent Number: 6,116,035

[45] Date of Patent: Sep. 12, 2000

[54] HEAT TRANSFER DEVICE

[75] Inventors: Osamu Tanaka; Takashi Matsuzaki; Kazuhide Mizutani; Yasushi Hori; Toru Inazuka, all of Osaka, Japan

[73] Assignee: Daikin Industries, Ltd., Osaka, Japan

[21] Appl. No.: 09/029,255

[22] PCT Filed: Sep. 6, 1996

[86] PCT No.: PCT/JP96/02558

§ 371 Date: Mar. 5, 1998

§ 102(e) Date: Mar. 5, 1998

[87] PCT Pub. No.: WO97/09570

PCT Pub. Date: Mar. 13, 1997

[30] Foreign Application Priority Data

Sep. 8, 1995 [JP] Japan ..... 7-231174

[51] Int. Cl.[7] ..... F25B 7/00

[52] U.S. Cl. ..... 62/175; 62/119; 62/185; 62/196.4; 62/DIG. 22

[58] Field of Search ..... 62/119, DIG. 22, 62/196.4, 185, 335, 333, 175

[56] References Cited

U.S. PATENT DOCUMENTS 4,295,342 10/1981 Parro ..... 62/119
4,333,517 6/1982 Parro ..... 165/1
4,393,663 7/1983 Grunes et al. ..... 62/119

FOREIGN PATENT DOCUMENTS 4-187993A 7/1990 Japan .
4-194515A 7/1992 Japan .
4-268124A 9/1992 Japan .

*Primary Examiner*—Henry Bennett
*Assistant Examiner*—Marc Norman
*Attorney, Agent, or Firm*—Sixbey, Friedman, Leedom & Ferguson, PC; Eric J. Robinson; Donald R. Studebaker

[57] ABSTRACT

A hot heat source heat exchanger (1) receives heat from a primary refrigerant circuit (A) to evaporate liquid refrigerant. The hot heat source heat exchanger (1) is connected to a cold heat source heat exchanger (2) through a gas flow pipe (4) and a liquid flow pipe (5). An indoor heat exchanger (3) is connected to the gas flow pipe (4) through a gas pipe (6) and connected to the liquid flow pipe (5) through a liquid pipe (7). Gas refrigerant evaporated in the hot heat source heat exchanger (1) flows into at least the cold heat source heat exchanger (2). In the cold heat source heat exchanger (2), the gas refrigerant is condensed and refrigerant flow with respect to the indoor heat exchanger (3) is changed in accordance with a cooling or a heating operation requested by the indoor heat exchanger. In the indoor heat exchanger (3), refrigerant is condensed or evaporated.

74 Claims, 53 Drawing Sheets

HEAT TRANSFER DEVICE

TECHNICAL FIELD

This invention relates to a heat transfer device applicable for refrigerant circuitry of an air conditioner and so on, and particularly relates to a device for transferring heat in a manner of circulating refrigerant without the need for a drive source such as a pump.

BACKGROUND ART

There is conventionally known refrigerant circuitry of an air conditioner with two refrigerant circuits, for example, as disclosed in Japanese Patent Application Laid-Open Gazette No. 62-238951. The refrigerant circuitry of this type has a primary refrigerant circuit formed such that a compressor, a first heat source-side heat exchanger, a pressure reduction mechanism and a first user-side heat exchanger are sequentially connected through refrigerant piping, and a secondary refrigerant circuit formed such that a pump, a second heat source-side heat exchanger and a second user-side heat exchanger are sequentially connected through refrigerant piping. Heat exchange is made between the first user-side heat exchanger of the primary refrigerant circuit and the second heat source-side heat exchanger of the secondary refrigerant circuit. The second user-side heat exchanger is placed in a room to be air-conditioned.

In the air conditioner, during the operation of cooling the room, heat is exchanged between refrigerant evaporated in the first user-side heat exchanger and refrigerant condensed in the second heat source-side heat exchanger, and the condensed refrigerant is then evaporated in the second user-side heat exchanger to cool the room.

On the other hand, during the operation of heating the room, heat is exchanged between refrigerant condensed in the first user-side heat exchanger and refrigerant evaporated in the second heat source-side heat exchanger, and the evaporated refrigerant is then condensed in the second user-side heat exchanger to heat the room.

Thus, the piping length of the primary refrigerant circuit is reduced thereby enhancing refrigerating capacity.

In the secondary refrigerant circuit of the air conditioner above-mentioned, however, the pump is required as a drive source for refrigerant circulation. This invites inconveniences such as increase in power consumption. Further, the addition of the drive source increases the number of failure sites. This incurs an inconvenience of degraded reliability of the overall device.

As a device capable of eliminating the above inconveniences, there is a heat transfer device with no drive source in the secondary refrigerant circuit, commonly-called non-power heat transfer type heat transfer device, as disclosed in Japanese Patent Application Laid-Open gazette No. 63-180022.

In such a heat transfer device, the secondary refrigerant circuit is configured such that a heater, a condenser and a hermetically sealed enclosure are sequentially connected through refrigerant piping. The hermetically sealed enclosure is placed at a higher position than the heater. Further, the heater and the hermetically sealed enclosure are connected through a pressure equalizing pipe having a shut-off valve.

In the above heat transfer device, during the operation of heating the room, the shut-off valve is first closed, gas refrigerant heated in the heater is condensed in the condenser so as to be liquefied, and the liquid refrigerant is recovered to the hermetically sealed enclosure. Thereafter, the shut-off valve is opened so that the heater and the hermetically sealed enclosure is equalized in pressure through the pressure equalizing pipe. Thereby, the liquid refrigerant is returned from the hermetically sealed enclosure located at the position higher than that of the heater to the heater. In a manner that such an operation is repeated, refrigerant circulates in the secondary refrigerant circuit without the need for providing a drive source such as a pump in the secondary refrigerant circuit.

Problems to be Solved

In the above heat transfer device, however, when gas refrigerant is introduced from the condenser into the hermetically sealed enclosure, the pressure in the enclosure rises so that excellent refrigerant circulation may be prevented. To cope with this, gas refrigerant in the condenser is required to be kept supercooled so as not to flow out of the condenser.

Further, in the above heat transfer device, the internal structure of the hermetically sealed enclosure is improved in order to suppress rise in pressure of the hermetically sealed enclosure. However, the reliability of the effect cannot sufficiently be ensured.

Furthermore, in order to introduce liquid refrigerant into the hermetically sealed enclosure with reliability, the condenser is required to be placed at a position higher than that of the hermetically sealed enclosure. This adds many constraints to the placement of elements. Accordingly, it is difficult to apply the above device to large-scaled systems and long-piping systems.

In view of the above problems, the present invention has been made and therefore has its object of reducing constraints to the placement of elements in a non-power heat transfer type heat transfer device necessitating no drive source, thereby providing the heat transfer device with high reliability and general versatility.

Disclosure of Invention

To attain the above object, in the present invention, a heat source is composed of a hot heat source means and a cold heat source means, both the heat source means are connected through a gas flow pipe and a liquid flow pipe, and the flow of refrigerant in the gas flow pipe and the liquid flow pipe with respect to user-side means is changed so that refrigerant is circulated. Further, gas refrigerant flowing out of the user-side means is transferred to the cold heat source means for condensation.

More specifically, a measure taken in the invention comprises hot heat source means (1) for evaporating refrigerant through the application of heat and cold heat source means (2) which is connected to the hot heat source means (1) through a gas flow pipe (4) and a liquid flow pipe (5) to form a closed circuit with the hot heat source means (1) and condenses refrigerant by heat radiation.

There is provided user-side means (3) which is connected to the gas flow pipe (4) through a gas pipe (6) and to the liquid flow pipe (5) through a liquid pipe (7).

Further, there are provided gas flow selecting means (8) for changing gas refrigerant flow between the gas flow pipe (4) and the gas pipe (6) and liquid flow selecting means (9) for changing liquid refrigerant flow between the liquid flow pipe (5) and the liquid pipe (7).

In addition, there is provided control means (C) for controlling at least one of the gas flow selecting means (8)

and the liquid flow selecting means (9) to change refrigerant flow with respect to the user-side means (3) according to an operation mode of the user-side means (3).

Under the arrangement, the control means (C) controls the gas flow selecting means (8) and the liquid flow selecting means (9) to change refrigerant flow with respect to the user-side means (3) according to the operation mode of the user-side means (3). Further, the circulation of refrigerant is made with the use of rise in pressure of refrigerant caused y the amount of heat given to the hot heat source means (1), hereby eliminating the need for a drive source for refrigerant circulation such as a pump.

Furthermore, since the condensation of refrigerant is made in the cold heat source means (2), gas refrigerant is liquefied with reliability and the cold heat source means (2) is prevented from rising in its internal pressure. This achieves excellent refrigerant circulation.

Thus, in the arrangement of the invention, since refrigerant circulation for allowing the user-side means (3) to execute a specified heat exchange is made with the use of rise in pressure caused by the amount of heat given to the hot heat source means (1), a drive source for refrigerant circulation such as a pump can be eliminated. This reduces power consumption and failure sites, thereby obtaining the reliability of the overall device.

Further, since refrigerant condensation is made in the cold heat source means (2), gas refrigerant can be liquefied with reliability and the cold heat source means (2) can be prevented from rising in internal pressure. This achieves excellent refrigerant circulation. As a result, there is no need for keeping refrigerant supercooled in the user-side means (3) so as to prevent gas refrigerant from flowing out of the user-side means (3) as in the conventional case. This ensures a sufficient amount of heat exchange in the user-side means (3) thereby increasing heat exchange capacity.

Furthermore, since constrains to the placement of elements can be reduced, this provides high reliability and general versatility.

As shown in FIG. 1, the control means (C) is preferably configured to control at least the gas flow selecting means (8) to execute an operation of radiating heat of the user-side means (3) in a manner that gas refrigerant is supplied from the hot heat source means (1) to the user-side means (3) for condensation and liquid refrigerant condensed in the user-side means (3) is transferred to the cold heat source means (2) by pressure difference between the cold heat source means (2) which condenses gas refrigerant at a temperature lower than that of the user-side means (3) and the user-side means (3).

Under the arrangement, during the operation of radiating heat of the user-side means (3), a pressure difference is generated between the user-side means (3) and the cold heat source means (2) which condenses gas refrigerant at a temperature lower than the condensation temperature of the user-side means (3). The pressure difference causes the refrigerant condensed in the user-side means (3) to be transferred to the cold heat source means (2). Thereby, refrigerant is circulated so that heat radiation is made in the user-side means (3).

In this case, the cold heat source means (2) is preferably placed at a position higher than the hot heat source means (1). Further, the control means (C) is preferably configured to control at least the gas flow selecting means (8) to execute an operation of recovering refrigerant when liquid refrigerant in the cold heat source means (2) exceeds a specified amount of storage, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering the liquid refrigerant in the cold heat source means (2) to the hot heat source means (1).

Under the arrangement, when liquid refrigerant in the cold heat source means (2) exceeds a specified amount of storage, the liquid refrigerant is recovered to the hot heat source means (1).

Accordingly, in the arrangement of the invention, since liquid refrigerant gradually stored in the cold heat source means (2) with the operation of the user-side means (3) can be recovered to the hot heat source means (1), the operation of the user-side means (3) can be maintained in an excellent condition.

Further, in this case, the gas flow selecting means (8) preferably has a shut-off valve (EV1) provided between the cold heat source means (2) and a connection point of the gas flow pipe (4) with the gas pipe (6). In addition, the control means (C) is preferably configured to close the shut-off valve (EV1) during the operation of radiating heat of the user-side means (3) and open it during the operation of recovering liquid refrigerant in the cold heat source means (2).

Accordingly, the above arrangement of the invention can provide concrete organization of the gas flow selecting means (8). This provides an increased practicality of the device.

Furthermore, in the above case, the liquid flow selecting means (9) preferably includes: a first check valve (CV1) which is provided between the hot heat source means (1) and a connection point of the liquid flow pipe (5) with the liquid pipe (7) and allows only a flow toward the hot heat source means (1); and a second check valve (CV2) which is provided in the liquid pipe (7) and allows only a flow toward the cold heat source means (2).

Accordingly, the above arrangement of the invention can provide concrete organization of the liquid flow selecting means (9). This provides an increased practicality of the device.

The control means (C) of the invention is preferably configured to control the gas flow selecting means (8) and the liquid flow selecting means (9) to execute an operation of absorbing heat of the user-side means (3) in a manner that gas refrigerant is supplied from the hot heat source means (1) to the cold heat source means (2) to push out liquid refrigerant in the cold heat source means (2) to the user-side means (3), the liquid refrigerant is evaporated in the user-side means (3) while the gas refrigerant is condensed in the cold heat source means (2), and the gas refrigerant evaporated in the user-side means (3) is transferred to the cold heat source means (2) by pressure difference between the user-side means (3) and the cold heat source means (2) caused due to drop in pressure of the cold heat source means (2).

Under the arrangement, during the operation of absorbing heat of the user-side means (3), gas refrigerant is supplied from the hot heat source means (1) to the cold heat source means (2) so that liquid refrigerant in the cold heat source means (3) is pushed out to the user-side means (3). Thereafter, the liquid refrigerant is evaporated in the user-side means (3) and the gas refrigerant is condensed in the cold heat source means (2) to decrease the pressure of the cold heat source means (2). The decrease in pressure causes a pressure difference between the user-side means (3) and the cold heat source means (2), so that the gas refrigerant evaporated in the user-side means (3) is transferred to the cold heat source means (2). Thereby, heat absorption is made in the user-side means (3).

In this case, the cold heat source means (2) is preferably placed at a position higher than that of the hot heat source means (1). In addition, the control means (C) is preferably configured to control the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering the liquid refrigerant in the cold heat source means (2) to the hot heat source means (1).

Under the above arrangement, liquid refrigerant in the cold heat source means (2) is recovered to the hot heat source means (1) when liquid refrigerant in the hot heat source means (1) becomes short of a specified amount of storage.

Accordingly, in the above arrangement of the invention, since liquid refrigerant gradually discharged from the hot heat source means (1) with the operation of the user-side means (3) can be recovered from the cold heat source means (2), refrigerant circulation can be maintained in an excellent condition.

Further, in this case, the gas flow selecting means (8) preferably includes: a shut-off valve (EV1) provided between the hot heat source means (1) and a connection point of the gas flow pipe (4) with the gas pipe (6); and a check valve (CVG) which is provided in the gas pipe (6) and allows a flow toward the cold heat source means (2). In addition, the control means (C) is preferably configured to open the shut-off valve (EV1) at the time of pushing out the liquid refrigerant from the cold heat source means (2) to the user-side means (3) and during the operation of recovering liquid refrigerant in the cold heat source means (2) and close it at the time of transfer of refrigerant from the user-side means (3) to the cold heat source means (2).

Accordingly, the above arrangement of the invention can provide concrete organization of the gas flow selecting means (8). This provides an increased practicality of the device.

Furthermore, in the above case, the liquid flow selecting means (9) preferably includes: a shut-off valve (EV4) provided at a recovery flow side part of the liquid flow pipe (5) between the hot heat source means (1) and a connection point with the liquid pipe (7); a first check valve (CV1) which is provided at a recovery flow side part of the liquid flow pipe (5) and allows only a flow toward the hot heat source means (1); and a second check valve (CV3) which is provided in the liquid pipe (7) and allows only a flow toward the user-side means (3). In addition, the control means (C) is preferably configured to close the shut-off valve (EV4) during the operation of absorbing heat of the user-side means (3) and open it during the operation of recovering liquid refrigerant in the cold heat source means (2).

Accordingly, the above arrangement of the invention can provide concrete organization of the liquid flow selecting means (9). This provides an increased practicality of the device.

The control means (C) of the invention may be configured to selectively execute the operation of radiating heat of the user-side means (3) and the operation of absorbing heat of the user-side means (3).

Under the arrangement, both effects of the operations of radiating and absorbing heat of the user-side means (3) can be obtained. This increases practicality.

In this case, the cold heat source means (2) is preferably placed at a position higher than the hot heat source means (1). Further, the control means (C) is preferably configured to control the gas flow selecting means (8) and the liquid flow selecting means (9) to execute an operation of recovering refrigerant when liquid refrigerant in the cold heat source means (2) exceeds a specified amount of storage during the operation of radiating heat and when liquid refrigerant in the hot heat source means (1) becomes short of a specified amount of storage during the operation of absorbing heat, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

Accordingly, in the arrangement of the invention, since liquid refrigerant is recovered to the hot heat source means (1), the operation of the user-side means (3) can be maintained in an excellent condition.

Further, in this case, the gas flow selecting means (8) preferably includes: a first shut-off valve (EV1) provided between the cold heat source means (2) and a connection point of the gas flow pipe (4) with the gas pipe (6); a second shut-off valve (EV2) provided in the gas pipe(6); a connecting pipe (10) whose one end is connected between the first shut-off valve (EV1) and the cold heat source means (2) and whose other end is connected between the second shut-off valve (EV2) and the user-side means (3); a third shut-off valve (EV3) provided in the connecting pipe (10); and a check valve (CVG) which is provided in the connecting pipe (10) and allows only a flow toward the cold heat source means (2).

In addition, the control means (C) is preferably configured to allow the first shut-off valve (EV1) to be closed during the operation of radiating heat of the user-side means (3) and at the transfer of gas refrigerant from the user-side means (3) to the cold heat source means (2) during the operation of absorbing heat of the user-side means (3) and to be open at the time of pushing out liquid refrigerant from the cold heat source means (2) to the user-side means (3) during the operation of absorbing heat of the user-side means (3) and during the operation of recovering liquid refrigerant in the cold heat source means (2), to allow the second shut-off valve (EV2) to be open only during the operation of radiating heat of the user-side means (3), and to allow the third shut-off valve (EV3) to be closed during the operation of radiating heat of the user-side means (3) and to be open during the operation of absorbing heat of the user-side means (3).

Accordingly, the above arrangement of the invention can provide concrete organization of the gas flow selecting means (8). This provides an increased practicality of the device.

Furthermore, in the above case, the liquid flow selecting means (9) preferably includes: a first shut-off valve (EV4) provided at a recovery flow side part of the liquid flow pipe (5) between the hot heat source means (1) and a connection point with the liquid pipe (7); a first check valve (CV1)

which is provided at a recovery flow side part of the liquid flow pipe (5) and allows only a flow toward the hot heat source means (1); and a second shut-off valve (EV5) provided in the liquid pipe (7).

In addition, the control means (C) is preferably configured to allow the shut-off valve (EV4) to be open during the operation of recovering liquid refrigerant in the cold heat source means (2) and to be closed during the operation of absorbing heat of the user-side means (3), and to allow the second shut-off valve (EV5) to be open during the operation of radiating heat of the user-side means (3) and during the operation of absorbing heat of the user-side means (3) and to be closed during the operation of recovering liquid refrigerant in the cold heat source means (2).

Accordingly, the above arrangement of the invention can provide concrete organization of the liquid flow selecting means (9). This provides an increased practicality of the device.

A plurality of the user-side means (3*a*–3*d*) are preferably provided and each of the user-side means (3*a*–3*d*) is preferably connected to the gas flow pipe (4) and the liquid flow pipe (5) through the gas pipe (6) and the liquid pipe (7) respectively in a manner capable of individual selection between an operation of radiating heat and an operation of absorbing heat.

In addition, the control means (C) is preferably configured in a manner of controlling the gas flow selecting means (8) and the liquid flow selecting means (9) to execute an operation of mainly radiating heat in which the heat balance among all the user-side means (3*a*–3*d*) is in a heat radiative condition, in a manner that: gas refrigerant is supplied from the hot heat source means (1) to the heat-radiative user-side means (3) for condensation and the liquid refrigerant condensed in the heat-radiative user-side means (3) is transferred to the cold heat source means (2) by pressure difference between the cold heat source means (2) which condenses the gas refrigerant at a temperature lower than that of the heat-radiative user-side means (3) and the heat-radiative user-side means (3) and transferred to the heat-absorptive user-side means (3) by pressure difference between the heat-absorptive user-side means (3) and the heat-radiative user-side means (3); while the gas refrigerant is concurrently evaporated in the heat-absorptive user-side means (3) and the gas refrigerant evaporated in the heat-absorptive user-side means (3) is transferred to the cold heat source means (2) by pressure difference between the cold heat source means (2) and the heat-absorptive user-side means (3) caused due to refrigerant condensation in the cold heat source means (2).

Under the above arrangement, when the user-side means (3*a*–3*d*) individually execute the operation of radiating heat or the operation of absorbing heat and the number of user-side means (3*a*–3*d*) executing the operation of radiating heat is larger, refrigerant is circulated by pressure difference between the cold heat source means (2) and the heat-radiative user-side means (3), by pressure difference between the heat-absorptive user-side means (3) and the heat-radiative user-side means (3) and by pressure difference between the cold heat source means (2) and the heat-absorptive user-side means (3), so that heat radiation or heat absorption is made in each of the user-side means (3*a*–3*d*).

In this case, the cold heat source means (2) is preferably placed at a position higher than the hot heat source means (1). Further, the control means (C) is preferably configured to control the gas flow selecting means (8) and the liquid flow selecting means (9) to execute an operation of recovering refrigerant when liquid refrigerant in the cold heat source means (2) exceeds a specified amount of storage, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

Accordingly, in the arrangement of the invention, since liquid refrigerant is recovered to the hot heat source means (1), the operation of the user-side means (3) can be maintained in an excellent condition.

A plurality of the user-side means (3*a*–3*d*) are preferably provided and each of the user-side means (3*a*–3*d*) is preferably connected to the gas flow pipe (4) and the liquid flow pipe (5) through the gas pipe (6) and the liquid pipe (7) respectively in a manner capable of individual selection between an operation of radiating heat and an operation of absorbing heat.

In addition, the control means (C) is preferably configured to control the gas flow selecting means (8) and the liquid flow selecting means (9) to execute an operation of mainly absorbing heat in which the heat balance among all the user-side means (3*a*–3*d*) is in a heat absorptive condition, in a manner that: gas refrigerant is supplied from the hot heat source means (1) to the cold heat source means (2) to push out liquid refrigerant in the cold heat source means (2) to the heat-absorptive user-side means (3), the liquid refrigerant is evaporated in the heat-absorptive user-side means (3) while the gas refrigerant is condensed in the cold heat source means (2), and the gas refrigerant evaporated in the heat-absorptive user-side means (3) is transferred to the cold heat source means (2) by pressure difference between the heat-absorptive user-side means (3) and the cold heat source means (2) caused due to drop in pressure of the cold heat source means (2); while gas refrigerant is concurrently supplied from the hot heat source means (1) to the heat-radiative user-side means (3) for condensation and the liquid refrigerant condensed in the heat-radiative user-side means (3) is transferred to the cold heat source means (2) by pressure difference between the heat-radiative user-side means (3) and the cold heat source means (2) having a condensation temperature lower than that of the heat-radiative user-side means (3).

Under the above arrangement, when the user-side means (3*a*–3*d*) individually execute the operation of radiating heat or the operation of absorbing heat and the number of user-side means (3*a*–3*d*) executing the operation of absorbing heat is larger, refrigerant is circulated by pressure difference between the heat-absorptive user-side means (3) and the cold heat source means (2) and by pressure difference between the cold heat source means (2) and the heat-radiative user-side means (3), so that heat radiation or heat absorption is made in each of the user-side means (3*a*–3*d*).

In this case, the cold heat source means (2) is preferably placed at a position higher than the hot heat source means (1). Further, the control means (C) is preferably configured to control the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the cold heat source means (2)

to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

Accordingly, in the arrangement of the invention, since liquid refrigerant is recovered to the hot heat source means (1), the operation of the user-side means (3) can be maintained in an excellent condition.

When a plurality of the user-side means (3*a*–3*d*) are provided, the control means (C) of the invention may be configured to selectively execute the operation of mainly radiating heat of the user-side means (3) and the operation of mainly absorbing heat of the user-side means (3).

Under the arrangement, both effects of the operation of mainly radiating heat of the user-side means (3) and the operation of mainly absorbing heat of the user-side means (3) can be obtained. This increases practicality.

In this case, the gas flow selecting means (8) preferably includes: a first shut-off valve (EV1) provided between the cold heat source means (2) and a connection point of the gas flow pipe (4) with the gas pipe (6); second shut-off valves (EV2-1 to EV2-4) provided in the gas pipes (6*a*–6*d*) and corresponding to the user-side means (3*a*–3*d*), respectively; a plurality of connecting pipes (10*a*–10*d*) each connected at one end thereof between the first shut-off valve (EV1) and the cold heat source means (2) and at the other end between the corresponding second shut-off valve (EV2-1 to EV2-4) and the corresponding user-side means (3*a*–3*d*); third shut-off valves (EV3-1 to EV3-4) provided in the connecting pipes (10*a*–10*d*) and corresponding to the user-side means (3*a*–3*d*), respectively; and a check valve (CVG) which is provided in the connecting pipe (10*a*–10*d*) and allows only a flow toward the cold heat source means (2).

In addition, the control means (C) is preferably configured to allow: the first shut-off valve (EV1) to be closed during the operation of mainly radiating heat and at the transfer of gas refrigerant from the user-side means (3) to the cold heat source means (2) during the operation of mainly absorbing heat but to be open at the time of pushing out liquid refrigerant from the cold heat source means (2) to the heat-absorptive user-side means (3) during the operation of mainly absorbing heat and during the operation of recovering liquid refrigerant in the cold heat source means (2); each of the second shut-off valves (EV2-1 to EV2-4) to be open only during the operation of radiating heat of the corresponding user-side means (3*a*–3*d*); and each of the third shut-off valves (EV3-1 to EV3-4) to be open only during the operation of absorbing heat of the corresponding user-side means (3*a*–3*d*).

Accordingly, the above arrangement of the invention can provide concrete organization of the gas flow selecting means (8). This provides an increased practicality of the device.

Furthermore, in the above case, the liquid flow selecting means (9) preferably includes: a first shut-off valve (EV4) provided at a recovery flow side part of the liquid flow pipe (5) between the hot heat source means (1) and a connection point with the liquid pipe (7); a check valve (CVL) which is provided at a recovery flow side part of the liquid flow pipe (5) and allows only a flow toward the hot heat source means (1); and second shut-off valves (EV5-1 to EV5-4) provided in the liquid pipes (7*a*–7*d*) and corresponding to the user-side means (3*a*–3*d*), respectively.

In addition, the control means (C) is preferably configured to allow: the shut-off valve (EV4) to be open during the operation of recovering liquid refrigerant in the cold heat source means (2) but to be closed during the operation of mainly absorbing heat; and each of the second shut-off valves (EV5-1 to EV5-4) to be open during the operation of radiating heat and the operation of absorbing heat of the corresponding user-side means (3*a*–3*d*) but to be closed during the operation of recovering liquid refrigerant in the cold heat source means (2).

Accordingly, the above arrangement of the invention can provide concrete organization of the liquid flow selecting means (9). This provides an increased practicality of the device.

In the present invention, liquid receive means (22) for storing liquid refrigerant is preferably provided in parallel with the cold heat source means (2). Further, preferably, the liquid receive means (22) is connected at one end thereof between the cold heat source means (2) and a connection point of the gas flow pipe (4) with the gas pipe (6) through a branch pipe (23) and connected at the other end between the cold heat source means (2) and a connection point of the liquid flow pipe (5) with the liquid pipe (7) through a branch pipe (23).

Under the above arrangement, liquid refrigerant is stored in the liquid receive means (22).

Accordingly, since the above arrangement of the invention prevents liquid refrigerant from being stored in the cold heat source means (2), reduction in heat exchange are can be avoided. As a result, the cold heat source means (2) can be maintained at a high efficiency of heat exchange. This increases the efficiency of the overall device.

In this case, as shown in FIG. 19, a shut-off valve (EV11) for changing a flow of refrigerant toward the cold heat source means (2) is preferably provided between the cold heat source means (2) and a connection point of the gas flow pipe (4) with the branch pipe (23).

Under the above arrangement, the shut-off valve (EV11) is closed when liquid refrigerant is discharged from the cold heat source means (2) or the liquid receive means (22).

Accordingly, since the above arrangement of the invention prevents a supply of gas refrigerant from the hot heat source means (1) to the cold heat source means (2), the cold heat source means (2) can be prevented from being unnecessarily heated. This promotes energy conservation.

Preferably, a plurality of the cold heat source means (2*a*, 2*b*) are provided, are connected to the hot heat source means (1) through the gas flow pipes (4*a*, 4*b*) and the liquid flow pipes (5*a*, 5*b*) respectively to each form a closed circuit with the hot heat source means (1), and are each configured to switchably serve as operating cold heat source means for executing an operation of radiating heat in a state that gas refrigerant is stored therein and as stopping cold heat source means for stopping the operation of radiating heat in a state that liquid refrigerant is stored therein.

In addition, preferably, the gas flow selecting means (8) is configured to change gas refrigerant flow between each of the gas flow pipes (4*a*, 4*b*) and the gas pipe (6) and the liquid flow selecting means (9) is configured to change liquid refrigerant flow between each of the liquid flow pipes (5*a*, 5*b*) and the liquid pipe (7).

Under the above arrangement, the connection-state of each of the cold heat source means (2*a*, 2*b*) with the user-side means (3) is changed while refrigerant is circulated between the operating cold heat source means (2*a*, 2*b*) and the user-side means (3) at all times.

Accordingly, since the above arrangement of the invention provides heat radiation or heat absorption of the user-side means (3) at all times, the operation of radiating heat or the operation of absorbing heat can be successively executed.

When the plurality of the cold heat source means (2*a*, 2*b*) are provided in the invention, as shown in FIG. 21, each of the cold heat source means (2*a*, 2*b*) is preferably placed at a position higher than that of the hot heat source means (1) and the user-side means (3) is preferably connected to the gas flow pipes (4*a*, 4*b*) and the liquid flow pipes (5*a*, 5*b*) through the gas pipe (6) and the liquid pipe (7) respectively.

In addition, the control means (C) is preferably configured to control at least the gas flow selecting means (8) to execute an operation of radiating heat of the user-side means (3) in a manner that: gas refrigerant is supplied from the hot heat source means (1) to the stopping cold heat source means (2*a*) and the user-side means (3) so that the gas refrigerant is condensed in the user-side means (3) and the liquid refrigerant condensed in the user-side means (3) is transferred to the operating cold heat source means (2*b*) by pressure difference between the operating cold heat source means (2*b*) which condenses the gas refrigerant at a temperature lower than that of the user-side means (3) and the user-side means (3); when liquid refrigerant in the operating cold heat source means (2*b*) exceeds a specified amount of storage, the control means (C) changes the operating cold heat source means (2*b*) into the stopping cold heat source means (2*b*) to execute an operation of recovering refrigerant and changes the remaining stopping cold heat source means (2*a*) into the operating cold heat source means (2*a*), whereby the supply of gas refrigerant from the hot heat source means (1) to the operating cold heat source means (2*a*) is stopped, gas refrigerant is supplied from the hot heat source means (1) to the user-side means (3) and is condensed in the user-side means (3) thereby allowing the operation of radiating heat to be continued, and gas refrigerant is supplied from the hot heat source means (1) to the stopping cold heat source means (2*b*) to equalize pressures of the hot heat source means (1) and the stopping cold heat source means (2*b*) thereby producing a flow of liquid refrigerant from the stopping cold heat source means (2*b*) to the hot heat source means (1) to recover the liquid refrigerant in the stopping cold heat source means (2*b*) to the hot heat source means (1); and the control means (C) alternately changes each of the cold heat source means (2*a*, 2*b*) between the operating cold heat source means and the stopping cold heat source means thereby successively executing the operation of radiating heat.

Under the above arrangement, refrigerant is circulated between the operating cold heat source means (2*a*, 2*b*) and the user-side means (3) during the operation of radiating heat of the user-side means (3), so that the operation of radiating heat of the user-side means (3) can be successively executed.

Accordingly, since the above arrangement provides a continuous operation of radiating heat of the user-side means (3), when the device having the above arrangement is applied to an air conditioner for heating a room, heating operation can be successively executed thereby increasing comfortableness of the room.

In this case, the gas flow selecting means (8) preferably includes shut-off valves (EV1-1, EV1-2) which are provided between the cold heat source means (2*a*, 2*b*) and connection points of the gas flow pipes (4*a*, 4*b*) with the gas pipe (6) and correspond to the cold heat source means (2*a*, 2*b*), respectively.

In addition, the control means (C) is preferably configured to close each of the shut-off valves (EV1-1, EV1-2) at the transfer of gas refrigerant from the user-side means (3) to the cold heat source means (2*a*, 2*b*) corresponding to the shut-off valve (EV1-1, EV1-2) and open it during the operation of recovering liquid refrigerant in the cold heat source means (2*a*, 2*b*) corresponding to the shut-off valve (EV1-1, EV1-2).

Accordingly, the above arrangement of the invention can provide concrete organization of the gas flow selecting means (8). This provides an increased practicality of the device.

Furthermore, in the above case, the liquid flow selecting means (9) preferably includes: first check valves (CV1-1, CV1-2) which are provided between the hot heat source means (1) and connection points of the liquid flow pipes (5*a*, 5*b*) with the liquid pipes (7*a*, 7*b*) and allow only flows toward the hot heat source means (1), respectively; and second check valves (CV2-1, CV2-2) which are provided in the liquid pipes (7*a*, 7*b*) and allows only flows toward the cold heat source means (2), respectively.

Accordingly, the above arrangement of the invention can provide concrete organization of the liquid flow selecting means (9). This provides an increased practicality of the device.

When the plurality of the cold heat source means (2*a*, 2*b*) are provided in the invention, as shown in FIG. 23, the user-means (3) is preferably connected to the gas flow pipes (4*a*, 4*b*) and the liquid flow pipes (5*a*, 5*b*) through the gas pipe (6) and the liquid pipe (7) respectively.

In addition, the control means (C) is preferably configured to control the gas flow selecting means (8) and the liquid flow selecting means (9) to execute an operation of absorbing heat of the user-side means (3) in a manner that: gas refrigerant is supplied from the hot heat source means (1) to the stopping cold heat source means (2*a*) to push out liquid refrigerant in the stopping cold heat source means (2*a*) to the user-side means (3), the liquid refrigerant is evaporated in the user-side means (3) while the gas refrigerant is condensed in the operating cold heat source means (2*b*), and the gas refrigerant evaporated in the user-side means (3) is transferred to the operating cold heat source means (2b-) by pressure difference between the user-side means (3) and the operating cold heat source means (2*b*) caused due to drop in pressure of the operating cold heat source means (2*b*); when liquid refrigerant in the operating cold heat source means (2*b*) exceeds a specified amount of storage, the control means (C) changes the operating cold heat source means (2*b*) and the remaining stopping cold heat source means (2*a*) into the stopping cold heat source means (2*b*) and the operating cold heat source means (2*a*) respectively, whereby the supply of gas refrigerant from the hot heat source means (1) to the operating cold heat source means (2*a*) is stopped while gas refrigerant is supplied from the hot heat source means (1) to the stopping cold heat source means (2*b*) to push out the liquid refrigerant in the stopping cold heat source means (2*b*) to the user-side means (3) thereby allowing the operation of absorbing heat to be continued; and the control means (C) alternately changes each of the cold heat source means (2*a*, 2*b*) between the operating cold heat source means and the stopping cold heat source means thereby successively executing the operation of absorbing heat.

Under the above arrangement, during the operation of absorbing heat of the user-side means (3), refrigerant is circulated between the operating cold heat source means (2*a*, 2*b*) and the user-side means (3) while liquid refrigerant in the stopping cold heat source means (2*a*, 2*b*) is recovered to the hot heat source means (1) at all times, so that the operation of absorbing heat of the user-side means (3) can be successively executed.

Accordingly, since the above arrangement provides a continuous operation of absorbing heat of the user-side means (3), when the device having the above arrangement is applied to an air conditioner for cooling a room, cooling operation can be successively executed thereby increasing comfortableness of the room.

In this case, the gas flow selecting means (8) preferably includes: shut-off valves (EV1-1, EV1-2) provided between the hot heat source means (1) and connection points of the gas flow pipes (4*a*, 4*b*) with the gas pipes (6*e*, 6*f*) and corresponding to the cold heat source means (2*a*, 2*b*), respectively; and check valves (CVG1, CVG2) which are provided in the gas pipes (6*e*, 6*f*) and allow only flows toward the cold heat source means (2*a*, 2*b*), respectively.

In addition, the control means (C) is preferably configured to open each of the shut-off valves (EV1-1, EV1-2) at the time of pushing out liquid refrigerant from the cold heat source means (2*a*, 2*b*) corresponding to the shut-off valve (EV1-1, EV1-2) to the user-side means (3) and during the operation of recovering the liquid refrigerant in the cold heat source means (2*a*, 2*b*) corresponding to the shut-off valve (EV1-1, EV1-2) and close it at the transfer of gas refrigerant from the user-side means (3) to the cold heat source means (2*a*, 2*b*) corresponding to the shut-off valve (EV1-1, EV1-2).

Accordingly, the above arrangement of the invention can provide concrete organization of the gas flow selecting means (8). This provides an increased practicality of the device.

Furthermore, in the above case, the liquid flow selecting means (9) preferably includes: a shut-off valve (EV4) provided at a recovery flow side part of the liquid flow pipes (5*a*, 5*b*) between the hot heat source means (1) and connection points with the liquid pipes (7*e*, 7*f*); first check valves (CV1-1, CV1-2) which are provided at recovery flow side parts of the liquid flow pipes (5*a*, 5*b*) and allow only flows toward the hot heat source means (1), respectively; and second check valves (CV3-1, CV3-2) which are provided in the liquid pipes (7*e*, 7*f*) and allow only flows toward the cold heat source means (2), respectively.

In addition, the control means (C) is preferably configured to close the shut-off valve (EV4) during the operation of absorbing heat of the user-side means (3) and open it during the operation of recovering liquid refrigerant in the cold heat source means (2).

Accordingly, the above arrangement of the invention can provide concrete organization of the liquid flow selecting means (9). This provides an increased practicality of the device.

When the plurality of the cold heat source means (2*a*, 2*b*) are provided, the control means (C) may be configured to selectively execute the operation of radiating heat of the user-side means (3) and the operation of absorbing heat of the user-side means (3).

Under the arrangement, both effects of the operations of radiating and absorbing heat of the user-side means (3) can be obtained. This increases practicality.

In this case, the control means (C) is preferably configured to control the gas flow selecting means (8) and the liquid flow selecting means (9) to execute an operation of recovering refrigerant when liquid refrigerant in the hot heat source means (1) becomes short of a specified amount of storage during the operation of absorbing heat of the user-side means (3), in a manner that gas refrigerant is supplied from the hot heat source means (1) to the operating cold heat source means (2) to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

Under the above arrangement, when the storage amount of liquid refrigerant in the hot heat source means (1) becomes small, liquid refrigerant is recovered to the hot heat source means (1).

Accordingly, in the arrangement of the invention, since liquid refrigerant can be recovered while the operation of absorbing heat of the user-side mans (3) is continued, this enables a continuous operation of the user-side means (3).

Further, in this case, the gas flow selecting means (8) preferably includes: first shut-off valves (EV1-1, EV1-2) which are provided between the cold heat source means (2) and connection points of the gas flow pipes (4*a*, 4*b*) with the gas pipe (6) and correspond to the cold heat source means (2*a*, 2*b*), respectively; a second shut-off valve (EV2) provided in the gas pipe (6); a connecting pipe (20) connected at one end thereof between the first shut-off valves (EV1-1, EV1-2) and the cold heat source means (2*a*, 2*b*) and at the other end between the second shut-off valve (EV2) and the user-side means (3); a third shut-off valve (EV3) provided in the connecting pipe (20); and check valves (CVG1, CVG2) which are provided in the connecting pipe (20) and allow only flows toward the cold heat source means (2*a*, 2*b*), respectively.

In addition, the control means (C) is preferably configured to allow: each of the first shut-off valves (EV1-1, EV1-2) to be closed at the transfer of liquid refrigerant from the user-side means (3) to the cold heat source means (2*a*, 2*b*) corresponding to the first shut-off valve (EV1-1, EV1-2) during the operation of radiating heat and at the transfer of gas refrigerant from the user-side means (3) to the cold heat source means (2*a*, 2*b*) corresponding to the first shut-off valve (EV1-1, EV1-2) during the operation of absorbing heat but to be open at the supply of gas refrigerant from the hot heat source means (1) to the cold heat source means (2*a*, 2*b*) corresponding to the first shut-off valve (EV1-1, EV1-2) during the operation of absorbing heat; the second shut-off valve (EV2) to be open only during the operation of radiating heat of the user-side means (3); and the third shut-off valve (EV3) to be open only during the operation of absorbing heat of the user-side means (3).

Accordingly, the above arrangement of the invention can provide concrete organization of the gas flow selecting means (8). This provides an increased practicality of the device.

Furthermore, in the above case, the liquid flow selecting means (9) preferably includes: a first shut-off valve (EV4) provided at a recovery flow side part of the liquid flow pipes (5*a*, 5*b*) between the hot heat source means (1) and connection points with the liquid pipes (7*e*, 7*f*); check valves (CV1-1, CV1-2) which are provided at recovery flow side parts of the liquid flow pipes (5*a*, 5*b*) and allow only flows toward the hot heat source means (1), respectively; and second shut-off valves (EV6-1, EV6-2) which are provided in the liquid pipes (7*e*, 7*f*) and correspond to the cold heat source means (2*a*, 2*b*), respectively.

In addition, the control means (C) is preferably configured to allow: the shut-off valve (EV4) to be open during the operation of recovering liquid refrigerant in the cold heat source means (2*a*, 2*b*) but to be closed during the operation of absorbing heat of the user-side means (3); each of the second shut-off valves (EV6-1, EV6-2) to be open at the transfer of liquid refrigerant from the user-side means (3) to the cold heat source means (2*a*, 2*b*) corresponding to the second shut-off valve (EV6-1, EV6-2) during the operation of radiating heat and at the time of pushing out liquid refrigerant from the cold heat source means (2*a*, 2*b*) corresponding to the second shut-off valve (EV6-1, EV6-2) to the user-side means (3) during the operation of absorbing heat; and each of the second shut-off valves (EV6-1, EV6-2) to be closed at the supply of gas refrigerant from the hot heat source means (1) to the cold heat source means (2*a*, 2*b*) corresponding to the second shut-off valve (EV6-1, EV6-2) during the operation of radiating heat and at the transfer of gas refrigerant from the user-side means (3) to the cold heat source means (2*a*, 2*b*) corresponding to the second shut-off valve (EV6-1, EV6-2) during the operation of absorbing heat.

Accordingly, the above arrangement of the invention can provide concrete organization of the liquid flow selecting means (9). This provides an increased practicality of the device.

When the plurality of the cold heat source means (2*a*, 2*b*) are provided, as shown in FIG. 28, a plurality of the user-side means (3*a*–3*d*) are preferably provided, each of the user-side means (3*a*–3*d*) is preferably connected to the gas flow pipes (4*a*, 4*b*) and the liquid flow pipes (5*a*, 5*b*) through the gas pipe (6) and the liquid pipes (7*e*, 7*f*) respectively in a manner capable of individual selection between an operation of radiating heat and an operation of absorbing heat, and each of the cold heat source means (2*a*, 2*b*) is preferably placed at a position higher than that of the hot heat source means (1).

In addition, the control means (C) is preferably configured to control the gas flow selecting means (8) and the liquid flow selecting means (9) to execute an operation of mainly radiating heat in which the heat balance among all the user-side means (3*a*–3*d*) is in a heat radiative condition, in a manner that: gas refrigerant is supplied from the hot heat source means (1) to the stopping cold heat source means (2*a*) and the heat-radiative user-side means (3) so that the gas refrigerant is condensed in the user-side means (3) and the liquid refrigerant condensed in the heat-radiative user-side means (3) is transferred to the operating cold heat source means (2*b*) by pressure difference between the operating cold heat source means (2*b*) which condenses the gas refrigerant at a temperature lower than that of the heat-radiative user-side means (3) and the heat-radiative user-side means (3) and transferred to the heat-absorptive user-side means (3) by pressure difference between the heat-absorptive user-side means (3) and the heat-radiative user-side means (3); while the gas refrigerant is concurrently evaporated in the heat-absorptive user-side means (3) and the gas refrigerant evaporated in the heat-absorptive user-side means (3) is transferred to the operating cold heat source means (2*b*) by pressure difference between the operating cold heat source means (2*b*) and the heat-absorptive user-side means (3) caused due to refrigerant condensation in the operating cold heat source means (2*b*).

Further, the control means (C) is preferably configured: (a) when liquid refrigerant in the operating cold heat source means (2*b*) exceeds a specified amount of storage, to change the operating cold heat source means (2*b*) into the stopping cold heat source means (2*b*) to execute an operation of recovering refrigerant and change the remaining stopping cold heat source means (2*a*) into the operating cold heat source means (2*a*), whereby the supply of gas refrigerant from the hot heat source means (1) to the operating cold heat source means (2*a*) is stopped, gas refrigerant is supplied from the hot heat source means (1) to the heat-radiative user-side means (3) and is condensed in the heat-radiative user-side means (3) thereby allowing the operation of mainly radiating heat to be continued, and gas refrigerant is supplied from the hot heat source means (1) to the stopping cold heat source means (2*b*) to equalize pressures of the hot heat source means (1) and the stopping cold heat source means (2*b*) thereby producing a flow of liquid refrigerant from the stopping cold heat source means (2*b*) to the hot heat source means (1) to recover the liquid refrigerant in the stopping cold heat source means (2*b*) to the hot heat source means (1); and (*b*) to alternately change each of the cold heat source means (2*a*, 2*b*) between the operating cold heat source means and the stopping cold heat source means thereby successively executing the operation of mainly radiating heat.

Under the above arrangement, refrigerant is circulated between each of the user-side means (3*a*–3*d*) and each of the cold heat source means (2*a*, 2*b*) so that heat radiation or heat absorption is executed in each of the user-side means (3*a*–3*d*).

When the plurality of the cold heat source means (2*a*, 2*b*) are provided, a plurality of the user-side means (3*a*–3*d*) are preferably provided, and each of the user-side means (3*a*–3*d*) is preferably connected to the gas flow pipes (4*a*, 4*b*) and the liquid flow pipes (5*a*, 5*b*) through the gas pipe (6) and the liquid pipes (7*e*, 7*f*) respectively in a manner capable of individual selection between an operation of radiating heat and an operation of absorbing heat.

In addition, the control means (C) is preferably configured to control the gas flow selecting means (8) and the liquid flow selecting means (9) to execute an operation of mainly absorbing heat in which the heat balance among all the user-side means (3*a*–3*d*) is in a heat absorptive condition, in a manner that: gas refrigerant is supplied from the hot heat source means (1) to the heat-radiative user-side means (3) and is condensed in the user-side means (3) and the liquid refrigerant condensed in the heat-radiative user-side means (3) is transferred to the heat-absorptive user-side means (3) by pressure difference between the heat-radiative user-side means (3) and the heat-absorptive user-side means (3) while gas refrigerant is supplied from the hot heat source means (1) to the stopping cold heat source means (2*a*) to push out liquid refrigerant in the stopping cold heat source means (2*a*) to the heat-absorptive user-side means (3); and the liquid refrigerant is evaporated in the heat-absorptive user-side means (3) while gas refrigerant is condensed in the operating cold heat source means (2*b*), and the gas refrigerant evaporated in the heat-absorptive user-side means (3) is transferred to the operating cold heat source means (2*b*) by pressure difference between the heat-absorptive user-side means (3) and the operating cold heat source means (2*b*) caused due to drop in pressure of the operating cold heat source means (2*b*).

Further, the control means (C) is preferably configured: (a) when liquid refrigerant in the operating cold heat source means (2*b*) exceeds a specified amount of storage, to change the operating cold heat source means (2*b*) and the remaining stopping cold heat source means (2*a*) into the stopping cold heat source means (2*b*) and the operating cold heat source means (2*a*) respectively, whereby the supply of gas refrigerant from the hot heat source means (1) to the operating cold heat source means (2*a*) is stopped while gas refrigerant is supplied from the hot heat source means (1) to the stopping cold heat source means (2*b*) and the heat-radiative user-side means (3) so that the liquid refrigerant in the stopping cold heat source means (2*b*) is pushed out to the heat-absorptive user-side means (3) thereby allowing the operation of mainly absorbing heat to be continued; and (b) to alternately change each of the cold heat source means (2*a*, 2*b*) between the operating cold heat source means and the stopping cold heat source means thereby successively executing the operation of mainly absorbing heat.

Under the above arrangement, refrigerant is circulated between each the user-side means (3*a*–3*d*) and each of the cold heat source means (2*a*, 2*b*) so that heat radiation or heat absorption is executed in each of the user-side means (3*a*–3*d*).

In this case, each of the cold heat source means (2*a*, 2*b*) is preferably placed at a position higher than that of the hot heat source means (1). Further, the control means (C) is preferably configured in a manner of controlling the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the operating cold heat source means (2*a*, 2*b*) to equalize pressures of the hot heat source means (1) and each of the cold heat source means (2*a*, 2*b*) so that a flow of liquid refrigerant from the cold heat source means (2*a*, 2*b*) to the hot heat source means (1) is produced thereby recovering liquid refrigerant in the cold heat source means (2*a*, 2*b*) to the hot heat source means (1).

Under the above arrangement, when the storage amount of liquid refrigerant in the hot heat source means (1) becomes small, liquid refrigerant is recovered to the hot heat source means (1).

Accordingly, in the arrangement of the invention, since liquid refrigerant can be recovered while the operation of mainly absorbing heat of the user-side means (3) is continued, this enables a continuous operation of the user-side means When the plurality of cold heat source means (2*a*, 2*b*) and a plurality of user-side means (3*a*–3*d*) are provided, the control means (C) of the invention may be configured to selectively execute the operation of mainly radiating heat of the user-side means (3) and the operation of mainly absorbing heat of the user-side means (3).

Under the arrangement, both effects of the operation of mainly radiating heat of the user-side means (3) and the operation of mainly absorbing heat of the user-side means (3) can be obtained. This increases practicality.

In this case, the gas flow selecting means (8) preferably includes: first shut-off valves (EV1-1, EV1-2) which are provided between the cold heat source means (2*a*, 2*b*) and connection points of the gas flow pipes (4*a*, 4*b*) with the gas pipe (6) and correspond to the cold heat source means (2*a*, 2*b*), respectively; second shut-off valves (EV2-1 to EV2-4) provided in the gas pipes (6*a*–6*d*) and corresponding to the user-side means (3*a*–3*d*), respectively; a plurality of connecting pipes (20) which are connected at one side thereof between the first shut-off valves (EV1-1, EV1-2) and the cold heat source means (2*a*, 2*b*) respectively and connected at the other side between the second shut-off valves (EV2-1 to EV2-4) and the user-side means (3*a*–3*d*) respectively; third shutoff valves (EV3-1 to EV3-4) provided in the connecting pipes (20) and corresponding to the user-side means (3*a*–3*d*), respectively; and check valves (CVG1, CVG2) which are provided in the connecting pipes (20) and allow only flows toward the cold heat source means (2*a*, 2*b*), respectively.

In addition, the control means (C) is preferably configured to allow: each of the first shut-off valves (EV1-1, EV1-2) to be closed at the transfer of liquid refrigerant from the heat-radiative user-side means (3) to the cold heat source means (2*a*, 2*b*) corresponding to the first shut-off valve (EV1-1, EV1-2) during the operation of mainly radiating heat and at the transfer of gas refrigerant from the heat-absorptive user-side means (3) to the cold heat source means (2*a*, 2*b*) corresponding to the first shut-off valve (EV1-1, EV1-2) during the operation of mainly absorbing heat, but to be open at the supply of gas refrigerant from the hot heat source means (1) to the cold heat source means (2*a*, 2*b*) corresponding to the first shut-off valve (EV1-1, EV1-2); each of the second shut-off valves (EV2-1 to EV2-4) to be open only during the operation of radiating heat of the user-side means (3) corresponding to the second shut-off valve (EV2-1 to EV2-4); and each of the third shut-off valves (EV3-1 to EV3-4) to be open only during the operation of absorbing heat of the user-side means (3) corresponding to the third shut-off valve (EV3-1 to EV3-4).

Accordingly, the above arrangement of the invention can provide concrete organization of the gas flow selecting means (8). This provides an increased practicality of the device.

Furthermore, in the above case, the liquid flow selecting means (9) preferably includes: a first shut-off valve (EV4) provided at a recovery flow side part of the liquid flow pipes (5*a*, 5*b*) between the hot heat source means (1) and connection points with the liquid pipes (7*e*, 7*f*); check valves (CV1-1, CV1-2) which are provided at recovery flow side parts of the liquid flow pipes (5*a*, 5*b*) and allow only flows toward the hot heat source means (1), respectively; and second shut-off valves (EV6-1, EV6-2) provided in the liquid pipes (7*e*, 7*f*) and corresponding to the cold heat source means (2*a*, 2*b*), respectively.

In addition, the control means (C) is preferably configured to allow: the shut-off valve (EV4) to be open only during the operation of recovering liquid refrigerant in the cold heat source means (2*a*, 2*b*); each of the second shut-off valves (EV6-1, EV6-2) to be open at the transfer of refrigerant from the heat-radiative user-side means (3) to the cold heat source means (2*a*, 2*b*) corresponding to the second shut-off valve (EV6-1, EV6-2) during the operation of mainly radiating heat and at the time of pushing out liquid refrigerant from the cold heat source means (2*a*, 2*b*) corresponding to the second shut-off valve (EV6-1, EV6-2) to the heat-absorptive user-side means (3); and each of the second shut-off valves (EV6-1, EV6-2) to be closed at the supply of gas refrigerant from the hot heat source means (1) to the cold heat source means (2*a*, 2*b*) corresponding to the second shut-off valve (EV6-1, EV6-2) during the operation of mainly radiating heat and at the transfer of gas refrigerant from the heat-absorptive user-side means (3) to the cold heat source means (2*a*, 2*b*) corresponding to the second shut-off valve (EV6-1, EV6-2) during the operation of mainly absorbing heat.

Accordingly, the above arrangement of the invention can provide concrete organization of the liquid flow selecting means (9). This provides an increased practicality of the device.

Preferably, in the present invention, a plurality of liquid receive means (25*a*, 25*b*) for storing liquid refrigerant are provided, are connected to the gas flow pipes (4*a*, 4*b*) and the liquid flow pipes (5*a*, 5*b*) through gas pipes (26*a*, 26*b*) and liquid pipes (27*a*, 27*b*) respectively and are each configured to switchably serve as charging liquid receive means for storing liquid refrigerant from a state that the storage amount of gas refrigerant is large and as discharging liquid receive means for discharging liquid refrigerant in a state that the storage amount of liquid refrigerant is large.

In addition, preferably, the gas flow selecting means (8) is configured to change gas refrigerant flow between each of the gas flow pipes (4*a*, 4*b*) and the corresponding gas pipe (26*a*, 26*b*) and the liquid flow selecting means (9) is configured to change liquid refrigerant flow between each of the liquid flow pipes (5*a*, 5*b*) and the corresponding liquid pipe (27*a*, 27*b*).

Under the above arrangement, the connection state of each of the liquid receive means (25*a*, 25*b*) with the user-side means (3) is changed while refrigerant is circulated between the charging liquid receive means (25*a*, 25*b*) and the user-side means (3) at all times.

Accordingly, since the above arrangement of the invention provides heat radiation or heat absorption of the user-side means (3) at all times, the operation of radiating heat or the operation of absorbing heat can be successively executed.

When the plurality of the liquid receive means (25*a*, 25*b*) are provided in the invention, as shown in FIG. 32, each of the liquid receive means (25*a*, 25*b*) is preferably placed at a position higher than that of the hot heat source means (1).

In addition, the control means (C) is preferably configured to control at least the gas flow selecting means (8) to execute an operation of radiating heat of the user-side means (3) in a manner that: gas refrigerant is supplied from the hot heat source means (1) to the discharging liquid receive means (25*a*) and the user-side means (3) so that the gas refrigerant is condensed in the user-side means (3) and the liquid refrigerant condensed in the user-side means (3) is transferred to the charging liquid receive means (25*b*) by pressure difference between the cold heat source means (2) which condenses the gas refrigerant at a temperature lower than that of the user-side means (3) and the user-side means (3).

Further, the control means (C) is preferably configured: (a) when liquid refrigerant in the charging liquid receive means (25*b*) exceeds a specified amount of storage, to change the charging liquid receive means (25*b*) into the discharging liquid receive means (25*b*) to execute an operation of recovering refrigerant and change the remaining discharging liquid receive means (25*a*) into the charging liquid receive means (25*a*), whereby the supply of gas refrigerant from the hot heat source means (1) to the charging liquid receive means (25*a*) is stopped, gas refrigerant is supplied from the hot heat source means (1) to the user-side means (3) and is condensed in the user-side means (3) thereby allowing the operation of radiating heat to be continued, and gas refrigerant is supplied from the hot heat source means (1) to the discharging liquid receive means (25*b*) to equalize pressures of the hot heat source means (1) and the discharging liquid receive means (25*b*) thereby producing a flow of liquid refrigerant from the discharging liquid receive means (25*b*) to the hot heat source means (1) to recover the liquid refrigerant in the discharging liquid receive means (25*b*) to the hot heat source means (1); and (*b*) to alternately change each of the liquid receive means (25*a*, 25*b*) between the charging liquid receive means and the discharging liquid receive means thereby successively executing the operation of radiating heat.

Under the above arrangement, during the operation of radiating heat of the user-side means (3), refrigerant is circulated between the charging liquid receive means (25*a*, 25*b*) and the user-side means (3) while liquid refrigerant is recovered from the discharging liquid receive means (25*a*, 25*b*) to the hot heat source means (1) at all times, so that the operation of radiating heat of the user-side means (3) can be successively executed.

Accordingly, since the above arrangement provides a continuous operation of radiating heat of the user-side means (3), when the device having the above arrangement is applied to an air conditioner for heating a room, heating operation can be successively executed thereby increasing comfortableness of the room.

In this case, the gas flow selecting means (8) preferably includes: first shut-off valves (EV7-1, EV7-2) which are provided between the hot heat source means (1) and connection points of the gas flow pipes (4*a*, 4*b*) with the gas pipes (26*a*, 26*b*) and correspond to the liquid receive means (25*a*, 25*b*), respectively; and second shut-off valves (EV8-1, EV8-2) which are provided between the cold heat source means (2) and connection points of the gas flow pipes (4*a*, 4*b*) with the gas pipes (26*a*, 26*b*) and correspond to the liquid receive means (25*a*, 25*b*), respectively.

In addition, the control means (C) is preferably configured to allow: each of the first shut-off valves (EV7-1, EV7-2) to be closed at the transfer of liquid refrigerant from the user-side means (3) to the liquid receive means (25*a*, 25*b*) corresponding to the first shut-off valve (EV7-1, EV7-2) but to be open during the operation of recovering liquid refrigerant in the liquid receive means (25*a*, 25*b*) corresponding to the first shut-off valve (EV7-1, EV7-2); and each of the second shut-off valves (EV8-1, EV8-2) to be closed at the supply of gas refrigerant from the hot heat source means (1) to the liquid receive means (25*a*, 25*b*) corresponding to the second shut-off valve (EV8-1, EV8-2) but to be open at the transfer of liquid refrigerant from the user-side means (3) to the liquid receive means (25*a*, 25*b*) corresponding to the second shut-off valve (EV8-1, EV8-2).

Accordingly, the above arrangement of the invention can provide concrete organization of the gas flow selecting means (8). This provides an increased practicality of the device.

Furthermore, in the above case, the liquid flow selecting means (9) preferably includes: first check valves (CV1-1, CV1-2) which are provided between the hot heat source means (1) and connection points of the liquid flow pipes (5*a*, 5*b*) with the liquid pipes (27*a*, 27*b*) and allow only flows toward the hot heat source means (1), respectively; second check valves (CV2-1, CV2-2) which are provided between the cold heat source means (2) and connection points of the liquid flow pipes (5*a*, 5*b*) with the liquid pipes (27*a*, 27*b*) and allow only flows toward the liquid receive means (25*a*, 25*b*), respectively; a third check valve (CV4) which is provided in the liquid pipe (7) and allows only flows toward the liquid receive means (25*a*, 25*b*).

Accordingly, the above arrangement of the invention can provide concrete organization of the liquid flow selecting means (9). This provides an increased practicality of the device.

When the plurality of the liquid receive means (25*a*, 25*b*) are provided in the invention, as shown in FIG. 34, the control means (C) is preferably configured to control the gas flow selecting means (8) and the liquid flow selecting means (9) to execute an operation of absorbing heat of the user-side means (3) in a manner that: gas refrigerant is supplied from the hot heat source means (1) to the discharging liquid receive means (25*a*) to push out liquid refrigerant in the discharging liquid receive means (25*a*) to the user-side means (3), the liquid refrigerant is evaporated in the user-side means (3) while the gas refrigerant is condensed in the cold heat source means (2), and the gas refrigerant evaporated in the user-side means (3) is transferred to the charging liquid receive means (25*b*) communicated with the cold heat source means (2) by pressure difference between the user-side means (3) and the cold heat source means (2) caused due to drop in pressure of the cold heat source means (2).

Further, the control means (C) is preferably configured: (a) when liquid refrigerant in the charging liquid receive means (25*b*) exceeds a specified amount of storage, to change the charging liquid receive means (25*b*) and the remaining discharging liquid receive means (25*a*) into the discharging liquid receive means (25*b*) and the charging liquid receive means (25*a*) respectively, whereby the supply of gas refrigerant from the hot heat source means (1) to the charging liquid receive means (25*a*) is stopped while gas refrigerant is supplied from the hot heat source means (1) to the discharging liquid receive means (25*b*) to push out the liquid refrigerant in the discharging liquid receive means (25*b*) to the user-side means (3) thereby allowing the operation of absorbing heat to be continued; and (*b*) to alternately change each of the liquid receive means (25*a*, 25*b*) between the charging liquid receive means and the discharging liquid receive means thereby successively executing the operation of absorbing heat.

Under the above arrangement, during the operation of absorbing heat of the user-side means (3), refrigerant is circulated between the charging liquid receive means (25*a*, 25*b*) and the user-side means (3) at all times so that the operation of absorbing heat of the user-side means (3) can be successively executed.

Accordingly, since the above arrangement provides a continuous operation of absorbing heat of the user-side means (3), when the device having the above arrangement is applied to an air conditioner for cooling a room, cooling operation can be successively executed thereby increasing comfortableness of the room.

In this case, each of the cold heat source means (2*a*, 2*b*) is preferably placed at a position higher than that of the hot heat source means (1).

Further, the control means (C) is preferably configured to control the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the charging liquid receive means (25*a*, 25*b*) to equalize pressures of the hot heat source means (1) and the charging liquid receive means (25*a*,25*b*) so that a flow of liquid refrigerant from the liquid receive means (25*a*, 25*b*) to the hot heat source means (1) is produced thereby recovering liquid refrigerant in the liquid receive means (25*a*, 25*b*) to the hot heat source means (1).

Under the above arrangement, when the storage amount of liquid refrigerant in the hot heat source means (1) becomes small, liquid refrigerant is recovered to the hot heat source means (1).

Accordingly, in the arrangement of the invention, since liquid refrigerant can be recovered while the operation of absorbing heat of the user-side means (3) is continued, this enables a continuous operation of the user-side means (3).

In this case, the gas flow selecting means (8) preferably includes: first shut-off valves (EV7-1, EV7-2) which are provided between the hot heat source means (1) and connection points of the gas flow pipes (4a, 4*b*) with the gas pipes (26*a*, 26*b*) and correspond to the liquid receive means (25*a*, 25*b*), respectively; and second shut-off valves (EV8-1, EV8-2) which are provided between the cold heat source means (2) and the connection points of the gas flow pipes (4*a*, 4*b*) with the gas pipes (26*a*, 26*b*) and correspond to the liquid receive means (25*a*, 25*b*), respectively.

In addition, the control means (C) is preferably configured to allow: each of the first shut-off valves (EV7-1, EV7-2) to be closed at the supply of liquid refrigerant from the cold heat source means (2) to the liquid receive means (25*a*, 25*b*) corresponding to the first shut-off valve (EV7-1, EV7-2) but to be open during the operation of recovering the liquid refrigerant in the liquid receive means (25*a*, 25*b*) corresponding to the first shut-off valve (EV7-1, EV7-2); and each of the second shut-off valves (EV8-1, EV8-2) to be closed at the supply of gas refrigerant from the hot heat source means (1) to the liquid receive means (25*a*, 25*b*) corresponding to the second shut-off valve (EV8-1, EV8-2) but to be open at the transfer of liquid refrigerant from the cold heat source means (2) to the liquid receive means (25*a*, 25*b*) corresponding to the second shut-off valve (EV8-1, EV8-2).

Accordingly, the above arrangement of the invention can provide concrete organization of the gas flow selecting means (8). This provides an increased practicality of the device.

Furthermore, in the above case, the liquid flow selecting means (9) preferably includes: a shut-off valve (EV4) provided at a recovery flow side part of the liquid flow pipes (5*a*, 5*b*) between the hot heat source means (1) and connection points with the liquid pipes (27*a*, 27*b*); first check valves (CV1-1, CV1-2) which are provided at recovery flow side parts of the liquid flow pipes (5*a*, 5*b*) respectively and each allow only a flow toward the hot heat source means (1) and the user-side means (3); and second check valves (CV2-1, CV2-2) which are provided between the cold heat source means (2) and the connection points of the liquid flow pipes (5*a*, 5*b*) with the liquid pipes (27*a*, 27*b*) and allow only flows toward the liquid receive means (25*a*, 25*b*), respectively.

In addition, the control means (C) is preferably configured to open the shut-off valve (EV4) during the operation of recovering liquid refrigerant in the discharging liquid receive means (25*a*, 25*b*).

Accordingly, the above arrangement of the invention can provide concrete organization of the liquid flow selecting means (9). This provides an increased practicality of the device.

When the plurality of the liquid receive means (25*a*, 25*b*) are provided, the control means (C) may be configured to selectively execute the operation of radiating heat of the user-side means (3) and the operation of absorbing heat of the user-side means (3).

Under the arrangement, both effects of the operations of radiating and absorbing heat of the user-side means (3) can be obtained. This increases practicality.

In this case, the control means (C) is preferably configured to control the gas flow selecting means (8) and the liquid flow selecting means (9) to execute an operation of recovering refrigerant when liquid refrigerant in the hot heat source means (1) becomes short of a specified amount of storage during the operation of absorbing heat of the user-side means (3), in a manner that gas refrigerant is supplied from the hot heat source means (1) to the charging liquid receive means (25*a*, 25*b*) to equalize pressures of the hot heat source means (1) and the charging liquid receive means (25*a*, 25*b*) so that a flow of liquid refrigerant from the cold heat source means (2) to the hot heat source means (1) is produced thereby recovering liquid refrigerant in the liquid receive means (25*a*, 25*b*) to the hot heat source means (1).

Under the above arrangement, when the storage amount of liquid refrigerant in the hot heat source means (1) becomes small, liquid refrigerant is recovered to the hot heat source means (1).

Accordingly, in the arrangement of the invention, since liquid refrigerant can be recovered while the operation of absorbing heat of the user-side mans (3) is continued, this enables a continuous operation of the user-side means (3).

Further, in this case, the gas flow selecting means (8) preferably includes: first shut-off valves (EV7-1, EV7-2) which are provided between the hot heat source means (1) and connection points of the gas flow pipes (4*a*, 4*b*) with the gas pipes (26*a*, 26*b*) and correspond to the liquid receive means (25*a*, 25*b*), respectively; second shut-off valves (EV8-1, EV8-2) which are provided between the cold heat source means (2) and the connection points of the gas flow pipes (4*a*, 4*b*) with the gas pipes (26*a*, 26*b*) and correspond to the liquid receive means (25*a*, 25*b*), respectively; a third shut-off valve (EV2) provided in the gas pipe (6); and a fourth shout-off valve (EV3) provided in a connecting pipe (20) for connecting the user-side means (3) and the cold heat source means (2). In addition, the control means (C) is preferably configured to allow: the first shut-off valve (EV7-1, EV7-2) corresponding to the charging liquid receive means (25*a*, 25*b*) to be closed at the transfer of liquid refrigerant from the user-side means (3) to the liquid receive means (25*a*, 25*b*) during the operation of radiating heat and at the transfer of liquid refrigerant from the cold heat source means (2) to the liquid receive means (25*a*, 25*b*) during the operation of absorbing heat; the first shut-off valve (EV7-1, EV7-2) corresponding to the discharging liquid receive means (25*a*, 25*b*) to be open during the operation of recovering liquid refrigerant from the liquid receive means (25*a*, 25*b*) to the hot heat source means (1); the second shut-off valve (EV8-1, EV8-2) corresponding to the discharging liquid receive means (25*a*, 25*b*) to be closed at the supply of gas refrigerant from the hot heat source means (1) to the liquid receive means (25*a*, 25*b*); the second shut-off valve (EV8-1, EV8-2) corresponding to the charging liquid receive means (25*a*, 25*b*) to be open at the transfer of liquid refrigerant from the cold heat source means (2) to the liquid receive means (25*a*, 25*b*); the third shut-off valve (EV2) to be open only during the operation of radiating heat of the user-side means (3); and the fourth shut-off valve (EV3) to be open only during the operation of absorbing heat of the user-side means (3).

Accordingly, the above arrangement of the invention can provide concrete organization of the gas flow selecting means (8). This provides an increased practicality of the device.

Furthermore, in the above case, the liquid flow selecting means (9) preferably includes: a first shut-off valve (EV4) provided at a recovery flow side part of the liquid flow pipes (5*a*, 5*b*) between the hot heat source means (1) and connection points with the liquid pipes (27*a*, 27*b*); first check valves (CV1-1, CV1-2) which are provided at recovery flow side parts of the liquid flow pipes (5*a*, 5*b*) respectively and each allow only a flow toward the hot heat source means (1) and the user-side means (3); second check valves (CV2-1, CV2-2) which are provided between the cold heat source means (2) and connection points of the liquid flow pipes (5*a*, 5*b*) with the liquid pipes (27*a*, 27*b*) and allow only flows toward the liquid receive means (25*a*, 25*b*), respectively; a second shut-off valve (EV9) provided in the liquid pipe (7); and a third shut-off valve (EV10) provided in a connecting pipe (21) for connecting the user-side means (3) with the liquid receive means (25*a*, 25*b*) through the second check valves (CV2-1, CV2-2) respectively.

In addition, the control means (C) is preferably configured to allow: the first shut-off valve (EV4) to be open only during the operation of recovering liquid refrigerant from the liquid receive means (25*a*, 25*b*) to the hot heat source means (1); the second shut-off valve (EV9) to be open only during the operation of absorbing heat of the user-side means (3); and the third shut-off valve (EV10) to be open only during the operation of radiating heat of the user-side means (3).

Accordingly, the above arrangement of the invention can provide concrete organization of the liquid flow selecting means (9). This provides an increased practicality of the device.

When the plurality of the liquid receive means (25*a*, 25*b*) are provided, as shown in FIG. 39, a plurality of the user-side means (3*a*–3*d*) are preferably provided, the user-side means (3*a*–3*d*) are preferably connected to the gas flow pipes (4*a*, 4*b*) and the liquid flow pipes (5*a*, 5*b*) through the gas pipes (6*a*–6*d*) and the liquid pipes (7*a*–7*d*) respectively in a manner capable of individual selection between an operation of radiating heat and an operation of absorbing heat, and each of the liquid receive means (25*a*, 25*b*) is preferably placed at a position higher than that of the hot heat source means (1).

In addition, the control means (C) is preferably configured to control the gas flow selecting means (8) and the liquid flow selecting means (9) to execute an operation of mainly radiating heat in which the heat balance among all the user-side means (3*a*–3*d*) is in a heat radiative condition, in a manner that: gas refrigerant is supplied from the hot heat source means (1) to the discharging liquid receive means (25*a*) and the heat-radiative user-side means (3) so that the gas refrigerant is condensed in the user-side means (3) and the liquid refrigerant condensed in the heat-radiative user-side means (3) is transferred to the charging liquid receive means (25*b*) by pressure difference between the cold heat source means (2) which condenses the gas refrigerant at a temperature lower than that of the heat-radiative user-side means (3) and the heat-radiative user-side means (3) and transferred to the heat-absorptive user-side means (3) by pressure difference between the heat-absorptive user-side means (3) and the heat-radiative user-side means (3); while the gas refrigerant is concurrently evaporated in the heat-absorptive user-side means (3) and the gas refrigerant evaporated in the heat-absorptive user-side means (3) is transferred to the charging liquid receive means (25*b*) by pressure difference between the cold heat source means (2) and the heat-absorptive user-side means (3) caused due to refrigerant condensation in the cold heat source means (2).

Further, the control means (C) is preferably configured: (a) when liquid refrigerant in the charging liquid receive means (25*b*) exceeds a specified amount of storage, to change the charging liquid receive means (25*b*) into the discharging liquid receive means (25*b*) to execute an operation of recovering refrigerant and change the remaining discharging liquid receive means (25*a*) into the charging liquid receive means (25*a*), whereby the supply of gas refrigerant from the hot heat source means (1) to the charging liquid receive means (25*a*) is stopped, gas refrigerant is supplied from the hot heat source means (1) to the heat-radiative user-side means (3) and is condensed in the heat-radiative user-side means (3) thereby allowing the operation of radiating heat to be continued, and gas refrigerant is supplied from the hot heat source means (1) to the discharging liquid receive means (25*b*) to equalize pressures of the hot heat source means (1) and the discharging liquid receive means (25*b*) thereby producing a flow of liquid refrigerant from the discharging liquid receive means (25*b*) to the hot heat source means (1) to recover the liquid refrigerant in the discharging liquid receive means (25*b*) to the hot heat source means (1); and (b) to alternately change each of the liquid receive means (25*a*, 25*b*) between the charging liquid receive means and the discharging liquid receive means thereby successively executing the operation of radiating heat.

Under the above arrangement, refrigerant is circulated between each of the user-side means (3*a*–3*d*) and each of the liquid receive means (25*a*, 25*b*) so that heat radiation or heat absorption is executed in each of the user-side means (3*a*–3*d*).

When the plurality of the liquid receive means (25*a*, 25*b*) are provided, a plurality of the user-side means (3*a*–3*d*) are preferably provided, the user-side means (3*a*–3*d*) are preferably connected to the gas flow pipes (4*a*, 4*b*) and the liquid flow pipes (5*a*, 5*b*) through the gas pipes (6*a*–6*d*) and the liquid pipes (7*a*–7*d*) respectively in a manner of individual selection between an operation of radiating heat and an operation of absorbing heat, and each of the cold heat source means (2*a*, 2*b*) is preferably placed at a position higher than that of the hot heat source means (1).

In addition, the control means (C) is preferably configured to control the gas flow selecting means (8) and the liquid flow selecting means (9) to execute an operation of mainly absorbing heat in which the heat balance among all the user-side means (3*a*–3*d*) is in a heat absorptive condition, in a manner that: gas refrigerant is supplied from the hot heat source means (1) to the heat-radiative user-side means (3) and is condensed in the user-side means (3) and the liquid refrigerant condensed in the heat-radiative user-side means (3) is transferred to the heat-absorptive user-side means (3) by pressure difference between the heat-radiative user-side means (3) and the heat-absorptive user-side means (3) while gas refrigerant is supplied from the hot heat source means (1) to the discharging liquid receive means (25*a*) to push out liquid refrigerant in the discharging liquid receive means (25*a*) to the heat-absorptive user-side means (3); the liquid refrigerant is evaporated in the heat-absorptive user-side means (3) while gas refrigerant is condensed in the cold heat source means (2), and the gas refrigerant evaporated in the heat-absorptive user-side means (3) is transferred to the charging liquid receive means (25*b*) by pressure difference between the heat-absorptive user-side means (3) and the cold heat source means (2) caused due to drop in pressure of the cold heat source means (2).

Further, the control means (C) is preferably configured: (a) when liquid refrigerant in the charging liquid receive means (25*b*) exceeds a specified amount of storage, to change the charging liquid receive means (25*b*) and the remaining discharging liquid receive means (25*a*) into the discharging liquid receive means (25*b*) and the charging liquid receive means (25*a*) respectively, whereby the supply of gas refrigerant from the hot heat source means (1) to the charging liquid receive means (25*a*) is stopped while gas refrigerant is supplied from the hot heat source means (1) to the discharging liquid receive means (25*b*) and the heat-radiative user-side means (3) so that the liquid refrigerant in the discharging liquid receive means (25*b*) is pushed out to the heat-absorptive user-side means (3) thereby allowing the operation of absorbing heat to be continued; and (b) to alternately change each of the liquid receive means (25*a*, 25*b*) between the charging liquid receive means and the discharging liquid receive means thereby successively executing the operation of absorbing heat.

Under the above arrangement, refrigerant is circulated between each the user-side means (3*a*–3*d*) and each of the liquid receive means (25*a*, 25*b*) so that heat radiation or heat absorption is executed in each of the user-side means (3*a*–3*d*).

In this case, each of the liquid receive means (25*a*, 25*b*) is preferably placed at a position higher than that of the hot heat source means (1).

Further, the control means (C) is preferably configured to control the gas flow selecting means (8) and the liquid flow selecting means (9) to execute an operation of recovering refrigerant when liquid refrigerant in the hot heat source means (1) becomes short of a specified amount of storage during the operation of mainly absorbing heat, in a manner that gas refrigerant is supplied from the hot heat source means (1) to the charging liquid receive means (25*a*, 25*b*) to equalize pressures of the hot heat source means (1) and the charging liquid receive means (25*a*, 25*b*) so that a flow of liquid refrigerant from the liquid receive means (25*a*, 25*b*) to the hot heat source means (1) is produced thereby recovering liquid refrigerant in the liquid receive means (25*a*, 25*b*) to the hot heat source means (1).

Under the above arrangement, when the storage amount of liquid refrigerant in the hot heat source means (1) becomes small, liquid refrigerant is recovered to the hot heat source means (1).

Accordingly, in the arrangement of the invention, since liquid refrigerant can be recovered while the operation of absorbing heat of the user-side means (3) is continued, this enables a continuous operation of the user-side means (3).

When the plurality of liquid receive means (25*a*, 25*b*) and a plurality of user-side means (3*a*–3*d*) are provided, the control means (C) of the invention may be configured to selectively execute the operation of mainly radiating heat of the user-side means (3) and the operation of mainly absorbing heat of the user-side means (3).

Under the arrangement, both effects of the operation of mainly radiating heat of the user-side means (3) and the operation of mainly absorbing heat of the user-side means (3) can be obtained. This increases practicality.

In this case, the gas flow selecting means (8) preferably includes: first shut-off valves (EV7-1, EV7-2) which are provided between the hot heat source means (1) and connection points of the gas flow pipes (4*a*, 4*b*) with the gas pipes (26*a*, 26*b*) and correspond to the liquid receive means (25*a*, 25*b*), respectively; second shut-off valves (EV8-1, EV8-2) which are provided between the cold heat source means (2) and connection points of the gas flow pipes (4*a*, 4*b*) with the gas pipes (26*a*, 26*b*) and correspond to the liquid receive means (25*a*, 25*b*), respectively; third shut-off valves (EV2-1 to EV2-4) provided in the gas pipes (6*a*–6*d*) and corresponding to the user-side means (3*a*–3*d*), respectively; a plurality of connecting pipes (10*a*–10*d*) which are each connected at one side thereof between the second shut-off valves (EV8-1, EV8-2) and the cold heat source means (2the third connected at the other side between the third shut-off valves (EV2-1 to EV2-4) and the user-side means (3*a*–3*d*) respectively; and fourth shut-off valves (EV3-1 to EV3-4) provided in the connecting pipes (10*a*–10*d*) and corresponding to the user-side means (3*a*–3*d*), respectively.

In addition, the control means (C) is preferably configured to allow: the first shut-off valve (EV7-1, EV7-2) corresponding to the charging liquid receive means (25*a*, 25*b*) to be closed at the transfer of liquid refrigerant from the heat-radiative user-side means (3) to the liquid receive means (25*a*, 25*b*) during the operation of mainly radiating heat and at the transfer of liquid refrigerant from the cold heat source means (2) to the liquid receive means (25*a*, 25*b*) during the operation of mainly absorbing heat; and the first shut-off valve (EV7-1, EV7-2) corresponding to the discharging liquid receive means (25*a*, 25*b*) to be open at the supply of gas refrigerant from the hot heat source means (1) to the liquid receive means (25*a*, 25*b*).

Further, the control means (C) is preferably configured to allow: the second shut-off valve (EV8-1, EV8-2) corresponding to the discharging liquid receive means (25*a*, 25*b*) to be closed at the supply of gas refrigerant from the hot heat source means (1) to the liquid receive means (25*a*, 25*b*); the second shut-off valve (EV8-1, EV8-2) corresponding to the charging liquid receive means (25*a*, 25*b*) to be open at the transfer of liquid refrigerant from the cold heat source means (2) to the liquid receive means (25*a*, 25*b*); each of the third shut-off valves (EV2-1 to EV2-4) to be open only during the operation of radiating heat of the corresponding user-side means (3); and each of the fourth shut-off valves (EV3-1 to EV3-4) to be open only during the operation of absorbing heat of the corresponding user-side means (3).

Accordingly, the above arrangement of the invention can provide concrete organization of the gas flow selecting means (8). This provides an increased practicality of the device.

Furthermore, in the above case, the liquid flow selecting means (9) preferably includes: a first shut-off valve (EV4) provided between the hot heat source means (1) and connection points of the liquid flow pipe (5) with the liquid pipes (27*a*, 27*b*); first check valves (CV1-1, CV1-2) which are provided between the hot heat source means (1) and connection points of the liquid flow pipes (5*a*, 5*b*) with the liquid pipes (27*a*, 27*b*) respectively and each allow only a flow toward the hot heat source means (1) and the user-side means (3*a*–3*d*); second check valves (CV2-1, CV2-2) which are provided between the cold heat source means (2) and connection points of the liquid flow pipes (5*a*, 5*b*) with the liquid pipes (27*a*, 27*b*) and allow only flows toward the liquid receive means (25*a*, 25*b*), respectively; a second shut-off valve (EV9) provided in the liquid pipe (7); and a third shut-off valve (EV10) provided in a connecting pipe (21) for connecting the user-side means (3*a*–3*d*) with the liquid receive means (25*a*, 25*b*) through the second check valves (CV2-1, CV2-2) respectively.

In addition, the control means (C) is preferably configured to allow: the first shut-off valve (EV4) to be open only during the operation of recovering liquid refrigerant from the liquid receive means (25*a*, 25*b*) to the hot heat source means (1); the second shut-off valve (EV9) to be open only during the operation of mainly absorbing heat of the user-side means (3); and the third shut-off valve (EV10) to be open only during the operation of mainly radiating heat of the user-side means (3).

Accordingly, the above arrangement of the invention can provide concrete organization of the liquid flow selecting means (9). This provides an increased practicality of the device.

Preferably, the hot heat source means (1) is configured to evaporate refrigerant by receiving an amount of heat from refrigerant for heat source circulating in a heat source-side refrigerant circuit (A) and the cold heat source means (2) is configured to condense refrigerant by losing an amount of heat to the refrigerant for heat source.

In addition, the heat source-side refrigerant circuit (A) preferably comprises: heating heat exchange means (12) for exchanging heat with the hot heat source means (1) to give an amount of heat for evaporating refrigerant to the hot heat source means (1); cooling heat exchange means (15) for exchanging heat with the cold heat source means (2) to take an amount of heat for condensing refrigerant from the cold heat source means (2); and heat exchange amount adjusting means (14) for giving, to the refrigerant for heat source, a difference between both the heat exchange amounts of the heating heat exchange means (12) and the cooling heat exchange means (15) during the operation of radiating heat of the user-side means (3) when the heat exchange amount of the heating heat exchange means (12) is larger than that of the cooling heat exchange means (15).

Under the above arrangement, during the operation of radiating heat of the user-side means (3) when the heat exchange amount of the heating heat exchange means (12) is larger than that of the cooling heat exchange means (15), the heat exchange amount adjusting means (14) gives an amount of heat to the refrigerant for heat source by a difference between both the heat exchange amounts. The heat exchange amount adjusting means (14) thus gives an amount of heat to the refrigerant for heat source so that the amount of heat radiated and the amount of heat absorbed become equal as the whole heat source-side refrigerant circuit (A).

Accordingly, the above arrangement of the invention provides an excellent circulation of refrigerant in the heat source-side refrigerant circuit (A), and gives stability to the supply of heat amount to the hot heat source means (1) and to the recovery of heat amount from the cold heat source means (2). This achieves a highly efficient operating condition of the user-side means (3).

In this case, the heat source-side refrigerant circuit (A) is preferably configured in a manner that refrigerant heating means (11), the heating heat exchange means (12), expansion mechanism (13), the heat exchange amount adjusting means (14) and the cooling heat exchange means (15) are connected in this order in a manner capable of circulating refrigerant.

In addition, preferably, the heat source-side refrigerant circuit (A) further comprises a bypass passage (17) which is connected at one end thereof between the expansion mechanism (13) and the heat exchange amount adjusting means (14) and at the other end between the heat exchange amount adjusting means (14) and the cooling heat exchange means (15), and the bypass passage (17) is provided with a flow control valve (18) adjustable in opening for controlling a flow rate of refrigerant flowing into the heat exchange amount adjusting means (14) according to a difference between the heat exchange amount of the heating heat exchange means (12) and that of the cooling heat exchange means (15).

Under the above arrangement, a flow rate of refrigerant flowing into the heat exchange amount adjusting means (14) is controlled by the flow control valve (18) so that an amount of heat to be given from the heat exchange amount adjusting means (14) to refrigerant for heat source is controlled. As a result, the amount of heat radiated and the amount of heat absorbed become equal as the whole heat source-side refrigerant circuit (A).

Accordingly, the above arrangement of the invention can provide concrete organization of the heat source-side refrigerant circuit (A). This provides an increased practicality of the device.

Further, in the above case, the heat source-side refrigerant circuit (A) is preferably configured in a manner that refrigerant heating means (11), the heating heat exchange means (12), expansion mechanism (18*a*) and the cooling heat exchange means (15) are connected in this order in a manner capable of circulating refrigerant.

In addition, preferably, the heat source-side refrigerant circuit (A) further comprises a bypass passage (17) for bypassing the cooling heat exchange means (15) and directly introducing refrigerant from the heating heat exchange means (12) into the refrigerant heating means (11), and the bypass passage (17) is provided with the heat exchange amount adjusting means (14).

Furthermore, in this case, the bypass passage (17) is preferably connected at one end thereof between the heating heat exchange means (12) and the expansion mechanism (18*a*) and at the other end between the cooling heat exchange means (15) and the refrigerant heating means (11). In addition, a flow control valve (18*b*) adjustable in opening for controlling a flow rate of refrigerant flowing into the heat exchange amount adjusting means (14) according to a difference between the heat exchange amount of the heating heat exchange means (12) and that of the cooling heat exchange means (15) and for reducing the pressure of refrigerant for heat source is preferably provided between one end of the bypass passage (17) and the heat exchange amount adjusting means (14).

Under the above arrangement, a flow rate of refrigerant flowing into the heat exchange amount adjusting means (14) is controlled by the flow control valve (18*b*) so that an amount of heat to be given from the heat exchange amount adjusting means (14) to refrigerant for heat source is controlled. As a result, the amount of heat radiated and the amount of heat absorbed become equal as the whole heat source-side refrigerant circuit (A).

Accordingly, the above arrangement of the invention can provide concrete organization of the heat source-side refrigerant circuit (A). This provides an increased practicality of the device.

Preferably, the hot heat source means (1) is configured to evaporate refrigerant by receiving an amount of heat from refrigerant for heat source circulating in a heat source-side refrigerant circuit (A) and the cold heat source means (2) is configured to condense refrigerant by losing an amount of heat to the refrigerant for heat source.

In addition, the heat source-side refrigerant circuit (A) preferably comprises: heating heat exchange means (12) for exchanging heat with the hot heat source means (1) to give an amount of heat for evaporating refrigerant to the hot heat source means (1); cooling heat exchange means (15) for exchanging heat with the cold heat source means (2) to take an amount of heat for condensing refrigerant from the cold heat source means (2); and heat exchange amount adjusting means (14) for taking, from the refrigerant for heat source, a difference between both the heat exchange amounts of the heating heat exchange means (12) and the cooling heat exchange means (15) during the operation of absorbing heat of the user-side means (3) when the heat exchange amount of the heating heat exchange means (12) is smaller than that of the cooling heat exchange means (15).

Under the above arrangement, during the operation of absorbing heat of the user-side means (3) when the heat exchange amount of the heating heat exchange means (12) is smaller than that of the cooling heat exchange means (15), the heat exchange amount adjusting means (14) takes an amount of heat from the refrigerant for heat source by a difference between both the heat exchange amounts. The heat exchange amount adjusting means (14) thus takes an amount of heat from the refrigerant for heat source so that the amount of heat radiated and the amount of heat absorbed become equal as the whole heat source-side refrigerant circuit (A).

Accordingly, the above arrangement of the invention provides an excellent circulation of refrigerant in the heat source-side refrigerant circuit (A), and gives stability to the supply of heat amount to the hot heat source means (1) and to the recovery of heat amount from the cold heat source means (2). This achieves a highly efficient operating condition of the user-side means (3).

In this case, the heat source-side refrigerant circuit (A) is preferably configured in a manner that refrigerant heating means (11), the heating heat exchange means (12), the heat exchange amount adjusting means (14), expansion mechanism (13) and the cooling heat exchange means (15) are connected in this order in a manner capable of circulating refrigerant.

In addition, preferably, the heat source-side refrigerant circuit (A) further comprises a bypass passage (17) which is connected at one end thereof between the expansion mechanism (13) and the heat exchange amount adjusting means (14) and at the other end between the heat exchange amount adjusting means (14) and the cooling heat exchange means (15), and the bypass passage (17) is provided with a flow control valve (18) adjustable in opening for controlling a flow rate of refrigerant flowing into the heat exchange amount adjusting means (14) according to a difference between the heat exchange amount of the heating heat exchange means (12) and that of the cooling heat exchange means (15).

Under the above arrangement, a flow rate of refrigerant flowing into the heat exchange amount adjusting means (14) is controlled by the flow control valve (18) so that an amount of heat to be taken from refrigerant for heat source by the heat exchange amount adjusting means (14) is controlled. As a result, the amount of heat radiated and the amount of heat absorbed become equal as the whole heat source-side refrigerant circuit (A).

Accordingly, the above arrangement of the invention can provide concrete organization of the heat source-side refrigerant circuit (A). This provides an increased practicality of the device.

Further, in the above case, the heat source-side refrigerant circuit (A) is preferably configured in a manner that refrigerant heating means (11), the heating heat exchange means (12), expansion mechanism (18*a*) and the cooling heat exchange means (15) are connected in this order in a manner capable of circulating refrigerant.

In addition, preferably, the heat source-side refrigerant circuit (A) further comprises a bypass passage (17) for bypassing the heating heat exchange means (12) and directly introducing refrigerant from the refrigerant heating means (11) into the cooling heat exchange means (15), and the bypass passage (17) is provided with the heat exchange amount adjusting means (14).

Furthermore, in this case, the bypass passage (17) is preferably connected at one end thereof between the expansion mechanism (18*a*) and the cooling heat exchange means (15) and at the other end between the refrigerant heating means (11) and the heating heat exchange means (12). In addition, a flow control valve (18*b*) adjustable in opening for controlling a flow rate of refrigerant flowing into the heat exchange amount adjusting means (14) according to a difference between the heat exchange amount of the heating heat exchange means (12) and that of the cooling heat exchange means (15) and for reducing the pressure of refrigerant for heat source is preferably provided between one end of the bypass passage (17) and the heat exchange amount adjusting means (14).

Under the above arrangement, a flow rate of refrigerant flowing into the heat exchange amount adjusting means (14) is controlled by the flow control valve (18*b*) so that an amount of heat to be taken from refrigerant for heat source by the heat exchange amount adjusting means (14) is controlled. As a result, the amount of heat radiated and the amount of heat absorbed become equal as the whole heat source-side refrigerant circuit (A).

Accordingly, the above arrangement of the invention can provide concrete organization of the heat source-side refrigerant circuit (A). This provides an increased practicality of the device.

Preferably, the hot heat source means (1) is configured to evaporate refrigerant by receiving an amount of heat from refrigerant for heat source circulating in a heat source-side refrigerant circuit (A) and the cold heat source means (2) is configured to condense refrigerant by losing an amount of heat to the refrigerant for heat source.

In addition, the heat source-side refrigerant circuit (A) preferably comprises: heating heat exchange means (12) for exchanging heat with the hot heat source means (1) to give an amount of heat for evaporating refrigerant to the hot heat source means (1); cooling heat exchange means (15) for exchanging heat with the cold heat source means (2) to take an amount of heat for condensing refrigerant from the cold heat source means (2); and heat exchange amount adjusting means (14) for giving, to the refrigerant for heat source, a difference between both the heat exchange amounts of the heating heat exchange means (12) and the cooling heat exchange means (15) during the operation of radiating heat of the user-side means (3) when the heat exchange amount of the heating heat exchange means (12) is larger than that of the cooling heat exchange means (15), but taking, from the refrigerant for heat source, a difference between both the heat exchange amounts of the heating heat exchange means (12) and the cooling heat exchange means (15) during the operation of absorbing heat of the user-side means (3) when the heat exchange amount of the heating heat exchange means (12) is smaller than that of the cooling heat exchange means (15).

Under the above arrangement, during the operation of radiating heat of the user-side means (3) when the heat exchange amount of the heating heat exchange means (12) is larger than that of the cooling heat exchange means (15), the heat exchange amount adjusting means (14) gives an amount of heat to the refrigerant for heat source by a difference between both the heat exchange amounts, and on the other hand, during the operation of absorbing heat of the user-side means (3) when the heat exchange amount of the heating heat exchange means (12) is smaller than that of the cooling heat exchange means (15), the heat exchange amount adjusting means (14) takes an amount of heat from the refrigerant for heat source by a difference between both the heat exchange amounts. In other words, the manner of heat exchange between the heat exchange amount adjusting means (14) and the refrigerant for heat source is changed according to the operation mode of the user-side means (3), so that the amount of heat radiated and the amount of heat absorbed become equal as the whole heat source-side refrigerant circuit (A).

Accordingly, the above arrangement of the invention provides an excellent circulation of refrigerant in the heat source-side refrigerant circuit (A), and gives stability to the supply of heat amount to the hot heat source means (1) and to the recovery of heat amount from the cold heat source means (2). This achieves a highly efficient operating condition of the user-side means (3).

In this case, the heat source-side refrigerant circuit (A) is preferably configured in a manner that refrigerant heating means (11), the heating heat exchange means (12), expansion mechanism (13), the heat exchange amount adjusting means (14) and the cooling heat exchange means (15) are connected in this order in a manner capable of circulating refrigerant.

In addition, preferably, the heat source-side refrigerant circuit (A) further comprises: a four-way selector valve (19) which selects, during the heating operation of the user-side means (3), a heating operation position that allows refrigerant from the heating heat exchange means (12) to pass through the expansion mechanism (13), the heat exchange amount adjusting means (14) and the cooling heat exchange means (15) in this order and selects, during the cooling operation of the user-side means (3), a cooling operation position that allows refrigerant from the heating heat exchange means (12) to pass through the heat exchange amount adjusting means (14), the expansion mechanism (13) and the cooling heat exchange means (15) in this order; and a bypass passage (17) which is connected at one end thereof between the expansion mechanism (13) and the heat exchange amount adjusting means (14) and at the other end between the heat exchange amount adjusting means (14) and the four-way selector valve (19), and the bypass passage (17) is provided with a flow control valve (18) adjustable in opening for controlling a flow rate of refrigerant flowing into the heat exchange amount adjusting means (14) according to a difference between the heat exchange amount of the heating heat exchange means (12) and that of the cooling heat exchange means (15).

Under the above arrangement, a flow rate of refrigerant flowing into the heat exchange amount adjusting means (14) is controlled by the flow control valve (18) so that an amount of heat to be given and taken between the heat exchange amount adjusting means (14) and refrigerant for heat source is controlled. As a result, the amount of heat radiated and the amount of heat absorbed become equal as the whole heat source-side refrigerant circuit (A).

Accordingly, the above arrangement of the invention can provide concrete organization of the heat source-side refrigerant circuit (A). This provides an increased practicality of the device.

Further, in the above case, the heat source-side refrigerant circuit (A) is preferably configured in a manner that refrigerant heating means (11), the heating heat exchange means (12), expansion mechanism (18*c*) and the cooling heat exchange means (15) are connected in this order in a manner capable of circulating refrigerant.

In addition, preferably, the heat source-side refrigerant circuit (A) further comprises a bypass passage (17) for bypassing the cooling heat exchange means (15) during the heating operation of the user-side means (3) to introduce refrigerant from the heating heat exchange means (12) into the refrigerant heating means (11) while bypassing the heating heat exchange means (12) during the cooing operation of the user-side means (3) to introduce refrigerant from the refrigerant heating means (11) into the cooling heat exchange means (15), and the bypass passage (17) is provided with the heat exchange amount adjusting means (14) and a pressure reduction mechanism (18) for reducing the pressure of refrigerant during the heating operation of the user-side means (3).

Furthermore, in this case, one end of the bypass passage (17) is preferably divided into a suction branch pipe (16*a*) and a discharge branch pipe (16*b*), the suction branch pipe (16*a*) is connected to a suction side of the refrigerant heating means (11), and the discharge branch pipe (16*b*) is connected to a discharge side of the refrigerant heating means (11). In addition, preferably, the suction branch pipe (16*a*) is provided with a shut-off valve (EVI) which is open during the heating operation of the user-side means (3) and is closed during the cooling operation thereof, and the discharge branch pipe (16*b*) is provided with a shut-off valve (EVO) which is closed during the heating operation of the user-side means (3) and is open during the cooling operation thereof.

Under the above arrangement, a flow rate of refrigerant flowing into the heat exchange amount adjusting means (14) is controlled by the flow control valve (18*b*) so that an amount of heat to be given and taken between the heat exchange amount adjusting means (14) and refrigerant for heat source is controlled. As a result, the amount of heat radiated and the amount of heat absorbed become equal as the whole heat source-side refrigerant circuit (A).

Accordingly, the above arrangement of the invention can provide concrete organization of the heat source-side refrigerant circuit (A). This provides an increased practicality of the device.

Preferably, the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted.

Under the above arrangement, frost on the heat exchange amount adjusting means (14) is promptly eliminated.

Accordingly, the above arrangement of the invention can defrost the heat exchange amount adjusting means (14) with reliability in a short time. This increases heat radiation performance of the user-side means (3).

Preferably, the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted, and the defrosting means (31) comprises: a hot gas pipe (32) which is connected at one end thereof to a discharge side of the refrigerant heating means (11) and at the other end to the heat exchange amount adjusting means (14); a shut-off valve (EVD1) which is provided in the hot gas pipe (32) and is opened only under defrosting operation; a suction pipe (33) for introducing refrigerant having passed through the heat exchange amount adjusting means (14), the expansion mechanism (13) and the heating heat exchange means (12) into a suction side of the refrigerant heating means (11); and a shut-off valve (EVD2) which is provided in the suction pipe (33) and is opened only under defrosting operation.

Accordingly, the above arrangement of the invention can provide concrete organization of the defrosting means (31). This provides an increased practicality of the device.

Preferably, the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted, and the defrosting means (31) comprises: a shut-off valve (EVD4) which is provided between the refrigerant heating means (11) and the heating heat exchange means (12) and is closed under defrosting operation; a connecting pipe (33) which is connected at one end thereof between the shut-off valve (EVD4) and the heating heat exchange means (12) and at the other end to a suction side of the refrigerant heating means (11); and a shut-off valve (EVD3) which is provided in the connecting pipe (33) and is closed under defrosting operation.

Accordingly, the above arrangement of the invention can provide concrete organization of the defrosting means (31). This provides an increased practicality of the device.

The refrigerant heating means of the invention is preferably a compressor (11).

Accordingly, the arrangement of the invention can supply to refrigerant for heat source, an amount of heat to be given to the hot heat source means (1), with reliability. This provides an increased reliability of the device.

BEST MODE FOR CARRYING OUT THE INVENTION

Below, embodiments of the present invention will be described in detail with reference to the drawings.

The following embodiments are applications of the present invention for refrigerant circuitry of an air conditioner including two refrigerant circuits, i.e., primary and secondary refrigerant circuits. The air conditioner executes air conditioning in a room in a manner of circulating refrigerant in the secondary refrigerant circuit with the use of heat amount given from the primary refrigerant circuit to the secondary refrigerant circuit.

First Embodiment

First an embodiment of a heat transfer device according to claims 2 to 5, 59 and 60 of the invention is described with reference to FIGS. 1 and 2.

In this first embodiment, the primary and secondary refrigerant circuits are configured for a heating-only air conditioner.

Figure 1:
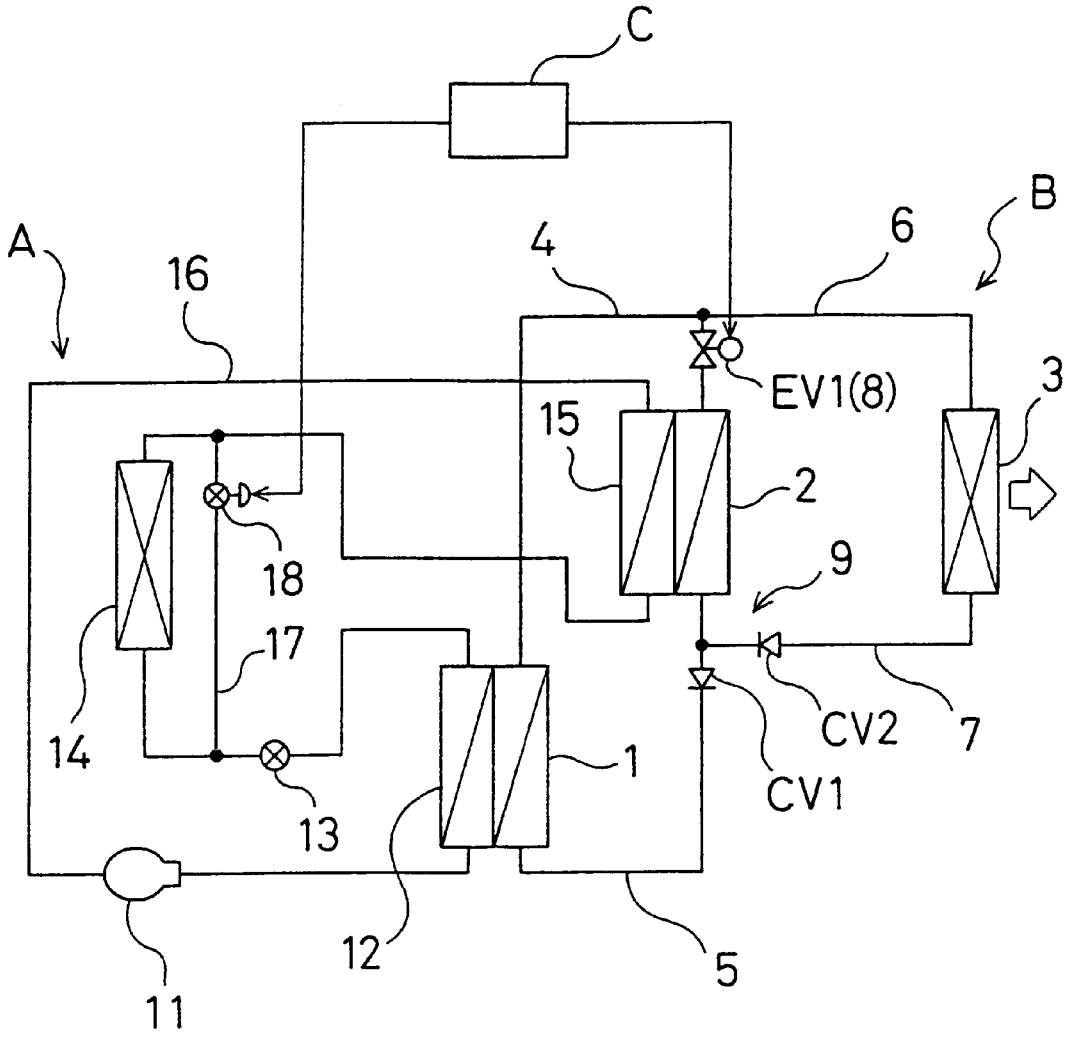
FIG. 1 is a diagram showing the entire structure of refrigerant circuitry of a first embodiment of the invention.

FIG. 1 shows refrigerant circuitry of the overall heat transfer device of this embodiment. As shown in this figure, the refrigerant circuitry executes heat exchange between refrigerant in the primary refrigerant circuit (A) as a heat source-side refrigerant circuit and refrigerant in the secondary refrigerant circuit (B). Below, description is made about the primary refrigerant circuit (A) and the secondary refrigerant circuit (B).

First described is the secondary refrigerant circuit (B) for exchanging heat with a room air to heat the room.

The secondary refrigerant circuit (B) is configured such that a hot heat source heat exchanger (1) as a hot heat source means and a cold heat source heat exchanger (2) as a cold heat source means are connected to each other through a gas flow pipe (4) and a liquid flow pipe (5). The secondary refrigerant circuit (B) forms a closed circuit in which refrigerant circulates between the hot heat source heat exchanger (1) and the cold heat source heat exchanger (2). For the placement of the hot heat source heat exchanger (1) and the cold heat source heat exchanger (2), the cold heat source heat exchanger (2) is placed at a position higher than that of the hot heat source heat exchanger (1).

The secondary refrigerant circuit (B) includes an indoor heat exchanger (3) as a user-side means which is placed in a room to be air-conditioned. The indoor heat exchanger (3) is connected to the gas flow pipe (4) through a gas pipe (6) and connected to the liquid flow pipe (5) through a liquid pipe (7).

Between the cold heat source heat exchanger (2) and a connection point of the gas flow pipe (4) with the gas pipe (6), a solenoid valve (EV1) forming a gas flow selecting means (8) is provided so as to be capable of opening and closing. The solenoid valve (EV1) are controlled, by a controller (C) as a control means, so as to be selected between the opening and closing states.

Further, between the hot heat source heat exchanger (1) and a connection point of the liquid flow pipe (5) with the liquid pipe (7), a first check valve (CV1) is provided which allows only a flow of liquid refrigerant from the cold heat source heat exchanger (2) to the hot heat source heat exchanger (1). In the liquid pipe (7), a second check valve (CV2) is provided which allows only a flow of liquid refrigerant from the indoor heat exchanger (3) to the cold heat source heat exchanger (2). Thus, a liquid flow selecting means (9) is formed.

Next described is the primary refrigerant circuit (A) for giving an amount of heat to the secondary refrigerant circuit (B).

This circuit (A) is configured such that a compressor (11) as a refrigerant heating means, a heating heat exchanger (12) as a heating heat exchange means for exchanging heat with the hot heat source heat exchanger (1), an expansion valve (13) as an expansion mechanism, a heat amount adjusting heat exchanger (14) as a heat exchange amount adjusting means, and a cooling heat exchanger (15) as a cooling heat exchange means for exchanging heat with the cold heat source heat exchanger (2), are connected in this order so as to be capable of circulating refrigerant through refrigerant piping (16). A bypass passage (17) is connected at one end thereof between the expansion valve (13) and the heat amount adjusting heat exchanger (14) and at the other end between the heat amount adjusting heat exchanger (14) and the cooling heat exchanger (15). The bypass passage (17) is provided with a motor-operated flow rate control valve (18) as a flow control valve adjustable in opening for controlling a flow rate of refrigerant flowing into the heat amount adjusting heat exchanger (14). The motor-operated flow rate control valve (18) is controlled in its opening by the controller (C).

Next, description is made about the operation of the refrigerant circuitry configured as above-mentioned during an heating operation. FIG. 2 for description of the operation shows respective rates between the storage amount of gas refrigerant and the storage amount of liquid refrigerant in respective heat exchangers (1, 2, 3) of the secondary refrigerant circuit (B).

During the heating operation, first, the solenoid valve (EV1) of the secondary refrigerant circuit (B) is closed by the controller (C), while the motor-operated flow rate control valve (18) of the primary refrigerant circuit (A) is controlled in its opening by the controller (C) so as to control a flow rate of refrigerant flowing into the heat amount adjusting heat exchanger (14) in accordance with a difference between the amount of heat exchange of the heating heat exchanger (12) with the hot heat source heat exchanger (1) and the amount of heat exchange of the cooling heat exchanger (15) with the cold heat source heat exchanger (2).

Specifically described is the operation of refrigerant circulation in the primary refrigerant circuit (A) and the secondary refrigerant circuit (B).

In the primary refrigerant circuit (A), refrigerant discharged from the compressor (11) is heat-exchanged, in the heating heat exchanger (12), with the hot heat source heat exchanger (1) to condense and is reduced in pressure in the expansion valve (13), and a part of refrigerant is then heat-exchanged, in the heat amount adjusting heat exchanger (14), with, for example, outside air to evaporate while the remaining refrigerant passes through the bypass passage (17) and is heat-exchanged, in the cooling heat exchanger (15), with the cold heat source heat exchanger (2) to evaporate. The gas refrigerant evaporated in the above manners is sucked into the compressor (11). Such a circulation of refrigerant is repeated.

Figure 2A:
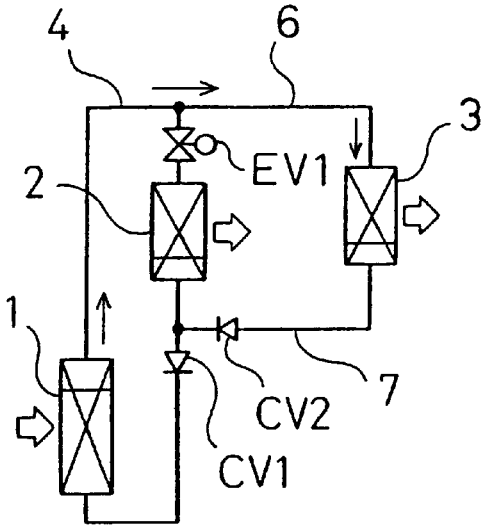
FIGS. 2(*a*), 2(*b*), and 2(*c*) show diagrams for illustrating refrigerant circulation in the first embodiment.
Figure 2B:
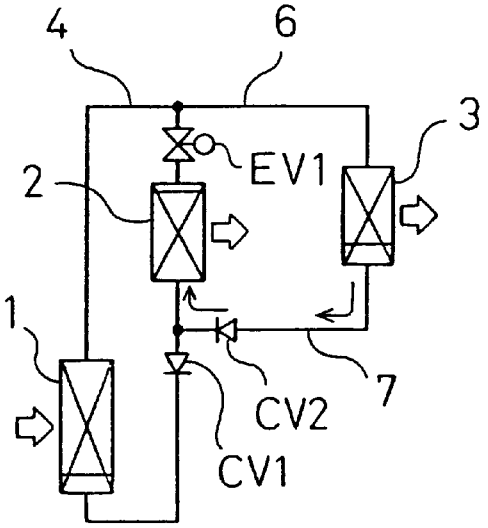
Figure 2C:
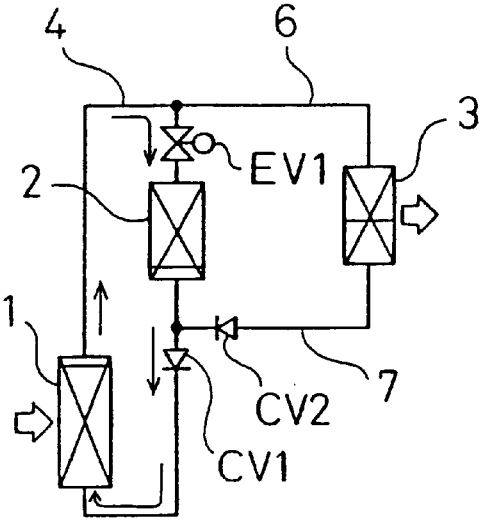

On the other hand, in the secondary refrigerant circuit (B), the hot heat source heat exchanger (1) receives a specified amount of heat from the heating heat exchanger (12) so that refrigerant is evaporated in the hot heat source heat exchanger (1), and, as shown in FIG. 2(*a*), high-pressure gas refrigerant is supplied from the hot heat source heat exchanger (1) to the indoor heat exchanger (3) through the gas flow pipe (4) and the gas pipe (6). Gas refrigerant exchanges heat with room air in the indoor heat exchanger (3) to condense therein so that room air is heated resulting in heating the room.

While refrigerant in the indoor heat exchanger (3) is condensed at a room temperature, refrigerant in the cold heat source heat exchanger (2) is condensed by refrigerant in the cooling heat exchanger (15). Therefore, the internal pressure of the indoor heat exchanger (3) is higher than that of the cold heat source heat exchanger (2) and the pressure difference causes liquid refrigerant in the indoor heat exchanger (3) to be transferred to the cold heat source heat exchanger (2) as shown in FIG. 2(*b*). Consequently, with the heating operation, liquid refrigerant is gradually stored in the cold heat source heat exchanger (2).

Even when gas refrigerant is introduced into the cold heat source heat exchanger (2), an amount of heat is taken from the cold heat source heat exchanger (2) by the cooling heat exchanger (15). Accordingly, the gas refrigerant is condensed at a relatively low temperature.

When such a heating operation is executed for a specified time so that the storage amount of liquid refrigerant in the cold heat source heat exchanger (2) exceeds a specified amount, the heating operation is stopped and changed to an operation of recovering liquid refrigerant.

In the operation of recovering liquid refrigerant, the solenoid valve (EV1) is opened by the controller (C). Thereby, as shown in FIG. 2(*c*), high-pressure gas refrigerant in the gas flow pipe (4) is introduced into the cold heat source heat exchanger (2) so that pressure is equalized between the hot heat source heat exchanger (1) and the cold heat source heat exchanger (2). Since the cold heat source heat exchanger (2) is placed at a position higher that that of the hot heat source heat exchanger (1) as described above, this level difference causes liquid refrigerant in the cold heat source heat exchanger (2) to be recovered to the hot heat source heat exchanger (1).

Since the liquid pipe (7) is provided with the second check valve (CV2), this prevents liquid refrigerant in the cold heat source heat exchanger (2) from flowing into the indoor heat exchanger (3) during the operation of recovering liquid refrigerant.

The cold heat source heat exchanger (2) is configured so as not to exchange heat with the cooling heat exchanger (15) during the operation of recovering liquid refrigerant.

Further, if the hot heat source heat exchanger (1) is configured so as not to heat refrigerant at this time, the time required for pressure equalization between the hot heat source heat exchanger (1) and the cold heat source heat exchanger (2) can be reduced. This allows the operation of recovering liquid refrigerant to be promptly completed thereby reducing the operating time.

The above-described heating operation and the operation of recovering liquid refrigerant are alternately conducted for continuous room heating.

In a state that the above-described heating operation is executed in the secondary refrigerant circuit (B), refrigerant is condensed in the indoor heat exchanger (3).

Accordingly, an amount of heat given from the heating heat exchanger (12) to the hot heat source heat exchanger (1) is larger than that taken from the cold heat source heat exchanger (2) by the cooling heat exchanger (15).

Therefore, it is required that the amount of heat radiated and the amount of heat absorbed are equal as the overall primary refrigerant circuit (A) for excellent refrigerant circulation in the primary refrigerant circuit (A). To satisfy the requirement, the opening of the motor-operated flow rate control valve (18) is set such that the amount of heat absorbed in the heat amount adjusting heat exchanger (14) becomes equal to a difference between both the heat exchange amounts described above, thereby controlling a flow rate of refrigerant in the heat amount adjusting heat exchanger (14). In other words, the opening of the motor-operated flow rate control valve (18) is set such that the sum of the amount of heat absorbed in the cooling heat exchanger (15) and the amount of heat absorbed in the heat amount adjusting heat exchanger (14) become equal to the amount of heat radiated in the heating heat exchanger (12).

In this manner, the heating operation of the secondary refrigerant circuit (B) is made while an excellent refrigerant circulation in the primary refrigerant circuit (A) is achieved.

As described above, since the heat transfer device of the first embodiment executes the operation of circulating refrigerant with the use of rise in pressure of refrigerant caused by an amount of heat given to the hot heat source heat exchanger (1), it eliminates the need of providing a drive source such as a pump in the secondary refrigerant circuit (B). This reduces power consumption and failure sites, thereby ensuring the reliability of the overall device.

Further, since refrigerant is condensed in the cold heat source heat exchanger (2), gas refrigerant can be liquefied with reliability and the cold heat source heat exchanger (2) can be prevented from raising its internal pressure, thereby achieving an excellent refrigerant circulation. This eliminates the need of keeping refrigerant supercooled in the indoor heat exchanger for preventing gas refrigerant from flowing out of the indoor heat exchanger as in the conventional case. As a result, a sufficient heat exchange amount can be obtained between refrigerant and room air. This increases heating capacity.

Furthermore, since constrains to the placement of elements can be reduced, this provides high reliability and general versatility.

The circuitry of this embodiment is not restricted to the above-mentioned configuration. For example, the first and second check valves (CV1, CV2) are substituted by flow control valves, respectively.

Modifications of Secondary Refrigerant Circuit

A plurality of modifications of the secondary refrigerant circuit (B) will be described below.

In the below-mentioned modifications of the secondary refrigerant circuit (B), description and illustrated figures for the primary refrigerant circuit are omitted. The modifications of the secondary refrigerant circuit (B) may be each combined with a circuit similar to the primary refrigerant circuit (A) described in the first embodiment or with one of modifications of the primary refrigerant circuit which are described later. Further, in the below-mentioned circuits, same names and reference numerals refer to parts having same functions.

Second Embodiment

A second embodiment is a heat transfer device according to claims 6 to 9 of this invention, in which the secondary refrigerant circuit is configured for a cooling-only air conditioner. In this embodiment, only differences in circuit configuration from the first embodiment are described.

Figure 3:
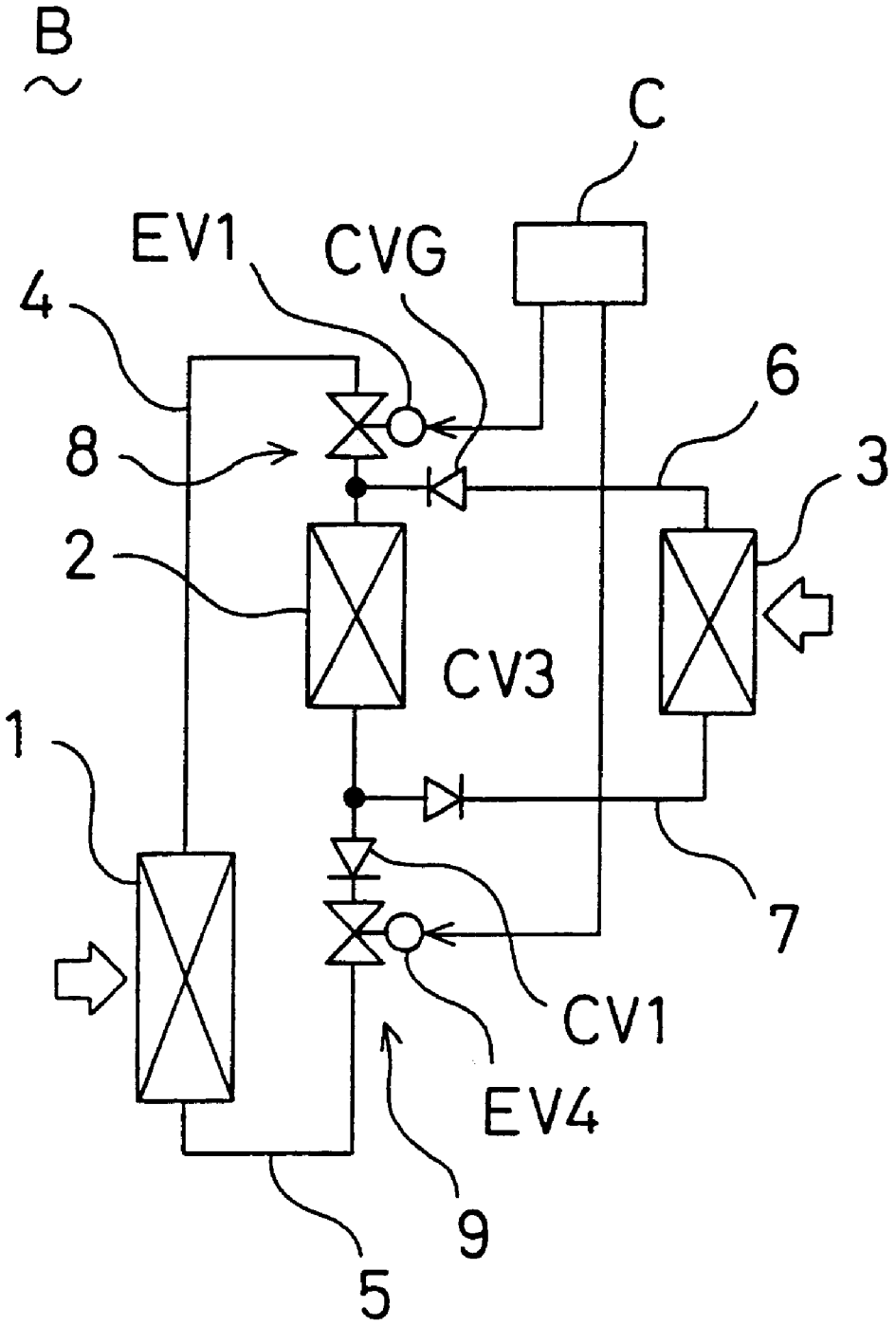
FIG. 3 is a diagram showing a secondary refrigerant circuit of a second embodiment of the invention.

As shown in FIG. 3, a solenoid valve (EV1) for gas refrigerant is provided between a hot heat source heat exchanger (1) and a connection point of a gas flow pipe (4) with a gas pipe (6), and a check valve (CVG) is provided in the gas pipe (6) so as to allow only a flow of gas refrigerant from an indoor heat exchanger (3) to a cold heat source heat exchanger (2). Thus, a gas flow selecting means (8) is formed.

Between the hot heat source heat exchanger (1) and a connection point of a liquid flow pipe (5) with a liquid pipe (7), a solenoid valve (EV4) for liquid refrigerant is provided in addition to a first check valve (CV1) as in the first embodiment.

In the liquid pipe (7), a third check valve (CV3) corresponding to the second check valve of claim 9 of the invention is provided so as to allow only a flow of liquid refrigerant from the cold heat source heat exchanger (2) to the indoor heat exchanger (3). Thus, a liquid flow selecting means (9) is formed. The solenoid valves (EVI, EV4) are each controlled by a controller (C).

Next, description is made about an cooling operation of the refrigerant circuit (B) configured as above-described.

Prior to the start of the cooling operation, liquid refrigerant is stored in the cold heat source heat exchanger (2). When the cooling operation is initiated in the above state, the controller (C) first opens the solenoid valve (EV1) for gas refrigerant and closes the solenoid valve (EV4) for liquid refrigerant. In this state, as shown in FIG. 4(*a*), high-pressure gas refrigerant is supplied from the hot heat source heat exchanger (1) to the cold heat source heat exchanger (2) through the gas flow pipe (4).

Figure 4A:
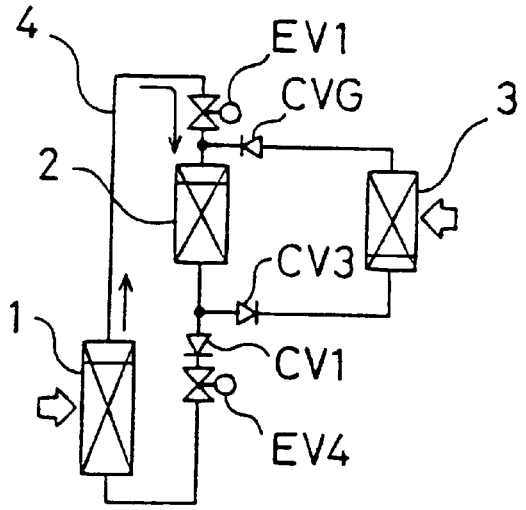
FIGS. 4(*a*), 4(*b*), and 4(*c*) show diagrams corresponding to FIG. 2 in the second embodiment.
Figure 4B:
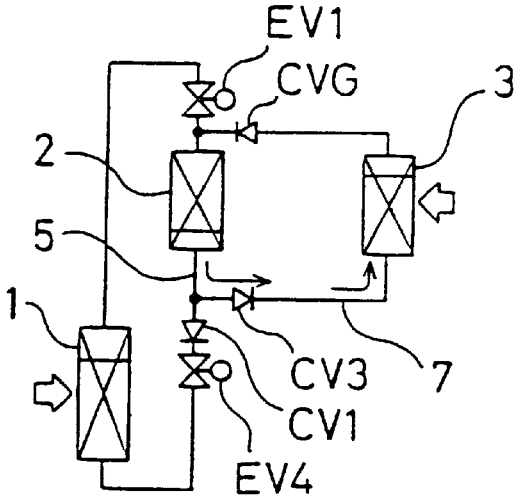
Figure 4C:
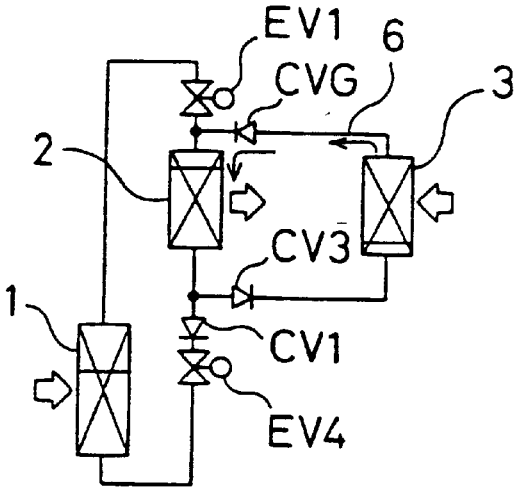

When the gas refrigerant is thus supplied, the pressure of the gas refrigerant acts so that liquid refrigerant previously stored in the cold heat source heat exchanger (2) is pushed out toward the indoor heat exchanger (3) through the liquid flow pipe (5) and the liquid pipe (7) as shown in FIG. 4(*b*). In the state shown in FIGS. 4(*a*) and 4(*b*), heat radiation is not made in the cold heat source heat exchanger (2).

After such an operation is continued for a specified time, the controller (C) closes the solenoid valve (EV1) for gas refrigerant. In this state, the supply of gas refrigerant from the hot heat source heat exchanger (1) to the cold heat source heat exchanger (2) is stopped. Then, in a state that gas refrigerant is introduced into the cold heat source heat exchanger (2) and liquid refrigerant is introduced into the indoor heat exchanger (3), gas refrigerant is condensed in the cold heat source heat exchanger (2). A drop in pressure associated with the condensation of gas refrigerant lowers the internal pressure of the cold heat source heat exchanger (2) to a lower level than the indoor heat exchanger (3).

This pressure difference causes refrigerant evaporated in the indoor heat exchanger (3) to be transferred to the cold heat source heat exchanger (2) as shown in FIG. 4(*c*). In the indoor heat exchanger (3), heat exchange is made between refrigerant and room air thereby cooling the room air.

When such a cooling operation is executed for a specified time so that the storage amount of liquid refrigerant in the hot heat source heat exchanger (1) becomes short of a specified amount, the cooling operation is stopped and changed to an operation of recovering liquid refrigerant. During the operation of recovering liquid refrigerant, both the solenoid valves (EV1, EV4) are opened by the controller (C). Thereby, as in the case of the first embodiment, pressure is equalized between the hot heat source heat exchanger (1) and the cold heat source heat exchanger (2) so that liquid refrigerant in the cold heat source heat exchanger (2) is recovered to the hot heat source heat exchanger (1).

Since the gas pipe (6) is provided with the check valve (CVG) for gas refrigerant, this prevents gas refrigerant in the hot heat source heat exchanger (2) from flowing into the indoor heat exchanger (3) during the operation of recovering liquid refrigerant.

The cold heat source heat exchanger (2) is configured so as not to exchange heat with the cooling heat exchanger (15) during the operation of recovering liquid refrigerant.

The above-described cooling operation and the operation of recovering liquid refrigerant are alternately conducted for continuous room cooling.

Since the heat transfer device of the second embodiment also eliminates the need of providing a drive source such as a pump in the secondary refrigerant circuit (B), this reduces power consumption and failure sites, thereby ensuring the reliability of the overall device.

The circuitry of this embodiment is not restricted to the above-mentioned configuration. For example, the check valve (CVG) for gas refrigerant is substituted by a flow control valve.

Further, only one of the first check valve (CV1) and the check valve (CVG) for gas refrigerant may be provided.

Figure 5:
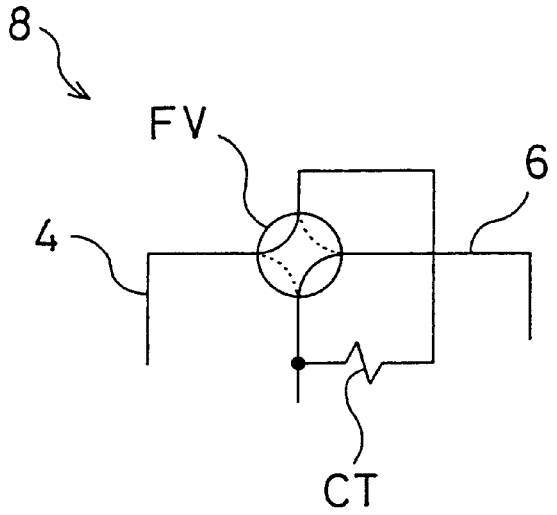
FIG. 5 is a diagram showing a modification of a gas flow selecting means.

For the gas flow selecting means (8), as shown in FIG. 5, a four-way selector valve (FV) and a capillary tube (CT) may be provided in place of the solenoid valve (EV1) for gas refrigerant and the check valve (CVG) for gas refrigerant such that the four-way selector valve (FV) selects the direction of refrigerant flow in accordance with the condition of refrigerant circulation. In detail, when liquid refrigerant is supplied from the cold heat source heat exchanger (2) to the indoor heat exchanger (3), the direction of refrigerant flow is selected as shown in broken lines in FIG. 5 through the four-way selector valve (FV). On the other hand, when gas refrigerant is supplied from the indoor heat exchanger (3) to the cold heat source heat exchanger (2), the direction of refrigerant flow is selected as shown in solid lines in FIG. 5 through the four-way selector valve (FV).

Figure 6:
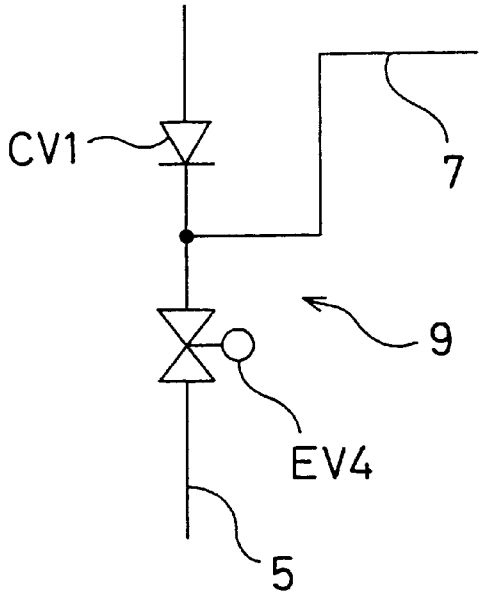
FIG. 6 is a diagram showing a modification of a liquid flow selecting means.

For the configuration of the liquid flow selecting means (9), if the first check valve (CV1) is placed between the cold heat source heat exchanger (2) and the connection point of the liquid flow pipe (5) with the liquid pipe (7) as shown in FIG. 6, the third check valve (CV3) can be dispensed with.

Third Embodiment

An embodiment of a heat transfer device according to claims 10 to 13 of the invention will be described next with reference to the drawings.

In this third embodiment, the secondary refrigerant circuit is configured for an air conditioner changeable between the heating operation and the cooling operation. Described in this embodiment are only differences in circuit configuration from the embodiments described so far.

Figure 7:
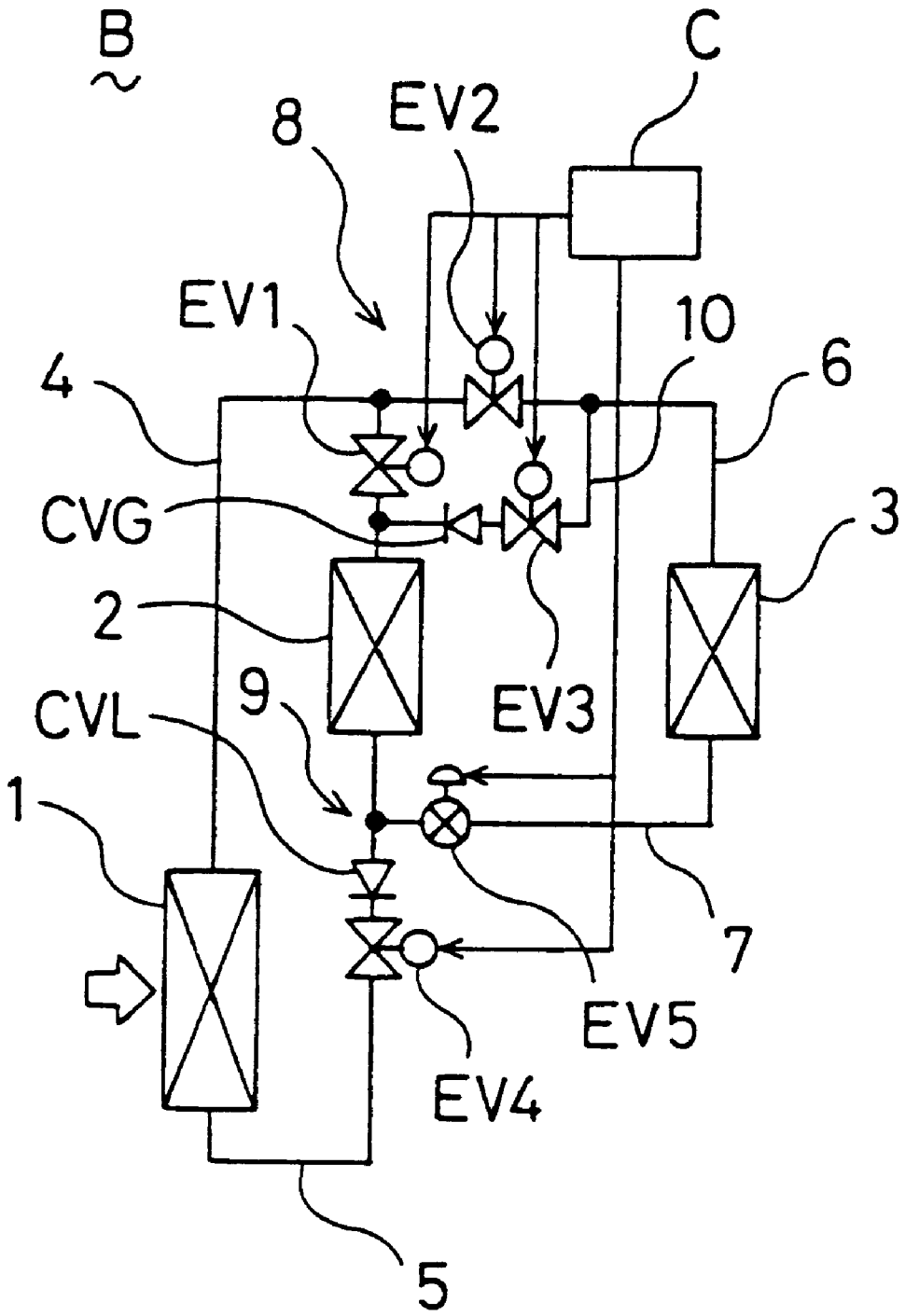
FIG. 7 is a diagram showing a secondary refrigerant circuit of a third embodiment of the invention.

As shown in FIG. 7, a first solenoid valve (EV1) is provided between a cold heat source heat exchanger (2) and a connection point of a gas flow pipe (4) with a gas pipe (6), and a second solenoid valve (EV2) is provided in the gas pipe (6).

A connecting pipe (10) is connected at one end thereof between the first solenoid valve (EV1) and the cold heat source heat exchanger (2) and at the other end between the second solenoid valve (EV2) and the indoor heat exchanger (3). In the connecting pipe (10), there are provided a third solenoid valve (EV3) and a check valve (CVG) for gas refrigerant for allowing only a flow of gas refrigerant from the indoor heat exchanger (3) to the cold heat source heat exchanger (2). Thus, a gas flow selecting means (8) is formed.

At a recovery flow side part of a liquid flow pipe (5) between the hot heat source heat exchanger (1) and a connection point with a liquid pipe (7), a fourth solenoid valve (EV4) referred to as a first shut-off valve in claim 13 of the invention is provided. Further, at the recovery flow side part, there is provided a check valve (CVL) for liquid refrigerant for allowing only a flow of liquid refrigerant from the cold heat source heat exchanger (2) to the hot heat source heat exchanger (1).

In the liquid pipe (7), there is provided a fifth motor-operated valve (EV5) referred to as a second shut-off valve in the claim 13. Thus, a liquid flow selecting means (9) is formed. The solenoid valves (EV1, EV2, EV3, EV4) and the motor-operated valve (EV5) are each controlled to be changeable between opening and closing states by a controller (C).

Next, description is made about heating and cooling operations of the refrigerant circuit (B) configured as above-described.

First described is the heating operation. In this heating operation, firstly, the controller (C) closes the first solenoid valve (EV1) and the third solenoid valve (EV3) and opens the second solenoid valve (EV2), the fourth solenoid valve (EV4) and the fifth motor-operated valve (EV5).

Figure 8A:
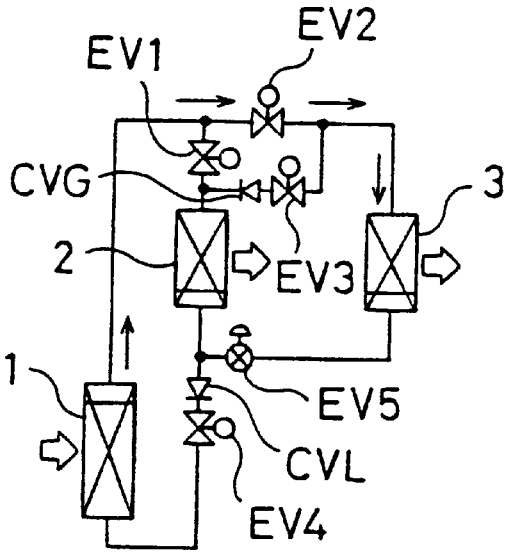
FIGS. 8(*a*), 8(*b*), and 8(*c*) show diagrams corresponding to FIG. 2 for illustrating a heating operation mode in the third embodiment.
Figure 8B:
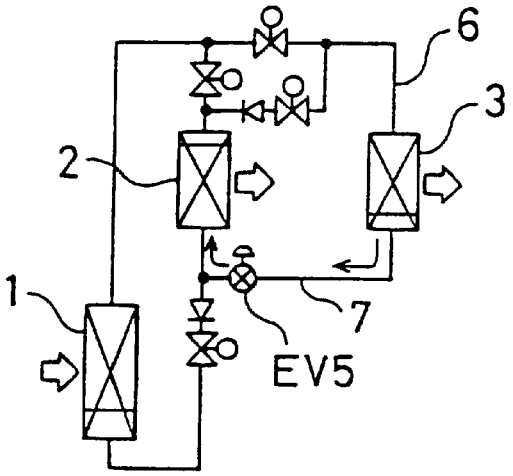
Figure 8C:
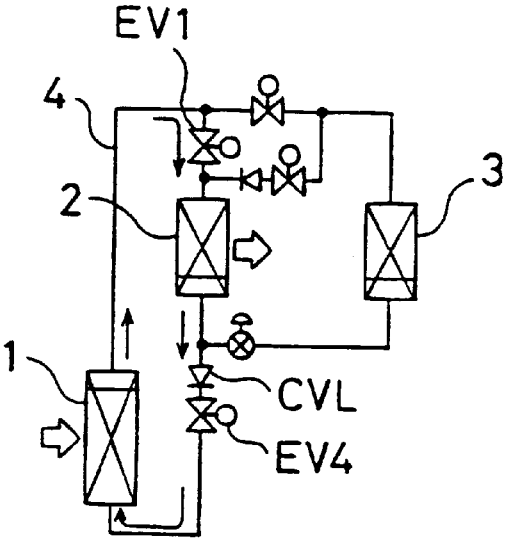

In this state, as in the case of the first embodiment and shown in FIG. 8(*a*), gas refrigerant is supplied from the hot heat source heat exchanger (1) to the indoor heat exchanger (3) for condensation so that room air is heated. Then, as shown in FIG. 8(*b*), the condensed liquid refrigerant is transferred to the cold heat source heat exchanger (2) by pressure difference between the indoor heat exchanger (3) and the cold heat source heat exchanger (2).

When the storage amount of liquid refrigerant in the cold heat source heat exchanger (2) exceeds a specified amount, the heating operation is stopped and switched to an operation of recovering liquid refrigerant as in the first embodiment.

In the operation of recovering liquid refrigerant, the controller (C) closes the second solenoid valve (EV2), the third solenoid valve (EV3) and the fifth motor-operated valve (EV5) and opens the first solenoid valve (EV1) and the fourth solenoid valve (EV4).

In this state, as shown in FIG. 8(*c*), high-pressure gas refrigerant in the gas flow pipe (4) is introduced into the cold heat source heat exchanger (2) so that pressure is equalized between the hot heat source heat exchanger (1) and the cold heat source heat exchanger (2). The level difference between both the heat exchangers (1, 2) causes liquid refrigerant in the cold heat source heat exchanger (2) to be recovered to the hot heat source heat exchanger (1).

Figure 9A:
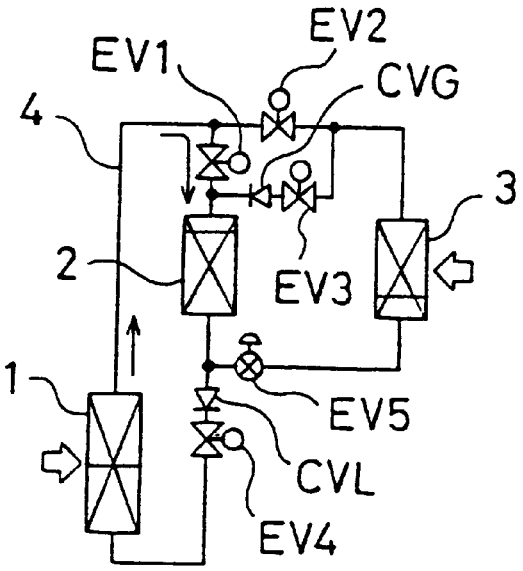
FIGS. 9(*a*), 9(*b*), and 9(*c*) show diagrams corresponding to FIG. 2 for illustrating a cooling operation mode in the third embodiment.
Figure 9B:
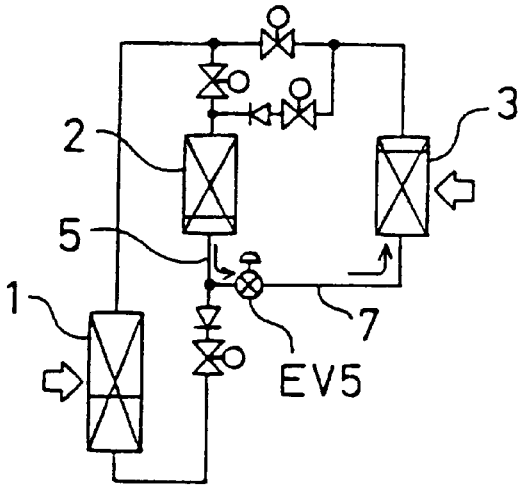
Figure 9C:
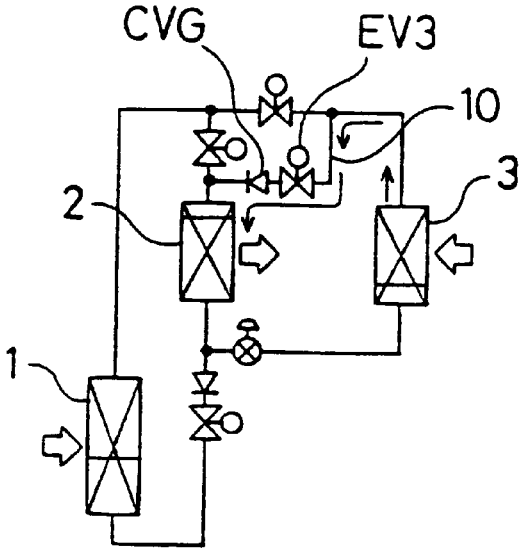

Next described is the cooling operation with reference to FIG. 9.

In this cooling operation, firstly, the controller (C) closes the second solenoid valve (EV2) and the fourth solenoid valve (EV4) and opens the first solenoid valve (EV1), the third solenoid valve (EV3) and the fifth motor-operated valve (EV5). In this state, as in the case of the second embodiment and shown in FIG. 9(*a*), high-pressure gas refrigerant is supplied from the hot heat source heat exchanger (1) to the cold heat source heat exchanger (2) through the gas flow pipe (4). Thereby, as shown in FIG. 9(*b*), liquid refrigerant previously stored in the cold heat source heat exchanger (2) is pushed out toward the indoor heat exchanger (3) through the liquid flow pipe (5) and the liquid pipe (7).

After such an operation is continued for a specified time, the controller (C) closes the first solenoid valve (EV1). Then, as shown in FIG. 9(*c*), a pressure difference between the cold heat source heat exchanger (2) in which refrigerant is condensed and the indoor heat exchanger (3) in which refrigerant is evaporated, causes refrigerant in the indoor heat exchanger (3) to be transferred to the cold heat source heat exchanger (2) through the connecting pipe (10).

When such a cooling operation is executed for a specified time so that the storage amount of liquid refrigerant in the hot heat source heat exchanger (1) becomes short of a specified amount, the cooling operation is stopped and switched to the operation of recovering liquid refrigerant.

In the operation of recovering liquid refrigerant, the first solenoid valve (EV1) and the fourth solenoid valve (EV4) are opened by the controller (C). Thereby, pressure is equalized between the hot heat source heat exchanger (1) and the cold heat source heat exchanger (2) so that liquid refrigerant in the cold heat source heat exchanger (2) is recovered to the hot heat source heat exchanger (1).

The circuit of this embodiment is not restricted to the above-described configuration. For example, the check valve (CVL) for liquid refrigerant and the fourth solenoid valve (EV4) maybe substituted by flow control valves, respectively.

Figure 10:
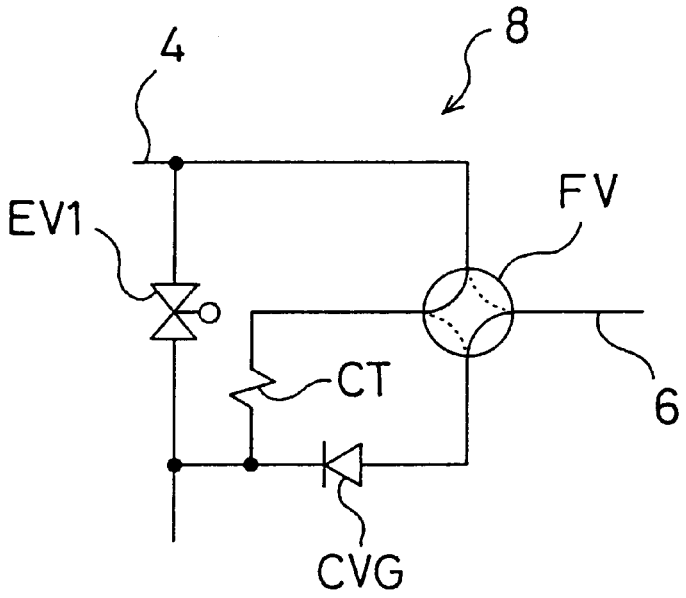
FIG. 10 is a diagram showing a modification of a gas flow selecting means.

For the gas flow selecting means (8), as shown in FIG. 10, a first solenoid valve (EV1), a check valve (CVG) for gas refrigerant, a four-way selector valve (FV) and a capillary tube (CT) may be provided such that the four-way selector valve (FV) selects the direction of refrigerant flow in accordance with the condition of refrigerant circulation. In detail, during the heating operation, the direction of refrigerant flow is selected as shown in broken lines in FIG. 10 through the four-way selector valve (FV). On the other hand, during the cooling operation and the operation of recovering liquid refrigerant from the cold heat source heat exchanger (2) to the hot heat source heat exchanger (1), the direction of refrigerant flow is selected as shown in solid lines in FIG. 10 through the four-way selector valve (FV).

Figure 11:
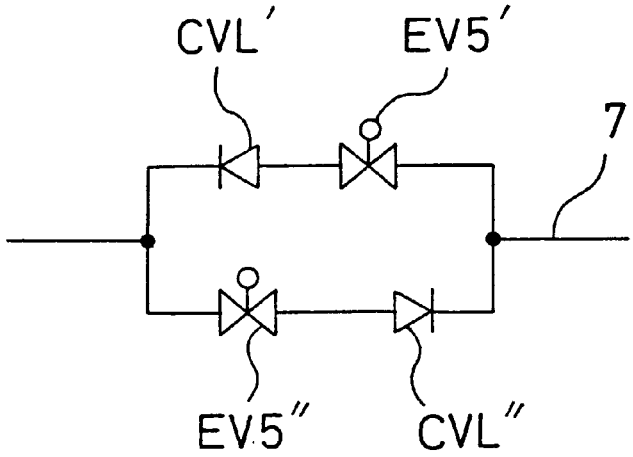
FIG. 11 is a diagram showing a modification of a liquid flow selecting means.

In place of the fifth motor-operated valve (EV5), as shown in FIG. 11, a part of the liquid pipe (7) may be divided into two branch lines and the branch lines may be provided with solenoid valves (EV5', EV5") respectively and with check valves (CVL', CVL") respectively. The check valves each allow a single- but opposite-directional flow of liquid refrigerant. In this case, during the heating operation, the solenoid valve (EV5') connected in series with the check valve (CVL') for allowing a flow of liquid refrigerant from the indoor heat exchanger (3) to the cold heat source heat exchanger (2) is opened. On the other hand, during the cooling operation, the solenoid valve (EV5") connected in series with the check valve (CVL") for allowing a flow of liquid refrigerant from the cold heat source heat exchanger (2) to the indoor heat exchanger (3) is opened.

Fourth Embodiment

An embodiment of a heat transfer device according to claims 14 to 20 of the invention will be described next with reference to the drawings.

In this fourth embodiment, the secondary refrigerant circuit is configured for a multi-type air conditioner freely operable for cooling and heating operations. The air conditioner has a plurality of indoor heat exchangers placed in a plurality of rooms individually so as to be individually selectable between the cooling and heating operations.

Figure 12:
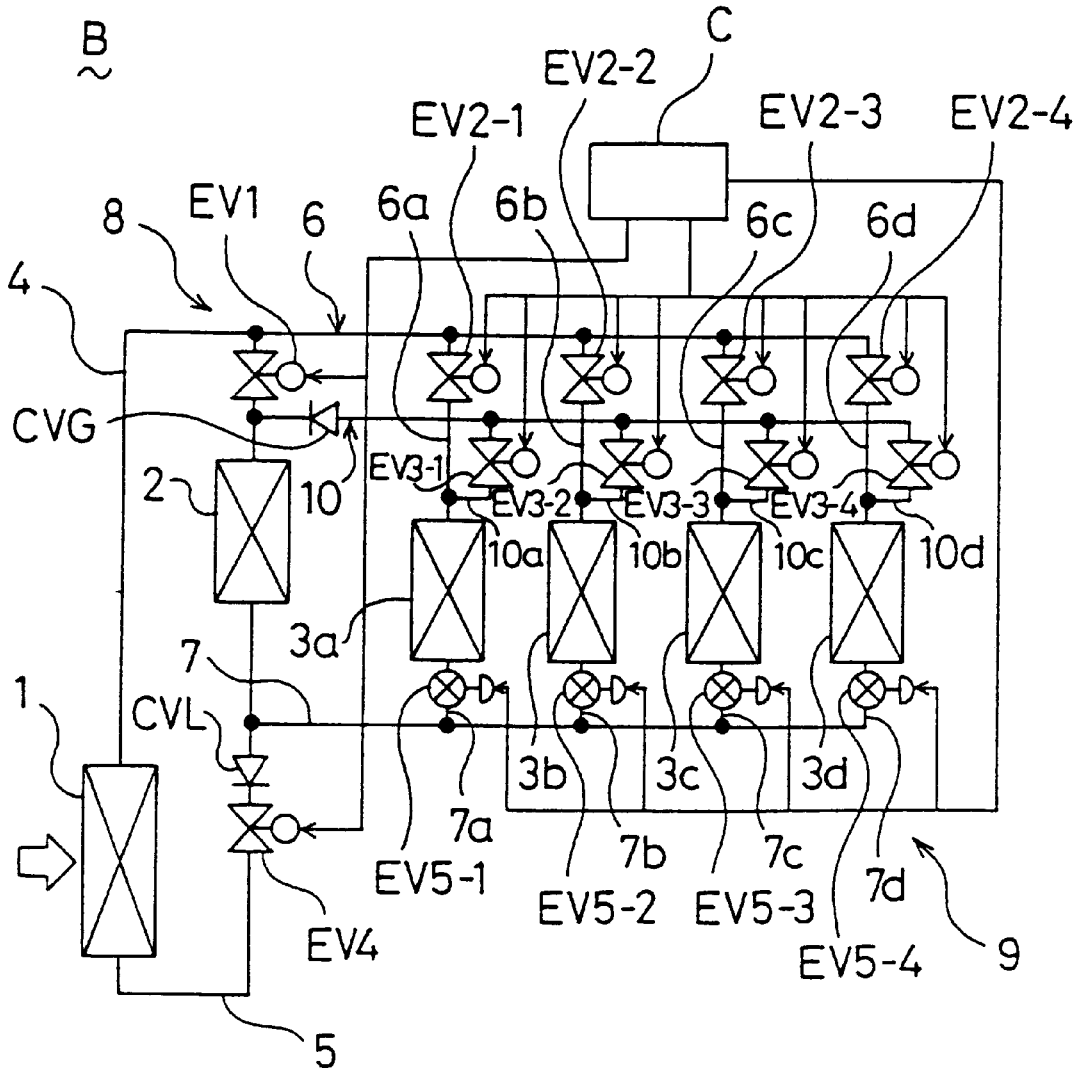
FIG. 12 is a diagram showing a secondary refrigerant circuit of a fourth embodiment of the invention.

As shown in FIG. 12, a first solenoid valve (EV1) is provided between a cold heat source heat exchanger (2) and a connection point of a gas flow pipe (4) with a gas pipe (6). The gas pipe (6) is divided into plural lines toward the indoor heat exchangers (3*a*–3*d*) thereby forming branch gas pipes (6*a*–6*d*) respectively. The branch gas pipes (6*a*–6*d*) are provided with second solenoid valves (EV2-1 to EV2-4) respectively.

A connecting pipe (10) is connected at one end thereof between the first solenoid valve (EV1) and the cold heat source heat exchanger (2) and at the other ends between the second solenoid valves (EV2-1 to EV2-4) and the indoor heat exchangers (3*a*–3*d*) respectively. The connecting pipe (10) is divided into plural lines toward the indoor heat exchangers (3*a*–3*d*) thereby forming a plurality of branch connecting pipes (10*a*–10*d*) respectively. The branch connecting pipes (10*a*–10*d*) are provided with third solenoid valves (EV3-1 to EV3-4) respectively.

Further, in the connecting pipe (10), there is provided a check valve (CVG) for gas refrigerant for allowing only a flow of gas refrigerant from the indoor heat exchangers (3*a*–3*d*) to the cold heat source heat exchanger (2). Thus, a gas flow selecting means (8) is formed.

Between the hot heat source heat exchanger (1) and a connection point of a liquid flow pipe (5) with a liquid pipe (7), a fourth solenoid valve (EV4) referred to as a first shut-off valve in claim 20 of the invention is provided. Further, the liquid flow pipe (5) is provided with a check valve (CVL) for liquid refrigerant for allowing only a flow of liquid refrigerant from the cold heat source heat exchanger (2) to the hot heat source heat exchanger (1).

The liquid pipe (7) is divided into plural lines toward the indoor heat exchangers (3*a*–3*d*) thereby forming a plurality of branch liquid pipes (7*a*–7*d*) respectively. The branch liquid pipes (7*a*–7*d*) are provided with fifth motor-operated valves (EV5-1 to EV5-4) referred to as second shut-off valves in claim 20 respectively.

Next, description is made about air conditioning in each room with the use of the refrigerant circuit (B) configured as above-described.

The air conditioning modes are the following three modes:

1. The mode that all the rooms are heated, i.e., the mode that all the indoor heat exchangers (3*a*–3*d*) execute the operation of radiating heat;
2. The mode that all the rooms are cooled, i.e., the mode that all the indoor heat exchangers (3*a*–3*d*) execute the operation of absorbing heat; and
3. The mode that one or more rooms are heated and the other rooms are cooled, i.e., the mode that one or more heat exchangers execute the operation of radiating heat and the other heat exchangers execute the operation of absorbing heat.

The mode that one or more rooms are heated and the other rooms are cooled, is further classified into the following three cases:

3-1. The case that the heat balance among all the rooms requests the heating operation (For example, the case of an operation of mainly radiating heat where the number of indoor heat exchangers executing the operation of radiating heat is larger that that of the indoor heat exchangers executing the operation of absorbing heat);

3-2. The case that the heat balance among all the rooms requests the cooling operation (For example, the case of an operation of mainly absorbing heat where the number of indoor heat exchangers executing the operation of absorbing heat is larger that that of the indoor heat exchangers executing the operation of radiating heat); and 3-3. The case that the total amount of heat radiated and the total amount of heat absorbed are equal among all the rooms (For example, the case that the number of indoor heat exchangers executing the operation of radiating heat is equal to that of the indoor heat exchangers executing the operation of absorbing heat).

Each of the modes and cases will be described below.

First, the mode that all the indoor heat exchangers (3*a*–3*d*) execute the operation of radiating heat is described with reference to FIG. 13.

In this mode, firstly, the controller (C) closes the first solenoid valve (EV1) and the third solenoid valves (EV3-1 to EV3-4) and opens the second solenoid valves (EV2-1 to EV2-4), the fourth solenoid valve (EV4) and the fifth motor-operated valves (EV5-1 to EV5-4).

Figure 13A:
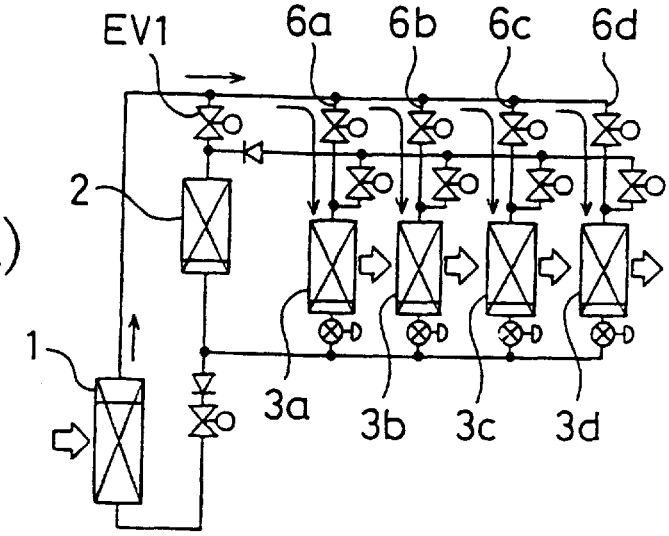
FIGS. 13(*a*), 13(*b*), and 13(*c*) show diagrams corresponding to FIG. 2 for illustrating the time when all rooms are in a heated condition in the fourth embodiment.
Figure 13B:
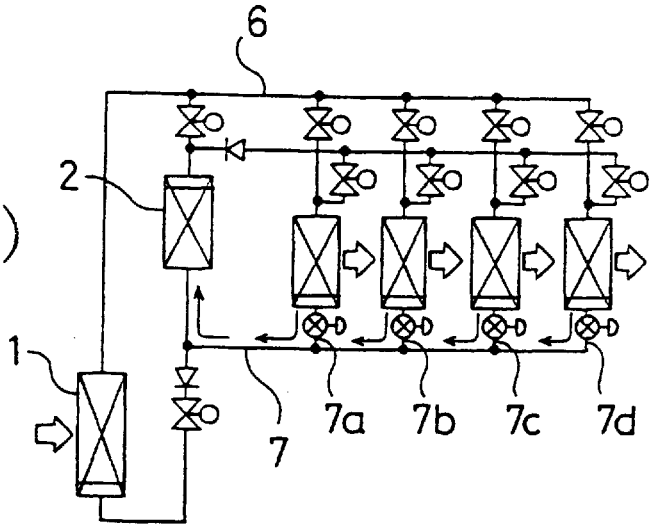
Figure 13C:
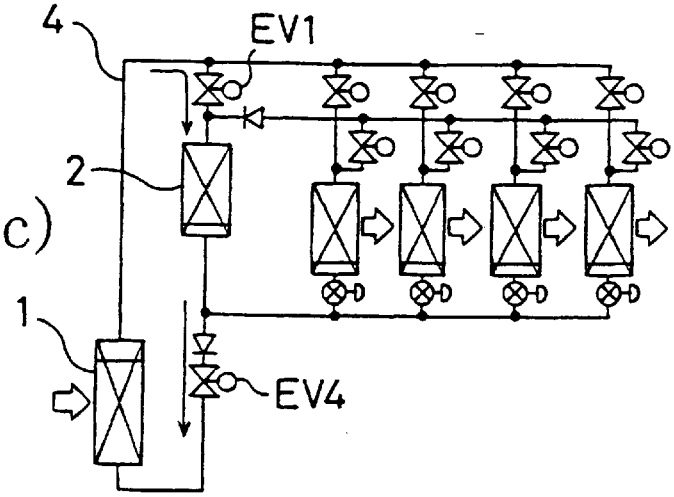

In this state, as in the case of the first embodiment and shown in FIG. 13(*a*), gas refrigerant is supplied from the hot heat source heat exchanger (1) to the indoor heat exchangers (3*a*–3*d*) through the branch gas pipes (6*a*–6*d*) respectively for condensation so that room air is heated. Then, as shown in FIG. 13(*b*), the condensed liquid refrigerant is transferred to the cold heat source heat exchanger (2) through each of the branch liquid pipes (7*a*–7*d*) by pressure difference between each of the indoor heat exchangers (3*a*–3*d*) and the cold heat source heat exchanger (2).

When the storage amount of liquid refrigerant in the cold heat source heat exchanger (2) exceeds a specified amount, the heating operation is stopped and switched to an operation of recovering liquid refrigerant as in the first embodiment.

In the operation of recovering liquid refrigerant, the controller (C) closes the second solenoid valves (EV2-1 to EV2-4), the third solenoid valves (EV3-1 to EV3-4) and the fifth motor-operated valves (EV5-1 to EV5-4) and opens the first solenoid valve (EV1) and the fourth solenoid valve (EV4).

In this state, as shown in FIG. 13(*c*), high-pressure gas refrigerant in the gas flow pipe (4) is introduced into the cold heat source heat exchanger (2) so that pressure is equalized between the hot heat source heat exchanger (1) and the cold heat source heat exchanger (2). The level difference between both the heat exchangers (1, 2) causes liquid refrigerant in the cold heat source heat exchanger (2) to be recovered to the hot heat source heat exchanger (1).

Next, the mode that all the indoor heat exchangers (3*a*–3*d*) execute the operation of absorbing heat is described with reference to FIG. 14.

In this mode, firstly, the controller (C) closes the second solenoid valves (EV2-1 to EV2-4) and the fourth solenoid valve (EV4) and opens the first solenoid valve (EV1), the third solenoid valves (EV3-1 to EV3-4) and the fifth motor-operated valves (EV5-1 to EV5-4).

Figure 14A:
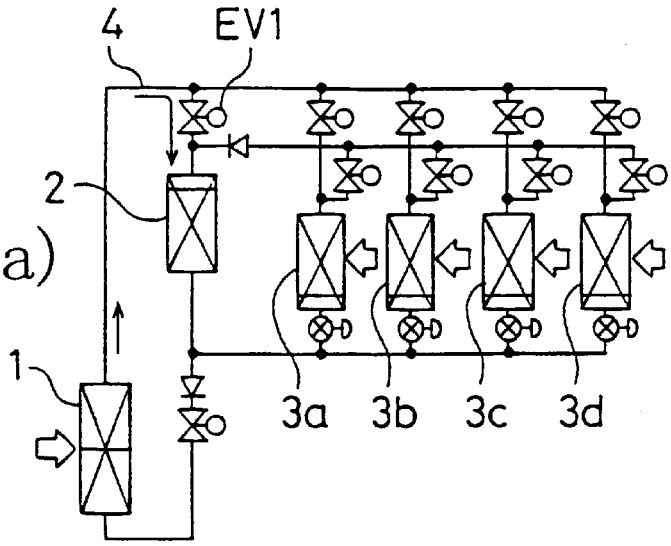
FIGS. 14(*a*), 14(*b*), and 14(*c*) show diagrams corresponding to FIG. 2 for illustrating the time when all the rooms are in a cooled condition in the fourth embodiment.
Figure 14B:
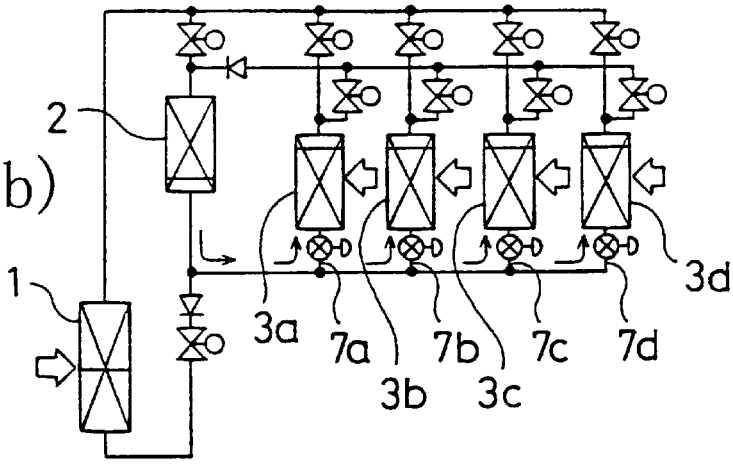
Figure 14C:
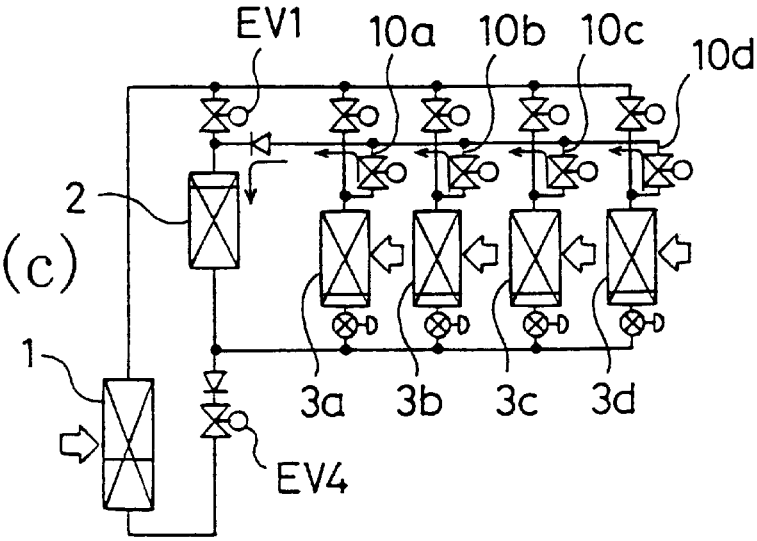

In this state, as in the case of the second embodiment and shown in FIG. 14(*a*), high-pressure gas refrigerant is supplied from the hot heat source heat exchanger (1) to the cold heat source heat exchanger (2) through the gas flow pipe (4). Thereby, as shown in FIG. 14(*b*), liquid refrigerant previously stored in the cold heat source heat exchanger (2) is introduced into the indoor heat exchangers (3*a*–3*d*) through the branch liquid pipes (7*a*–7*d*) respectively.

After such an operation is continued for a specified time, the controller (C) closes the first solenoid valve (EV1). Then, as shown in FIG. 14(*c*), respective pressure differences between the cold heat source heat exchanger (2) in which refrigerant is condensed and the respective indoor heat exchangers (3*a*–3*d*) in which refrigerant is evaporated, cause refrigerant in the indoor heat exchangers (3*a*–3*d*) to be transferred to the cold heat source heat exchanger (2) through the respective branch connecting pipes (10*a*–10*d*).

When such a cooling operation is executed for a specified time so that the storage amount of liquid refrigerant in the hot heat source heat exchanger (1) becomes short of a specified amount, the cooling operation is stopped and switched to an operation of recovering liquid refrigerant.

In the operation of recovering liquid refrigerant, the first solenoid valve (EV1) and the fourth solenoid valve (EV4) are opened by the controller (C). Thereby, pressure is equalized between the hot heat source heat exchanger (1) and the cold heat source heat exchanger (2) so that liquid refrigerant in the cold heat source heat exchanger (2) is recovered to the hot heat source heat exchanger (1).

Figure 15A:
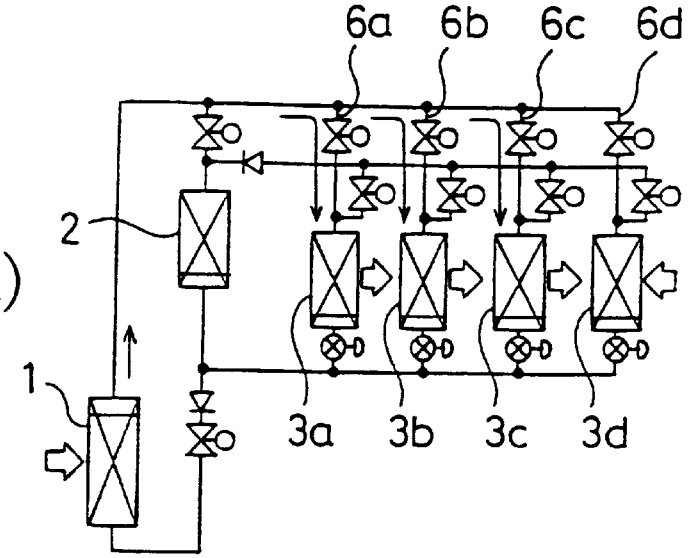
FIGS. 15(*a*), 15(*b*), and 15(*c*) show diagrams corresponding to FIG. 2 for illustrating the time when the heat balance among all the rooms requests a heating operation in the fourth embodiment.
Figure 15B:
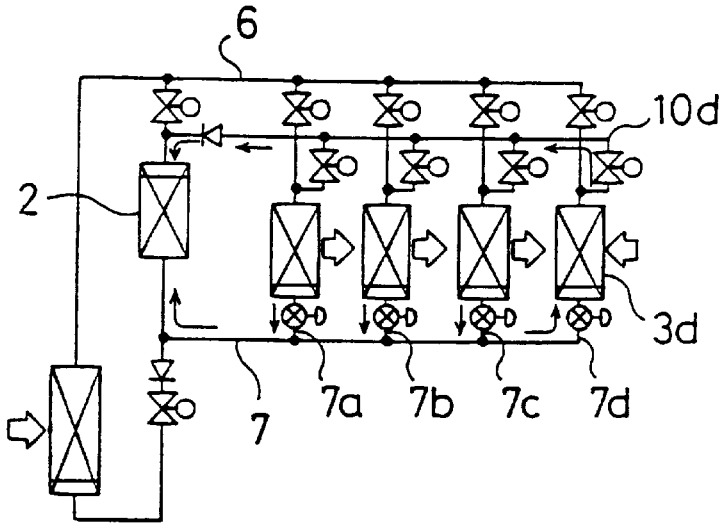
Figure 15C:
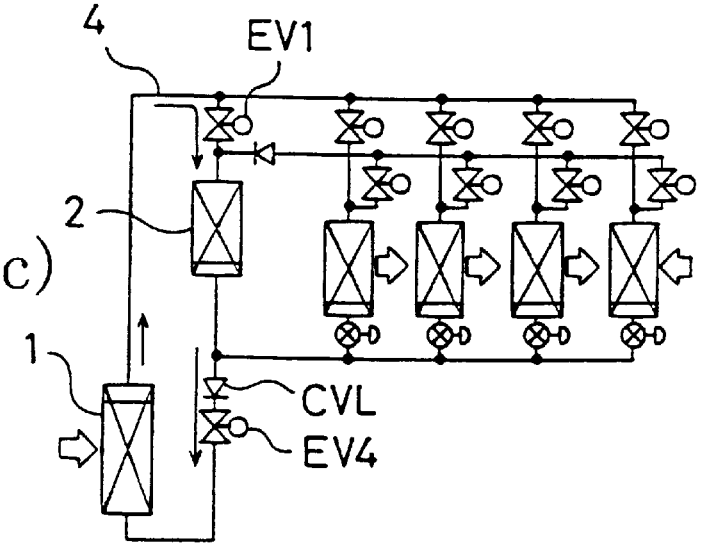

Next, description is made about the case that the heat balance among all the rooms requests the heating operation, i.e., the case of the operation of mainly radiating heat where the number of indoor heat exchangers executing the operation of radiating heat is larger that that of the indoor heat exchangers executing the operation of absorbing heat, with reference to FIG. 15. Here, the case that only the right end one (3*d*) of four indoor heat exchangers (3*a*–3*d*) in FIG. 15 executes the operation of absorbing heat and the other indoor heat exchangers (3*a*–3*c*) execute the operation of radiating heat is described as an example.

In this case, the controller (C) closes the first solenoid valve (EV1), three third solenoid valves (EV3-1 to EV3-3) connected to the indoor heat exchangers (3*a*–3*c*) for executing the operation of radiating heat and one second solenoid valve (EV2-4) connected to the indoor heat exchanger (3*d*) for executing the operation of absorbing heat, while the controller (C) opens three second solenoid valves (EV2-1 to EV2-3) connected to the indoor heat exchangers (3*a*–3*c*) for executing the operation of radiating heat, the fourth solenoid valve (EV4), the fifth motor-operated valves (EV5-1 to EV5-4) and one third solenoid valve (EV3-4) connected to the indoor heat exchanger (3*d*) for executing the operation of absorbing heat.

In this state, as shown in FIG. 15(*a*), gas refrigerant from the hot heat source heat exchanger (1) is supplied to the indoor heat exchangers (3*a*–3*c*) for executing the operation of radiating heat through the branch gas pipes (6*a*–6*c*) respectively and is condensed so that room air is heated in the respective rooms thereby heating the rooms. Then, as shown in FIG. 15(*b*), the condensed liquid refrigerant is transferred, at a specified distribution rate, to the cold heat source heat exchanger (2) through each of the branch liquid pipes (7*a*–7*c*) by pressure difference between each of the indoor heat exchangers (3*a*–3*c*) for executing the operation of radiating heat and the cold heat source heat exchanger (2), and to the indoor heat exchanger (3*d*) for executing the operation of absorbing heat through the branch liquid pipe (7*d*) by pressure difference between each of the indoor heat exchangers (3*a*–3*c*) and the indoor heat exchanger (3*d*). The liquid refrigerant is evaporated in the indoor heat exchanger (3*d*) thereby cooling the room.

The gas refrigerant evaporated in the indoor heat exchanger (3*d*) is supplied to the cold heat source heat exchanger (2) through the branch connecting pipe (10*d*) and is condensed in the cold heat source heat exchanger (2).

When the storage amount of liquid refrigerant in the cold heat source heat exchanger (2) exceeds a specified amount, the heating operation is stopped and switched to the operation of recovering liquid refrigerant.

In the operation of recovering liquid refrigerant, the controller (C) closes the second solenoid valves (EV2-1 to EV2-4), the third solenoid valves (EV3-1 to EV3-4) and the fifth motor-operated valves (EV5-1 to EV5-4) and opens the first solenoid valve (EV1) and the fourth solenoid valve (EV4). In this state, as shown in FIG. 15(*c*), high-pressure gas refrigerant in the gas flow pipe (4) is introduced into the cold heat source heat exchanger (2) so that pressure is equalized between the hot heat source heat exchanger (1) and the cold heat source heat exchanger (2). The level difference between both the heat exchangers (1, 2) causes liquid refrigerant in the cold heat source heat exchanger (2) to be recovered to the hot heat source heat exchanger (1).

Figure 16A:
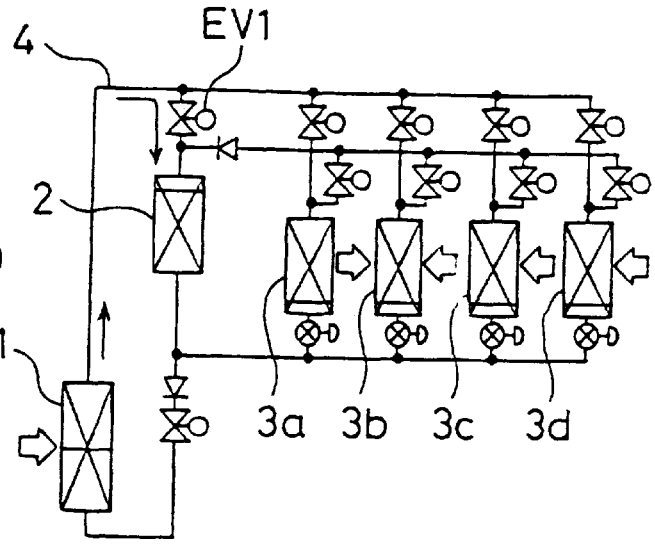
FIGS. 16(*a*), 16(*b*), and 16(*c*) show diagrams corresponding to FIG. 2 for illustrating the time when the heat balance among all the rooms requests a cooling operation in the fourth embodiment.
Figure 16B:
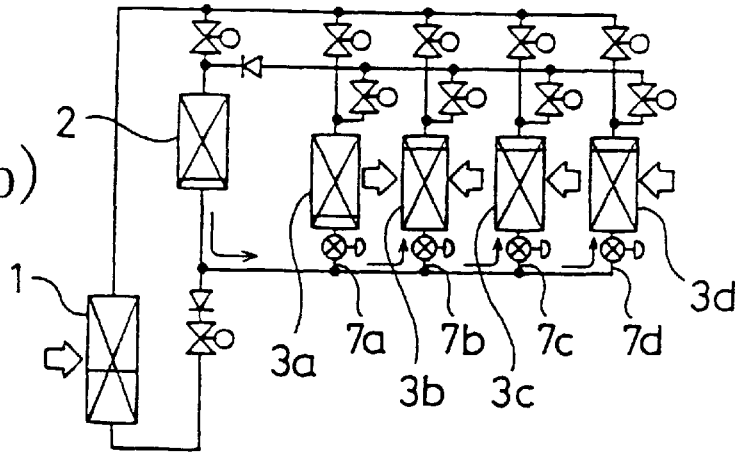

Next, description is made about the case that the heat balance among all the rooms requests the cooling operation, i.e., the case of the operation of mainly absorbing heat where the number of indoor heat exchangers executing the operation of absorbing heat is larger that that of the indoor heat exchangers executing the operation of radiating heat, with reference to FIG. 16. Here, the case that only the left end one (3*a*) of four indoor heat exchangers (3*a*–3*d*) in FIG. 16 executes the operation of radiating heat and the other indoor heat exchangers (3*b*–3*d*) execute the operation of absorbing heat is described as an example.

In this case, firstly, the controller (C) closes the second solenoid valves (EV2-1 to EV2-4), the fourth solenoid valve (EV4), the third solenoid valve (EV3-1) connected to the indoor heat exchanger (3*a*) for executing the operation of radiating heat and the fifth motor-operated valve (EV5-1) connected to the indoor heat exchanger (3*a*) for executing the operation of radiating heat, while it opens the first solenoid valve (EV1), the third solenoid valves (EV3-2 to EV3-4) connected to the indoor heat exchangers (3*b*–3*d*) for executing the operation of absorbing heat and the fifth motor-operated valves (EV5-2 to EV5-4) connected to the indoor heat exchangers (3*b*–3*d*) for executing the operation of absorbing heat.

Figure 16C:
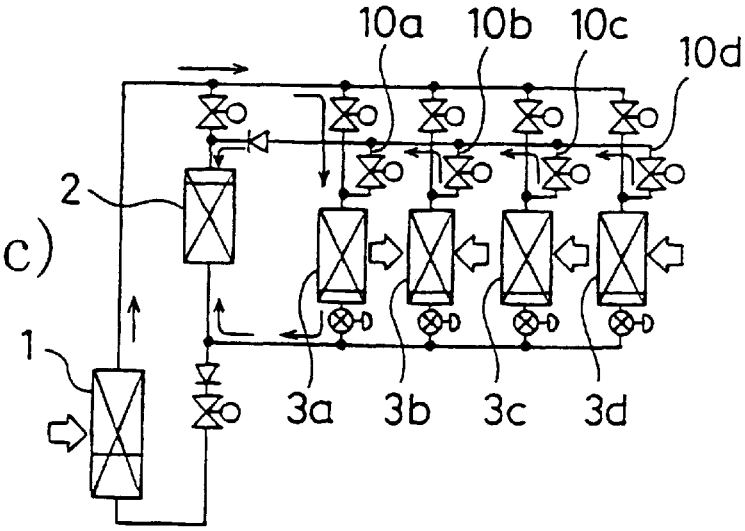

In this state, as shown in FIG. 16(*a*), high-pressure gas refrigerant is supplied from the hot heat source heat exchanger (1) to the cold heat source heat exchanger (2) through the gas flow pipe (4). Thereby, as shown in FIG. 16(*b*), liquid refrigerant previously stored in the cold heat source heat exchanger (2) is introduced into the indoor heat exchangers (3*b*–3*d*) for executing the operation of absorbing heat through the branch liquid pipes (7*b*–7*d*) respectively. Then, the second solenoid valve (EV2-1) and the fifth solenoid valve (EV5-1) both connected to the indoor heat exchanger (3*a*) for executing the operation of radiating heat are opened while the first solenoid valve (EV1) is closed. Thereby, as shown in FIG. 16(C), gas refrigerant evaporated in the indoor heat exchangers (3*b*–3*d*) under the operation of absorbing heat is supplied to the cold heat source heat exchanger (2) through the branch connecting pipes (10*b*–10*d*) respectively and is condensed in the cold heat source heat exchanger (2).

The gas refrigerant is also supplied from the hot heat source heat exchanger (1) to the indoor heat exchanger (3*a*) for executing the operation of radiating heat, is condensed in the indoor heat exchanger (3*a*) to heat the room, and is then transferred to the cold heat source heat exchanger (2) through the branch connecting pipe (7*a*).

When such air conditioning is executed for a specified time so that the storage amount of liquid refrigerant in the hot heat source heat exchanger (1) becomes short of a specified amount, the air conditioning is stopped and switched to the operation of recovering liquid refrigerant. In the operation of recovering liquid refrigerant, the first solenoid valve (EV1) and the fourth solenoid valve (EV4) are opened by the controller (C). Thereby, pressure is equalized between the hot heat source heat exchanger (1) and the cold heat source heat exchanger (2) so that liquid refrigerant in the cold heat source heat exchanger (2) is recovered to the hot heat source heat exchanger (1).

Figure 17A:
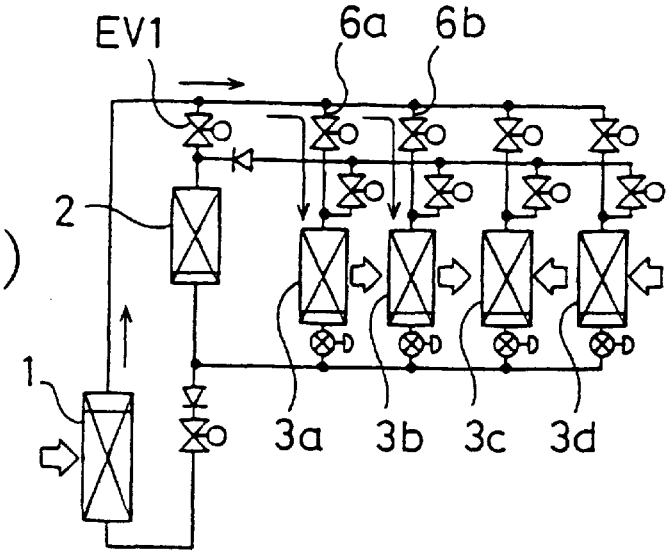
FIGS. 17(*a*), 17(*b*), and 17(*c*) show diagrams corresponding to FIG. 2 for illustrating the time when the amount of heat radiated and the amount of heat absorbed are equal among all indoor heat exchangers in the fourth embodiment.
Figure 17B:
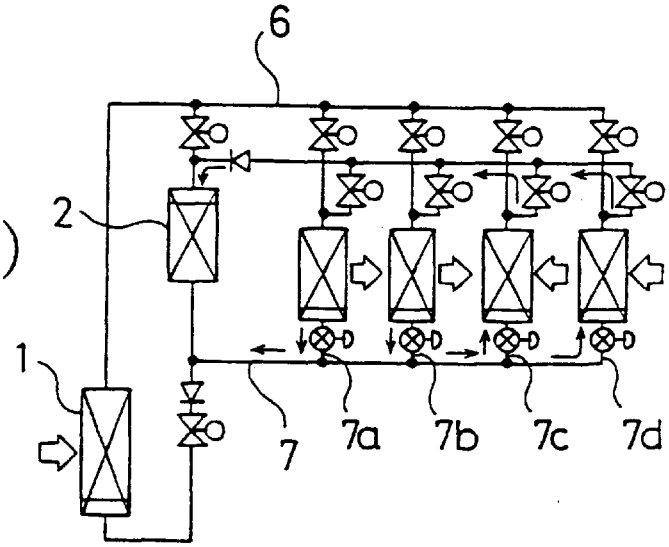
Figure 17C:
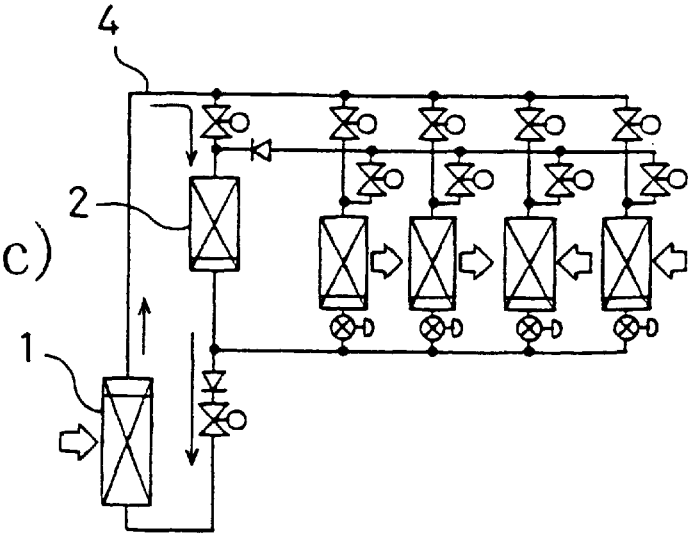

Next, description is made about the case that the total amount of heat radiated and the total amount of heat absorbed are equal among all the indoor heat exchangers, i.e., the case that the number of indoor heat exchangers executing the operation of absorbing heat is equal to that of the indoor heat exchangers executing the operation of radiating heat, with reference to FIG. 17. Here, the case that the right-side two (3*c*, 3*d*) of four indoor heat exchangers (3*a*–3*d*) in FIG. 17 execute the operation of absorbing heat and the left-side two indoor heat exchangers (3*a*, 3*b*) execute the operation of radiating heat is described as an example.

In this case, the controller (C) closes the first solenoid valve (EV1), two third solenoid valves (EV3-1, EV3-2) connected to the indoor heat exchangers (3*a*, 3*b*) for executing the operation of radiating heat and two second solenoid valves (EV2-3, EV2-4) connected to the indoor heat exchangers (3*c*, 3*d*) for executing the operation of absorbing heat, while the controller (C) opens two second solenoid valves (EV2-1, EV2-2) connected to the indoor heat exchangers (3*a*, 3*b*) for executing the operation of radiating heat, the fourth solenoid valve (EV4), the fifth motor-operated valves (EV5-1 to EV5-4) and two third solenoid valves (EV3-3, EV3-4) connected to the indoor heat exchangers (3*c*, 3*d*) for executing the operation of absorbing heat.

In this state, as shown in FIG. 17(*a*), gas refrigerant from the hot heat source heat exchanger (1) is supplied to the indoor heat exchangers (3*a*, 3*b*) for executing the operation of radiating heat through the branch gas pipes (6*a*, 6*b*) respectively and is condensed so that room air is heated in the respective rooms thereby heating the rooms. Then, as shown in FIG. 17(*b*), the condensed liquid refrigerant is transferred, at a specified distribution rate, to the cold heat source heat exchanger (2) through each of the branch liquid pipes (7*a*, 7*b*) by pressure difference between each of the indoor heat exchangers (3*a*, 3*b*) for executing the operation of radiating heat and the cold heat source heat exchanger (2), and to the indoor heat exchangers (3*c*, 3*d*) for executing the operation of absorbing heat by pressure difference between the indoor heat exchangers (3*a*, 3*b*) and the indoor heat exchangers (3*c*, 3*d*). The liquid refrigerant is evaporated in the indoor heat exchangers (3*c*, 3*d*) thereby cooling the rooms.

The gas refrigerant evaporated in the indoor heat exchangers (3*c*, 3*d*) is supplied to the cold heat source heat exchanger (2) through the branch connecting pipes (10*c*, 10*d*) respectively and is condensed in the cold heat source heat exchanger (2).

When the storage amount of liquid refrigerant in the cold heat source heat exchanger (2) exceeds a specified amount, air conditioning is stopped and switched to the operation of recovering liquid refrigerant. In the operation of recovering liquid refrigerant, the controller (C) closes the second solenoid valves (EV2-1 to EV2-4), the third solenoid valves (EV3-1 to EV3-4) and the fifth motor-operated valves (EV5-1 to Ev5-4) and opens the first solenoid valve (EV1) and the fourth solenoid valve (EV4).

In this state, as shown in FIG. 17(*c*), high-pressure gas refrigerant in the gas flow pipe (4) is introduced into the cold heat source heat exchanger (2) so that pressure is equalized between the hot heat source heat exchanger (1) and the cold heat source heat exchanger (2). The level difference between both the heat exchangers (1, 2) causes liquid refrigerant in the cold heat source heat exchanger (2) to be recovered to the hot heat source heat exchanger (1).

Modifications Embodiments

Embodiments according to claims 21 and 22 of the invention are described next as modifications of the first to fourth embodiments described above.

Each of these modifications is configured such that the periphery of the cold heat source heat exchanger (2) in the refrigerant circuitry is modified. When the modification is applied to any embodiments described above, it has similar configuration. Therefore, here, description is made only about applications for the first and second embodiments.

Figure 18:
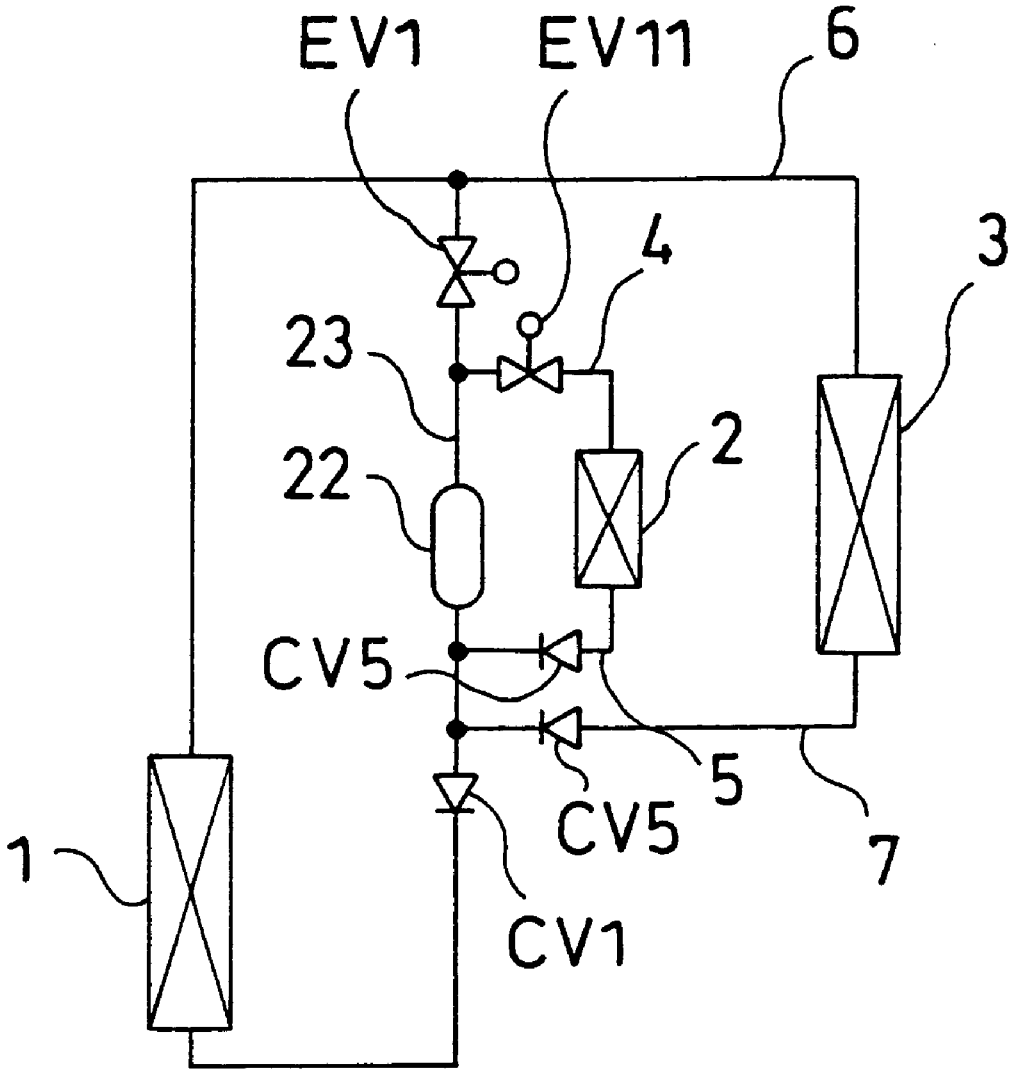
FIG. 18 is a diagram showing a secondary refrigerant circuit in a modification of the invention including a single liquid receiver.

FIG. 18 shows the case that the modification is applied to the first embodiment (heating-only device). A liquid receiver (22) as a liquid receive means capable of storing liquid refrigerant is connected at one end thereof to the gas flow pipe (4) through a branch pipe (23) and at the other end to the liquid flow pipe (5) through a branch pipe (23), and is connected with the cold heat source heat exchanger (2) in rows.

Between the cold heat source heat exchanger (2) and a connection point of the gas flow pipe (4) with the branch pipe (23), a solenoid valve (EV11) is provided. Between the cold heat source heat exchanger (2) and a connection point of the liquid flow pipe (5) with the branch pipe (23), a check valve (CV5) is provided for allowing only a flow of refrigerant from the liquid flow pipe (5) to the branch pipe (23). Other configurations are the same as in the first embodiment.

The heating operation of the device above configured is described with reference to FIG. 19.

Figure 19A:
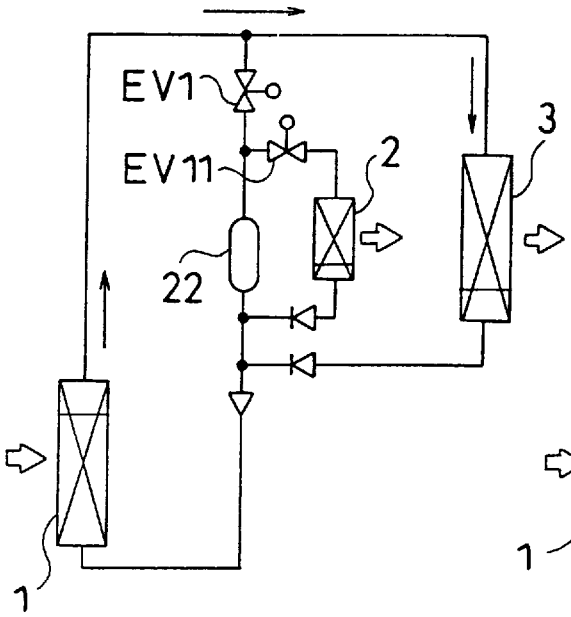
FIGS. 19(*a*), 19(*b*), and 19(*c*) show diagrams corresponding to FIG. 2 for illustrating a heating operation mode in the modification including a single liquid receiver.
Figure 19B:
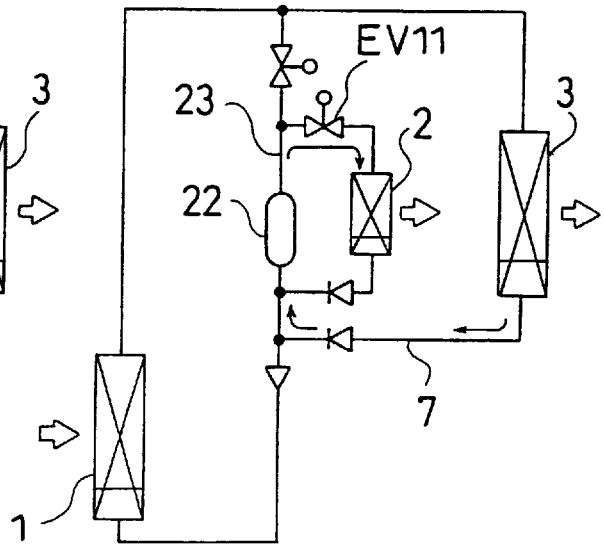
Figure 19C:
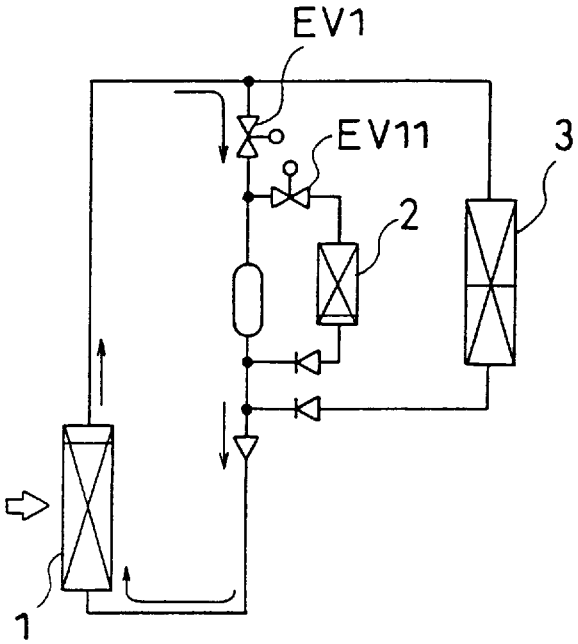

First, the solenoid valve (EV1) is closed and the solenoid valve (EV11) is opened, so that gas refrigerant is supplied from the hot heat source heat exchanger (1) to the indoor heat exchanger (3) and is condensed in the indoor heat exchanger (3) (See FIG. 19(*a*)). The cold heat source heat exchanger (2) for condensing refrigerant at a condensation temperature lower than that of the indoor heat exchanger (3) and the liquid receiver (22) connected to the cold heat source heat exchanger (2) through the solenoid valve (EV11), each have a lower pressure than the indoor heat exchanger (3). Accordingly, the liquid refrigerant condensed in the indoor heat exchanger (3) is introduced into the branch pipe (23) through the liquid pipe (7) and is stored in the liquid receiver (22).

At this time, the gas refrigerant having been introduced into the liquid receiver (22) is introduced into the cold heat source heat exchanger (2) through the solenoid valve (EV11) and is condensed in the cold heat source heat exchanger (2) (See FIG. 19(*b*)). The condensed liquid refrigerant is recovered from the cold heat source heat exchanger (2) to the liquid receiver (22). When the storage amount of liquid refrigerant in the liquid receiver (22) exceeds a specified amount, the solenoid valve (EV1) is opened and the solenoid valve (EV11) is closed, thereby executing the operation of recovering liquid refrigerant as in the above-described embodiments (See FIG. 19(*c*)).

According to such an operation, the amount of liquid refrigerant stored in the cold heat source heat exchanger (2) during the heating operation can be reduced and therefore a sufficient heat exchange area of the cold heat source heat exchanger (2) can be ensured. This minimizes the cold heat source heat exchanger (2) resulting in compaction of the overall device.

Figure 20A:
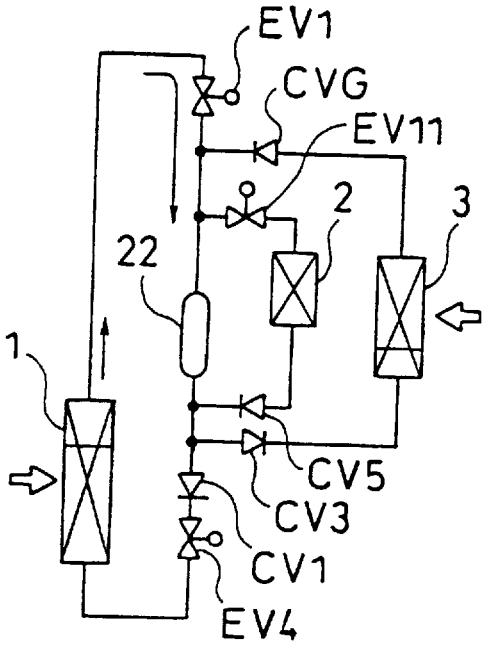
FIGS. 20(*a*), 20(*b*), and 20(*c*) show diagrams corresponding to FIG. 2 for illustrating a cooling operation mode in the modification including a single liquid receiver.
Figure 20B:
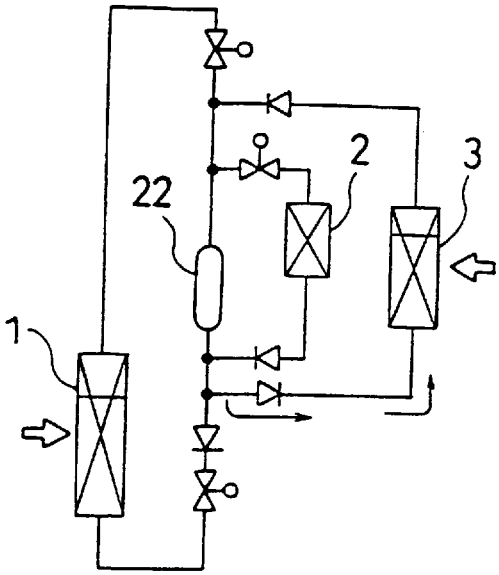
Figure 20C:
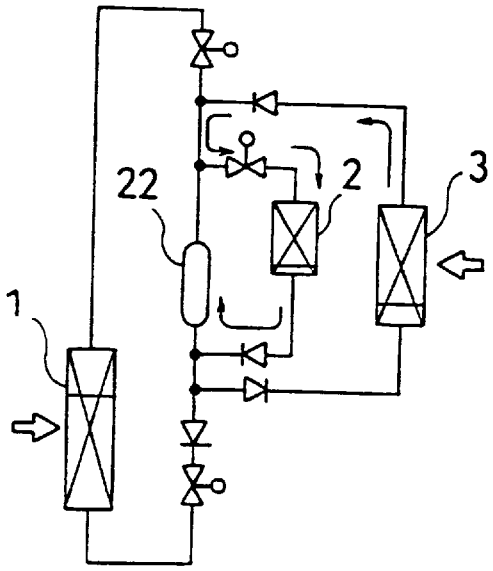

FIG. 20 shows the cooling operation in the case that the modification is applied to the second embodiment (cooling-only device).

First, the solenoid valve (EV1) is opened and the solenoid valve (EV11) is closed, so that high-pressure gas refrigerant is supplied from the hot heat source heat exchanger (1) to the liquid receiver (22) (See FIG. 20(*a*)), so that liquid refrigerant previously stored in the liquid receiver (22) is introduced into the indoor heat exchanger (3) (See FIG. 20(*b*)). Then, the solenoid valve (EV1) is closed and the solenoid valve (EV11) is opened, so that gas refrigerant is introduced into the indoor heat exchanger (3). The gas refrigerant is reduced in pressure with the condensation of refrigerant in the cold heat source heat exchanger (2), is evaporated, is introduced into the cold heat source heat exchanger (2) by pressure difference between the indoor heat exchanger (3) and the cold heat source heat exchanger (2), is liquefied through the condensation in the cold heat source heat exchanger (2), and is then recovered to the liquid receiver (22) (See FIG. 20(*c*)).

Also according to this operation, the amount of liquid refrigerant stored in the cold heat source heat exchanger (2) during the cooling operation can be reduced. This minimizes the cold heat source heat exchanger (2).

Further, under the configuration of this modification, the solenoid valve (EV1) is closed when liquid refrigerant is discharged from the cold heat source heat exchanger (2) or the liquid receiver (22). Accordingly, gas refrigerant from the hot heat source heat exchanger (1) can be prevented from being supplied to the cold heat source heat exchanger (2) and therefore it is avoided that the cold heat source heat exchanger (2) is unnecessarily heated. This promotes energy conservation.

Furthermore, the provision of the check valve (CV5) prevents liquid refrigerant in the liquid receiver (22) from flowing back to the cold heat source heat exchanger (2). This also promotes energy conservation.

When the configuration of the modification applied to the second embodiment is applied to the device having a plurality of indoor heat exchangers (3*a*–3*d*) as in the fourth embodiment, liquid receivers (22) are connected in rows with the indoor heat exchangers (3*a*–3*d*) respectively.

Modifications Having Plural Cold Heat Source Heat Exchangers

The following fifth to eighth embodiments of the invention each have the circuit configuration having a plurality of cold heat source heat exchangers (two heat exchangers in the embodiments).

Fifth Embodiment

The fifth embodiment is an embodiment according to claims 24 to 26 of the invention and has first and second cold heat source heat exchangers. In this embodiment, the secondary refrigerant circuit is configured for a heating-only air conditioner.

Figure 21:
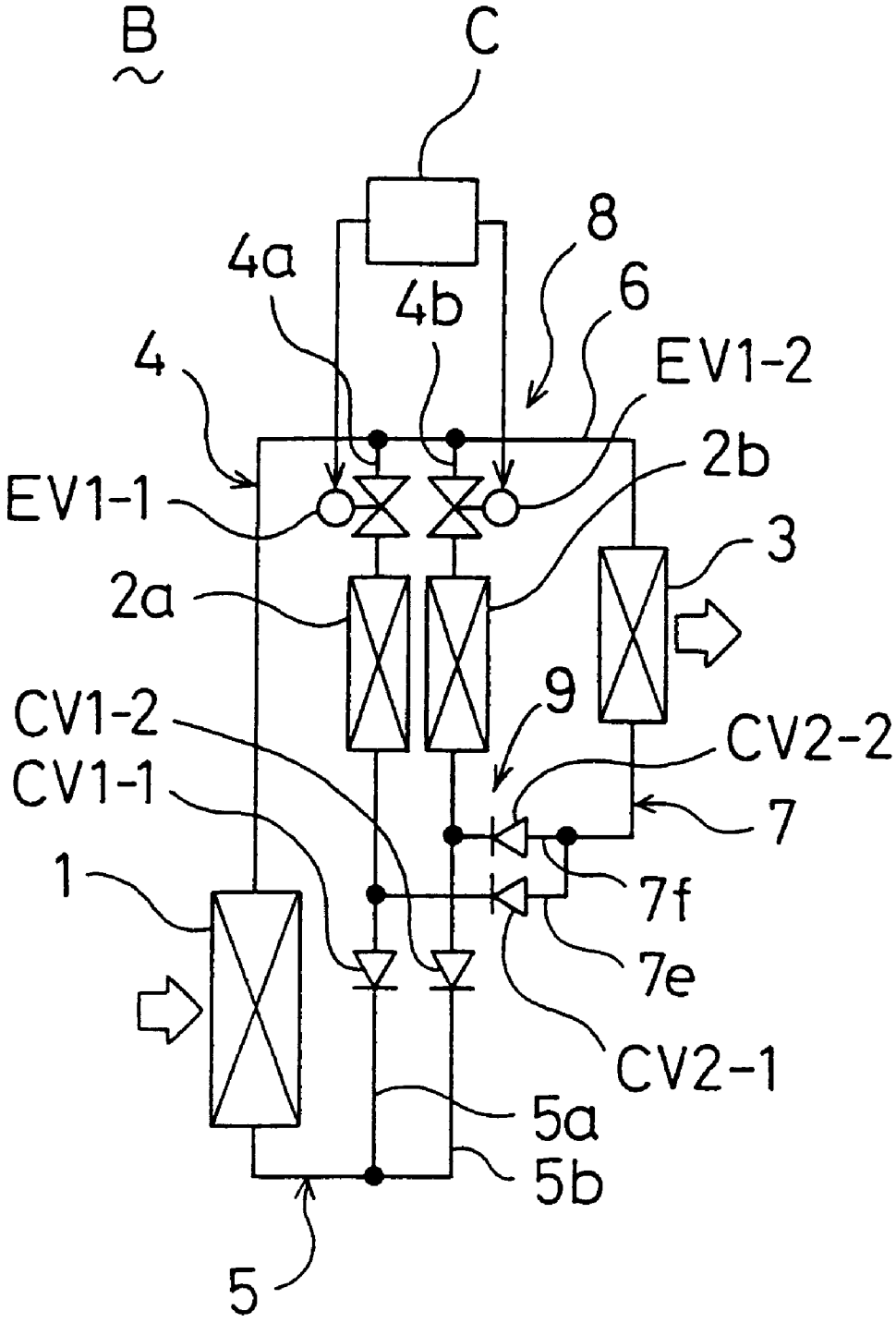
FIG. 21 is a diagram showing a secondary refrigerant circuit of a fifth embodiment of the invention.
Figure 22A:
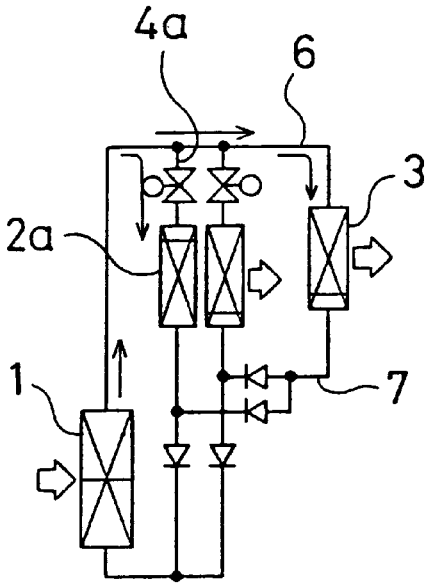
FIGS. 22(*a*), 22(*b*), 22(*c*), and 22(*d*) show diagrams corresponding to FIG. 2 in the fifth embodiment.
Figure 22B:
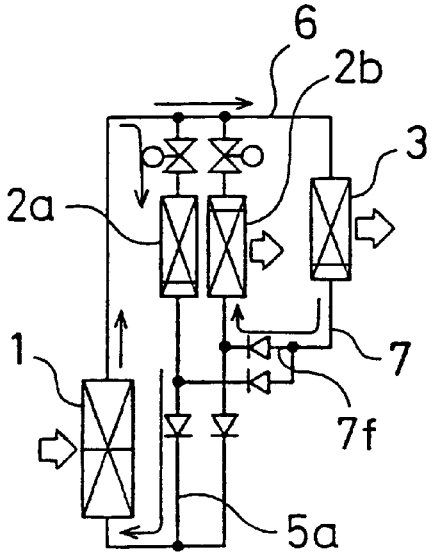
Figure 22C:
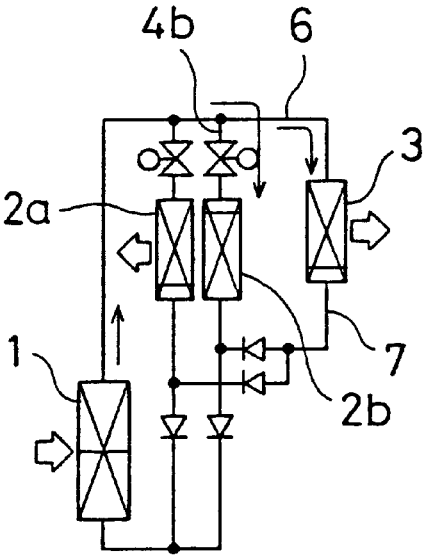
Figure 22D:
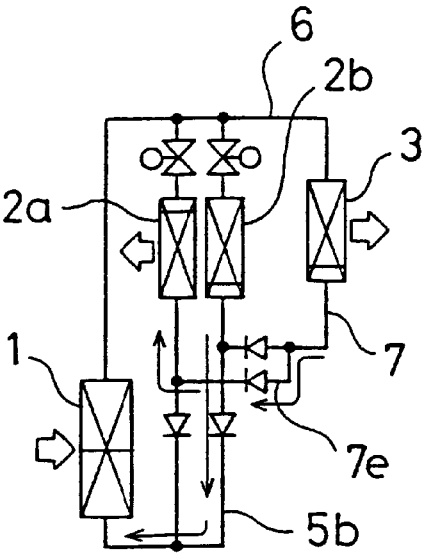

As shown in FIG. 21, a gas flow pipe (4) is divided into first and second branch gas flow pipes (4*a*, 4*b*) toward the cold heat source heat exchangers. The first branch gas flow pipe (4*a*) is connected to the first cold heat source heat exchanger (2*a*) and the second branch gas flow pipe (4*b*) is connected to the second cold heat source heat exchanger (2*b*). The branch gas flow pipes (4*a*, 4*b*) are each connected to a gas pipe (6) and are provided with solenoid valves (EV1-1, EV1-2) respectively. The solenoid valves (EV1-1, EV1-2) are controlled between their opened and closed positions by a controller (C).

A liquid flow pipe (5) is also divided into first and second branch liquid flow pipes (5*a*, 5*b*) toward the cold heat source heat exchangers. The first branch liquid flow pipe (5*a*) is connected to the first cold heat source heat exchanger (2*a*) and the second branch liquid flow pipe (5*b*) is connected to the second cold heat source heat exchanger (2*b*).

Further, a liquid pipe (7) is also divided into first and second branch liquid pipes (7*e*, 7*f*) toward the liquid flow pipe (5) connected thereto. The first branch liquid pipe (7*e*) is connected to the first branch liquid flow pipe (5*a*) and the second branch liquid pipe (7*f*) is connected to the second branch liquid flow pipe (5*b*).

Between the hot heat source heat exchanger (1) and the connection points of the branch liquid pipes (7*e*, 7*f*) with the branch liquid flow pipes (5*a*, 5*b*), there are respectively provided first check valves (CV1-1, CV1-2) which allow only a flow of liquid refrigerant from the cold heat source heat exchanger (2) to the hot heat source heat exchanger (1). The branch liquid pipes (7*e*, 7*f*) are provided with second check valves (CV2-1, CV2-2) which allow only flows of liquid refrigerant from the indoor heat exchanger (3) to the cold heat source heat exchangers (2*a*, 2*b*) respectively.

Next, description is made about a heating operation of the secondary refrigerant circuit (B) configured as above-described.

In this heating operation, firstly, the controller (C) opens the solenoid valve (EV1-1) located in the first branch gas flow pipe (4*a*) and closes the solenoid valve (EV1-2) located in the second branch gas flow pipe (4*b*).

In this state, the hot heat source heat exchanger (1) receives an amount of heat from the primary refrigerant circuit to evaporate refrigerant so that, as shown in FIG. 22(*a*), a part of high-pressure gas refrigerant from the hot heat source heat exchanger (1) is supplied to the first cold heat source heat exchanger (2*a*) through the first branch gas flow pipe (4*a*) and the remaining high-pressure gas refrigerant is supplied to the indoor heat exchanger (3) through the gas pipe (6). The gas refrigerant exchanges heat with room air in the indoor heat exchanger (3) to condense therein so that the room air is heated resulting in heating the room.

Under this condition, the second cold heat source heat exchanger (2*b*) is an operating cold heat source heat exchanger while the first cold heat source heat exchanger (2*a*) is a stopping cold heat source heat exchanger. Then, as shown in FIG. 22(*b*), the condensed liquid refrigerant in the indoor heat exchanger (3) is transferred to the second cold heat source heat exchanger (2*b*) through the second branch liquid pipe (7*f*) by pressure difference between the indoor heat exchanger (3) and the second cold heat source heat exchanger (2*b*). Consequently, with the running of the heating operation, liquid refrigerant is gradually stored in the second cold heat source heat exchanger (2*b*).

On the other hand, when gas refrigerant is supplied from the hot heat source heat exchanger (1) to the first cold heat source heat exchanger (2*a*), liquid refrigerant in the first cold heat source heat exchanger (2*a*) is recovered to the hot heat source heat exchanger (1) through the first branch liquid flow pipe (5*a*).

When such a heating operation is executed for a specified time so that the storage amount of liquid refrigerant in the second cold heat source heat exchanger (2*b*) exceeds a specified amount, the controller (C) opens the solenoid valve (EV1-2) located in the second branch gas flow pipe (4*b*) and closes the solenoid valve (EV1-1) located in the first branch gas flow pipe (4*a*).

Thereby, the second cold heat source heat exchanger (2*b*) is changed to a stopping cold heat source heat exchanger and the first cold heat source heat exchanger (2*a*) is changed to an operating cold heat source heat exchanger. Then, as shown in FIG. 22(*c*), a part of high-pressure gas refrigerant from the hot heat source heat exchanger (1) is supplied to the second cold heat source heat exchanger (2*b*) through the second branch gas flow pipe (4*b*) and the remaining high-pressure gas refrigerant is supplied to the indoor heat exchanger (3) through the gas pipe (6). The gas refrigerant exchanges heat with room air in the indoor heat exchanger (3) to condense therein so that the room air is heated resulting in heating the room.

Under this condition, as shown in FIG. 22(*d*), liquid refrigerant in the indoor heat exchanger (3) is transferred to the first cold heat source heat exchanger (2*a*) through the first branch liquid pipe (7*e*) by pressure difference between the indoor heat exchanger (3) and the first cold heat source heat exchanger (2*a*). Consequently, with the running of the heating operation, liquid refrigerant is gradually stored in the first cold heat source heat exchanger (2*a*). On the other hand, when gas refrigerant is supplied from the hot heat source heat exchanger (1) to the second cold heat source heat exchanger (2*b*), liquid refrigerant in the second cold heat source heat exchanger (2*b*) is recovered to the hot heat source heat exchanger (1) through the second branch liquid flow pipe (5*b*). Such two operations are alternately executed.

Thus, under the configuration of this embodiment, two cold heat source heat exchangers (2*a*, 2*b*) are provided, refrigerant is transferred from the indoor heat exchanger (3) to one of the cold heat source heat exchangers while liquid refrigerant is recovered from the other cold heat source heat exchanger to the hot heat source heat exchanger (1), and the operations of these cold heat source heat exchangers (2*a*, 2*b*) are alternately executed. Accordingly, the operation of radiating heat of the indoor heat exchanger (3) can be successively executed. In other words, the heating operation can be successively executed. This increases comfortableness of the room.

Sixth Embodiment

This sixth embodiment is an embodiment according to claims 27 to 30 of this invention and has first and second cold heat source heat exchangers. The secondary refrigerant circuit is configured for a cooling-only air conditioner. In this embodiment, only differences in circuit configuration from the fifth embodiment are described.

Figure 23:
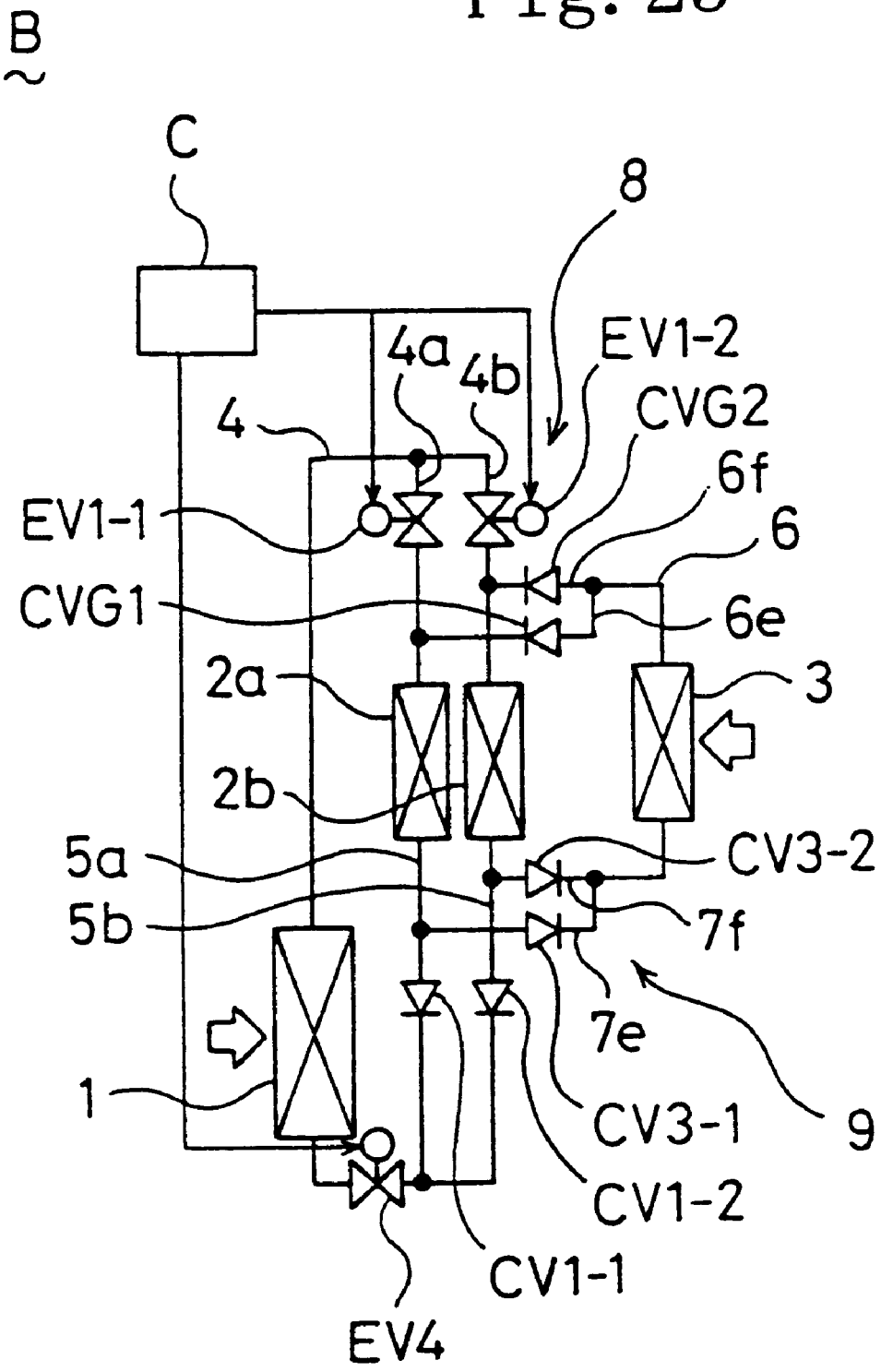
FIG. 23 is a diagram showing a secondary refrigerant circuit of a sixth embodiment of the invention.
Figure 24A:
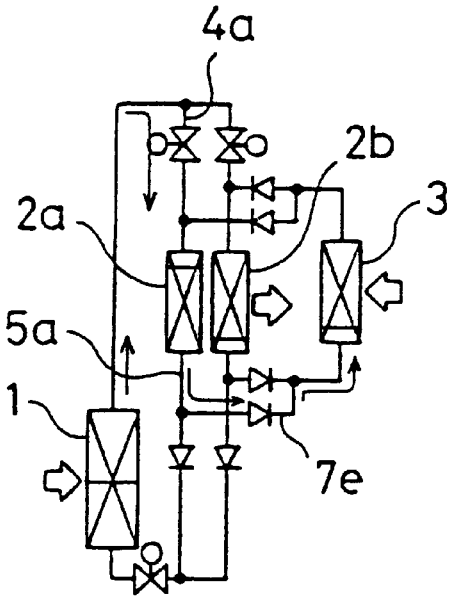
FIGS. 24(*a*), 24(*b*), 24(*c*), and 24(*d*) show diagrams corresponding to FIG. 2 in the sixth embodiment.
Figure 24B:
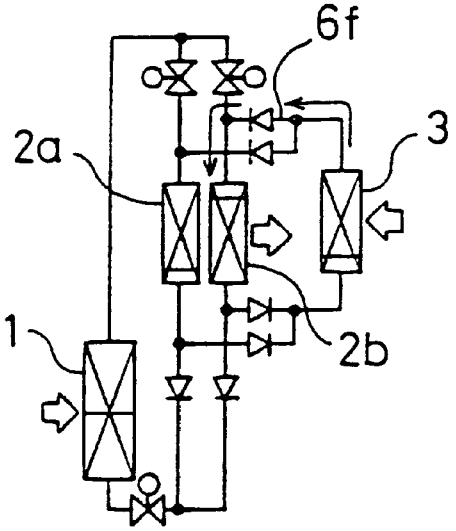
Figure 24C:
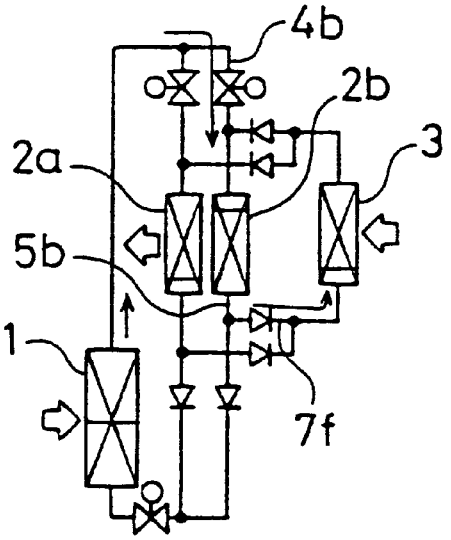
Figure 24D:
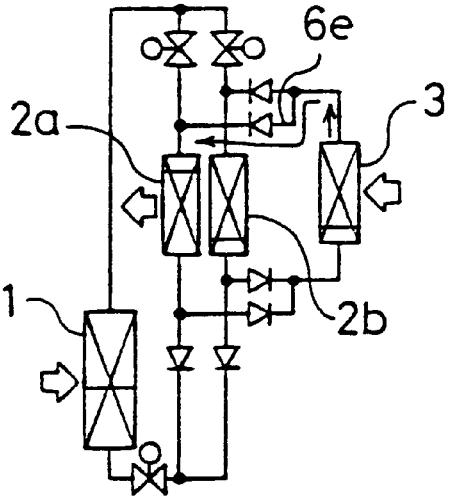

As shown in FIG. 23, a gas pipe (6) is divided into first and second branch gas pipes (6*e*, 6*f*) toward a gas flow pipe (4) connected thereto. The first branch gas pipe (6*e*) is connected to a first branch gas flow pipe (4*a*) and the second branch gas pipe (6*f*) is connected to a second branch gas flow pipe (4*b*). The connection points between the branch gas pipes (6*e*, 6*f*) and the branch gas flow pipes (4*a*, 4*b*) are respectively located between the cold heat source heat exchangers (2*a*, 2*b*) and solenoid valves (EV1-1, EV1-2) for gas refrigerant provided in the branch gas flow pipes (4*a*, 4*b*).

Branch liquid pipes (7*e*, 7*f*) are respectively provided with third check valves (CV3-1, CV3-2) referred to as second check valves in claim 30 for allowing only flows of liquid refrigerant from the cold heat source heat exchangers (2*a*, 2*b*) to the indoor heat exchanger (3), in place of the second check valves (CV2-1, CV2-2) in the fifth embodiment.

Further, a liquid flow pipe (5) is provided with a solenoid valve (EV4) for liquid refrigerant. The solenoid valve (EV4) for liquid refrigerant is controlled between its opened and closed positions by a controller (C).

Next, description is made about the cooling operation of the refrigerant circuit (B) configured as above-described.

At the start of the cooling operation, firstly, the controller (C) opens a solenoid valve (EV1-1) for gas refrigerant provided in the first branch gas flow pipe (4*a*), and closes a solenoid valve (EV1-2) for gas refrigerant provided in the second branch gas flow pipe (4*b*) and the solenoid valve (EV4) for liquid refrigerant.

In this state, as shown in FIG. 24(*a*), high-pressure gas refrigerant is supplied from the hot heat source heat exchanger (1) to the first cold heat source heat exchanger (2*a*) through the first branch gas flow pipe (4*a*). When the gas refrigerant is thus supplied, the pressure of the gas refrigerant acts so that liquid refrigerant previously stored in the first cold heat source heat exchanger (2*a*) is introduced into the indoor heat exchanger (3) through the first branch liquid flow pipe (5*a*) and the first branch liquid pipe (7*e*). Then, liquid refrigerant exchanges heat with room air in the indoor heat exchanger (3) to evaporate therein so that the room air is cooled resulting in cooling the room.

At this time, as shown in FIG. 24(*b*), the gas refrigerant in the indoor heat exchanger (3) is transferred to the second cold heat source heat exchanger (2*b*) through the second branch gas pipe (6*f*) by pressure difference between the operating second cold heat source heat exchanger (2*b*) under the condensation of refrigerant and the indoor heat exchanger (3) under the evaporation of refrigerant.

When such an operation is executed for a specified time so that the storage amount of liquid refrigerant in the first cold heat source heat exchanger (2*a*) becomes short of a specified amount, the controller (C) closes the solenoid valve (EV1-1) for gas refrigerant provided in the first branch gas flow pipe (4*a*) and opens the solenoid valve (EV1-2) for gas refrigerant provided in the second branch gas flow pipe (4*b*). Thereby, the first cold heat source heat exchanger (2*a*) is changed to an operating cold heat source heat exchanger and the second cold heat source heat exchanger (2*b*) is changed to a stopping cold heat source heat exchanger.

Then, as shown in FIG. 24(*c*), high-pressure gas refrigerant is supplied from the hot heat source heat exchanger (1) to the second cold heat source heat exchanger (2*b*) through the second branch gas flow pipe (4*b*). When the gas refrigerant is thus supplied, the pressure of the gas refrigerant acts so that liquid refrigerant previously stored in the second cold heat source heat exchanger (2*b*) is introduced into the indoor heat exchanger (3) through the second branch liquid flow pipe (5*b*) and the second branch liquid pipe (7*f*). Then, liquid refrigerant exchanges heat with room air in the indoor heat exchanger (3) to evaporate therein so that the room air is cooled resulting in cooling the room.

At this time, as shown in FIG. 24(*d*), the gas refrigerant in the indoor heat exchanger (3) is transferred to the first cold heat source heat exchanger (2*a*) through the first branch gas pipe (6*e*) by pressure difference between the first cold heat source heat exchanger (2*a*) and the indoor heat exchanger (3).

The above two operations of the cold heat source heat exchangers (2*a*, 2*b*) are alternately executed so that the operation of absorbing heat of the indoor heat exchanger (3) is successively executed. In other words, the cooling operation can be successively executed.

When the cooling operation is executed for a specified time so that the storage amount of liquid refrigerant in the hot heat source heat exchanger (1) becomes short of a specified amount, the controller (C) opens the solenoid valves (EV1-1, EV1-2) for gas refrigerant connected to the cold heat source heat exchangers (2*a*, 2*b*) in which liquid refrigerant is stored, and opens the solenoid valve (EV4) for liquid refrigerant. Thereby, pressure is equalized between the hot heat source heat exchanger (1) and the cold heat source heat exchanger (2) so that liquid refrigerant in the cold heat source heat exchanger (2) is recovered to the hot heat source heat exchanger (1).

Seventh Embodiment

An embodiment of a heat transfer device according to claims 31 to 34 of the invention will be described next with reference to the drawings.

This seventh embodiment has first and second cold heat source heat exchangers and the secondary refrigerant circuit is configured for an air conditioner changeable between a heating operation and a cooling operation. Described in this embodiment are only differences in circuit configuration from the embodiments described so far.

Figure 25:
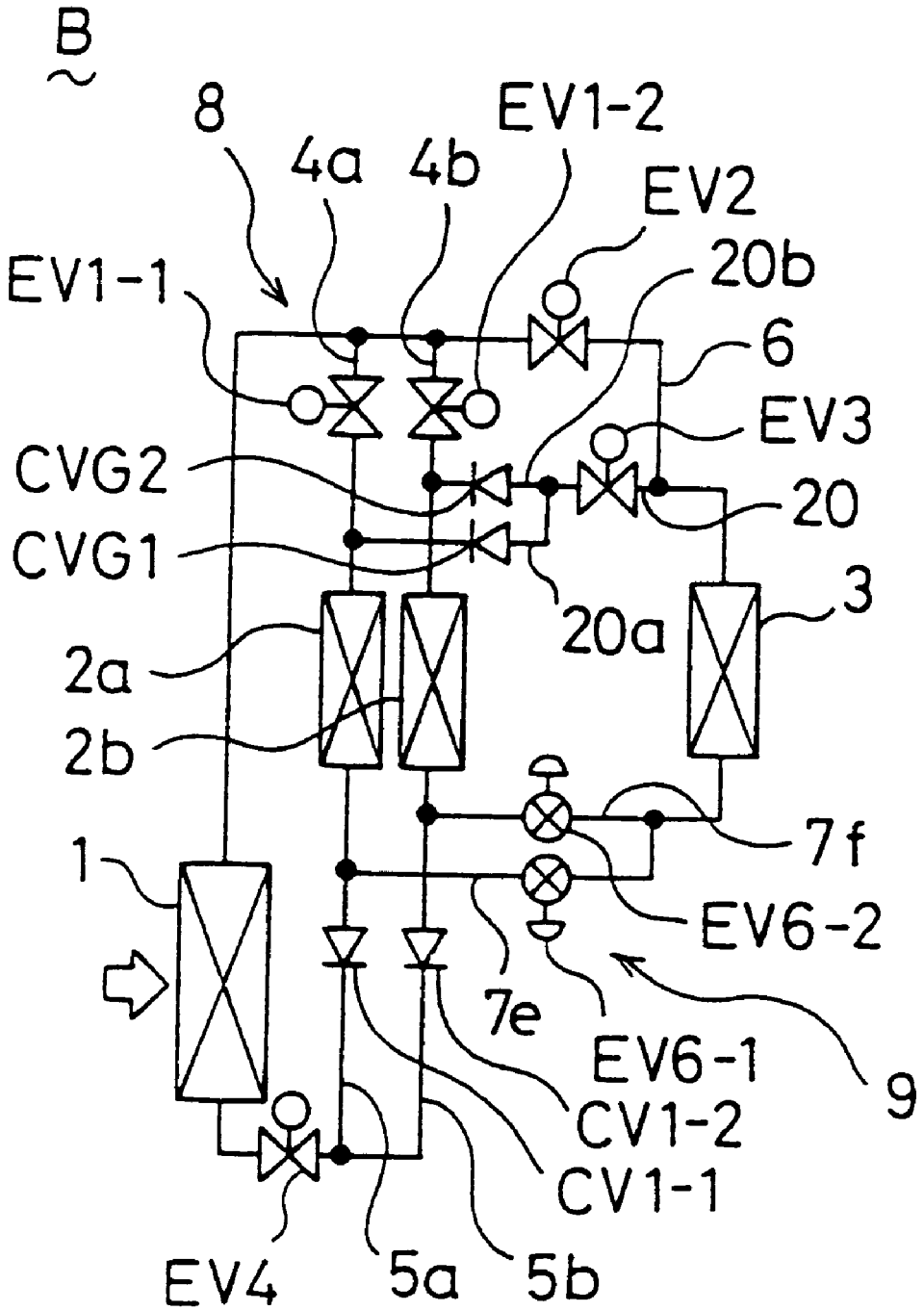
FIG. 25 is a diagram showing a secondary refrigerant circuit of a seventh embodiment of the invention.

As shown in FIG. 25, a gas flow selecting means (8) of the secondary refrigerant circuit (B) of this embodiment is configured such that in the refrigerant circuit of the fifth embodiment, a second solenoid valve (EV2) is provided in the gas pipe (6) and a gas connecting pipe (20) is provided between each of the branch gas pipes (4*a*, 4*b*) and the gas pipe (6).

More specifically, one end of the gas connecting pipe (20) is connected to a part of the gas pipe (6) located between the second solenoid valve (EV2) and the indoor heat exchanger (3). A part of the gas connecting pipe (20) on the other end side is divided into first and second branch gas connecting pipes (20*a*, 20*b*). The first branch gas connecting pipe (20*a*) is connected to the first branch gas flow pipe (4*a*) and the second branch gas connecting pipe (20*b*) is connected to the second branch gas flow pipe (4*b*).

The gas connecting pipe (20) is provided with a third solenoid valve (EV3). The branch gas connecting pipes (20*a*, 20*b*) are provided with check valves (CVG1, CVG2) for gas refrigerant for allowing only flows of gas refrigerant from the indoor heat exchanger (3) to the cold heat source heat exchangers (2*a*, 2*b*) respectively.

A liquid flow selecting means (9) is configured such that in the refrigerant circuit of the sixth embodiment, the branch liquid pipes (7*e*, 7*f*) are respectively provided with sixth motor-operated valves (EV6-1, EV6-2) referred to as second shut-off valves in claim 34, in place of the third check valves (CV3-1, CV3-2).

Figure 26:
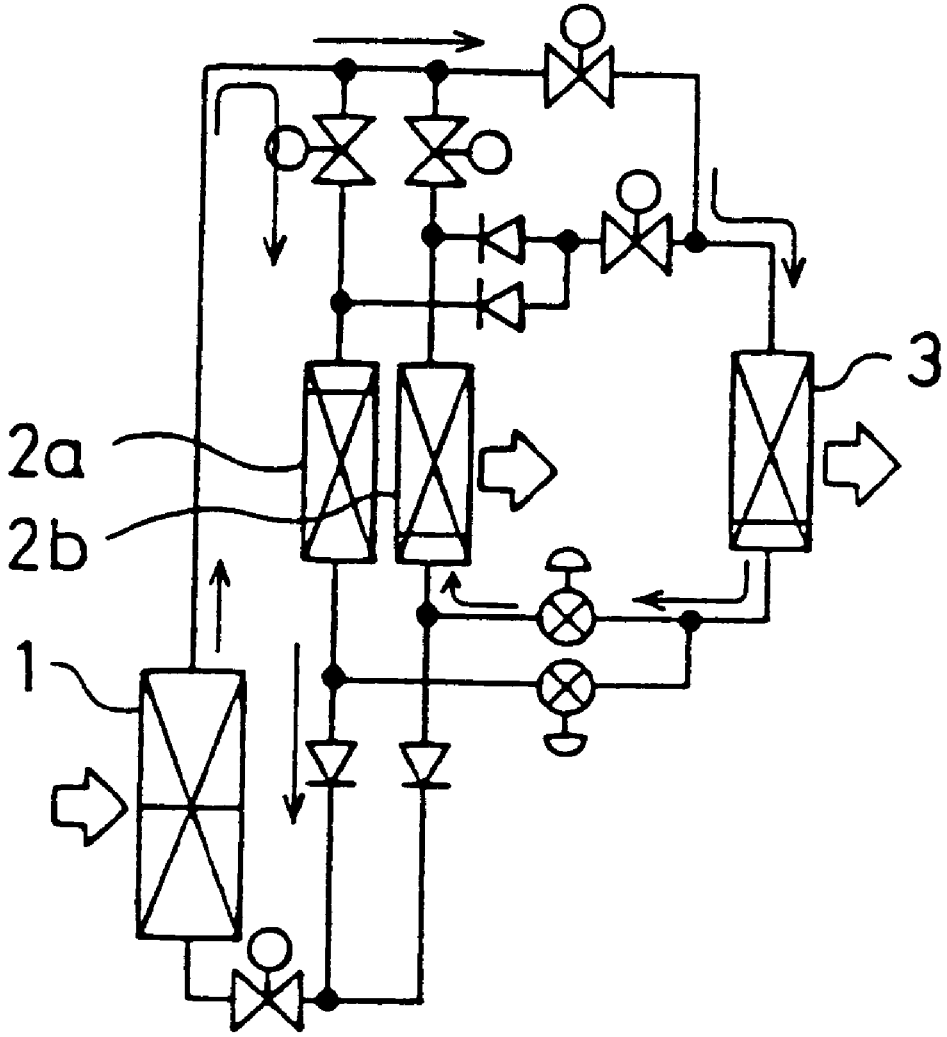
FIG. 26 is a diagram corresponding to FIG. 2 for illustrating a heating operation mode in the seventh embodiment.

Under such a configuration, in a heating operation of the secondary refrigerant circuit (B), the heating operation as described in the fifth embodiment is executed so that a room is successively heated. In detail, as shown in FIG. 26, when the recovery of liquid refrigerant is executed with respect to one cold heat source heat exchanger (2*a*), liquid refrigerant condensed in the indoor heat exchanger (3) is transferred to the other cold heat source heat exchanger (2*b*). Such operations are alternately repeated.

Figure 27:
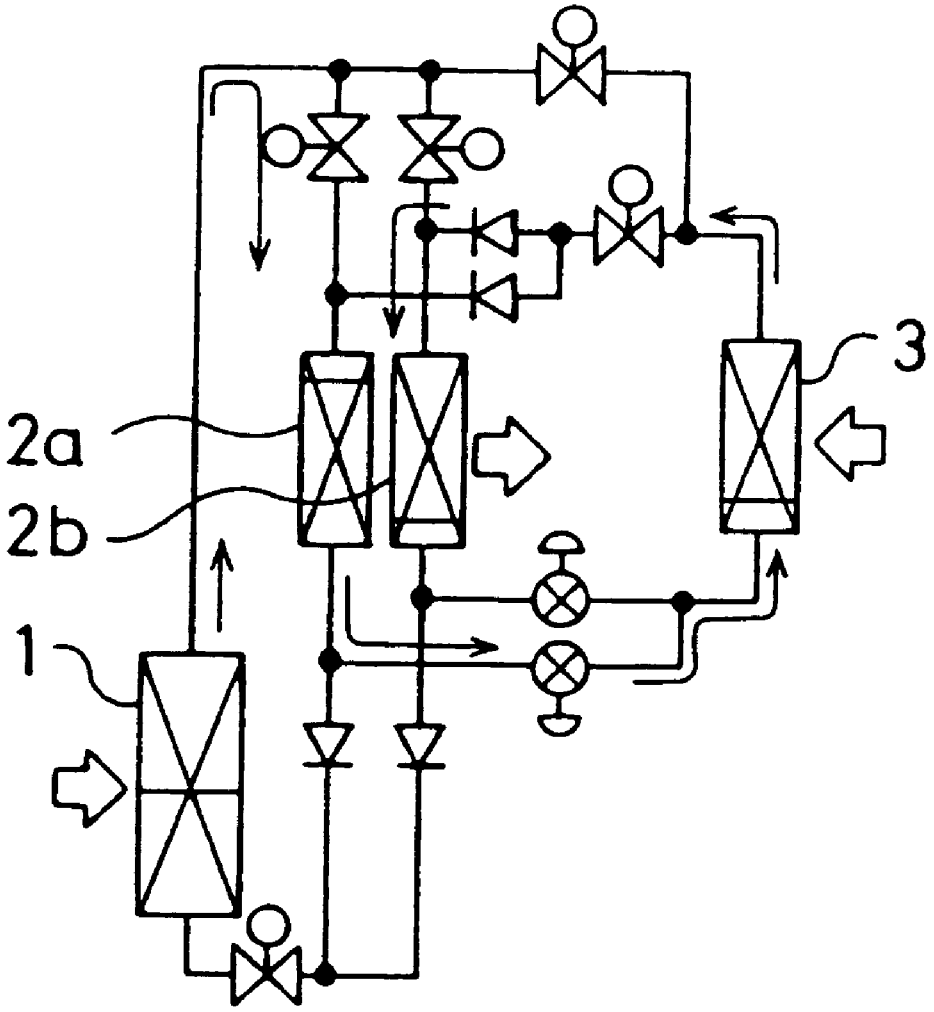
FIG. 27 is a diagram corresponding to FIG. 2 for illustrating a cooling operation mode in the seventh embodiment.

On the other hand, in the cooling operation, the cooling operation as described in the sixth embodiment is executed so that the room is successively cooled. In detail, as shown in FIG. 27, when liquid refrigerant is supplied from one cold heat source heat exchanger (2*a*) to the indoor heat exchanger (3), gas refrigerant evaporated in the indoor heat exchanger (3) is transferred to the other cold heat source heat exchanger (2*b*). Such operations are alternately repeated.

When the storage amount of liquid refrigerant in the hot heat source heat exchanger (1) becomes short of a specified amount with the running of the cooling operation, liquid refrigerant is recovered from the liquid flow pipe (5) to the hot heat source heat exchanger (1).

Eighth Embodiment

An embodiment of a heat transfer device according to claims 35 to 40 of the invention will be described next with reference to the drawings.

In this eighth embodiment, the secondary refrigerant circuit is configured for a multi-type air conditioner freely operable for cooling and heating operations. The air conditioner has first and second cold heat source heat exchangers and four indoor heat exchangers placed in four rooms individually so as to be individually selectable between the cooling and heating operations. Described in this embodiment are only differences in circuit configuration from the fourth embodiment.

Figure 28:
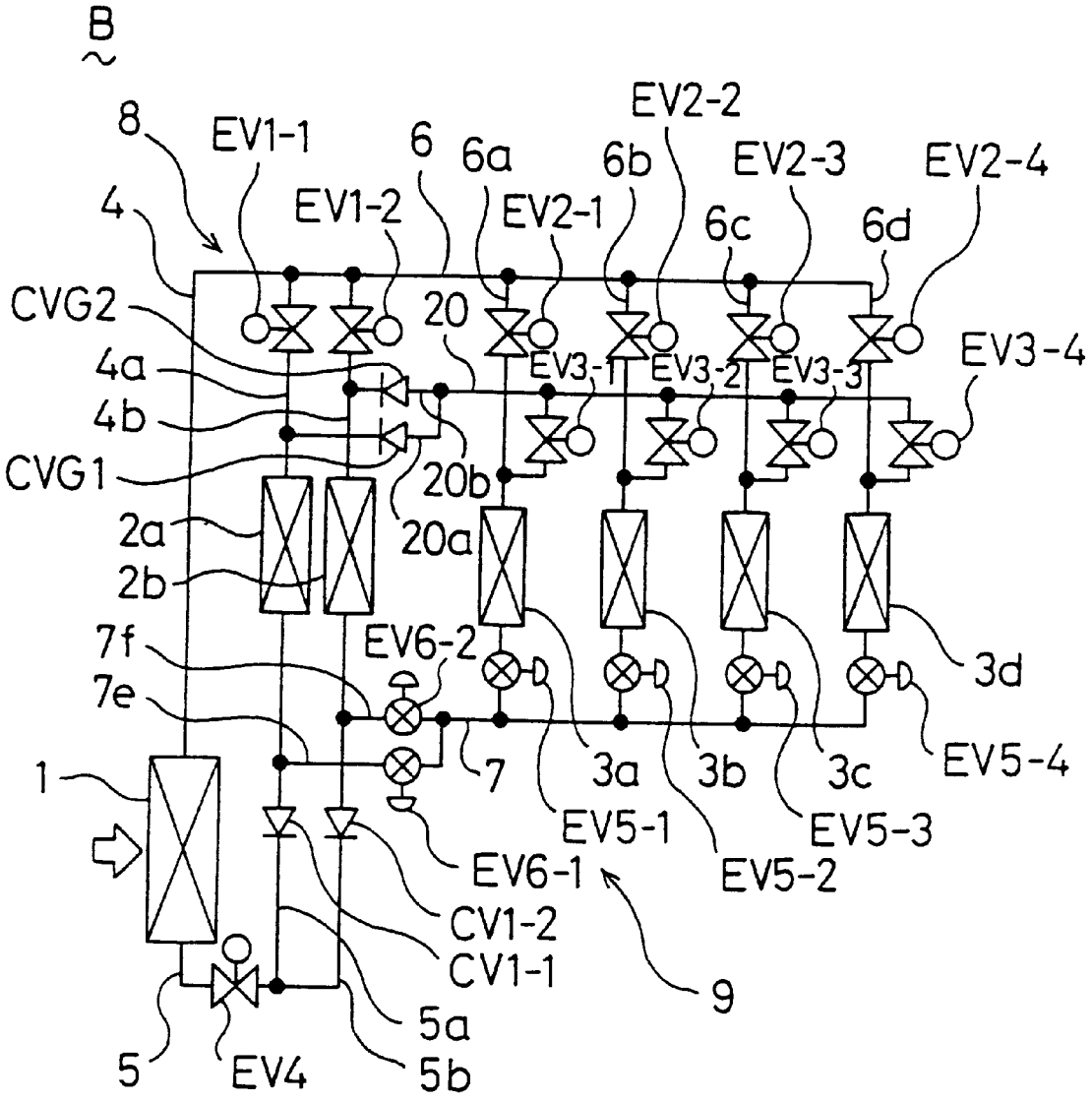
FIG. 28 is a diagram showing a secondary refrigerant circuit of an eighth embodiment of the invention.

As shown in FIG. 28, a gas flow selecting means (8) of the secondary refrigerant circuit (B) is configured such that a gas flow pipe (4) is divided into first and second branch gas flow pipes (4*a*, 4*b*) toward the cold heat source heat exchangers, the first branch gas flow pipe (4*a*) is connected to the first cold heat source heat exchanger (2*a*) and the second branch gas flow pipe (4*b*) is connected to the second cold heat source heat exchanger (2*b*). Further, the branch gas flow pipes (4*a*, 4*b*) are provided with first solenoid valves (EV1-1, EV1-2) respectively.

A gas connecting pipe (20) is connected at one side thereof to parts of a gas pipe (6) located between second solenoid valves (EV2-1 to EV2-4) and indoor heat exchangers (3*a*–3*d*) respectively. The gas connecting pipe (20) is divided on the other side into first and second branch gas connecting pipes (20*a*, 20*b*). The first branch gas connecting pipe (20*a*) is connected to the first branch gas flow pipe (4*a*) and the second branch gas connecting pipe (20*b*) is connected to the second branch gas flow pipe (4*b*). The branch gas connecting pipes (20*a*, 20*b*) are provided with check valves (CVG1, CVG2) for gas refrigerant respectively.

A liquid flow selecting means (9) is configured such that a liquid flow pipe (5) is divided into first and second branch liquid flow pipes (5*a*, 5*b*) toward the cold heat source heat exchangers, the first branch liquid flow pipe (5*a*) is connected to the first cold heat source heat exchanger (2*a*) and the second branch liquid flow pipe (5*b*) is connected to the second cold heat source heat exchanger (2*b*). Further, a liquid pipe (7) is divided into first and second branch liquid pipes (7*e*, 7*f*) toward the liquid flow pipe (5) connected thereto. The first branch liquid pipe (7*e*) is connected to the first branch liquid flow pipe (5*a*) and the second branch liquid pipe (7*f*) is connected to the second branch liquid flow pipe (5*b*).

Between the hot heat source heat exchanger (1) and connection points of the branch liquid pipes (7*e*, 7*f*) with the branch liquid flow pipes (5*a*, 5*b*), first check valves (CV1-1, CV1-2) are respectively provided for allowing only flows of liquid refrigerant from the cold heat source heat exchangers (2*a*, 2*b*) to the hot heat source heat exchanger (1). The branch liquid pipes (7*e*, 7*f*) are provided with sixth motor-operated valves (EV6-1, EV6-2) referred to as third shut-off valves in claim 40 respectively. Other structures are the same as in the fourth embodiment (See FIG. 12).

Under such a configuration, at the time of air conditioning of the secondary refrigerant circuit (B), the direction of refrigerant flow is changed in accordance with the operation mode of each of the indoor heat exchangers (3*a*–3*d*) described in the fourth embodiment and recovery and supply of liquid refrigerant with respect to each of the cold heat source heat exchangers (2*a*, 2*b*) are alternately changed, so that the operation of each of the indoor heat exchanges (3*a*–3*d*) is successively executed.

Figure 29:
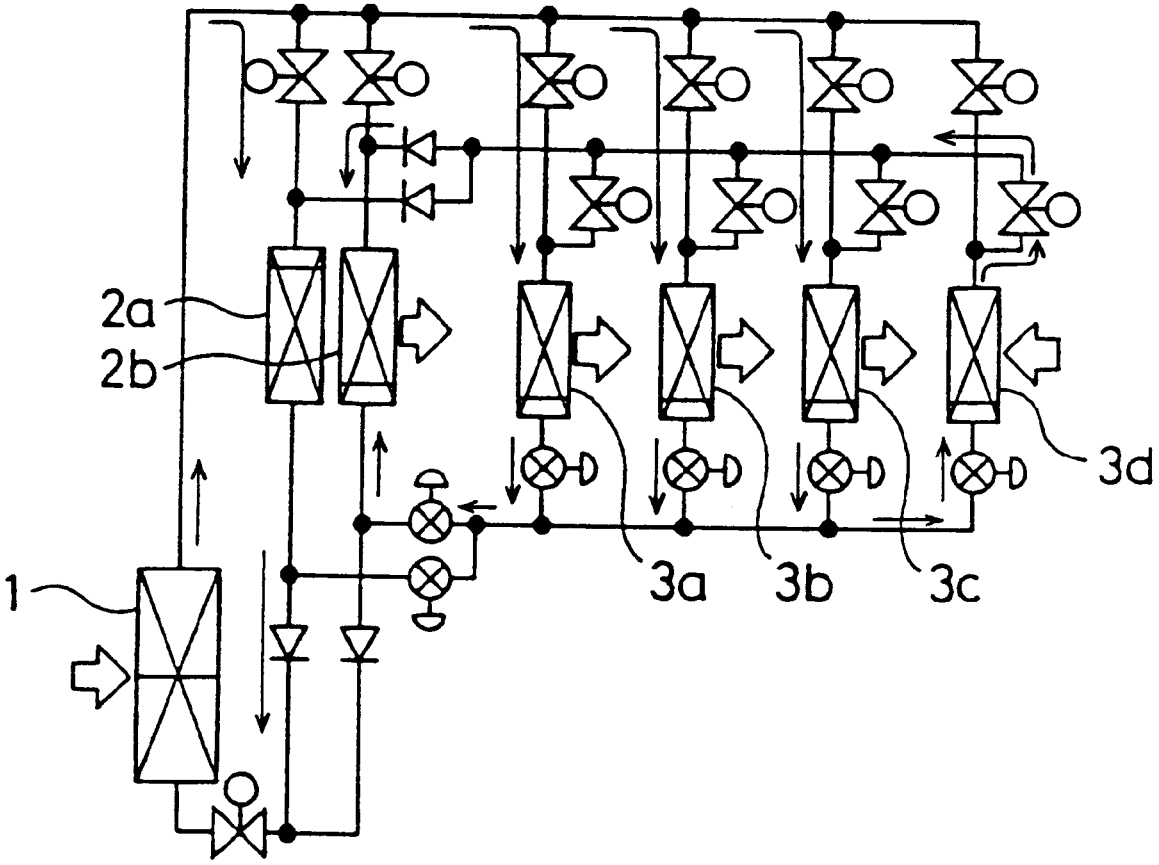
FIG. 29 is a diagram corresponding to FIG. 2 for illustrating the time when the heat balance among all rooms requests a heating operation in the eighth embodiment.

More specifically, the case of the operation of mainly radiating heat in which the heat balance among all rooms requests the heating operation is as shown in FIG. 29. When recovery of liquid refrigerant from the stopping cold heat source heat exchanger (2*a*) to the hot heat source heat exchanger (1) is made, liquid refrigerant is supplied from the indoor heat exchangers (3*a*–3*c*) under the operation of radiating heat to the operating cold heat source heat exchanger (2*b*) while gas refrigerant is transferred from the indoor heat exchanger (3*d*) under the operation of absorbing heat to the cold heat source heat exchanger (2*b*). Such an operation is repeated alternately between the cold heat source heat exchangers.

Figure 30:
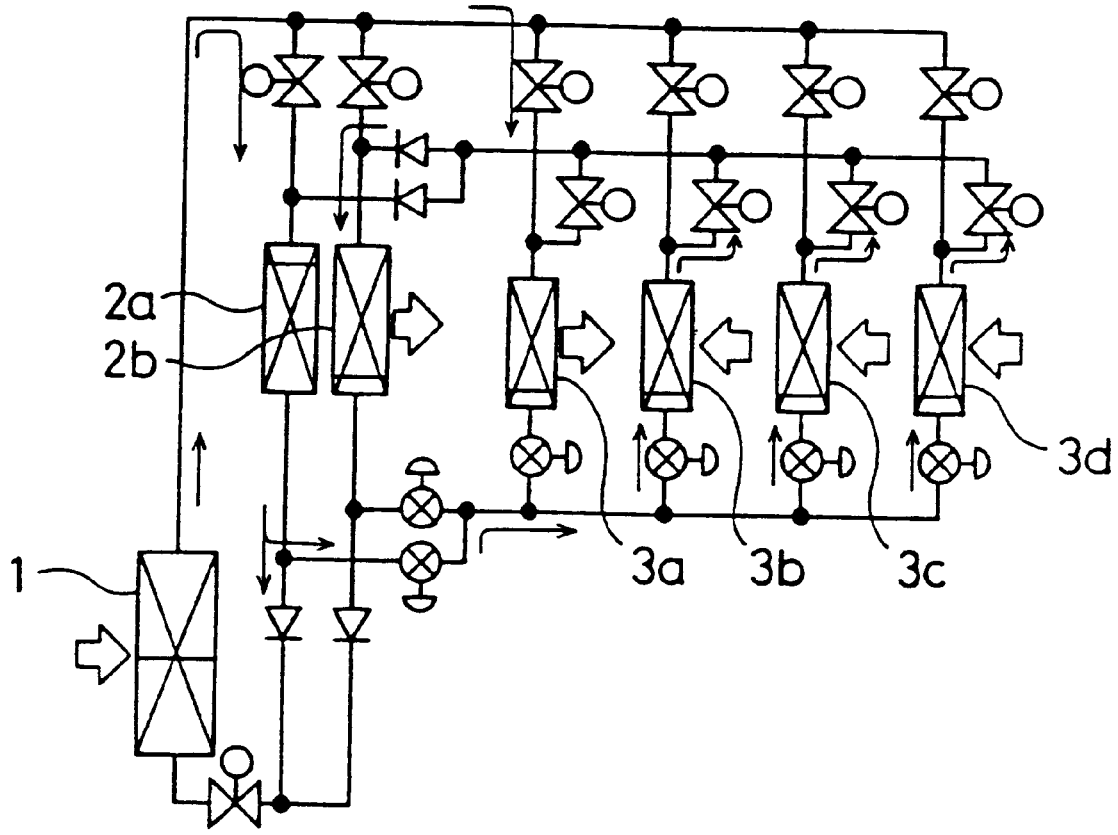
FIG. 30 is a diagram corresponding to FIG. 2 for illustrating the time when the heat balance among all the rooms requests a cooling operation in the eighth embodiment.

The case of the operation of mainly absorbing heat in which the heat balance among all the rooms requests the cooling operation is as shown in FIG. 30. When gas refrigerant is transferred from the indoor heat exchangers (3*b*–3*d*) under the operation of absorbing heat to the operating cold heat source heat exchanger (2*b*), liquid refrigerant is recovered from the stopping cold heat source heat exchanger (2*a*) to the hot heat source heat exchanger (1) while liquid refrigerant is supplied from the cold heat source heat exchanger (2*a*) to the indoor heat exchangers (3*b*–3*d*) under the operation of absorbing heat. Such an operation is repeated alternately between the cold heat source heat exchangers.

Figure 31:
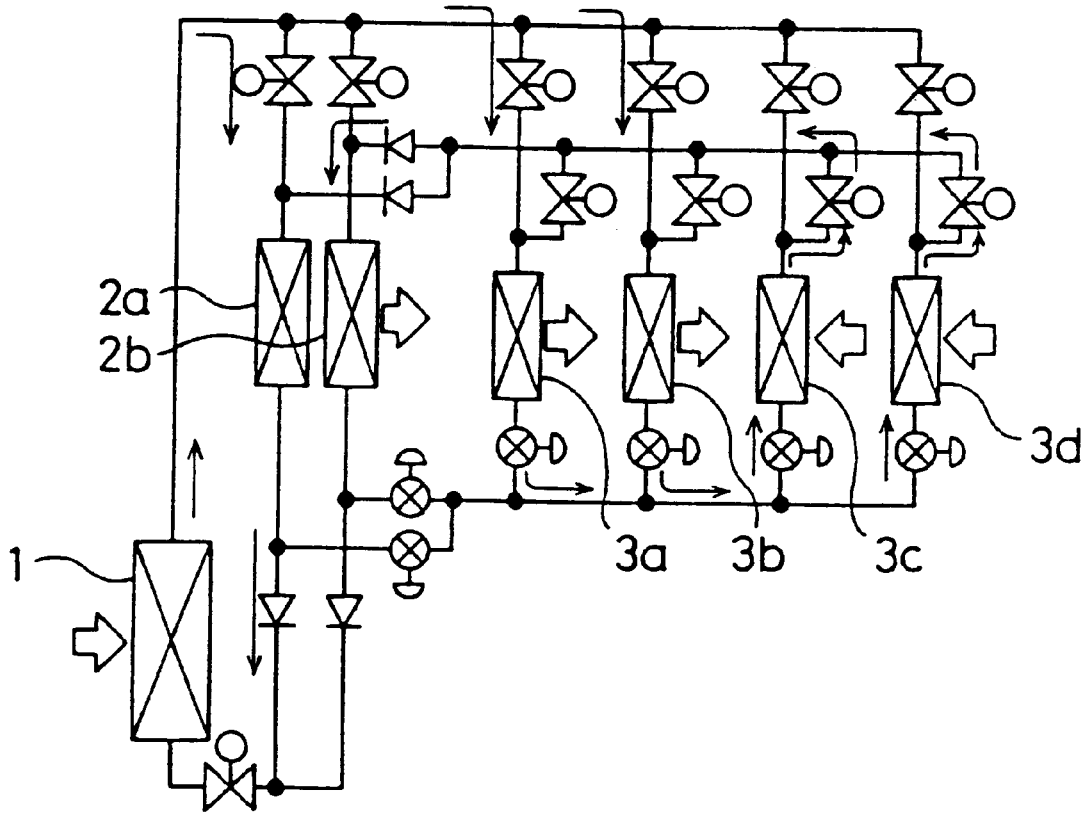
FIG. 31 is a diagram corresponding to FIG. 2 for illustrating the time when the amount of heat radiated and the amount of heat absorbed are equal among all indoor heat exchangers in the eighth embodiment.

The case that the total amount of heat radiated and the total amount of heat absorbed are equal among all the indoor heat exchangers is as shown in FIG. 31. When recovery of liquid refrigerant from the stopping cold heat source heat exchanger (2*a*) to the hot heat source heat exchanger (1) is made, liquid refrigerant is supplied from the indoor heat exchangers (3*a*, 3*b*) under the operation of radiating heat to the indoor heat exchangers (3*c*, 3*d*) under the operation of absorbing heat and gas refrigerant evaporated in the indoor heat exchangers (3*c*, 3*d*) is transferred to the operating cold heat source heat exchanger (2*b*). Such an operation is repeated alternately between the cold heat source heat exchangers.

Since the operations in the case that all the indoor heat exchangers (3*a*–3*d*) execute the operation of radiating heat and in the case that all the indoor heat exchangers (3*a*–3*d*) execute the operation of absorbing heat are the same as in the operations described in the seventh embodiment, description is omitted.

Modifications Having Plural Liquid Receivers

The following ninth to twelfth embodiments of the invention are modifications for implementing continuous air conditioning and each have a circuit configuration having a plurality of liquid receivers (two liquid receivers in the embodiments) capable of storing liquid refrigerant.

Ninth Embodiment

The ninth embodiment has first and second liquid receivers. In this embodiment, the secondary refrigerant circuit is configured for a heating-only air conditioner.

Figure 32:
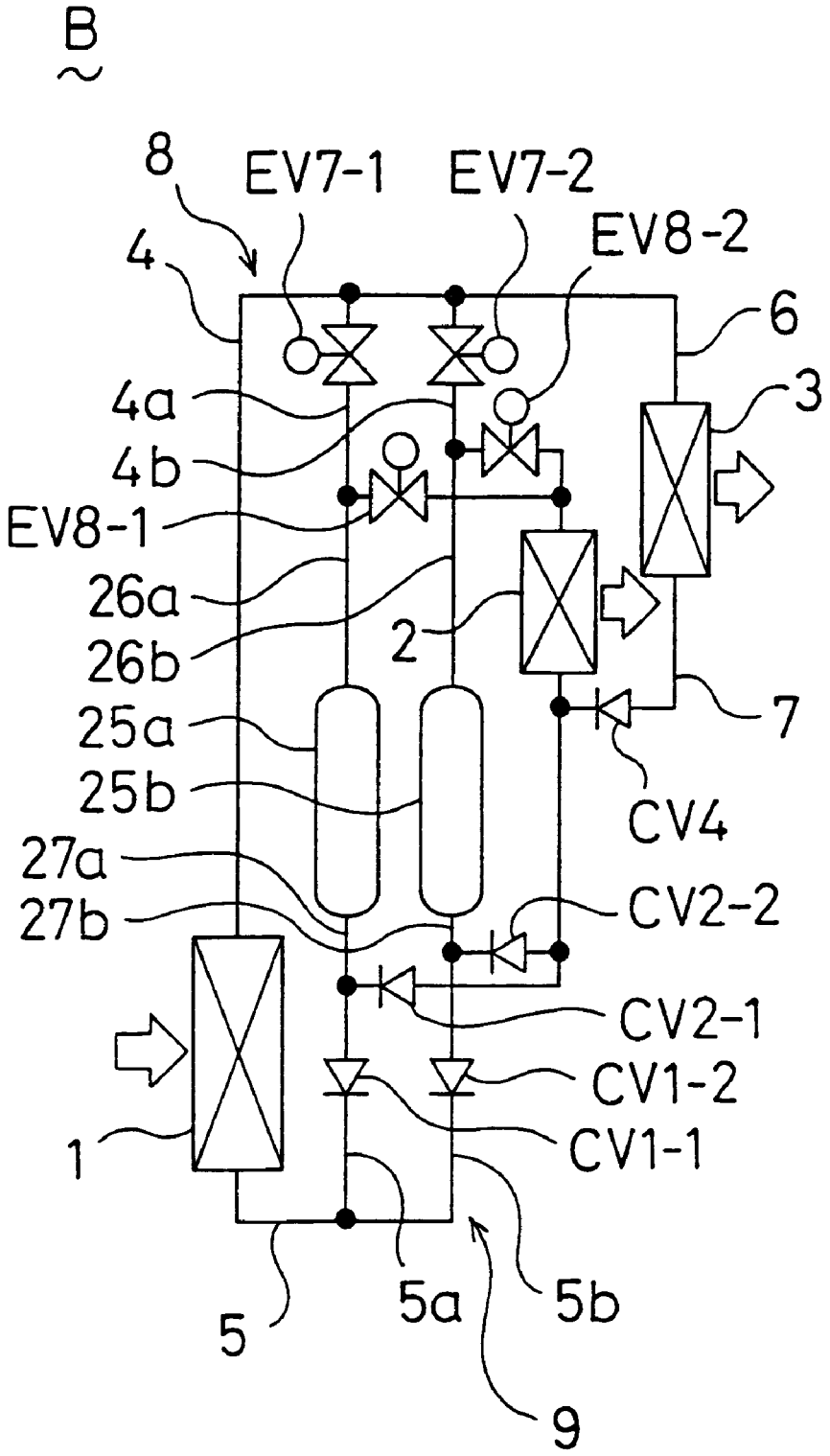
FIG. 32 is a diagram showing a secondary refrigerant circuit of a ninth embodiment of the invention.
Figure 33A:
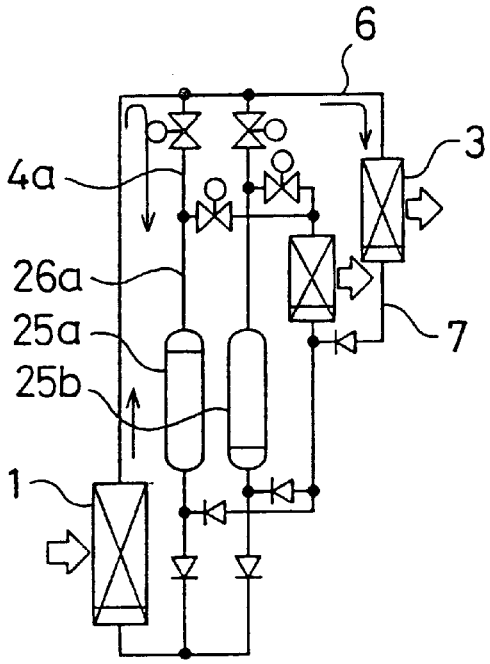
FIGS. 33(*a*), 33(*b*), 33(*c*), 33(*d*) show diagrams corresponding to FIG. 2 in the ninth embodiment.
Figure 33B:
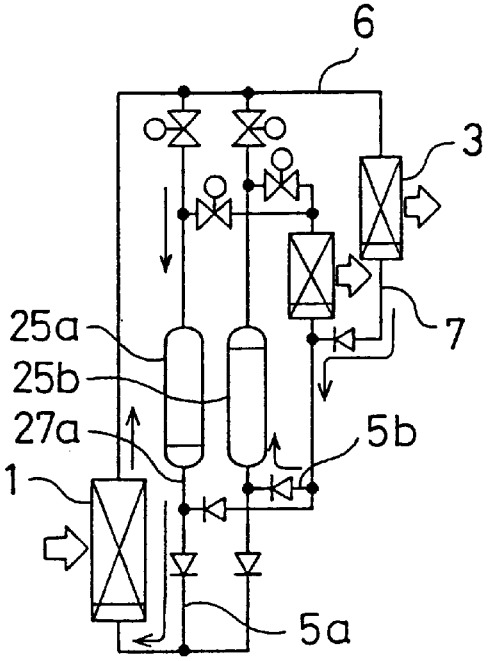
Figure 33C:
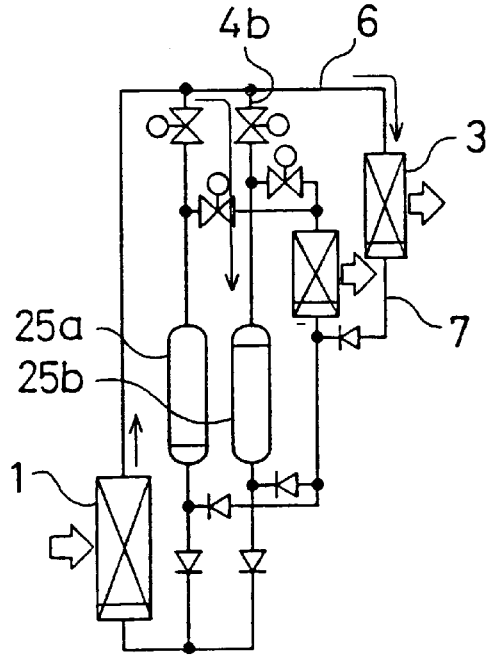
Figure 33D:
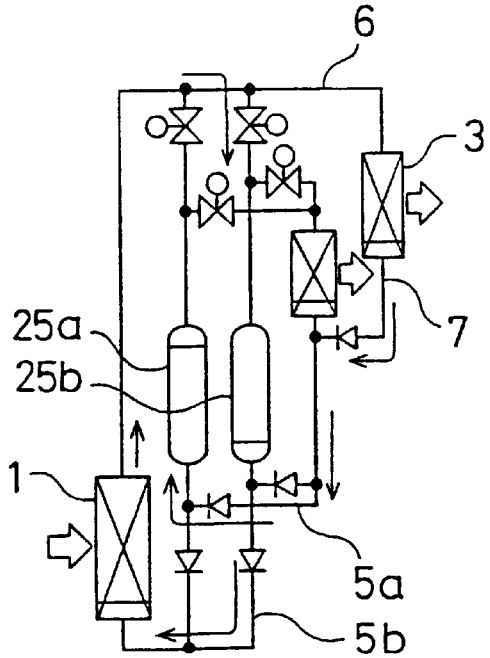

As shown in FIG. 32, a part of a gas flow pipe (4) is divided into first and second branch gas flow pipes (4*a*, 4*b*). The first branch gas flow pipe (4*a*) is connected to a first liquid receiver (25*a*) through a first gas pipe (26*a*) and the second branch gas flow pipe (4*b*) is connected to a second liquid receiver (25*b*) through a second gas pipe (26*b*).

Between the hot heat source heat exchanger (1) and the connection points of the gas flow pipes (4*a*, 4*b*) with the gas pipes (26*a*, 26*b*), there are respectively provided seventh solenoid valves (EV7-1, EV7-2) referred to as first shutoff valves in claim 43 of the invention. Between the cold heat source heat exchanger (2) and the connection points of the gas flow pipes (4*a*, 4*b*) with the gas pipes (26*a*, 26*b*), there are respectively provided eighth solenoid valves (EV8-1, EV8-2) referred to as second shut-off valves in claim 43 of the invention.

A part of a liquid flow pipe (5) is divided into first and second branch liquid flow pipes (5*a*, 5*b*). The first branch liquid flow pipe (5*a*) is connected to the first liquid receiver (25*a*) through a first liquid pipe (27*a*) and the second branch liquid flow pipe (5*b*) is connected to the second liquid receiver (52*b*) through a second liquid pipe (27*b*). Between the hot heat source heat exchanger (1) and the connection points of the liquid pipes (27*a*, 27*b*) with the branch liquid flow pipes (5*a*, 5*b*), there are respectively provided first check valves (CV1-1, CV1-2) which allow only flows of liquid refrigerant from the liquid receivers (25*a*, 25*b*) to the hot heat source heat exchanger (1).

Between the cold heat source heat exchanger (2) and the connection points of the liquid pipes (27*a*, 27*b*) with the branch liquid flow pipes (5*a*, 5*b*), there are respectively provided second check valves (CV2-1, CV2-2) which allow only flows of liquid refrigerant from the indoor heat exchanger (3) and the cold heat source heat exchangers (2) to the liquid receivers (25*a*, 25*b*).

Further, a liquid pipe (7) is provided with a fourth check valve (CV4) which allows only a flow of liquid refrigerant from the indoor heat exchanger (3) to the liquid receivers (25*a*, 25*b*).

Next, description is made about a heating operation of the secondary refrigerant circuit (B) configured as above-described.

In this heating operation, firstly, the controller (C) opens the seventh solenoid valve (EV7-1) located in the first branch gas flow pipe (4*a*) and the eighth solenoid valve (EV8-2) located in the second branch gas flow pipe (4*b*), and closes the seventh solenoid valve (EV7-2) located in the second branch gas flow pipe (4*b*) and the eighth solenoid valve (EV8-1) located in the first branch gas flow pipe (4*a*).

In this state, the hot heat source heat exchanger (1) receives an amount of heat from the primary refrigerant circuit to evaporate refrigerant so that, as shown in FIG. 33(*a*), a part of high-pressure gas refrigerant from the hot heat source heat exchanger (1) is supplied to the discharging first liquid receiver (25*a*) through the first branch gas flow pipe (4*a*) and the first gas pipe (26*a*), and the remaining high-pressure gas refrigerant is supplied to the indoor heat exchanger (3) through the gas pipe (6). The gas refrigerant exchanges heat with room air in the indoor heat exchanger (3) to condense therein so that the room air is heated resulting in heating the room.

Under this condition, as shown in FIG. 33(*b*), the liquid refrigerant in the indoor heat exchanger (3) is transferred to the charging liquid receiver (25*b*) through the second branch liquid flow pipe (5*b*) by pressure difference between the indoor heat exchanger (3) and the second liquid receiver (25*b*). Consequently, with the running of the heating operation, liquid refrigerant is gradually stored in the second liquid receiver (25*b*). On the other hand, when gas refrigerant is supplied from the hot heat source heat exchanger (1) to the first liquid receiver (25*a*), liquid refrigerant in the first liquid receiver (25*a*) is recovered to the hot heat source heat exchanger (1) through the first liquid pipe (27*a*) and the first branch liquid flow pipe (5*a*).

When such a heating operation is executed for a specified time so that the storage amount of liquid refrigerant in the second liquid receiver (25*b*) exceeds a specified amount, the controller (C) opens the seventh solenoid valve (EV7-2) in the second branch gas flow pipe (4*b*) and the eighth solenoid valve (EV8-1) in the first branch gas flow pipe (4*a*), and closes the seventh solenoid valve (EV7-1) in the first branch gas flow pipe (4*a*) and the eighth solenoid valve (EV8-2) in the second branch gas flow pipe (4*b*). Thereby, the second liquid receiver (25*b*) is changed to a discharging liquid receiver and the first liquid receiver (25*a*) is changed to a charging liquid receiver.

Then, as shown in FIG. 33(*c*), a part of high-pressure gas refrigerant from the hot heat source heat exchanger (1) is supplied to the second liquid receiver (25*b*) through the second branch gas flow pipe (4*b*) and the remaining high-pressure gas refrigerant is supplied to the indoor heat exchanger (3) through the gas pipe (6). The gas refrigerant exchanges heat with the room air in the indoor heat exchanger (3) to condense therein so that the room air is heated resulting in heating the room.

Under this condition, as shown in FIG. 33(*d*), liquid refrigerant in the indoor heat exchanger (3) is transferred to the first liquid receiver (25*a*) through the first branch liquid flow pipe (5*a*) by pressure difference between the gas pipe (6) and the liquid pipe (7). Consequently, with the running of the heating operation, liquid refrigerant is gradually stored in the first liquid receiver (25*a*).

On the other hand, when gas refrigerant is supplied from the hot heat source heat exchanger (1) to the second liquid receiver (25*b*), liquid refrigerant in the second liquid receiver (25*b*) is recovered to the hot heat source heat exchanger (1) through the second branch liquid flow pipe (5*b*). Such two operations are alternately executed.

Thus, under the configuration of this embodiment, two liquid receivers (25*a*, 25*b*) are provided, refrigerant is transferred from the indoor heat exchanger (3) to one of the liquid receivers while liquid refrigerant is recovered from the other liquid receiver to the hot heat source heat exchanger (1), and the operations of these liquid receivers (25*a*, 25*b*) are alternately executed. Accordingly, the operation of radiating heat of the indoor heat exchanger (3) can be successively executed. In other words, the heating operation can be successively executed. This increases comfortableness of the room.

Tenth Embodiment

This tenth embodiment is an embodiment according to claims 45 to 48 of this invention and has first and second liquid receivers. The secondary refrigerant circuit is configured for a cooling-only air conditioner. In this embodiment, only differences in circuit configuration from the ninth embodiment are described.

Figure 34:
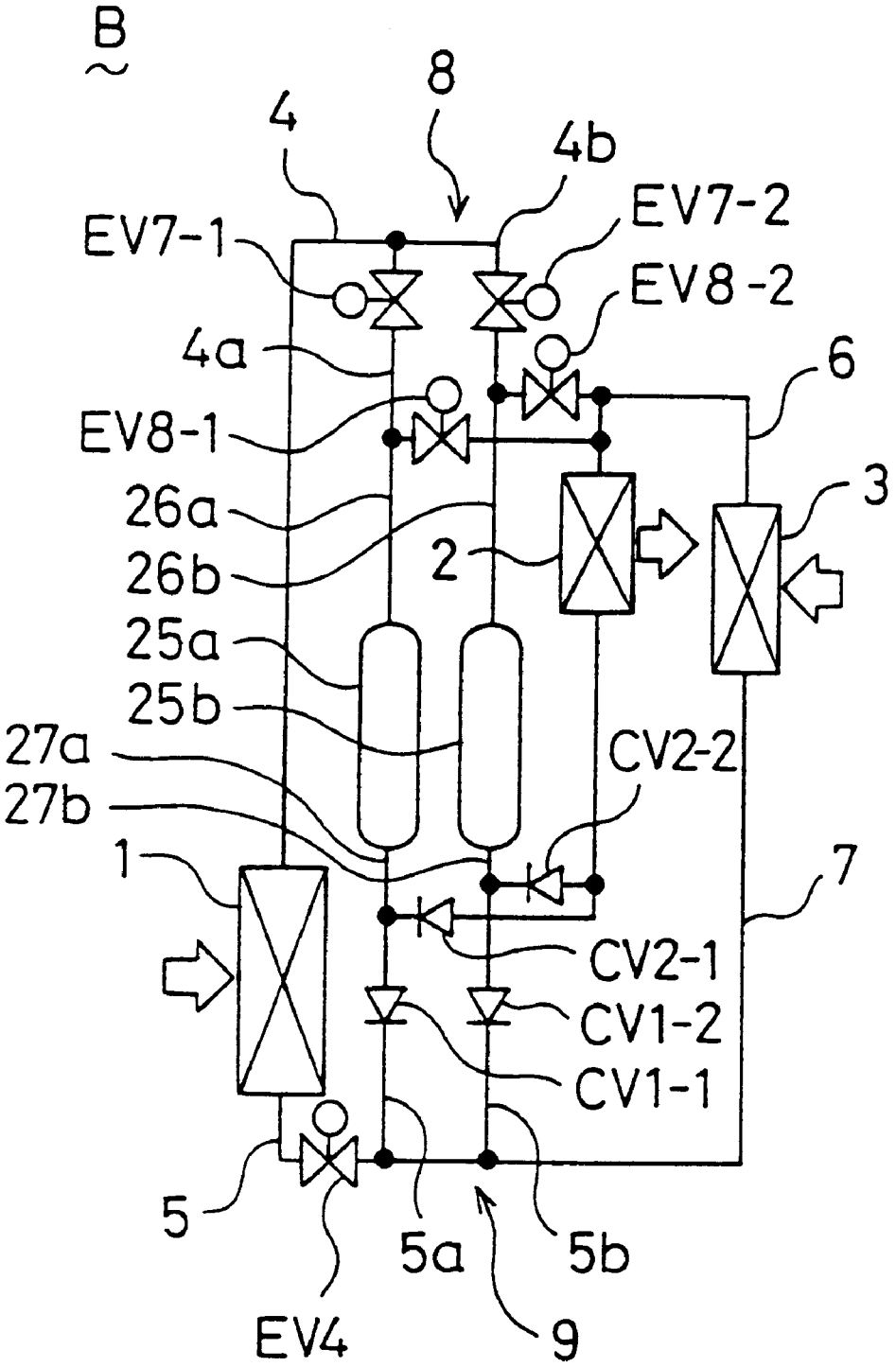
FIG. 34 is a diagram showing a secondary refrigerant circuit of a tenth embodiment of the invention.
Figure 35A:
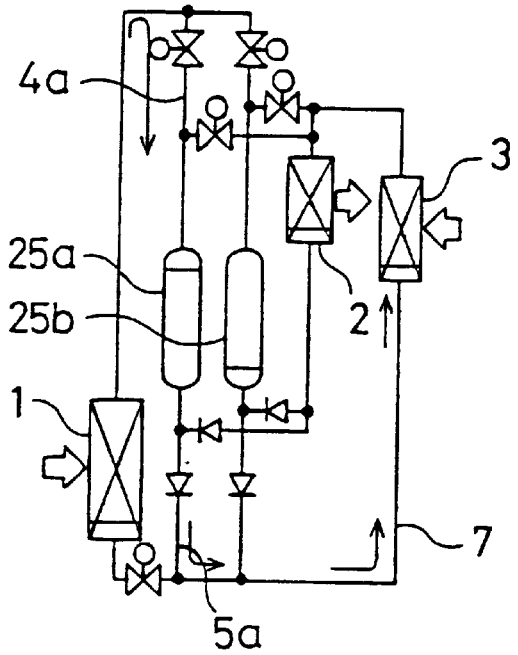
FIGS. 35(*a*), 35(*b*), 35(*c*), and 35(*d*) show diagrams corresponding to FIG. 2 in the tenth embodiment.
Figure 35B:
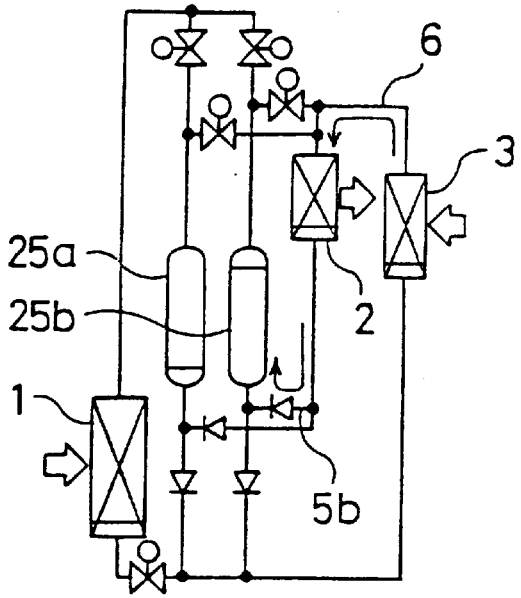
Figure 35C:
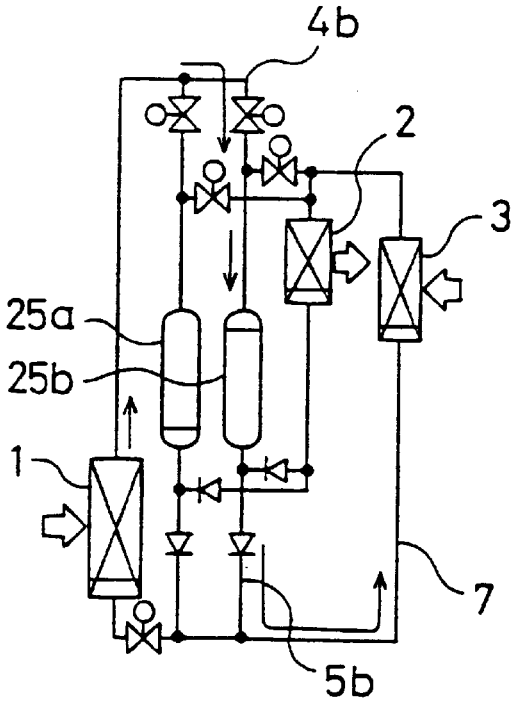
Figure 35D:
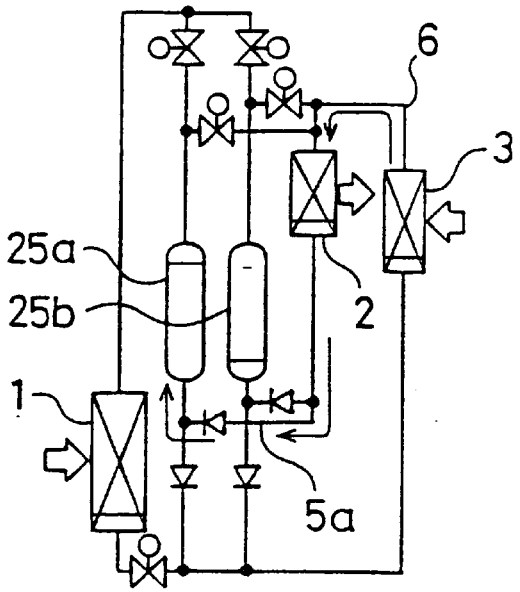

As shown in FIG. 34, a connection point of a gas pipe (6) with a gas flow pipe (4) is located between a cold heat source heat exchanger (2) and an eighth solenoid valve (EV8-2) provided in a second branch gas flow pipe (4*b*).

A connection point of a liquid pipe (7) with a liquid flow pipe (5) is located between a hot heat source heat exchanger (1) and a first check valve (CV1-2) provided in a second branch liquid flow pipe (5*b*). Further, the liquid flow pipe (5) is provided with a fourth solenoid valve (EV4). In this embodiment, the liquid pipe (7) is provided with no fourth check valve (CV4). Other structures are the same as in the ninth embodiment.

Next, description is made about a cooling operation of the refrigerant circuit (B) configured as above-described.

At the start of the cooling operation, firstly, the controller (C) opens the seventh solenoid valve (EV7-1) provided in the first branch gas flow pipe (4*a*) and the eighth solenoid valve (EV8-2) provided in the second branch gas flow pipe (4*b*), and closes the seventh solenoid valve (EV7-2) provided in the second branch gas flow pipe (4*b*) and the eighth solenoid valve (EV8-1) provided in the first branch gas flow pipe (4*a*).

In this state, as shown in FIG. 35(*a*), high-pressure gas refrigerant is supplied from the hot heat source heat exchanger (1) to the discharging first liquid receiver (25*a*) through the first branch gas flow pipe (4*a*). When the gas refrigerant is thus supplied, the pressure of the gas refrigerant acts so that liquid refrigerant previously stored in the first liquid receiver (25*a*) is introduced into the indoor heat exchanger (3) through the first branch liquid flow pipe (5*a*) and the liquid pipe (7). Then, liquid refrigerant exchanges heat with room air in the indoor heat exchanger (3) to evaporate therein so that the room air is cooled resulting in cooling the room.

At this time, as shown in FIG. 35(*b*), the gas refrigerant in the indoor heat exchanger (3) is transferred to the cold heat source heat exchanger (2) through the gas pipe (6) by pressure difference between the cold heat source heat exchanger (2) under the condensation of refrigerant and the indoor heat exchanger (3) under the evaporation of refrigerant. Then, the gas refrigerant is condensed to liquid refrigerant in the cold heat source heat exchanger (2). The liquid refrigerant is transferred to the charging second liquid receiver (25*b*) through the second branch liquid flow pipe (5*b*).

When such an operation is continued for a specified time so that the storage amount of liquid refrigerant in the first liquid receiver (25*a*) becomes short of a specified amount, the controller (C) opens the seventh solenoid valve (EV7-2) provided in the second branch gas flow pipe (4*b*) and the eighth solenoid valve (EV8-1) provided in the first branch gas flow pipe (4*a*) and closes the seventh solenoid valve (EV7-1) provided in the first branch gas flow pipe (4*a*) and the eighth solenoid valve (EV8-2) provided in the second branch gas flow pipe (4*b*). Thereby, the second liquid receiver (25*b*) is changed to a discharging liquid receiver and the first liquid receiver (25*a*) is changed to a charging liquid receiver.

Then, as shown in FIG. 35(*c*), high-pressure gas refrigerant is supplied from the hot heat source heat exchanger (1) to the second liquid receiver (25*b*) through the second branch gas flow pipe (4*b*). When the gas refrigerant is thus supplied, the pressure of the gas refrigerant acts so that liquid refrigerant previously stored in the second liquid receiver (25*b*) is introduced into the indoor heat exchanger (3) through the second branch liquid flow pipe (5*b*) and the liquid pipe (7). Then, liquid refrigerant exchanges heat with the room air in the indoor heat exchanger (3) to evaporate therein so that the room air is cooled resulting in cooling the room.

At this time, as shown in FIG. 35(*d*), the gas refrigerant in the indoor heat exchanger (3) is transferred to the cold heat source heat exchanger (2) through the gas pipe (6) by pressure difference between the cold heat source heat exchanger (2) and the indoor heat exchanger (3). Thereafter, the gas refrigerant is condensed to liquid refrigerant in the cold heat source heat exchanger (2). The liquid refrigerant is transferred to the first liquid receiver (25*a*) through the first branch liquid flow pipe (5*a*).

The above operations of the liquid receivers (25*a*, 25*b*) are alternately executed so that the operation of absorbing heat of the indoor heat exchanger (3) is successively executed. In other words, the cooling operation can be successively executed.

When the cooling operation is executed for a specified time so that the storage amount of liquid refrigerant in the hot heat source heat exchanger (1) becomes short of a specified amount, the controller (C) opens the seventh solenoid valves (EV7-1, EV7-2) connected to the liquid receivers (25*a*, 25*b*) in which liquid refrigerant is stored, and opens the fourth solenoid valve (EV4). Thereby, pressure is equalized between the hot heat source heat exchanger (1) and the cold heat source heat exchanger (2) so that liquid refrigerant in the cold heat source heat exchanger (2) is recovered to the hot heat source heat exchanger (1).

Eleventh Embodiment

An embodiment of a heat transfer device according to claims 49 to 52 of the invention will be described next with reference to the drawings.

In this eleventh embodiment, first and second liquid receivers are provided and the secondary refrigerant circuit is configured for an air conditioner changeable between a heating operation and a cooling operation. Described in this embodiment are only differences in circuit configuration from the embodiments described so far.

Figure 36:
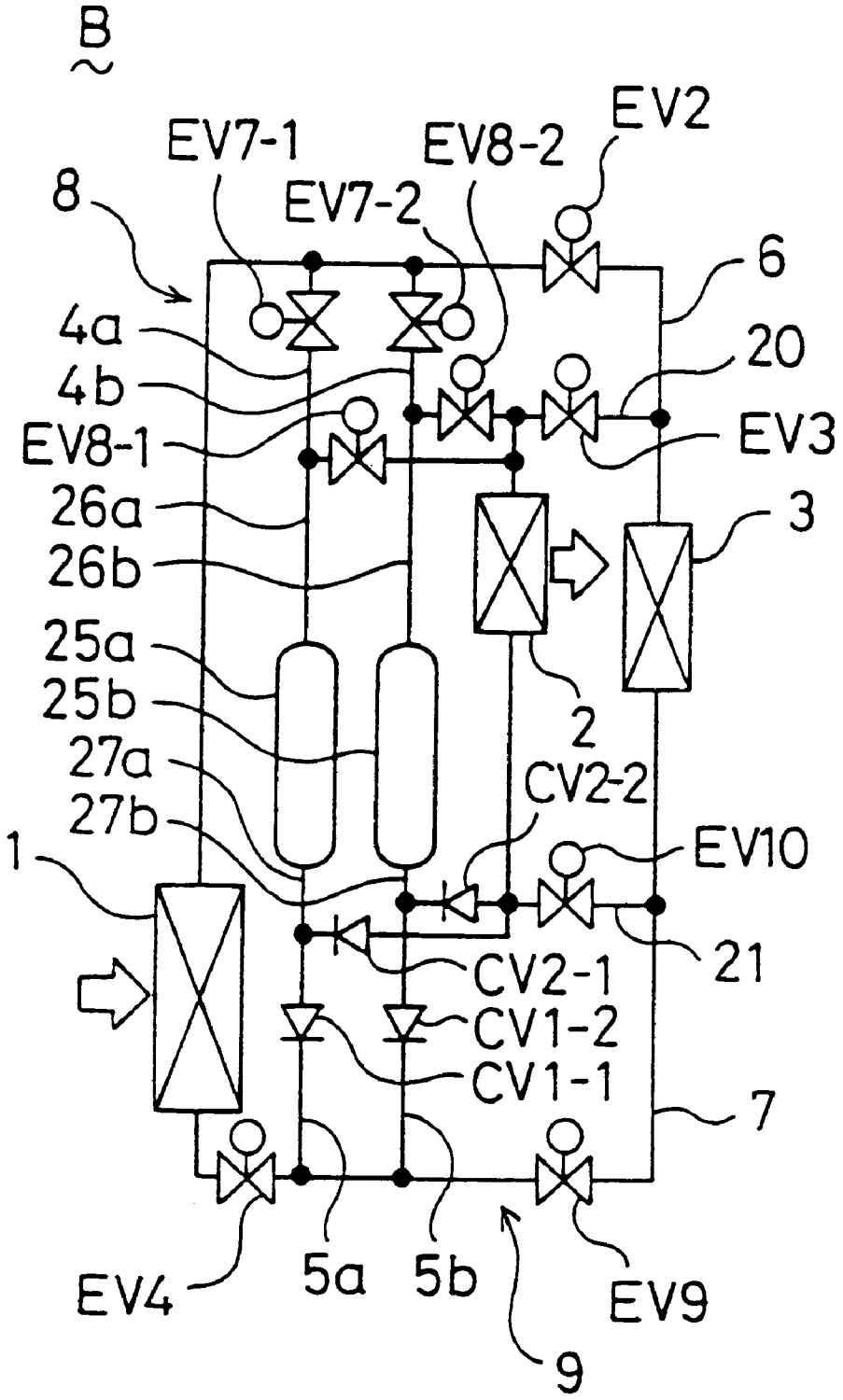
FIG. 36 is a diagram showing a secondary refrigerant circuit of an eleventh embodiment of the invention.

As shown in FIG. 36, a gas flow selecting means (8) of the secondary refrigerant circuit (B) of this eleventh embodiment is configured such that in the refrigerant circuit of the ninth embodiment, a second solenoid valve (EV2) referred to as a third shut-off valve in claim 51 is provided in the gas pipe (6) and a gas connecting pipe (20) is provided between each of the branch gas pipes (4*a*, 4*b*) and the gas pipe (6).

More specifically, one end of the gas connecting pipe (20) is connected to a part of the gas pipe (6) located between the second solenoid valve (EV2) and the indoor heat exchanger (3). The other end of the gas connecting pipe (20) is connected to a part of the second branch gas flow pipe (4*b*) located between the eighth solenoid valve (EV8-2) and the cold heat source heat exchanger (2). Further, the gas connecting pipe (20) is provided with a third solenoid valve (EV3) referred to as a fourth shut-off valve in claim 51.

A liquid flow selecting means (9) is configured such that in addition to the refrigerant circuit of the tenth embodiment, the liquid pipe (7) is provided with a ninth solenoid valve (EV9) and a liquid connecting pipe (21) is provided between each of the branch liquid flow pipes (5*a*, 5*b*) and the liquid pipe (7). In detail, the liquid connecting pipe (21) is connected at one end thereof to a part of the liquid pipe (7) located between the ninth solenoid valve (EV9) and the indoor heat exchanger (3) and is connected at the other end to a part of the second branch liquid flow pipe (5*b*) located between the second solenoid valve (EV2-2) and the cold heat source heat exchanger (2). The liquid connecting pipe (21) is provided with a tenth solenoid valve (EV10).

Figure 37:
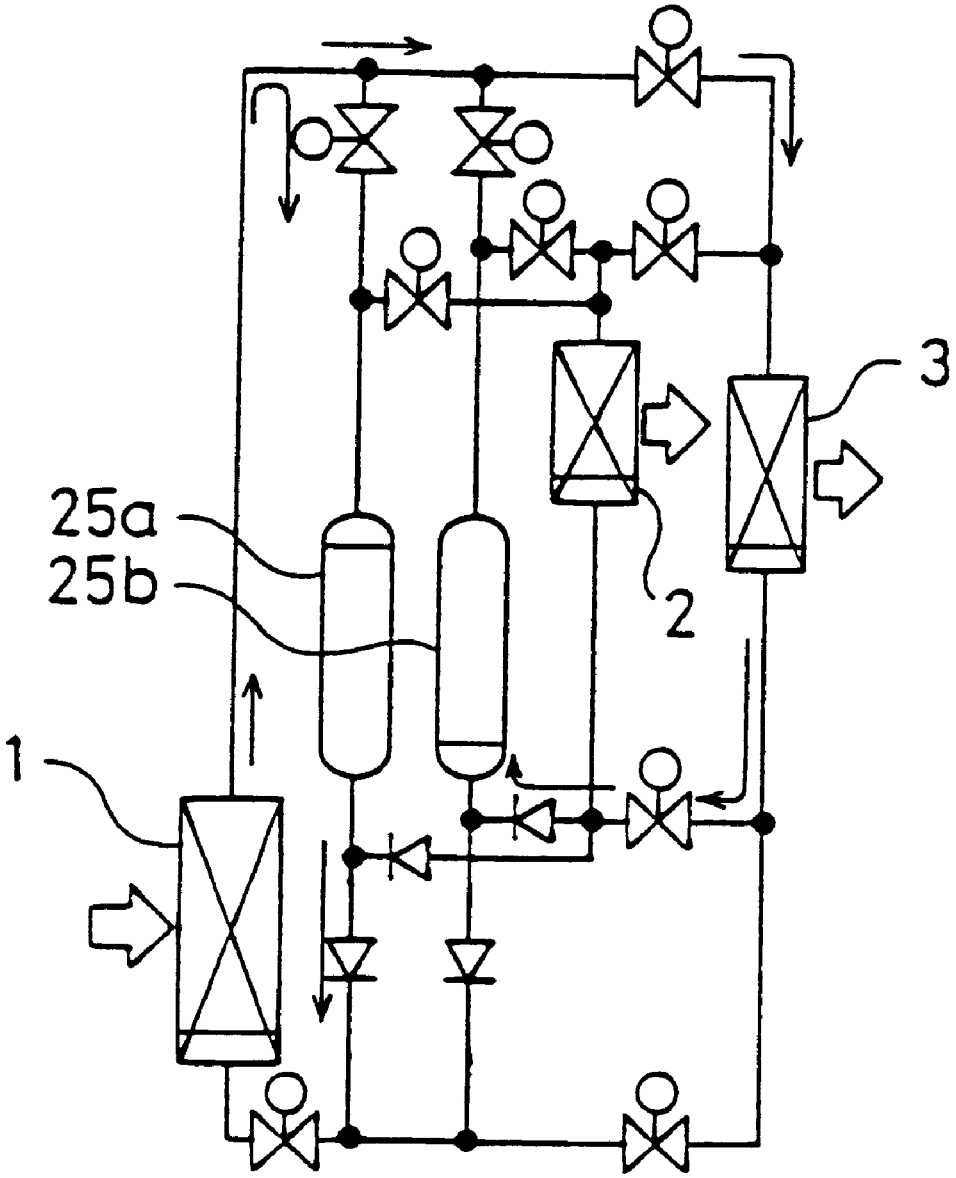
FIG. 37 is a diagram corresponding to FIG. 2 for illustrating a heating operation mode in the eleventh embodiment.

Under such a configuration, in a heating operation of the secondary refrigerant circuit (B), the heating operation as described in the ninth embodiment is executed so that a room is successively heated. In detail, as shown in FIG. 37, when recovery of liquid refrigerant is executed with respect to the discharging liquid receiver (25*a*), liquid refrigerant condensed in the indoor heat exchanger (3) is transferred to the charging liquid receiver (25*b*). Such an operation is alternately repeated between both the liquid receivers (25*a*, 25*b*).

Figure 38:
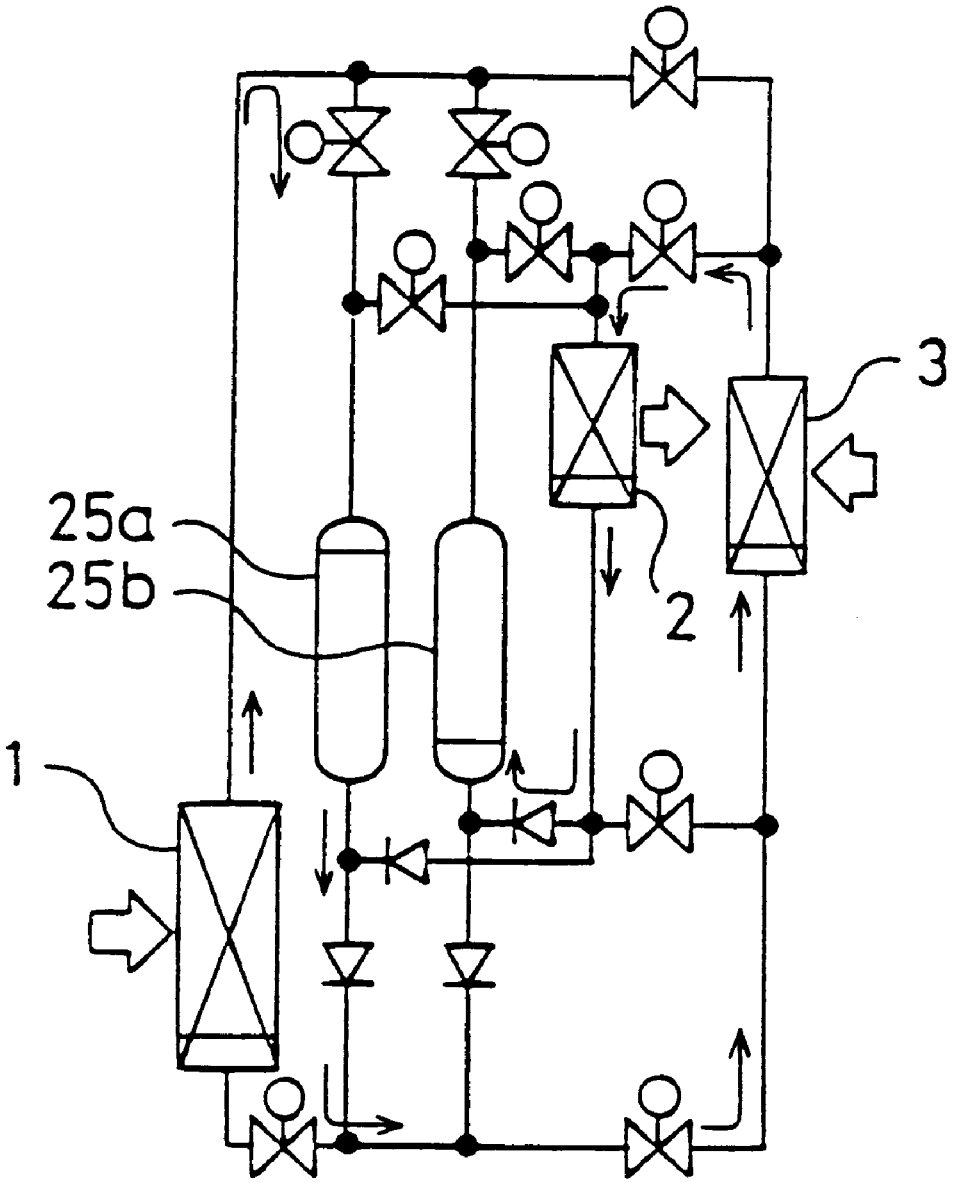
FIG. 38 is a diagram corresponding to FIG. 2 for illustrating a cooling operation mode in the eleventh embodiment.

On the other hand, in a cooling operation, the cooling operation as described in the tenth embodiment is executed so that the room is successively cooled. In detail, as shown in FIG. 38, when liquid refrigerant is supplied from the discharging liquid receiver (25*a*) to the indoor heat exchanger (3), the liquid refrigerant is evaporated to gas refrigerant in the indoor heat exchanger (3), the gas refrigerant is condensed to liquid refrigerant in the cold heat source heat exchanger (2) and the liquid refrigerant is transferred to the charging liquid receiver (25*b*). Such an operation is alternately repeated between both the liquid receivers (25*a*, 25*b*). Further, when the storage amount of liquid refrigerant in the hot heat source heat exchanger (1) becomes short of a specified amount with the running of the cooling operation, liquid refrigerant is recovered to the hot heat source heat exchanger (1) through the liquid flow pipe (5).

Twelfth Embodiment

An embodiment of a heat transfer device according to claims 53 to 58 of the invention will be described next with reference to the drawings.

In this twelfth embodiment, the secondary refrigerant circuit is configured for a multi-type air conditioner freely operable for cooling and heating operations. The air conditioner has first and second liquid receivers and four indoor heat exchangers placed in four rooms individually so as to be individually selectable between the cooling and heating operations. Described in this embodiment are only differences in circuit configuration from the fourth embodiment.

Figure 39:
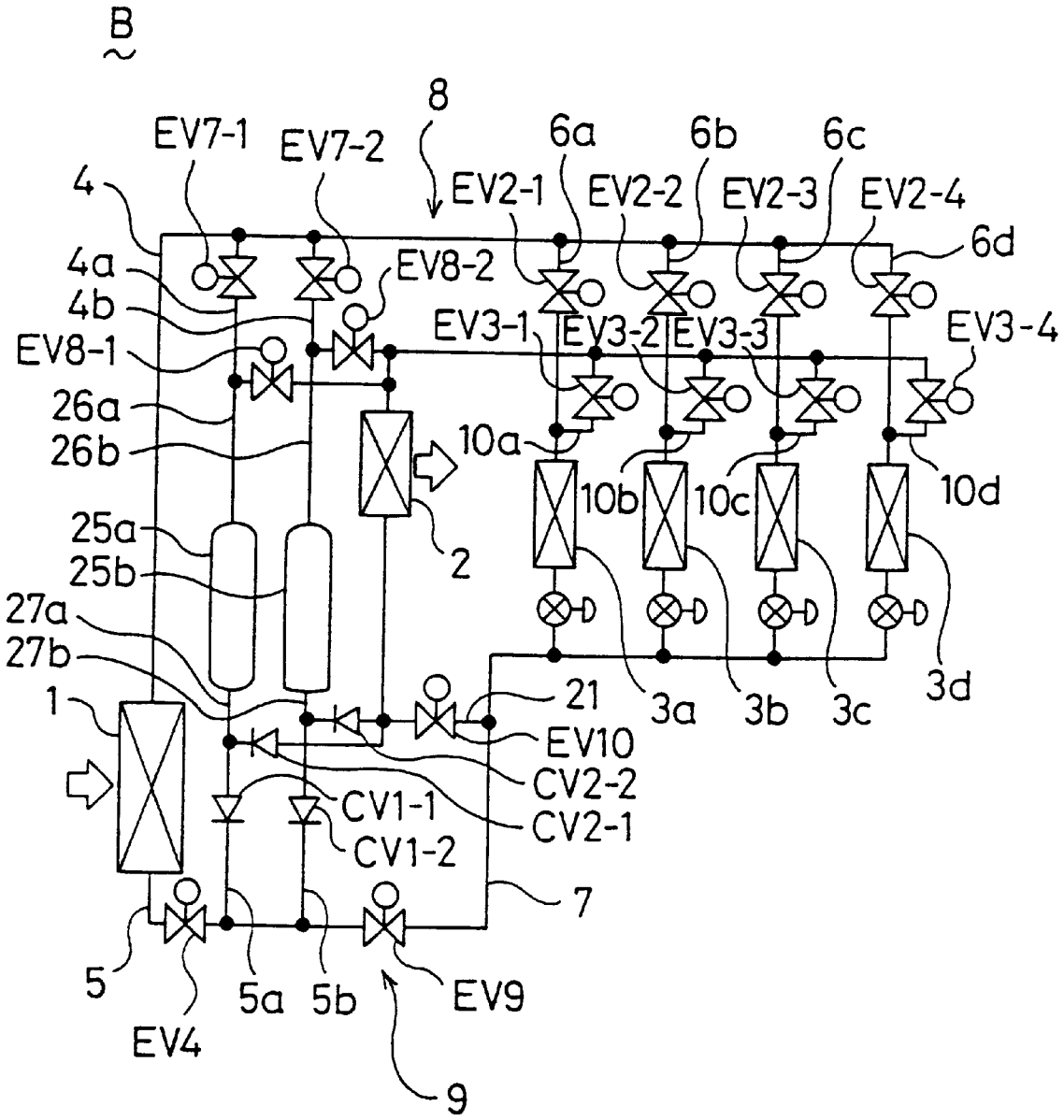
FIG. 39 is a diagram showing a secondary refrigerant circuit of a twelfth embodiment of the invention.

As shown in FIG. 39, a gas flow selecting means (8) of the secondary refrigerant circuit (B) is configured such that a part of a gas flow pipe (4) is divided into first and second branch gas flow pipes (4*a*, 4*b*), the first branch gas flow pipe (4*a*) is connected to a first liquid receiver (25*a*) through a first gas pipe (26*a*) and the second branch gas flow pipe (4*b*) is connected to a second liquid receiver (25*b*) through a second gas pipe (26*b*).

Further, between a hot heat source heat exchanger (1) and connection points of the branch gas flow pipes (4*a*, 4*b*) with the gas pipes (26*a*, 26*b*), seventh solenoid valves (EV7-1, EV7-2) are provided respectively. Between a cold heat source heat exchanger (2) and the connection points of the branch gas flow pipes (4*a*, 4*b*) with the gas pipes (26*a*, 26*b*), eighth solenoid valves (EV8-1, EV8-2) are provided respectively.

A part of a liquid flow pipe (5) is divided into first and second branch liquid flow pipes (5*a*, 5*b*), the first branch liquid flow pipe (5*a*) is connected to the first liquid receiver (25*a*) through a first liquid pipe (27*a*) and the second branch liquid flow pipe (5*b*) is connected to the second liquid receiver (25*b*) through a second liquid pipe (27*b*).

Between the hot heat source heat exchanger (1) and connection points of the branch liquid flow pipes (5*a*, 5*b*) with the liquid pipes (27*a*, 27*b*), first check valves (CV1-1, CV1-2) for allowing only flows of liquid refrigerant from the liquid receivers (25*a*, 25*b*) to the hot heat source heat exchanger (1) are provided respectively. Between the cold heat source heat exchanger (2) and the connection points of the branch liquid flow pipes (5*a*, 5*b*) with the liquid pipes (27*a*, 27*b*), second check valves (CV2-1, CV2-2) for allowing only flows of liquid refrigerant from indoor heat exchanges (3*a*–3*d*) and the cold heat source heat exchanger (2) to the liquid receivers (25*a*, 25*b*) are provided respectively.

Further, the liquid pipe (7) is provided with a ninth solenoid valve (EV9) and a liquid connecting pipe (21) is provided between each of the branch liquid flow pipes (5*a*, 5*b*) and the liquid pipe (7). In detail, the liquid connecting pipe (21) is connected at one end thereof to a part of the liquid pipe (7) located between the ninth solenoid valve (EV9) and the indoor heat exchanges (3*a*–3*d*) and is connected at the other end to a part of the second branch liquid flow pipe (5*b*) located between the second check valve (CV2-2) and the cold heat source heat exchanger (2).

The liquid connecting pipe (21) is provided with a tenth solenoid valve (EV10). Other structures are the same as in the fourth embodiment (See FIG. 12).

Under such a configuration, at the time of air conditioning of the secondary refrigerant circuit (B), the direction of refrigerant flow is changed in accordance with the operation mode of each of the indoor heat exchangers (3*a*–3*d*) described in the fourth embodiment and recovery and supply of liquid refrigerant with respect to each of the liquid receivers (25*a*, 25*b*) are alternately changed, so that the operation of each of the indoor heat exchanges (3*a*–3*d*) is successively executed.

Figure 40:
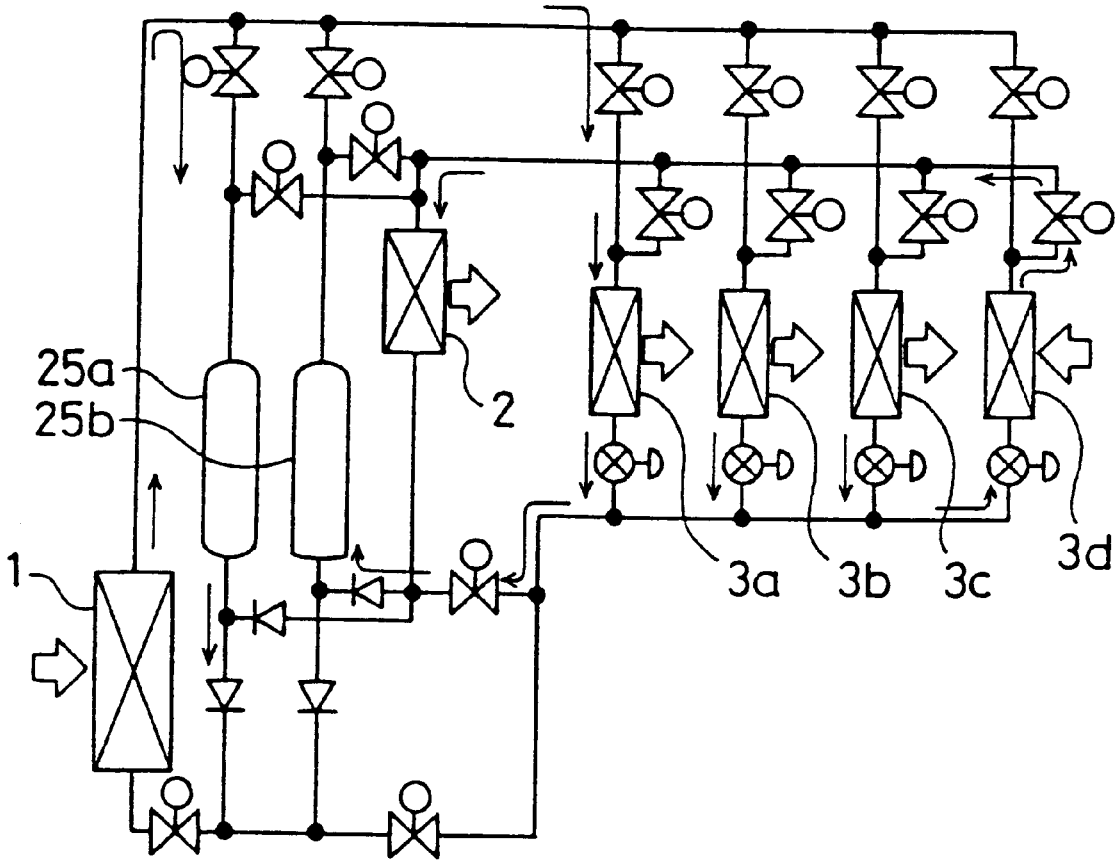
FIG. 40 is a diagram corresponding to FIG. 2 for illustrating the time when the heat balance among all rooms requests a heating operation in the twelfth embodiment.

More specifically, the case of the operation of mainly radiating heat in which the heat balance among all rooms requests the heating operation is as shown in FIG. 40. When recovery of liquid refrigerant from the discharging liquid receiver (25*a*) to the hot heat source heat exchanger (1) is made, liquid refrigerant is supplied from the indoor heat exchangers (3*a*–3*c*) under the operation of radiating heat to the charging liquid receiver (25*b*). Such an operation is repeated alternately between both the liquid receivers.

Figure 41:
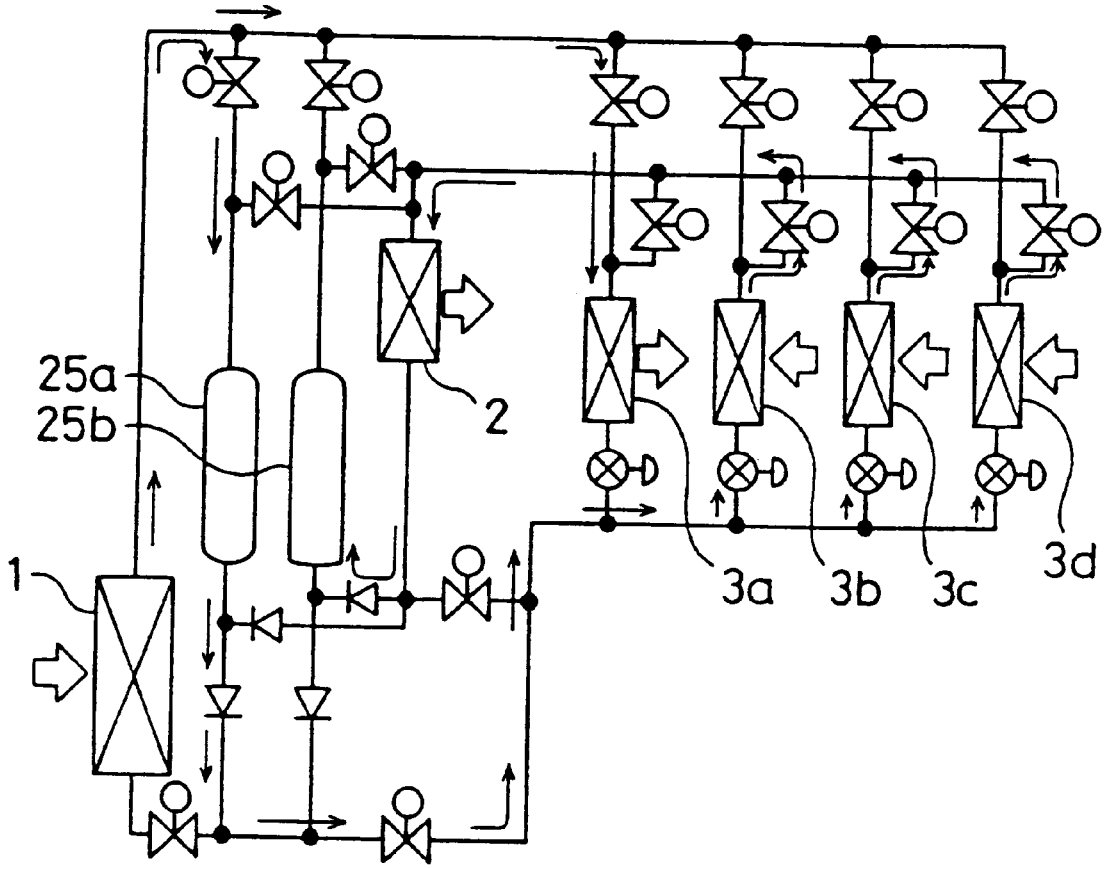
FIG. 41 is a diagram corresponding to FIG. 2 for illustrating the time when the heat balance among all the rooms requests a cooling operation in the twelfth embodiment.

The case of the operation of mainly absorbing heat in which the heat balance among all the rooms requests the cooling operation is as shown in FIG. 41. When gas refrigerant evaporated in the indoor heat exchangers (3*b*–3*d*) under the operation of absorbing heat is condensed to liquid refrigerant in the cold heat source heat exchanger (2) and is transferred to the discharging liquid receiver (25*b*), liquid refrigerant is recovered from the charging liquid receiver (25*a*) to the hot heat source heat exchanger (1) while liquid refrigerant is supplied from the charging liquid receiver (25*a*) to the indoor heat exchangers (3*b*–3*d*) under the operation of absorbing heat. Such an operation is repeated alternately between both the liquid receivers.

Figure 42:
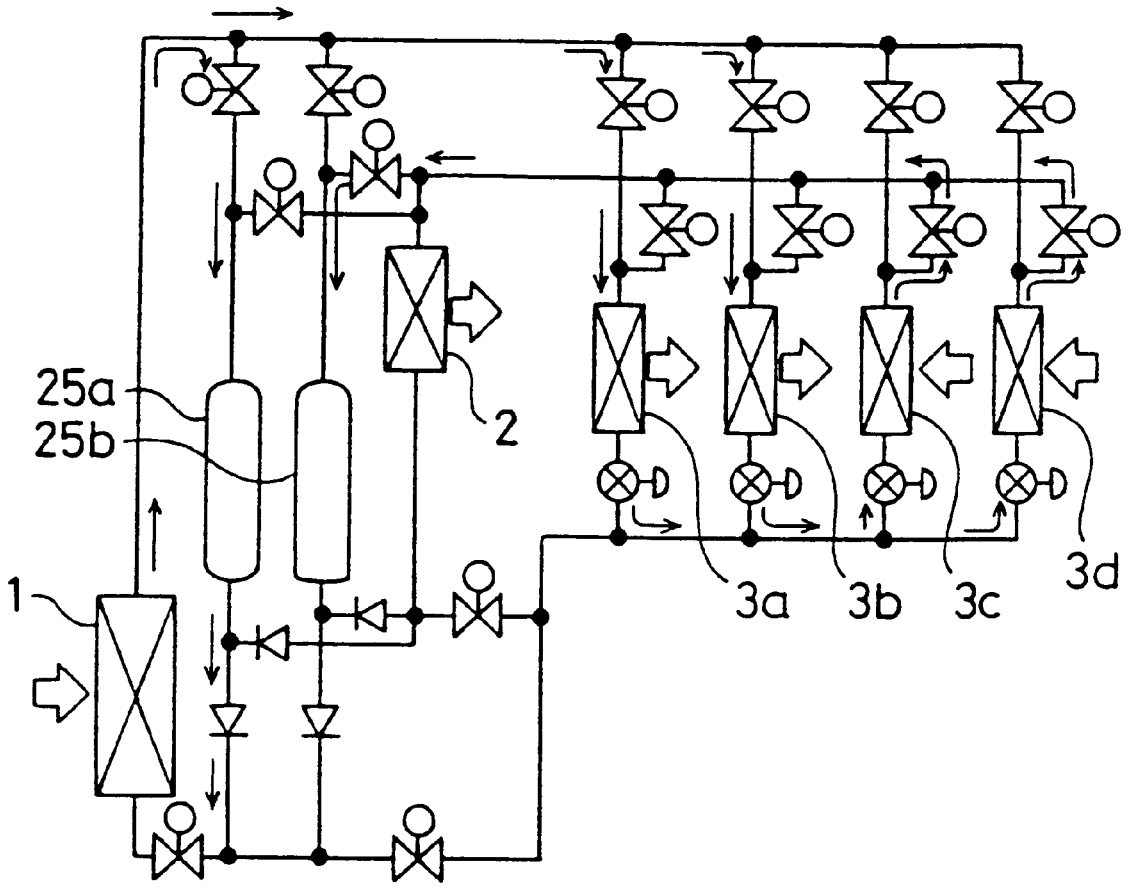
FIG. 42 is a diagram corresponding to FIG. 2 for illustrating the time when the amount of heat radiated and the amount of heat absorbed are equal among all indoor heat exchangers in the twelfth embodiment.

The case that the total amount of heat radiated and the total amount of heat absorbed are equal among all the indoor heat exchangers (3*a*–3*d*) is as shown in FIG. 42. When recovery of liquid refrigerant from the discharging liquid receiver (25*a*) to the hot heat source heat exchanger (1) is made, liquid refrigerant is supplied from the indoor heat exchangers (3*a*, 3*b*) under the operation of radiating heat to the indoor heat exchangers (3*c*, 3*d*) under the operation of absorbing heat and gas refrigerant evaporated in the indoor heat exchangers (3*c*, 3*d*) is transferred to the charging liquid receiver (25*b*). Such an operation is repeated alternately between both the liquid receivers.

Since the operations in the case that all the indoor heat exchangers (3*a*–3*d*) execute the operation of radiating heat and in the case that all the indoor heat exchangers (3*a*–3*d*) execute the operation of absorbing heat are the same as in the operations described in the eleventh embodiment, description is omitted.

Modifications of Primary Refrigerant Circuit

Description has been made so far about the secondary refrigerant circuits (B). The following description will be made about plural modifications of the primary refrigerant circuit (A) combinable with the above-described secondary refrigerant circuits (B).

In the below-described modifications of the primary refrigerant circuit (A), description about the secondary refrigerant circuit (B) is omitted. Further, in the below-described circuits, same names and reference numerals refer to parts having same functions.

Thirteenth Embodiment

This thirteenth embodiment is an embodiment according to claims 61 and 62 of the invention and a modification of the primary refrigerant circuit (A) applied to a heating-only air conditioner.

Figure 43:
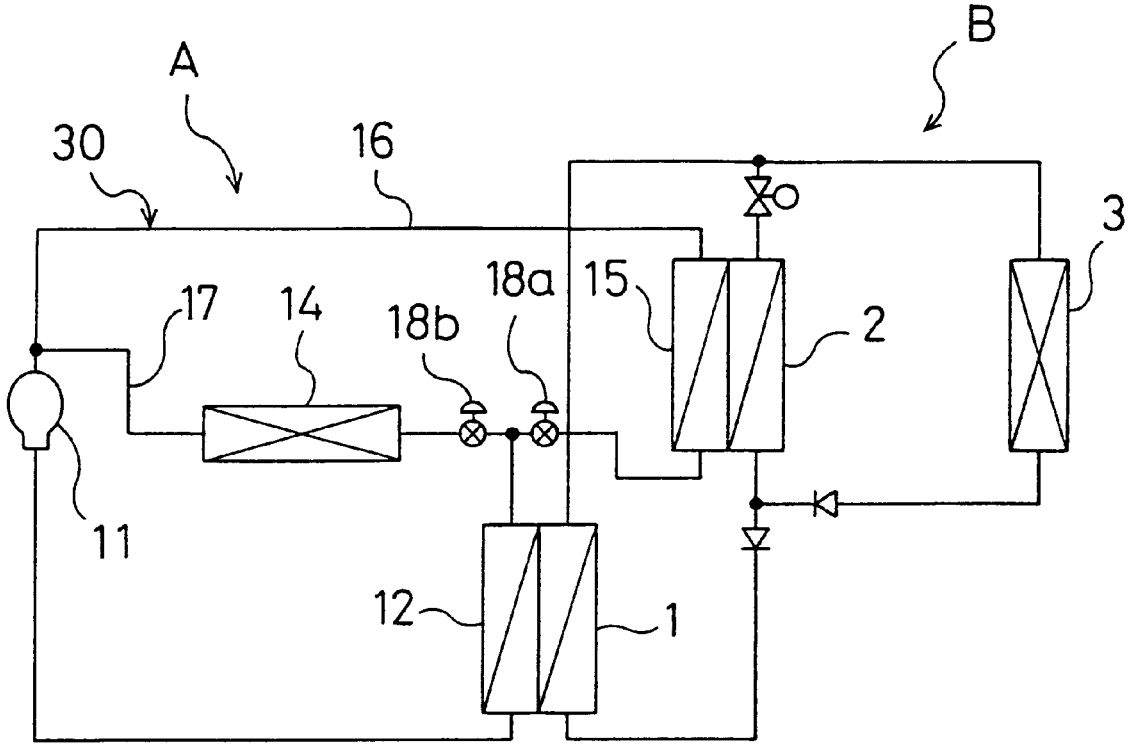
FIG. 43 is a diagram corresponding to FIG. 1 in a thirteenth embodiment of the invention.

As shown in FIG. 43, in this primary refrigerant circuit (A), a compressor (11), a heating heat exchanger (12)

capable of exchanging heat with a hot heat source heat exchanger (1), a first motor-operated valve (18*a*) as an expansion mechanism, and a cooling heat exchanger (15) for exchanging heat with a cold heat source heat exchanger (2), are connected in this order so as to be capable of circulating refrigerant through refrigerant piping (16). Thereby, a main refrigerant circulating passage (30) is formed.

A bypass passage (17) is connected at one end thereof between the motor-operated valve (18*a*) and the heating heat exchanger (12) and at the other end between the compressor (11) and the cooling heat exchanger (15). The bypass passage (17) is provided with a heat amount adjusting heat exchanger (14) and a second motor-operated valve (18*b*) as a flow control valve adjustable in opening for controlling a flow rate of refrigerant flowing into the heat amount adjusting heat exchanger (14). The motor-operated valves (18*a*, 18*b*) are each controlled in its opening by an unshown controller.

Under such a configuration, during the refrigerant circulation in the primary refrigerant circuit (A), the motor-operated valves (18*a*, 18*b*) are each controlled in its opening in accordance with a difference between an amount of heat given from the heating heat exchanger (12) to the hot heat source heat exchanger (1) and an amount of heat taken from the cold heat source heat exchanger (2) to the cooling heat exchanger (15).

Refrigerant discharged from the compressor (11) is heat-exchanged, in the heating heat exchanger (12), with the hot heat source heat exchanger (1) to condense to liquid refrigerant. In accordance with respective openings of the motor-operated valves (18*a*, 18*b*), a part of the liquid refrigerant introduced from the heating heat exchanger (12) is introduced into the main circulating passage (on the first motor-operated valve (18*a*) side) while the remaining liquid refrigerant is introduced into the bypass passage (on the second motor-operated valve (18*b*) side).

The liquid refrigerant introduced into the main circulating passage (30) is reduced in pressure in the first motor-operated valve (18*a*), and is heat-exchanged, in the cooling heat exchanger (15), with the cold heat source heat exchanger (2) to evaporate. On the other hand, the liquid refrigerant introduced into the bypass passage (17) is reduced in pressure in the second motor-operated valve (18*b*), and is heat-exchanged, in the heat amount adjusting heat exchanger (14), with, for example, outside air to evaporate. The gas refrigerant evaporated in the above manners is sucked into the compressor (11). Such a circulation of refrigerant is repeated.

Under such a circulation of refrigerant, when the opening of the motor-operated flow rate control valve (18) is set such that the amount of heat absorbed in the heat amount adjusting heat exchanger (14) becomes equal to a difference between the heat exchange amounts described above, the amount of heat radiated and the amount of heat absorbed can become equal as the overall primary refrigerant circuit (A). This achieves excellent refrigerant circulation in the primary refrigerant circuit (A).

Fourteenth Embodiment

This fourteenth embodiment is an embodiment according to claims 63 and 64 of the invention and a modification of the primary refrigerant circuit (A) applied to a cooling-only air conditioner. Described in this embodiment are only differences from the primary refrigerant circuit (A) described in the first embodiment.

Figure 44:
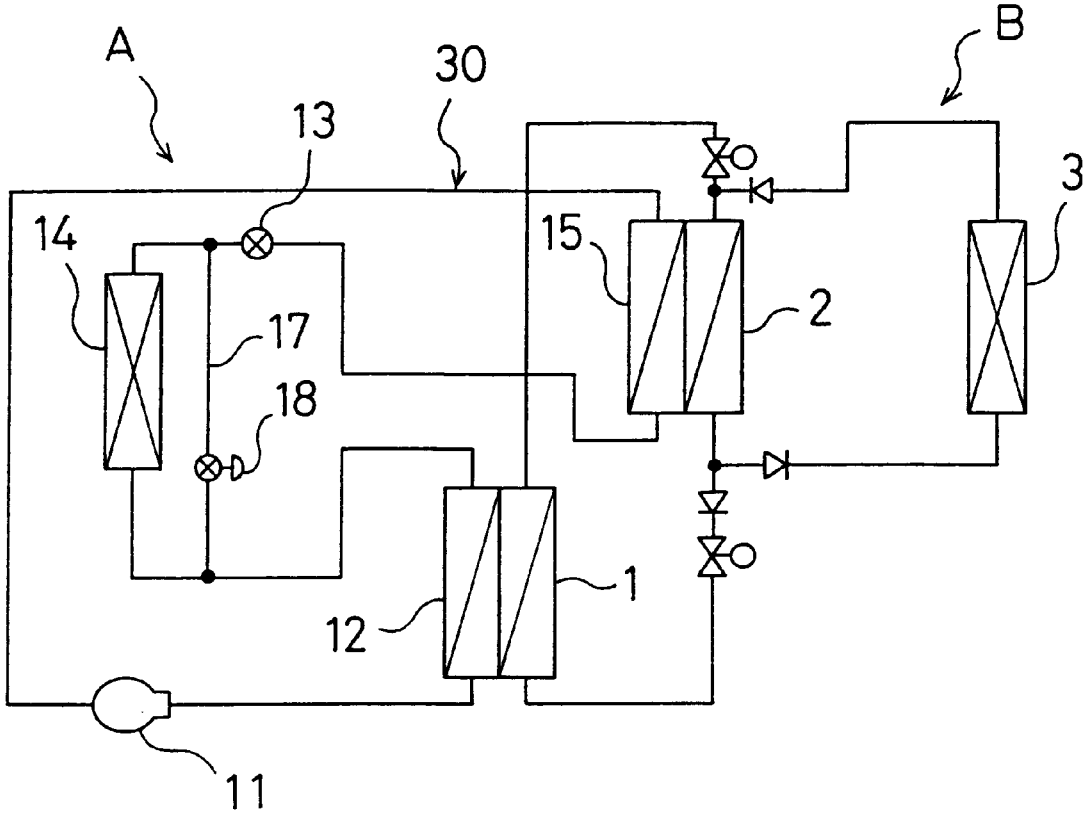
FIG. 44 is a diagram corresponding to FIG. 1 in a fourteenth embodiment of the invention.

As shown in FIG. 44, the primary refrigerant circuit (A) is configured such that an expansion valve (13) is provided between a heat amount adjusting heat exchanger (14) and a cooling heat exchanger (15) and a bypass passage (17) is connected at one end thereof between the expansion valve (13) and the heat amount adjusting heat exchanger (14) and at the other end between a heating heat exchanger (12) and the heat amount adjusting heat exchanger (14). In other words, the primary refrigerant circuit (A) is configured such that gas refrigerant is heat-exchanged, in the heat amount adjusting heat exchanger (14), with, for example, outside air to condense.

Under such a configuration, when the opening of the motor-operated flow rate control valve (18) is set such that the amount of heat radiated in the heat amount adjusting heat exchanger (14) becomes equal to a difference between an amount of heat given from the heating heat exchanger (12) to the hot heat source heat exchanger (1) and an amount of heat taken from the cold heat source heat exchanger (2) to the cooling heat exchanger (15), the amount of heat radiated and the amount of heat absorbed can become equal as the overall primary refrigerant circuit (A). This achieves excellent refrigerant circulation in the primary refrigerant circuit (A).

Fifteenth Embodiment

This fifteenth embodiment is an embodiment according to claims 65 and 66 of the invention and a modification of the primary refrigerant circuit (A) applied to a cooling-only air conditioner. Described in this embodiment are only differences from the primary refrigerant circuit (A) described in the thirteenth embodiment.

Figure 45:
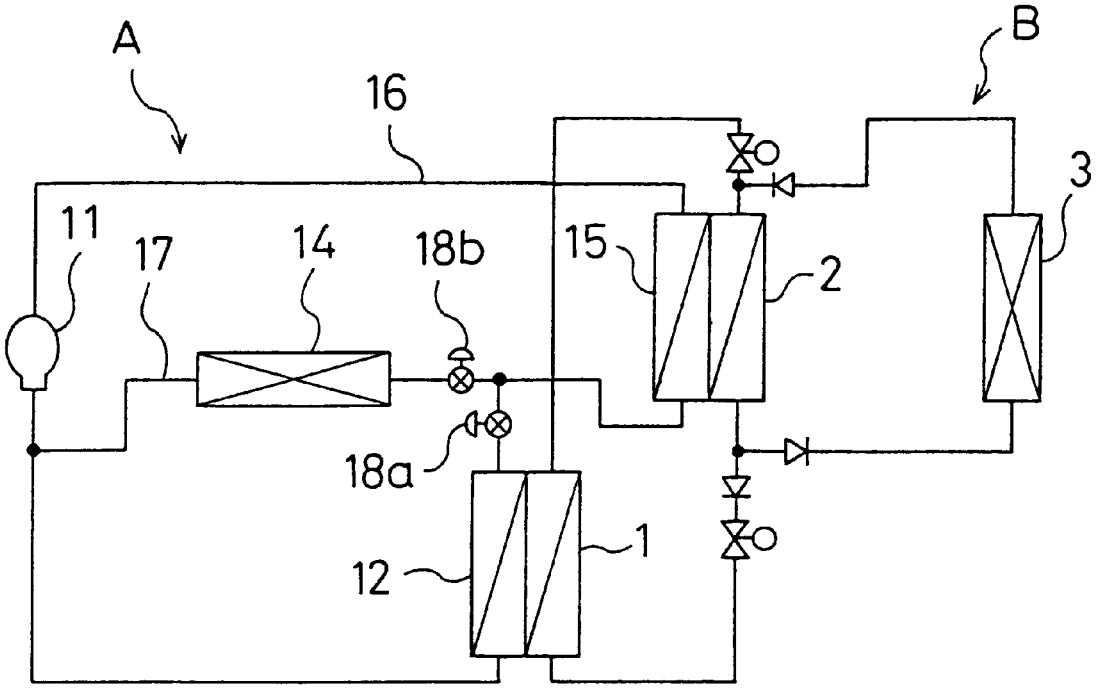
FIG. 45 is a diagram corresponding to FIG. 1 in a fifteenth embodiment of the invention.

As shown in FIG. 45, the primary refrigerant circuit (A) is configured such that a bypass passage (17) is connected at one end thereof between a first motor-operated valve (18*a*) as an expansion mechanism and a cooling heat exchanger (15) and at the other end to the discharge side of a compressor (11), i.e., between the compressor (11) and a heating heat exchanger (12). In other words, the primary refrigerant circuit (A) is configured such that gas refrigerant discharged from the compressor (11) is distributed between the heating heat exchanger (12) and the heat amount adjusting heat exchanger (14).

Under such a configuration, when the openings of the motor-operated valves (18*a*, 18*b*) are set respectively such that the amount of heat radiated in the heat amount adjusting heat exchanger (14) becomes equal to a difference between an amount of heat given from the heating heat exchanger (12) to the hot heat source heat exchanger (1) and an amount of heat taken from the cold heat source heat exchanger (2) to the cooling heat exchanger (15), the amount of heat radiated and the amount of heat absorbed can become equal as the overall primary refrigerant circuit (A). This achieves excellent refrigerant circulation in the primary refrigerant circuit (A).

Sixteenth Embodiment

This sixteenth embodiment is an embodiment according to claims 67 and 68 of the invention and a modification of the primary refrigerant circuit (A) applied to an air conditioner changeable between cooling and heating operations. Described in this embodiment are only differences from the primary refrigerant circuit (A) described in the first embodiment.

Figure 46:
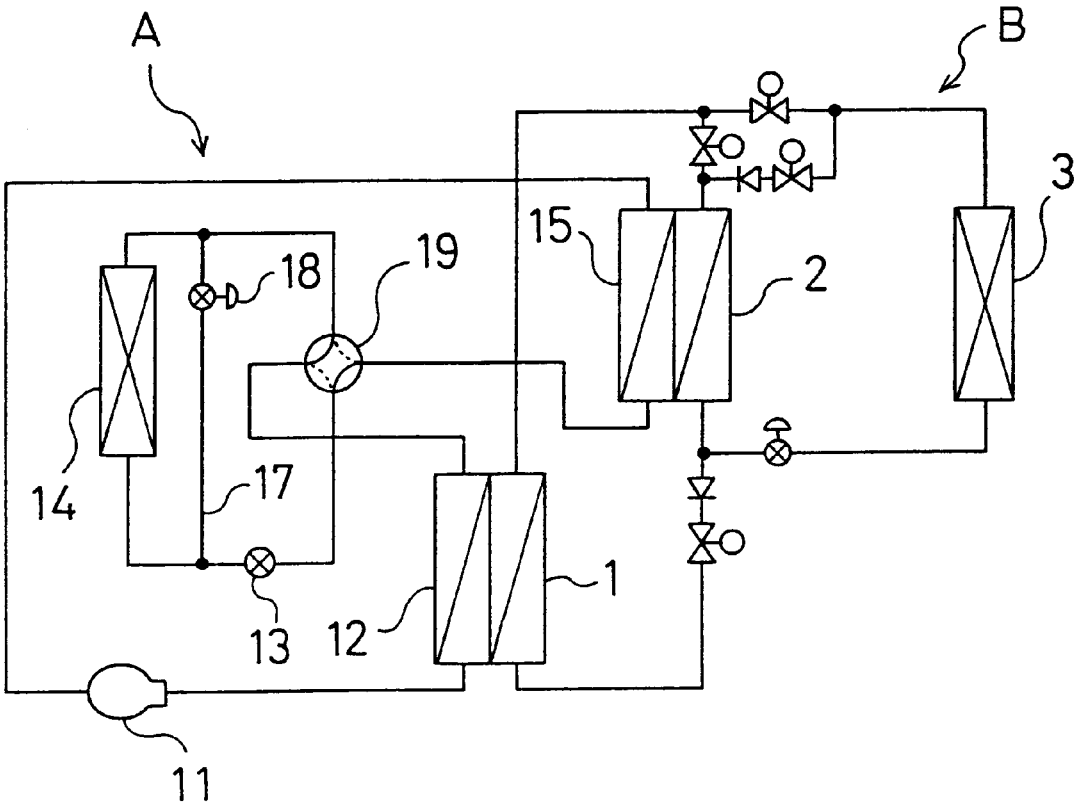
FIG. 46 is a diagram corresponding to FIG. 1 in a sixteenth embodiment of the invention.

As shown in FIG. 46, the primary refrigerant circuit (A) includes a four-way selector valve (19) selectable between (a) a first position capable of introducing liquid refrigerant from a heating heat exchanger (12) to a heat amount adjusting heat exchanger (14) and a bypass passage (17) through an expansion valve (13) and (b) a second position capable of introducing the liquid refrigerant to the expansion valve (13) through the heat amount adjusting heat exchanger

(14) and the bypass passage (17). Other structures are the same as in the first embodiment.

Under such a configuration, during the heating operation (during the operation of radiating heat of an indoor heat exchanger (3)), the four-way selector valve (19) selects the first position shown in broken lines in FIG. 46 so that refrigerant absorbs heat in the heat amount adjusting heat exchanger (14) to evaporate. The amount of heat absorbed is controlled by an motor-operated flow rate control valve (18).

On the other hand, during the cooling operation (during the operation of absorbing heat of the indoor heat exchanger (3)), the four-way selector valve (19) selects the second position shown in solid lines in FIG. 46 so that refrigerant radiates heat in the heat amount adjusting heat exchanger (14) to condense. The amount of heat radiated is controlled by the motor-operated flow rate control valve (18). Such operations allow the amount of heat radiated and the amount of heat absorbed to become equal as the overall primary refrigerant circuit (A) during either operation. This achieves excellent refrigerant circulation in the primary refrigerant circuit (A).

Figure 47:
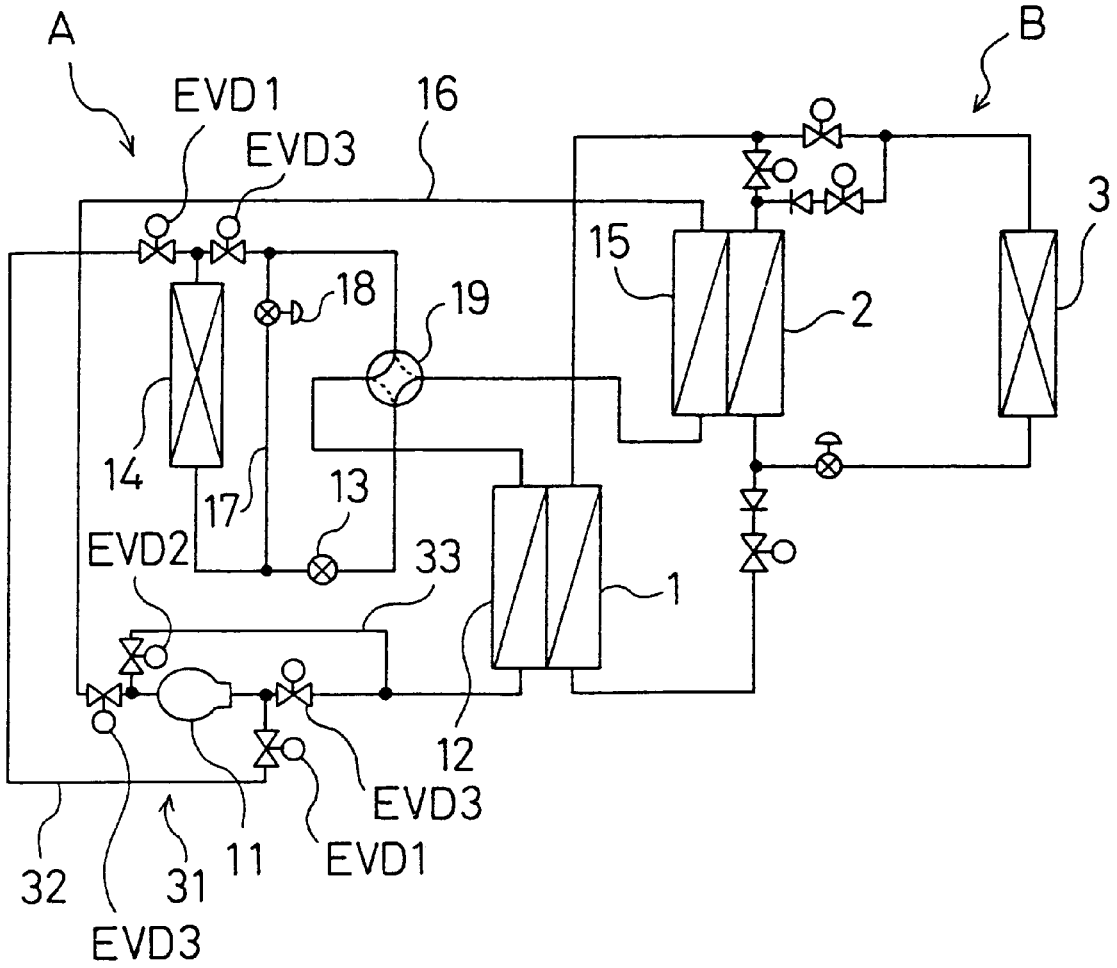
FIG. 47 is a diagram corresponding to FIG. 1 for illustrating a modification of the sixteenth embodiment including a defrosting circuit.

FIG. 47 shows a modification of the sixteenth embodiment. As shown in the figure, the modification includes a defrosting circuit (31) as defrosting means for defrosting the heat amount adjusting heat exchanger (14) when the heat amount adjusting heat exchanger (14) is frosted during the heating operation.

More specifically, a hot gas pipe (32) is connected at one end thereof between the compressor (11) and the heating heat exchanger (12) (to the discharge side of the compressor (11)) and at the other end between the heat amount adjusting heat exchanger (14) and the four-way selector valve (19). In the vicinities of both ends of the hot gas pipe (32), first solenoid valves (EVD1, EVD1) for defrosting are provided respectively.

Further, a refrigerant recovery pipe (33) is connected at one end thereof between the heating heat exchanger (12) and one end of the hot gas pipe (32) and is connected at the other end between a cooling heat exchanger (15) and the compressor (11) (to the discharge side of the compressor (11)). The refrigerant recovery pipe (33) is provided with a second solenoid valve (EDV2) for defrosting.

On the discharge side of the compressor (11), a third solenoid valve (EDV3) for defrosting is provided between a connection point of the refrigerant piping (16) with the hot gas pipe (32) and a connection point of the refrigerant piping (16) with the refrigerant recovery pipe (33). On the suction side of the compressor (11), a third solenoid valve (EDV3) for defrosting is provided between a connection point of the refrigerant piping (16) with the refrigerant recovery pipe (33) and the cooling heat exchanger (15).

Under such a configuration, when the heat amount adjusting heat exchanger (14) is frosted, the four-way selector valve (19) is changed to the position shown in broken lines in FIG. 47, the third solenoid valves (EDV3, EDV3) for defrosting are closed and the first solenoid valves (EDV1, EDV1) for defrosting and the second solenoid valve (EDV2) for defrosting are opened. Thereby, hot refrigerant discharged from the compressor (11) is introduced into the heat amount adjusting heat exchanger (14) through the hot gas pipe (32) thereby defrosting the heat amount adjusting heat exchanger (14). Thereafter, the refrigerant is recovered to the compressor (11) through the expansion valve (13), the four-way selector valve (19), the heating heat exchanger (12) and the refrigerant recovery pipe (33). Accordingly, frost on the heat amount adjusting heat exchanger (14) can be promptly eliminated. This increases air conditioning performance.

Further, such a defrosting circuit (31) can be applied to the first and thirteenth embodiments as well as the air conditioner changeable between the heating and cooling operations as in this embodiment.

Seventeenth Embodiment

This seventeenth embodiment is an embodiment according to claims 69 and 70 of the invention and a modification of the primary refrigerant circuit (A) applied to an air conditioner changeable between cooling and heating operations. Described in this embodiment are only differences from the primary refrigerant circuit (A) described in the thirteenth embodiment (See FIG. 43).

Figure 48:
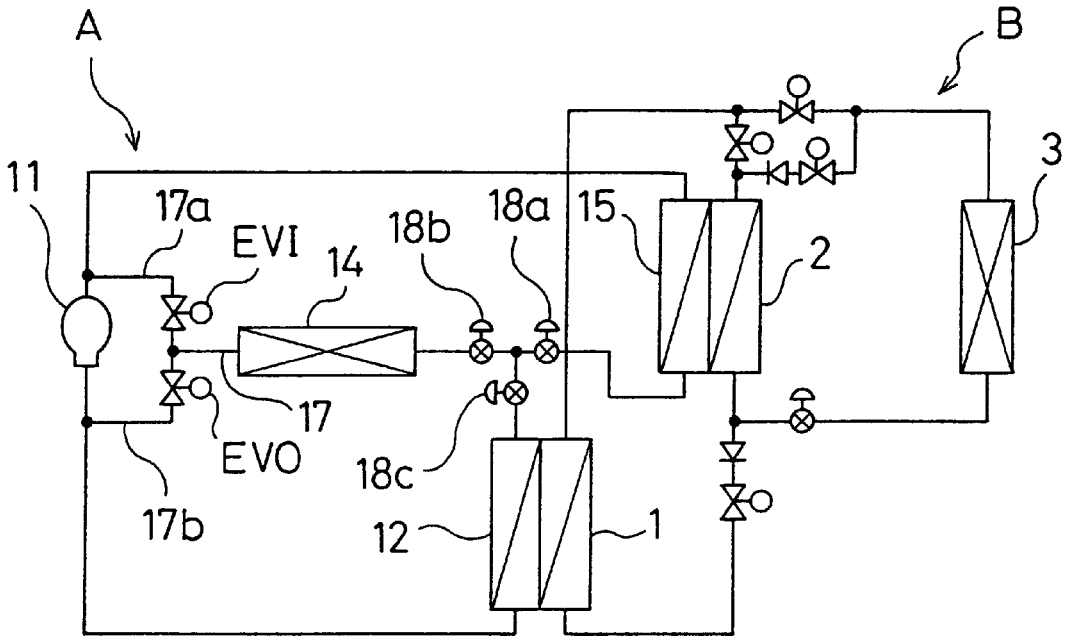
FIG. 48 is a diagram corresponding to FIG. 1 in a seventeenth embodiment of the invention.

As shown in FIG. 48, the primary refrigerant circuit (A) is configured such that a third motor-operated valve (18*c*) is provided on the discharge side of the heating heat exchanger (12), a bypass passage (17) between a compressor (11) and a heat amount adjusting heat exchanger (14) is divided into a suction side branch pipe (17*a*) and a discharge side branch pipe (17*b*), the suction side branch pipe (17*a*) is connected to the suction side of the compressor (11) and the discharge side branch pipe (17*b*) is connected to the discharge side of the compressor (11).

The suction side branch pipe (17*a*) is provided with a suction side solenoid valve (EV1) which is opened during the heating operation and is closed during the cooling operation. The discharge side branch pipe (17*b*) is provided with a discharge side solenoid valve (EVO) which is closed during the heating operation and is opened during the cooling operation. Other structures are the same as in the thirteenth embodiment.

Under such a configuration, during the heating operation (during the operation of radiating heat of an indoor heat exchanger (3)), the suction side solenoid valve (EV1) is opened and the discharge side solenoid valve (EVO) is closed so that refrigerant absorbs heat in the heat amount adjusting heat exchanger (14) to evaporate. The amount of heat absorbed is controlled by motor-operated valves (18*a*, 18*b*).

On the other hand, during the cooling operation (during the operation of absorbing heat of the indoor heat exchanger (3)), the suction side solenoid valve (EV1) is closed and the discharge side solenoid valve (EVO) is opened so that refrigerant radiates heat in the heat amount adjusting heat exchanger (14) to condense. The amount of heat radiated is controlled by the motor-operated valves (18*a*, 18*b*). Such operations allow the amount of heat radiated and the amount of heat absorbed to become equal as the overall primary refrigerant circuit (A) during either operation. This achieves excellent refrigerant circulation in the primary refrigerant circuit (A).

Figure 49:
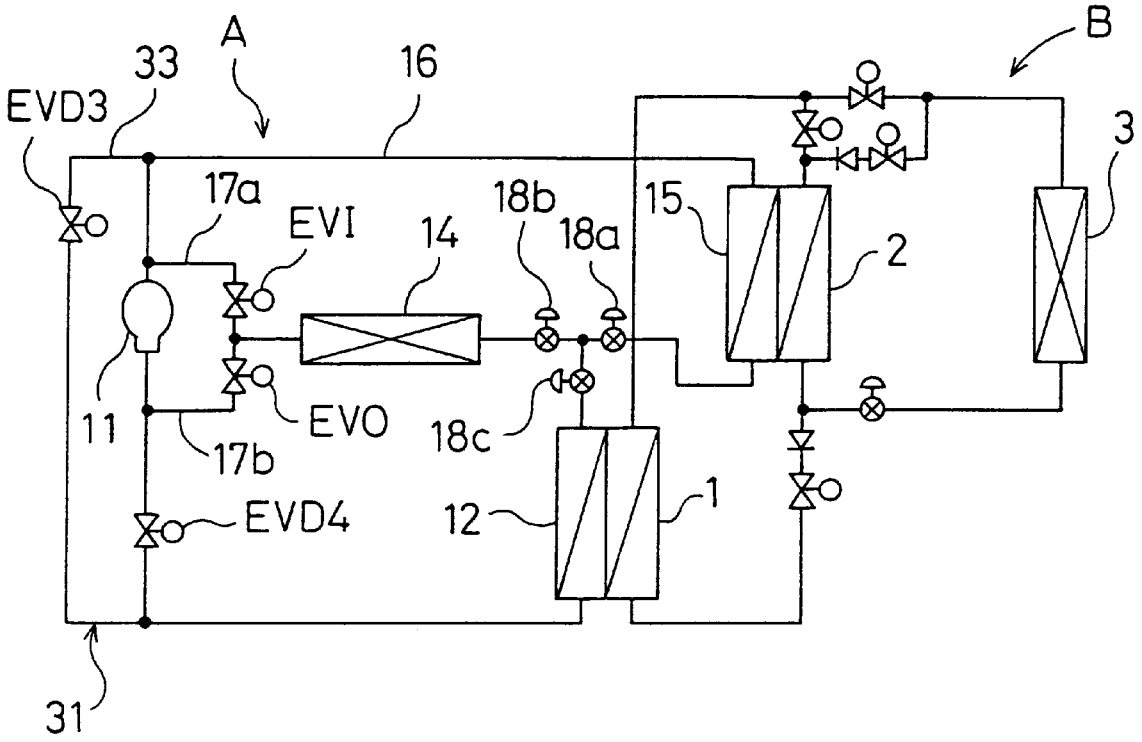
FIG. 49 is a diagram corresponding to FIG. 1 for illustrating a modification of the seventeenth embodiment including a defrosting circuit.

FIG. 49 shows a modification of the seventeenth embodiment. As shown in the figure, the modification includes a defrosting circuit (31) for defrosting the heat amount adjusting heat exchanger (14) when the heat amount adjusting heat exchanger (14) is frosted during the heating operation. More specifically, a refrigerant recovery pipe (33) is connected at one end thereof between the compressor (11) and the heating heat exchanger (12) (to the discharge side of the compressor (11)) and is connected at the other end between the compressor (11) and a cooling heat exchanger (15) (to the suction side of the compressor (11)). The refrigerant recovery pipe (33) is provided with a third solenoid valve (EDV3) for defrosting.

On the discharge side of the compressor (11), a fourth solenoid valve (EDV4) for defrosting is provided between the compressor (11) and a connection point of the refrigerant piping (16) with the refrigerant recovery pipe (33).

Under such a configuration, when the heat amount adjusting heat exchanger (14) is frosted, the suction side solenoid valve (EV1) and the fourth solenoid valve (EVD4) for defrosting are closed, and the discharge side solenoid valve (EVO) and the third solenoid valve (EVD3) for defrosting are opened.

Thereby, hot refrigerant discharged from the compressor (11) is introduced into the heat amount adjusting heat exchanger (14) through the discharge side branch pipe (17*b*) thereby defrosting the heat amount adjusting heat exchanger (14). Thereafter, the refrigerant is recovered to the compressor (11) through the second and third expansion valves (18*b*, 18*c*), the heating heat exchanger (12) and the refrigerant recovery pipe (33). Accordingly, frost on the heat amount adjusting heat exchanger (14) can be promptly eliminated. This increases air conditioning performance.

Further, such a defrosting circuit (31) can be applied to the circuit of the thirteenth embodiments as well as the air conditioner selectively operable between the heating and cooling operations as in this embodiment.

The configuration of the above-mentioned primary refrigerant circuits (A) can be applied to the ninth to twelfth embodiments including a plurality of liquid receivers (25*a*, 25*b*).

Modifications Having Plural Cold Heat Source Heat Exchangers

In the following eighteenth to twenty-third embodiments of the invention, the primary refrigerant circuit configurations in the cases that the secondary refrigerant circuits each have a plurality of cold heat source heat exchangers (two heat exchangers in the embodiments) are shown.

Eighteenth Embodiment

Figure 50:
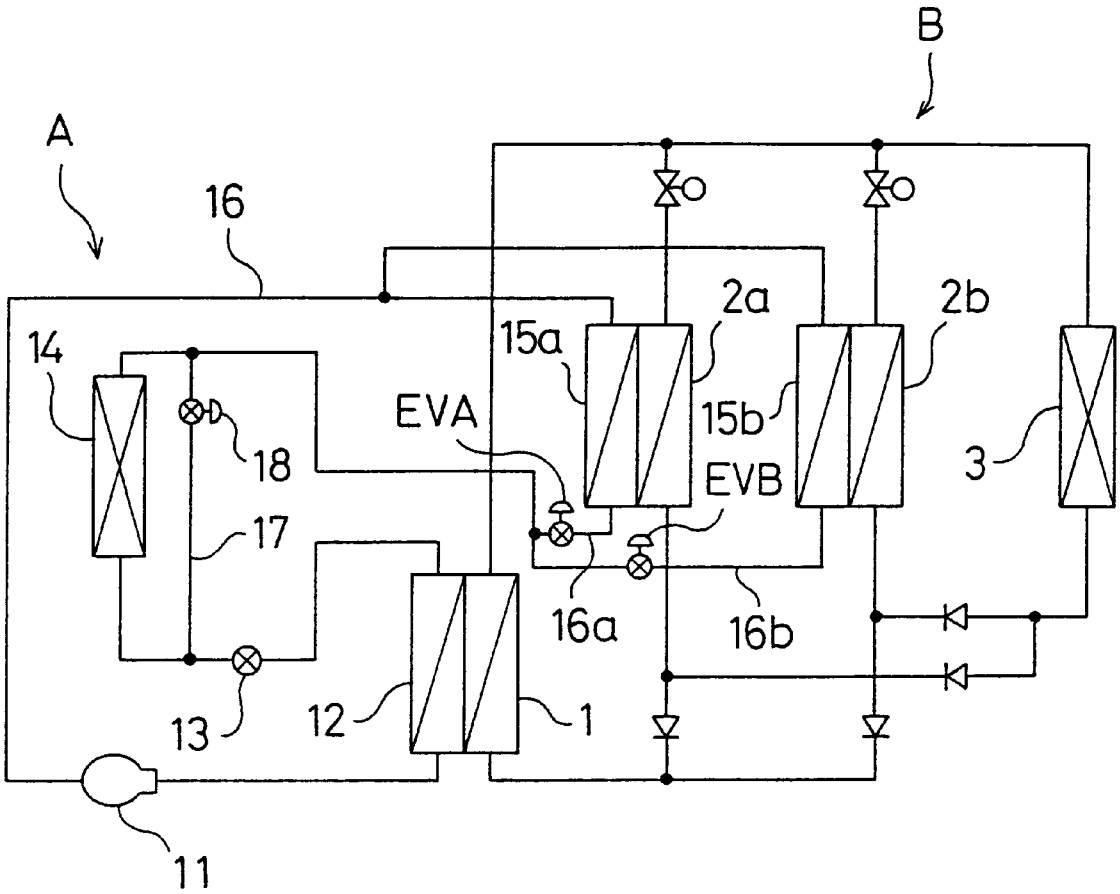
FIG. 50 is a diagram corresponding to FIG. 1 in an eighteenth embodiment of the invention.

As shown in FIG. 50, this eighteenth embodiment has the configuration that the secondary refrigerant circuit (B) of the first embodiment includes two cold heat source heat exchangers (2*a*, 2*b*). As a primary refrigerant circuit (A), same configuration as in the first embodiment (See FIG. 1) is employed.

In such a configuration, the primary refrigerant circuit (A) is configured such that cooling heat exchangers (15*a*, 15*b*) are provided in correspondence with the cold heat source heat exchangers (2*a*, 2*b*), refrigerant piping (16) is divided into branch pipes (16*a*, 16*b*) in correspondence with the cooling heat exchangers (15*a*, 15*b*) and the branch pipes (16*a*, 16*b*) are provided with motor-operated valves (EVA, EVB) for controlling flow rates of refrigerant toward the cooling heat exchangers (15*a*, 15*b*) respectively.

The configuration of the secondary refrigerant circuit (B) is the same as in the fifth embodiment (See FIG. 21).

Nineteenth Embodiment

Figure 51:
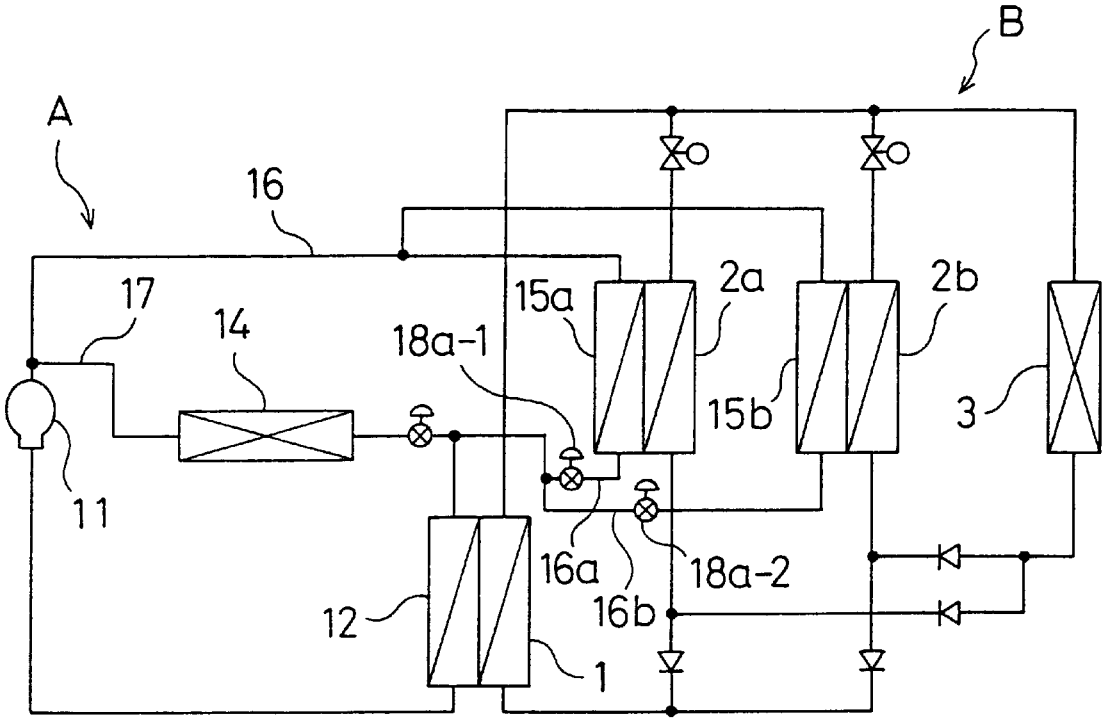
FIG. 51 is a diagram corresponding to FIG. 1 in a nineteenth embodiment of the invention.

As shown in FIG. 51, this nineteenth embodiment has the configuration that the secondary refrigerant circuit (B) of the first embodiment includes two cold heat source heat exchangers (2*a*, 2*b*). As a primary refrigerant circuit (A), same configuration as in the thirteenth embodiment (See FIG. 43) is employed.

In such a configuration, the primary refrigerant circuit (A) is configured such that branch pipes (16*a*, 16*b*) of refrigerant piping (16) are provided with second motor-operated valves (18*a*-1, 18*a*-2) for controlling flow rates of refrigerant toward cooling heat exchangers (15*a*, 15*b*) respectively. Also in this embodiment, the configuration of the secondary refrigerant circuit is the same as in the fifth embodiment (See FIG. 21).

Twentieth Embodiment

Figure 52:
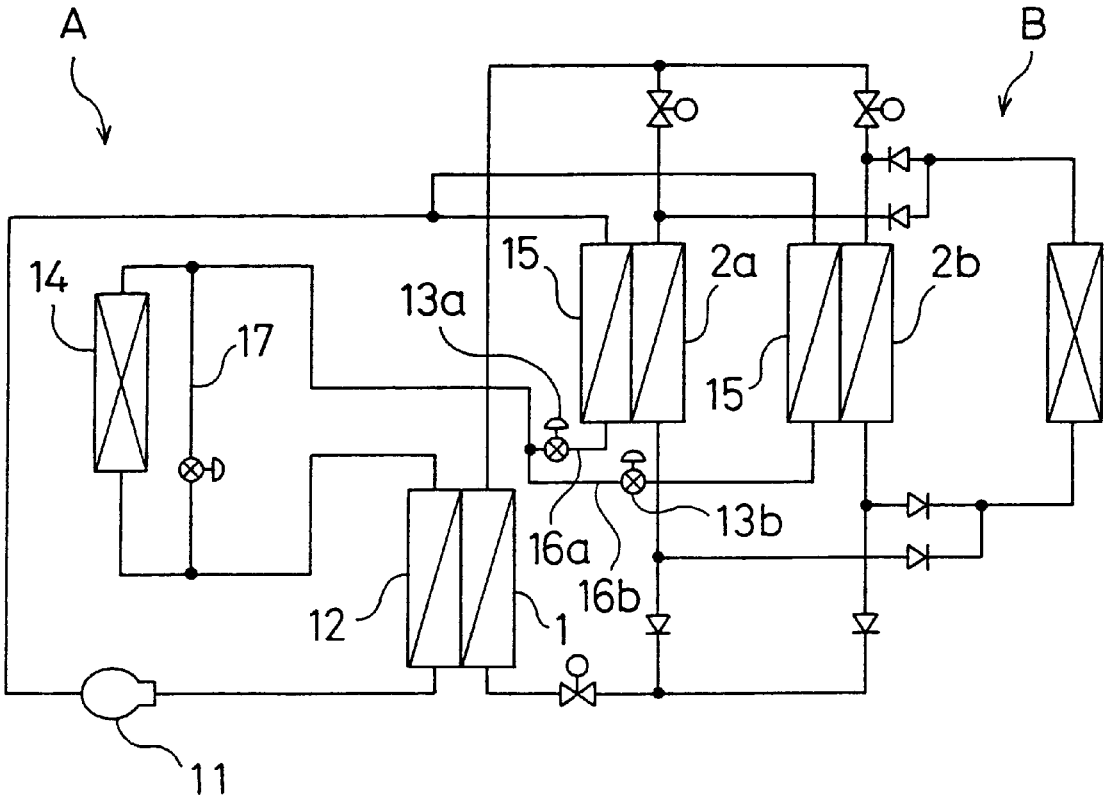
FIG. 52 is a diagram corresponding to FIG. 1 in a twentieth embodiment of the invention.

As shown in FIG. 52, this twentieth embodiment has the configuration that the secondary refrigerant circuit (B) of the fourteenth embodiment (See FIG. 44) includes two cold heat source heat exchangers (2*a*, 2*b*).

In such a configuration, a primary refrigerant circuit (A) is configured such that branch pipes (16*a*, 16*b*) of refrigerant piping (16) are provided with expansion valves (13*a*, 13*b*) for controlling flow rates of refrigerant toward cooling heat exchangers (15*a*, 15*b*) respectively. The configuration of the secondary refrigerant circuit (B) is the same as in the sixth embodiment (See FIG. 23).

Twenty-First Embodiment

Figure 53:
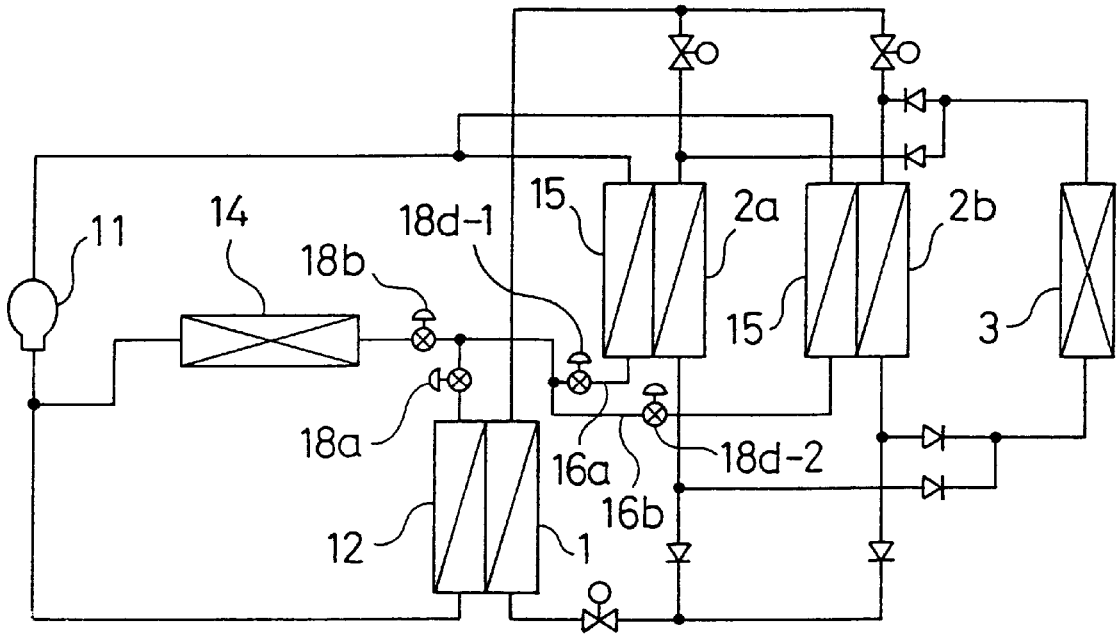
FIG. 53 is a diagram corresponding to FIG. 1 in a twenty-first embodiment of the invention.

As shown in FIG. 53, this twenty-first embodiment has the configuration that the secondary refrigerant circuit (B) of the fifteenth embodiment (See FIG. 45) includes two cold heat source heat exchangers (2*a*, 2*b*).

In such a configuration, a primary refrigerant circuit (A) is configured such that branch pipes (16*a*, 16*b*) of refrigerant piping (16) are provided with motor-operated valves (18*d*-1, 18*d*-2) for controlling flow rates of refrigerant toward cooling heat exchangers (15*a*, 15*b*) respectively. Also in this embodiment, the configuration of the secondary refrigerant circuit (B) is the same as in the sixth embodiment (See FIG. 23).

Twenty-Second Embodiment

Figure 54:
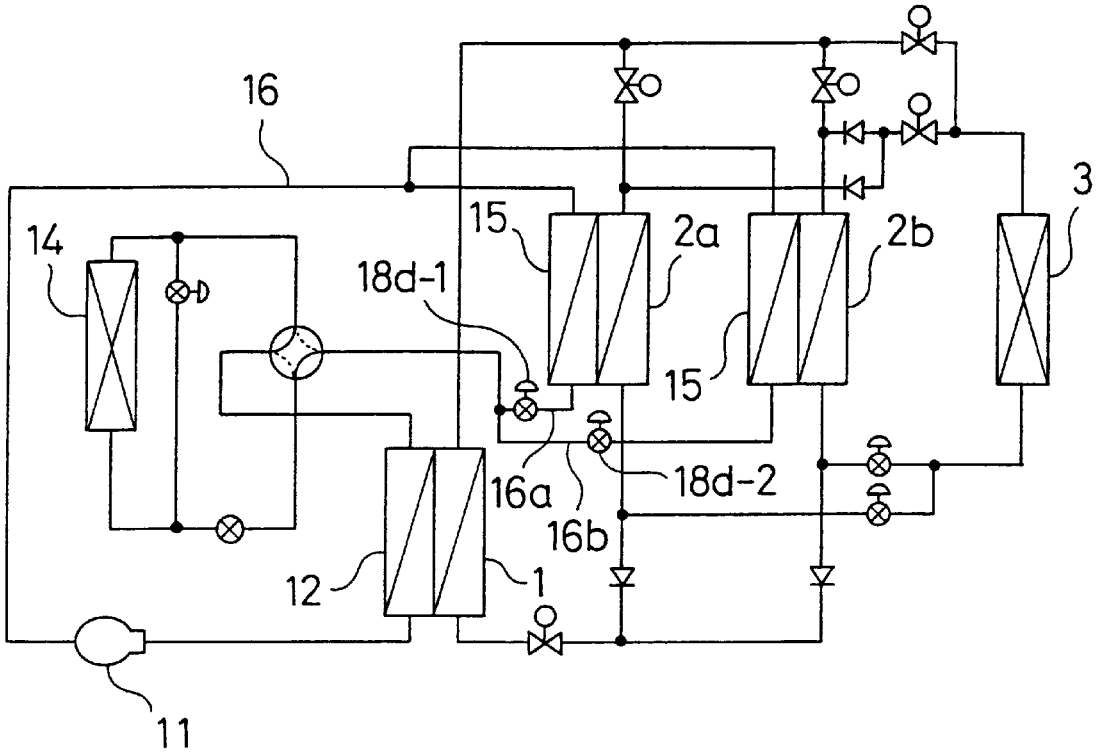
FIG. 54 is a diagram corresponding to FIG. 1 in a twenty-second embodiment of the invention.

As shown in FIG. 54, this twenty-second embodiment has the configuration that the secondary refrigerant circuit (B) of the sixteenth embodiment (See FIG. 46) includes two cold heat source heat exchangers (2*a*, 2*b*).

In such a configuration, a primary refrigerant circuit (A) is configured such that branch pipes (16*a*, 16*b*) of refrigerant piping (16) are provided with expansion valves (18*d*-1, 18*d*-2) composed of motor-operated valves for controlling flow rates of refrigerant toward cooling heat exchangers (15*a*, 15*b*) respectively. The configuration of the secondary refrigerant circuit (B) is the same as in the seventh embodiment (See FIG. 25).

Twenty-Third Embodiment

Figure 55:
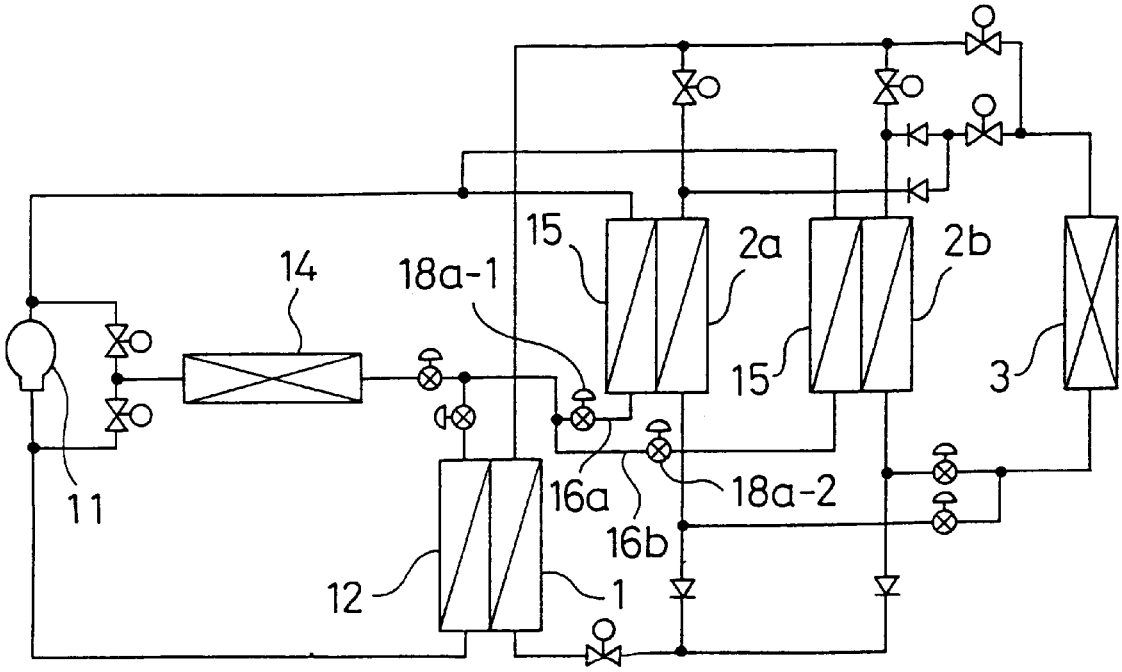
FIG. 55 is a diagram corresponding to FIG. 1 in a twenty-third embodiment of the invention.

As shown in FIG. 55, this twenty-third embodiment has the configuration that the secondary refrigerant circuit (B) of the seventeenth embodiment (See FIG. 48) includes two cold heat source heat exchangers (2*a*, 2*b*).

In such a configuration, a primary refrigerant circuit (A) is configured such that branch pipes (16*a*, 16*b*) are provided with motor-operated valves (18*a*-1, 18*a*-2) for controlling flow rates of refrigerant toward cooling heat exchangers (15*a*, 15*b*) respectively. Also in this embodiment, the configuration of the secondary refrigerant circuit (B) is the same as in the seventh embodiment (See FIG. 25).

Other Embodiments

The above embodiments describe the cases that the present invention is applied to refrigerant circuitry of air conditioners for air-conditioning one or more rooms. However, this invention is not restricted to these cases and can be applied to various kinds of refrigerating machines such as refrigerant circuitry for refrigerator.

The above-described embodiments are each configured such that the hot heat source heat exchanger (1) of the secondary refrigerant circuit (B) receives heat from refrigerant circulating in the primary refrigerant circuit (A) and the cold heat source heat exchanger (2) of the secondary refrigerant circuit (B) gives heat to refrigerant circulating in the primary refrigerant circuit (A). The heat transfer devices according to claims 1 to 58 of the invention are not limited to the above configuration, and may be configured such that a heater is disposed in the hot heat source heat exchanger (1) of the secondary refrigerant circuit (B) so as to evaporate refrigerant through the application of heat from the heater or the cold heat source heat exchanger (2) exchanges heat with outside air.

In this invention, an absorption refrigerating machine may be provided in place of the compressor (11) of the primary refrigerant circuit (A).

Industrial Applicability

As described so far, a heat transfer device of this invention is suitable for a non-power heat transfer type device necessitating no drive source and particularly useful in refrigerant circuitry for air conditioner.

We claim:

1. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein the control means (C) is configured to control the gas flow selecting means (8) and the liquid flow selecting means (9) to execute an operation of absorbing heat of the user-side means (3)

in a manner that gas refrigerant is supplied from the hot heat source means (1) to the cold heat source means (2) to push out liquid refrigerant in the cold heat source means (2) to the user-side means (3), the liquid refrigerant is evaporated in the user-side means (3) while the gas refrigerant is condensed in the cold heat source means (2), and the gas refrigerant evaporated in the user-side means (3) is transferred to the cold heat source means (2) by pressure difference between the user-side means (3) and the cold heat source means (2) caused due to drop in pressure of the cold heat source means (2).

2. A heat transfer device according to claim 1, wherein the cold heat source means (2) is placed at a position higher than that of the hot heat source means (1), and the control means (C) is configured to control the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering the liquid refrigerant in the cold heat source means (2) to the hot heat source means (1).

3. A heat transfer device according to claim 2, wherein the gas flow selecting means (8) includes: a shut-off valve (EV1) provided between the hot heat source means (1) and a connection point of the gas flow pipe (4) with the gas pipe (6); and a check valve (CVG) which is provided in the gas pipe (6) and allows a flow toward the cold heat source means (2), and the control means (C) is configured to open the shut-off valve (EV1) at the time of pushing out the liquid refrigerant from the cold heat source means (2) to the user-side means (3) and during the operation of recovering liquid refrigerant in the cold heat source means (2) and close it at the time of transfer of refrigerant from the user-side means (3) to the cold heat source means (2).

4. A heat transfer device according to claim 2, wherein the liquid flow selecting means (9) includes: a shut-off valve (EV4) provided at a recovery flow side part of the liquid flow pipe (5) between the hot heat source means (1) and a connection point with the liquid pipe (7); a first check valve (CV1) which is provided at a recovery flow side part of the liquid flow pipe (5) and allows only a flow toward the hot heat source means (1); and a second check valve (CV3) which is provided in the liquid pipe (7) and allows only a flow toward the user-side means (3), and the control means (C) is configured to close the shut-off valve (EV4) during the operation of absorbing heat of the user-side means (3) and open it during the operation of recovering liquid refrigerant in the cold heat source means (2).

5. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein the control means (C) is configured to control the gas flow selecting means (8) and the liquid flow selecting means (9) to selectively execute an operation of radiating heat of the user-side means (3) and an operation of absorbing heat of the user-side means (3) in a manner that:

during the operation of radiating heat, gas refrigerant is supplied from the hot heat source means (1) to the user-side means (3) for condensation and liquid refrigerant condensed in the user-side means (3) is transferred to the cold heat source means (2) by pressure difference between the cold heat source means (2) which condenses gas refrigerant at a temperature lower than that of the user-side means (3) and the user-side means (3); and during the operation of absorbing heat, gas refrigerant is supplied from the hot heat source means (1)

to the cold heat source means (2) to push out liquid refrigerant in the cold heat source means (2) to the user-side means (3), the liquid refrigerant is evaporated in the user-side means (3) while the gas refrigerant is condensed in the cold heat source means (2), and the gas refrigerant evaporated in the user-side means (3) is transferred to the cold heat source means (2) by pressure difference between the user-side means (3) and the cold heat source means (2) caused due to drop in pressure of the cold heat source means (2).

6. A heat transfer device according to claim 5, wherein the cold heat source means (2) is placed at a position higher than the hot heat source means (1), and the control means (C) is configured to control the gas flow selecting means (8) and the liquid flow selecting means (9) to execute an operation of recovering refrigerant when liquid refrigerant in the cold heat source means (2) exceeds a specified amount of storage during the operation of radiating heat and when liquid refrigerant in the hot heat source means (1) becomes short of a specified amount of storage during the operation of absorbing heat, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

7. A heat transfer device according to claim 6, wherein the gas flow selecting means (8) includes: a first shut-off valve (EV1) provided between the cold heat source means (2) and a connection point of the gas flow pipe (4) with the gas pipe (6); a second shut-off valve (EV2) provided in the gas pipe (6); a connecting pipe (10) whose one end is connected between the first shut-off valve (EV1) and the cold heat source means (2) and whose other end is connected between the second shut-off valve (EV2) and the user-side means (3); a third shut-off valve (EV3) provided in the connecting pipe (10); and a check valve (CVG) which is provided in the connecting pipe (10) and allows only a flow toward the cold heat source means (2), and the control means (C) is configured to allow:

the first shut-off valve (EV1) to be closed during the operation of radiating heat of the user-side means (3) and at the transfer of gas refrigerant from the user-side means (3) to the cold heat source means (2) during the operation of absorbing heat of the user-side means (3) and to be open at the time of pushing out liquid refrigerant from the cold heat source means (2) to the user-side means (3) during the operation of absorbing heat of the user-side means (3) and during the operation of recovering liquid refrigerant in the cold heat source means (2);

the second shut-off valve (EV2) to be open only during the operation of radiating heat of the user-side means (3); and the third shut-off valve (EV3) to be closed during the operation of radiating heat of the user-side means (3) and to be open during the operation of absorbing heat of the user-side means (3).

8. A heat transfer device according to claim 6, wherein the liquid flow selecting means (9) includes: a first shut-off valve (EV4) provided at a recovery flow side part of the liquid flow pipe (5) between the hot heat source means (1) and a connection point with the liquid pipe (7); a first check valve (CV1) which is provided at a recovery flow side part of the liquid flow pipe (5) and allows only a flow toward the hot heat source means (1); and a second shut-off valve (EV5) provided in the liquid pipe (7), and the control means (C) is configured to allow:

the shut-off valve (EV4) to be open during the operation of recovering liquid refrigerant in the cold heat source means (2) and to be closed during the operation of absorbing heat of the user-side means (3); and the second shut-off valve (EV5) to be open during the operation of radiating heat of the user-side means (3) and during the operation of absorbing heat of the user-side means (3) and to be closed during the operation of recovering liquid refrigerant in the cold heat source means (2).

9. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein a plurality of the user-side means (3*a*–3*d*) are provided and each of the user-side means (3*a*–3*d*) is connected to the gas flow pipe (4) and the liquid flow pipe (5) through the gas pipe (6) and the liquid pipe (7) respectively in a manner capable of individual selection between an operation of radiating heat and an operation of absorbing heat, and the control means (C) is configured to control the gas flow selecting means (8) and the liquid flow selecting means (9) to execute an operation of mainly radiating heat in which the heat balance among all the user-side means (3*a*–3*d*) is in a heat radiative condition, in a manner that;

gas refrigerant is supplied from the hot heat source means (1) to the heat-radiative user-side means (3) for condensation and the liquid refrigerant condensed in the heat-radiative user-side means (3) is transferred to the cold heat source means (2) by pressure difference between the cold heat source means (2) which condenses the gas refrigerant at a temperature lower than that of the heat-radiative user-side means (3) and the heat-radiative user-side means (3) and transferred to the heat-absorptive user-side means (3) by pressure difference between the heat-absorptive user-side means (3) and the heat-radiative user-side means (3);

while the gas refrigerant is concurrently evaporated in the heat-absorptive user-side means (3) and the gas refrigerant evaporated in the heat-absorptive user-side means (3) is transferred to the cold heat source means (2) by pressure difference between the cold heat source means (2) and the heat-absorptive user-side means (3) caused due to refrigerant condensation in the cold heat source means (2).

10. A heat transfer device according to claim 9, wherein the cold heat source means (2) is placed at a position higher than the hot heat source means (1), and the control means (C) is configured to control the gas flow selecting means (8) and the liquid flow selecting means (9) to execute an operation of recovering refrigerant when liquid refrigerant in the cold heat source means (2) exceeds a specified amount of storage, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

11. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein a plurality of the user-side means (3*a*–3*d*) are provided 20 and each of the user-side means (3*a*–3*d*) is connected to the gas flow pipe (4) and the liquid flow pipe (5) through the gas pipe (6) and the liquid pipe (7) respectively in a manner capable of individual selection between an operation of radiating heat and an operation of absorbing heat, and the control means (C) is configured to control the gas flow selecting means (8) and the liquid flow selecting means (9) to execute an operation of mainly absorbing heat in which the heat balance among all the user-side means (3*a*–3*d*) is in a heat absorptive condition, in a manner that:

gas refrigerant is supplied from the hot heat source means (1) to the cold heat source means (2) to push out liquid refrigerant in the cold heat source means (2) to the heat-absorptive user-side means (3), the liquid refrigerant is evaporated in the heat-absorptive user-side means (3) while the gas refrigerant is condensed in the cold heat source means (2), and the gas refrigerant evaporated in the heat-absorptive user-side means (3) is transferred to the cold heat source means (2) by pressure difference between the heat-absorptive user-side means (3) and the cold heat source means (2) caused due to drop in pressure of the cold heat source means (2);

while gas refrigerant is concurrently supplied from the hot heat source means (1) to the heat-radiative user-side means (3) for condensation and the liquid refrigerant condensed in the heat-radiative user-side means (3) is transferred to the cold heat source means (2) by pressure difference between the heat-radiative user-side means (3) and the cold heat source means (2) having a condensation temperature lower than that of the heat-radiative user-side means (3).

12. A heat transfer device according to claim 11, wherein the cold heat source means (2) is placed at a position higher than the hot heat source means (1), and the control means (C) is configured to control the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

13. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein a plurality of the user-side means (3*a*–3*d*) are provided and each of the user-side means (3*a*–3*d*) is connected to the gas flow pipe (4) and the liquid flow pipe (5) through the gas pipe (6) and the liquid pipe (7) respectively in a manner capable of individual selection between an operation of radiating heat and an operation of absorbing heat, the cold heat source means (2) is placed at a position higher than the hot heat source means (1), the control means (C) is configured to control the gas flow selecting means (8) and the liquid flow selecting means (9) to execute:

(a) an operation of mainly radiating heat in which the heat balance among all the user-side means (3*a*–3*d*) is in a heat radiative condition, in a manner that gas refrigerant is supplied from the hot heat source means (1) to the heat-radiative user-side means (3) for condensation and the liquid refrigerant condensed in the heat-radiative user-side means (3) is transferred to the cold heat source means (2) by pressure difference between the cold heat source means (2) which condenses the gas refrigerant at a temperature lower than that of the heat-radiative user-side means (3) and the heat-radiative user-side means (3) and to the heat-absorptive user-side means (3) by pressure difference between the heat-absorptive user-side means (3) and the heat-radiative user-side means (3), while the gas refrigerant is concurrently evaporated in the heat-absorptive user-side means (3) and the gas refrigerant evaporated in the heat-absorptive user-side means (3) is transferred to the cold heat source means (2) by pressure difference between the cold heat source means (2) and the heat-absorptive user-side means (3) caused due to refrigerant condensation in the cold heat source means (2);

(b) an operation of mainly absorbing heat in which the heat balance among all the user-side means (3*a*–3*d*) is in a heat absorptive condition, in a manner that gas refrigerant is supplied from the hot heat source means (1) to the cold heat source means (2) to push out liquid refrigerant in the cold heat source means (2) to the heat-absorptive user-side means (3), the liquid refrigerant is evaporated in the heat-absorptive user-side means (3) while the gas refrigerant is condensed in the cold heat source means (2), and the gas refrigerant evaporated in the heat-absorptive user-side means (3) is transferred to the cold heat source means (2) by pressure difference between the heat-absorptive user-side means (3) and the cold heat source means (2) caused due to drop in pressure of the cold heat source means (2), while gas refrigerant is concurrently supplied from the hot heat source means (1) to the heat-radiative user-side means (3) for condensation and the liquid refrigerant condensed in the heat-radiative user-side means (3) is transferred to the cold heat source means (2) by pressure difference between the heat-radiative user-side means (3) and the cold heat source means (2) having a condensation temperature lower than that of the heat-radiative user-side means (3); and (c) an operation of recovering refrigerant when liquid refrigerant in the cold heat source means (2) exceeds a specified amount of storage and when liquid refrigerant in the hot heat source means (1) becomes short of a specified amount of storage, in a manner that gas refrigerant is supplied from the hot heat source means (1) to the cold heat source means (2) to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

14. A heat transfer device according to claim 13, wherein the gas flow selecting means (8) includes: a first shut-off valve (EV1) provided between the cold heat source means (2) and a connection point of the gas flow pipe (4) with the gas pipe (6); second shut-off valves (EV2-1 to EV2-4) provided in the gas pipes (6*a*–6*d*) and corresponding to the user-side means (3*a*–3*d*), respectively; a plurality of connecting pipes (10*a*–10*d*) each connected at one end thereof between the first shut-off valve (EV1) and the cold heat source means (2) and at the other end between the corresponding second shut-off valve (EV2-1 to EV2-4) and the corresponding user-side means (3*a*–3*d*); third shut-off valves (EV3-1 to EV3-4) provided in the connecting pipes (10*a*–10*d*) and corresponding to the user-side means (3*a*–3*d*), respectively; and a check valve (CVG) which is provided in the connecting pipe (10*a*–10*d*) and allows only a flow toward the cold heat source means (2), and the control means (C) is configured to allow:

the first shut-off valve (EV1) to be closed during the operation of mainly radiating heat and at the transfer of gas refrigerant from the user-side means (3) to the cold heat source means (2) during the operation of mainly absorbing heat but to be open at the time of pushing out liquid refrigerant from the cold heat source means (2) to the heat-absorptive user-side means (3) during the operation of mainly absorbing heat and during the operation of recovering liquid refrigerant in the cold heat source means (2);

each of the second shut-off valves (EV2-1 to EV2-4) to be open only during the operation of radiating heat of the corresponding user-side means (3*a*–3*d*); and each of the third shut-off valves (EV3-1 to EV3-4) to be open only during the operation of absorbing heat of the corresponding user-side means (3*a*–3*d*).

15. A heat transfer device according to claim 13, wherein the liquid flow selecting means (9) includes: a first shut-off valve (EV4) provided at a recovery flow side part of the liquid flow pipe (5) between the hot heat source means (1) and a connection point with the liquid pipe (7); a check valve (CVL) which is provided at a recovery flow side part of the liquid flow pipe (5) and allows only a flow toward the hot heat source means (1); and second shut-off valves (EV5-1 to EV5-4) provided in the liquid pipes (7*a*–7*d*) and corresponding to the user-side means (3*a*–3*d*), respectively, and the control means (C) is configured to allow:

the shut-off valve (EV4) to be open during the operation of recovering liquid refrigerant in the cold heat source means (2) but to be closed during the operation of mainly absorbing heat; and each of the second shut-off valves (EV5-1 to EV5-4) to be open during the operation of radiating heat and the operation of absorbing heat of the corresponding user-side means (3*a*–3*d*) but to be closed during the operation of recovering liquid refrigerant in the cold heat source means (2).

16. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein liquid receive means (22) for storing liquid refrigerant is provided in parallel with the cold heat source means (2), and the liquid receive means (22) is connected at one end thereof between the cold heat source means (2) and a connection point of the gas flow pipe (4) with the gas pipe (6) through a branch pipe (23) and connected at the other end between the cold heat source means (2) and a connection point of the liquid flow pipe (5) with the liquid pipe (7) through a branch pipe (23).

17. A heat transfer device according to claim 16, wherein a shut-off valve (EV11) for changing a flow of refrigerant toward the cold heat source means (2) is provided between the cold heat source means (2) and a connection point of the gas flow pipe (4) with the branch pipe (23).

18. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein a plurality of the cold heat source means (2*a*, 2*b*) are provided, are connected to the hot heat source means (1) through the gas flow pipes (4*a*, 4*b*) and the liquid flow pipes (5*a*, 5*b*) respectively to each form a closed circuit with the hot heat source means (1), and are each configured to switchably serve as operating cold heat source means for executing the operation of radiating heat in a state that gas refrigerant is stored therein and as stopping cold heat source means for stopping the operation of radiating heat in a state that liquid refrigerant is stored therein, the gas flow selecting means (8) is configured to change gas refrigerant flow between each of the gas flow pipes (4*a*, 4*b*) and the gas pipe (6), and the liquid flow selecting means (9) is configured to change liquid refrigerant flow between each of the liquid flow pipes (5*a*, 5*b*) and the liquid pipe (7).

19. A heat transfer device according to claim 18, wherein each of the cold heat source means (2*a*, 2*b*) is placed at a position higher than that of the hot heat source means (1), the user-side means (3) is connected to the gas flow pipes (4*a*, 4*b*) and the liquid flow pipes (5*a*, 5*b*) through the gas pipe (6) and the liquid pipe (7) respectively, and the control means (C) is configured to control at least the gas flow selecting means (8) to execute an operation of radiating heat of the user-side means (3) in a manner that:

gas refrigerant is supplied from the hot heat source means (1) to the stopping cold heat source means (2*a*) and the user-side means (3) so that the gas refrigerant is condensed in the user-side means (3) and the liquid refrigerant condensed in the user-side means (3) is transferred to the operating cold heat source means (2*b*) by pressure difference between the operating cold heat source means (2*b*) which condenses the gas refrigerant at a temperature lower than that of the user-side means (3) and the user-side means (3);

when liquid refrigerant in the operating cold heat source means (2*b*) exceeds a specified amount of storage, the control means (C) changes the operating cold heat source means (2*b*) into the stopping cold heat source means (2*b*) to execute an operation of recovering refrigerant and changes the remaining stopping cold heat source means (2*a*) into the operating cold heat source means (2*a*), whereby the supply of gas refrigerant from the hot heat source means (1) to the operating cold heat source means (2*a*) is stopped, gas refrigerant is supplied from the hot heat source means (1) to the user-side means (3) and is condensed in the user-side means (3) thereby allowing the operation of radiating heat to be continued, and gas refrigerant is supplied from the hot heat source means (1) to the stopping cold heat source means (2*b*) to equalize pressures of the hot heat source means (1) and the stopping cold heat source means (2*b*) thereby producing a flow of liquid refrigerant from the stopping cold heat source means (2*b*) to the hot heat source means (1) to recover the liquid refrigerant in the stopping cold heat source means (2*b*) to the hot heat source means (1); and the control means (C) alternately changes each of the cold heat source means (2*a*, 2*b*) between the operating cold heat source means and the stopping cold heat source means thereby successively executing the operation of radiating heat.

20. A heat transfer device according to claim 19, wherein the gas flow selecting means (8) includes shut-off valves (EV1-1, EV1-2) which are provided between the cold heat source means (2*a*, 2*b*) and connection points of the gas flow pipes (4*a*, 4*b*) with the gas pipe (6) and correspond to the cold heat source means (2*a*, 2*b*), respectively, and the control means (C) is configured to close each of the shut-off valves (EV1-1, EV1-2) at the transfer of gas refrigerant from the user-side means (3) to the cold heat source means (2*a*, 2*b*) corresponding to the shut-off valve (EV1-1, EV1-2) and open it during the operation of recovering liquid refrigerant in the cold heat source means (2*a*, 2*b*) corresponding to the shut-off valve (EV1-1, EV1-2).

21. A heat transfer device according to claim 19, wherein the liquid flow selecting means (9) includes: first check valves (CV1-1, CV1-2) which are provided between the hot heat source means (1) and connection points of the liquid flow pipes (5*a*, 5*b*) with the liquid pipes (7*a*, 7*b*) and allow only flows toward the hot heat source means (1), respectively; and second check valves (CV2-1, CV2-2) which are provided in the liquid pipes (7*a*, 7*b*) and allows only flows toward the cold heat source means (2), respectively.

22. A heat transfer device according to claim 18, wherein the user-means (3) is connected to the gas flow pipes (4*a*, 4*b*) and the liquid flow pipes (5*a*, 5*b*) through the gas pipe (6) and the liquid pipe (7) respectively, and the control means (C) is configured to control the gas flow selecting means (8) and the liquid flow selecting means (9) to execute an operation of absorbing heat of the user-side means (3) in a manner that:

gas refrigerant is supplied from the hot heat source means (1) to the stopping cold heat source means (2*a*) to push out liquid refrigerant in the stopping cold heat source means (2*a*) to the user-side means (3), the liquid refrigerant is evaporated in the user-side means (3) while the gas refrigerant is condensed in the operating cold heat source means (2*b*), and the gas refrigerant evaporated in the user-side means (3) is transferred to the operating cold heat source means (2*b*) by pressure difference between the user-side means (3) and the operating cold heat source means (2*b*) caused due to drop in pressure of the operating cold heat source means (2*b*);

when liquid refrigerant in the operating cold heat source means (2*b*) exceeds a specified amount of storage, the control means (C) changes the operating cold heat source means (2*b*) and the remaining stopping cold heat source means (2*a*) into the stopping cold heat source means (2*b*) and the operating cold heat source means (2*a*) respectively, whereby the supply of gas refrigerant from the hot heat source means (1) to the operating cold heat source means (2*a*) is stopped while gas refrigerant is supplied from the hot heat source means (1) to the stopping cold heat source means (2*b*) to push out the liquid refrigerant in the stopping cold heat source means (2*b*) to the user-side means (3) thereby allowing the operation of absorbing heat to be continued; and the control means (C) alternately changes each of the cold heat source means (2*a*, 2*b*) between the operating cold heat source means and the stopping cold heat source means thereby successively executing the operation of absorbing heat.

23. A heat transfer device according to claim 22, wherein the cold heat source means (2*a*, 2*b*) are each placed at a position higher than that of the hot heat source means (1), and the control means (C) is configured to control the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the operating cold heat source means (2) to equalize pressures of the hot heat source means (1) and the cold heat source means (2) so that a flow of liquid refrigerant from the cold heat source means (2) to the hot heat source means (1) is produced thereby recovering the liquid refrigerant in the cold heat source means (2) to the hot heat source means (1).

24. A heat transfer device according to claim 23, wherein the gas flow selecting means (8) includes: shut-off valves (EV1-1, EV1-2) provided between the hot heat source means (1) and connection points of the gas flow pipes (4*a*, 4*b*) with the gas pipes (6*e*, 6*f*) and corresponding to the cold heat source means (2*a*, 2*b*), respectively; and check valves (CVG1, CVG2) which are provided in the gas pipes (6*e*, 6*f*) and allow only flows toward the cold heat source means (2*a*, 2*b*), respectively, and the control means (C) is configured to open each of the shut-off valves (EV1-1, EV1-2) at the time of pushing out liquid refrigerant from the cold heat source means (2*a*, 2*b*) corresponding to the shut-off valve (EV1-1, EV1-2) to the user-side means (3) and during the operation of recovering the liquid refrigerant in the cold heat source means (2*a*, 2*b*) corresponding to the shut-off valve (EV1-1, EV1-2) and close it at the transfer of gas refrigerant from the user-side means (3) to the cold heat source means (2*a*, 2*b*) corresponding to the shut-off valve (EV1-1, EV1-2).

25. A heat transfer device according to claim 23, wherein the liquid flow selecting means (9) includes: a shut-off valve (EV4) provided at a recovery flow side part of the liquid flow pipes (5*a*, 5*b*) between the hot heat source means (1) and connection points with the liquid pipes (7*e*, 7*f*); first check valves (CV1-1, CV1-2) which are provided at recovery flow side parts of the liquid flow pipes (5*a*, 5*b*) and allow only flows toward the hot heat source means (1), respectively; and second check valves (CV3-1, CV3-2) which are provided in the liquid pipes (7*e*, 7*f*) and allow only flows toward the cold heat source means (2), respectively, and the control means (C) is configured to close the shut-off valve (EV4) during the operation of absorbing heat of the user-side means (3) and open it during the operation of recovering liquid refrigerant in the cold heat source means (2).

26. A heat transfer device according to claim 18, wherein each of the cold heat source means (2*a*, 2*b*) is placed at a position higher than that of the hot heat source means (1), the user-side means (3) is connected to the gas flow pipes (4*a*, 4*b*) and the liquid flow pipes (5*a*, 5*b*) through the gas pipe (6) and the liquid pipe (7) respectively, and the control means (C) is configured to control the gas flow selecting means (8) and the liquid flow selecting means (9) to selectively execute:

(a) an operation of radiating heat of the user-side means (3) in a manner that gas refrigerant is supplied from the hot heat source means (1) to the stopping cold heat source means (2*a*) and the user-side means (3) so that the gas refrigerant is condensed in the user-side means (3) and the liquid refrigerant condensed in the user-side means (3) is transferred to the operating cold heat source means (2*b*) by pressure difference between the operating cold heat source means (2*b*) which condenses the gas refrigerant at a temperature lower than that of the user-side means (3) and the user-side means (3), when liquid refrigerant in the operating cold heat source means (2*b*) exceeds a specified amount of storage, the control means (C) changes the operating cold heat source means (2*b*) into the stopping cold heat source means (2*b*) to execute an operation of recovering refrigerant and changes the remaining stopping cold heat source means (2*a*) into the operating cold heat source means (2*a*), whereby the supply of gas refrigerant from the hot heat source means (1) to the operating cold heat source means (2*a*) is stopped, gas refrigerant is supplied from the hot heat source means (1) to the user-side means (3) and is condensed in the user-side means (3) thereby allowing the operation of radiating heat of the user-side means (3) to be continued, and gas refrigerant is supplied from the hot heat source means (1) to the stopping cold heat source means (2*b*) to equalize pressures of the hot heat source means (1) and the stopping cold heat source means (2*b*) thereby producing a flow of liquid refrigerant from the stopping cold heat source means (2*b*) to the hot heat source means (1) to recover the liquid refrigerant in the stopping cold heat source means (2*b*) to the hot heat source means (1), and the control means (C) alternately changes each of the cold heat source means (2*a*, 2*b*) between the operating cold heat source means and the stopping cold heat source means thereby successively executing the operation of radiating heat; and (b) an operation of absorbing heat of the user-side means (3) in a manner that gas refrigerant is means (1) to the e hot heat source means (1) to the stopping cold heat source means (2*a*) to push out liquid refrigerant in the stopping cold heat source means (2*a*) to the user-side means (3), the liquid refrigerant is evaporated in the user-side means (3) while the gas refrigerant is condensed in the operating cold heat source means (2*b*), and the gas refrigerant evaporated in the user-side means (3) is transferred to the operating cold heat source means (2*b*) by pressure difference between the user-side means (3) and the operating cold heat source means (2*b*) caused due to drop in pressure of the operating cold heat source means (2*b*), when liquid refrigerant in the operating cold heat source means (2*b*) exceeds a specified amount of storage, the control means (C) changes the operating cold heat source means (2*b*) and the remaining stopping cold heat source means (2*a*) into the stopping cold heat source means (2*b*) and the operating cold heat source means (2*a*) respectively, whereby the supply of gas refrigerant from the hot heat source means (1) to the operating cold heat source means (2*a*) is stopped while gas refrigerant is supplied from the hot heat source means (1) to the stopping cold heat source means (2*b*) to push out the liquid refrigerant in the stopping cold heat source means (2*b*) to the user-side means (3) thereby allowing the operation of absorbing heat of the user-side means (3) to be continued, and the control means (C) alternately changes each of the cold heat source means (2*a*, 2*b*) between the operating cold heat source means and the stopping cold heat source means thereby successively executing the operation of radiating heat.

27. A heat transfer device according to claim 26, wherein the control means (C) is configured to control the gas flow selecting means (8) and the liquid flow selecting means (9) to execute an operation of recovering refrigerant when liquid refrigerant in the hot heat source means (1) becomes short of a specified amount of storage during the operation of absorbing heat of the user-side means (3), in a manner that gas refrigerant is supplied from the hot heat source means (1) to the operating cold heat source means (2) to equalize pressures of the hot heat source means (1) and the cold heat source means (2) so that a flow of liquid refrigerant from the cold heat source means (2) to the hot heat source means (1) is produced thereby recovering liquid refrigerant in the cold heat source means (2) to the hot heat source means (1).

28. A heat transfer device according to claim 27, wherein the gas flow selecting means (8) includes: first shut-off valves (EV1-1, EV1-2) which are provided between the cold heat source means (2) and connection points of the gas flow pipes (4*a*, 4*b*) with the gas pipe (6) and correspond to the cold heat source means (2*a*, 2*b*), respectively; a second shut-off valve (EV2) provided in the gas pipe (6); a connecting pipe (20) connected at one end thereof between the first shut-off valves (EV1-1, EV1-2) and the cold heat source means (2*a*, 2*b*) and at the other end between the second shut-off valve (EV2) and the user-side means (3); a third shut-off valve (EV3) provided in the connecting pipe (20); and check valves (CVG1, CVG2) which are provided in the connecting pipe (20) and allow only flows toward the cold heat source means (2*a*, 2*b*), respectively, and the control means (C) is configured to allow:

each of the first shut-off valves (EV1-1, EV1-2) to be closed at the transfer of liquid refrigerant from the user-side means (3) to the cold heat source means (2*a*, 2*b*) corresponding to the first shut-off valve (EV1-1, EV1-2) during the operation of radiating heat and at the transfer of gas refrigerant from the user-side means (3) to the cold heat source means (2*a*, 2*b*) corresponding to the first shut-off valve (EV1-1, EV1-2) during the operation of absorbing heat but to be open at the supply of gas refrigerant from the hot heat source means (1) to the cold heat source means (2*a*, 2*b*) corresponding to the first shut-off valve (EV1-1, EV1-2) during the operation of absorbing heat; the second shut-off valve (EV2) to be open only during the operation of radiating heat of the user-side means (3); and the third shut-off valve (EV3) to be open only during the operation of absorbing heat of the user-side means (3).

29. A heat transfer device according to claim 27, wherein the liquid flow selecting means (9) includes: a first shut-off valve (EV4) provided at a recovery flow side part of the liquid flow pipes (5*a*, 5*b*) between the hot heat source means (1) and connection points with the liquid pipes (7*e*, 7*f*); check valves (CV1-1, CV1-2) which are provided at recovery flow side parts of the liquid flow pipes (5*a*, 5*b*) and allow only flows toward the hot heat source means (1), respectively; and second shut-off valves (EV6-1, EV6-2) which are provided in the liquid pipes (7*e*, 7*f*) and correspond to the cold heat source means (2*a*, 2*b*), respectively, and the control means (C) is configured to allow:

the shut-off valve (EV4) to be open during the operation of recovering liquid refrigerant in the cold heat source means (2*a*, 2*b*) but to be closed during the operation of absorbing heat of the user-side means (3); each of the second shut-off valves (EV6-1, EV6-2) to be open at the transfer of liquid refrigerant from the user-side means (3) to the cold heat source means (2a, 2b) corresponding to the second shut-off valve (EV6-1, EV6-2) during the operation of radiating heat and at the time of pushing out liquid refrigerant from the cold heat source means (2a, 2b) corresponding to the second shut-off valve (EV6-1, EV6-2) to the user-side means (3) during the operation of absorbing heat; and each of the second shut-off valves (EV6-1, EV6-2) to be closed at the supply of gas refrigerant from the hot heat source means (1) to the cold heat source means (2a, 2b) corresponding to the second shut-off valve (EV6-1, EV6-2) during the operation of radiating heat and at the transfer of gas refrigerant from the user-side means (3) to the cold heat source means (2a, 2b) corresponding to the second shut-off valve (EV6-1, EV6-2) during the operation of absorbing heat.

30. A heat transfer device according to claim 18, wherein a plurality of the user-side means (3a–3d) are provided and each of the user-side means (3a–3d) is connected to the gas flow pipes (4a, 4b) and the liquid flow pipes (5a, 5b) through the gas pipe (6) and the liquid pipes (7e, 7f) respectively in a manner capable of individual selection between an operation of radiating heat and an operation of absorbing heat, each of the cold heat source means (2a, 2b) is placed at a position higher than that of the hot heat source means (1), and the control means (C) is configured to control the gas flow selecting means (8) and the liquid flow selecting means (9) to execute an operation of mainly radiating heat in which the heat balance among all the user-side means (3a–3d) is in a heat radiative condition, in a manner that:

gas refrigerant is supplied from the hot heat source means (1) to the stopping cold heat source means (2a) and the heat-radiative user-side means (3) so that the gas refrigerant is condensed in the user-side means (3) and the liquid refrigerant condensed in the heat-radiative user-side means (3) is transferred to the operating cold heat source means (2b) by pressure difference between the operating cold heat source means (2b) which condenses the gas refrigerant at a temperature lower than that of the heat-radiative user-side means (3) and the heat-radiative user-side means (3) and transferred to the heat-absorptive user-side means (3) by pressure difference between the heat-absorptive user-side means (3) and the heat-radiative user-side means (3);

while the gas refrigerant is concurrently evaporated in the heat-absorptive user-side means (3) and the gas refrigerant evaporated in the heat-absorptive user-side means (3) is transferred to the operating cold heat source means (2b) by pressure difference between the operating cold heat source means (2b) and the heat-absorptive user-side means (3) caused due to refrigerant condensation in the operating cold heat source means (2b);

when liquid refrigerant in the operating cold heat source means (2b) exceeds a specified amount of storage, the control means (C) changes the operating cold heat source means (2b) into the stopping cold heat source means (2b) to execute an operation of recovering refrigerant and changes the remaining stopping cold heat source means (2a) into the operating cold heat source means (2a), whereby the supply of gas refrigerant from the hot heat source means (1) to the operating cold heat source means (2a) is stopped, gas refrigerant is supplied from the hot heat source means (1) to the heat-radiative user-side means (3) and is condensed in the heat-radiative user-side means (3) thereby allowing the operation of mainly radiating heat to be continued, and gas refrigerant is supplied from the hot heat source means (1) to the stopping cold heat source means (2b) to equalize pressures of the hot heat source means (1) and the stopping cold heat source means (2b) thereby producing a flow of liquid refrigerant from the stopping cold heat source means (2b) to the hot heat source means (1) to recover the liquid refrigerant in the stopping cold heat source means (2b) to the hot heat source means (1); and the control means (C) alternately changes each of the cold heat source means (2a, 2b) between the operating cold heat source means and the stopping cold heat source means thereby successively executing the operation of mainly radiating heat.

31. A heat transfer device according to claim 18, wherein a plurality of the user-side means (3a–3d) are provided and each of the user-side means (3a –3d) is connected to the gas flow pipes (4a, 4b) and the liquid flow pipes (5a, 5b) through the gas pipe (6) and the liquid pipes (7e, 7f) respectively in a manner capable of individual selection between an operation of radiating heat and an operation of absorbing heat, and the control means (C) is configured to control the gas flow selecting means (8) and the liquid flow selecting means (9) to execute an operation of mainly absorbing heat in which the heat balance among all the user-side means (3a–3d) is in a heat absorptive condition, in a manner that:

gas refrigerant is supplied from the hot heat source means (1) to the heat-radiative user-side means (3) and is condensed in the user-side means (3) and the liquid refrigerant condensed in the heat-radiative user-side means (3) is transferred to the heat-absorptive user-side means (3) by pressure difference between the heat-radiative user-side means (3) and the heat-absorptive user-side means (3) while gas refrigerant is supplied from the hot heat source means (1) to the stopping cold heat source means (2a) to push out liquid refrigerant in the stopping cold heat source means (2a) to the heat-absorptive user-side means (3);

the liquid refrigerant is evaporated in the heat-absorptive user-side means (3) while gas refrigerant is condensed in the operating cold heat source means (2b), and the gas refrigerant evaporated in the heat-absorptive user-side means (3) is transferred to the operating cold heat source means (2b) by pressure difference between the heat-absorptive user-side means (3) and the operating cold heat source means (2b) caused due to drop in pressure of the operating cold heat source means (2b);

when liquid refrigerant in the operating cold heat source means (2b) exceeds a specified amount of storage, the control means (C) changes the operating cold heat source means (2b) and the remaining stopping cold heat source means (2a) into the stopping cold heat source means (2b) and the operating cold heat source means (2a) respectively, whereby the supply of gas refrigerant from the hot heat source means (1) to the operating cold heat source means (2*a*) is stopped while gas refrigerant is supplied from the hot heat source means (1) to the stopping cold heat source means (2*b*) and the heat-radiative user-side means (3) so that the liquid refrigerant in the stopping cold heat source means (2*b*) is pushed out to the heat-absorptive user-side means (3) thereby allowing the operation of mainly absorbing heat to be continued; and the control means (C) alternately changes each of the cold heat source means (2*a*, 2*b*) between the operating cold heat source means and the stopping cold heat source means thereby successively executing the operation of mainly absorbing heat.

32. A heat transfer device according to claim 31, wherein each of the cold heat source means (2*a*, 2*b*) is placed at a position higher than that of the hot heat source means (1), and the control means (C) is configured to control the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the operating cold heat source means (2*a*, 2*b*) to equalize pressures of the hot heat source means (1) and each of the cold heat source means (2*a*, 2*b*) so that a flow of liquid refrigerant from the cold heat source means (2*a*, 2*b*) to the hot heat source means (1) is produced thereby recovering liquid refrigerant in the cold heat source means (2*a*, 2*b*) to the hot heat source means (1).

33. A heat transfer device according to claim 18, wherein a plurality of the user-side means (3*a*–3*d*) are provided and each of the user-side means (3*a*–3*d*) is connected to the gas flow pipes (4*a*, 4*b*) and the liquid flow pipes (5*a*, 5*b*) through the gas pipe (6) and the liquid pipes (7*e*, 7*f*) respectively in a manner capable of individual selection between an operation of radiating heat and an operation of absorbing heat, each of the cold heat source means (2*a*, 2*b*) is placed at a position higher than that of the hot heat source means (1), and the control means (C) is configured to control the gas flow selecting means (8) and the liquid flow selecting means (9) to execute:

(a) an operation of mainly radiating heat in which the heat balance among all the user-side means (3*a*–3*d*) is in a heat radiative condition, in a manner that gas refrigerant is supplied from the hot heat source means (1) to the stopping cold heat source means (2*a*) and the heat-radiative user-side means (3) so that the gas refrigerant is condensed in the user-side means (3) and the liquid refrigerant condensed in the heat-radiative user-side means (3) is transferred to the operating cold heat source means (2*b*) by pressure difference between the operating cold heat source means (2*b*) which condenses the gas refrigerant at a temperature lower than that of the heat-radiative user-side means (3) and the heat-radiative user-side means (3) and transferred to the heat-absorptive user-side means (3) by pressure difference between the heat-absorptive user-side means (3) and the heat-radiative user-side means (3), and while the gas refrigerant is concurrently evaporated in the heat-absorptive user-side means (3) and the gas refrigerant evaporated in the heat-absorptive user-side means (3) is transferred to the operating cold heat source means (2*b*) by pressure difference between the operating cold heat source means (2*b*) and the heat-absorptive user-side means (3) caused due to refrigerant condensation in the operating cold heat source means (2*b*), when liquid refrigerant in the operating cold heat source means (2*b*) exceeds a specified amount of storage, the control means (C) changes the operating cold heat source means (2*b*) into the stopping cold heat source means (2*b*) to execute an operation of recovering refrigerant and changes the remaining stopping cold heat source means (2*a*) into the operating cold heat source means (2*a*), whereby the supply of gas refrigerant from the hot heat source means (1) to the operating cold heat source means (2*a*) is stopped, gas refrigerant is supplied from the hot heat source means (1) to the heat-radiative user-side means (3) and is condensed in the heat-radiative user-side means (3) thereby allowing the operation of mainly radiating heat to be continued, and gas refrigerant is supplied from the hot heat source means (1) to the stopping cold heat source means (2*b*) to equalize pressures of the hot heat source means (1) and the stopping cold heat source means (2*b*) thereby producing a flow of liquid refrigerant from the stopping cold heat source means (2*b*) to the hot heat source means (1) to recover the liquid refrigerant in the stopping cold heat source means (2*b*) to the hot heat source means (1), and the control means (C) alternately changes each of the cold heat source means (2*a*, 2*b*) between the operating cold heat source means and the stopping cold heat source means thereby successively executing the operation of mainly radiating heat; and (b) an operation of mainly absorbing heat in which the heat balance among all the user-side means (3*a*–3*d*) is in a heat absorptive condition, in a manner that gas refrigerant is supplied from the hot heat source means (1) to the heat-radiative user-side means (3) and is condensed in the user-side means (3) and the liquid refrigerant condensed in the heat-radiative user-side means (3) is transferred to the heat-absorptive user-side means (3) by pressure difference between the heat-radiative user-side means (3) and the heat-absorptive user-side means (3) while gas refrigerant is supplied from the hot heat source means (1) to the stopping cold heat source means (2*a*) to push out liquid refrigerant in the stopping cold heat source means (2*a*) is pushed out to the heat-absorptive user-side means (3), the liquid refrigerant is evaporated in the heat-absorptive user-side means (3) while gas refrigerant is condensed in the operating cold heat source means (2*b*), and the gas refrigerant evaporated in the heat-absorptive user-side means (3) is transferred to the operating cold heat source means (2*b*) by pressure difference between the heat-absorptive user-side means (3) and the operating cold heat source means (2*b*) caused due to drop in pressure of the operating cold heat source means (2*b*), when liquid refrigerant in the operating cold heat source means (2*b*) exceeds a specified amount of storage, the control means (C) changes the operating cold heat source means (2*b*) and the remaining stopping cold heat source means (2*a*) into the stopping cold heat source means (2*b*) into the operating cold heat source means (2*a*) respectively, whereby the supply of gas refrigerant from the hot heat source means (1) to the operating cold heat source means (2*a*) is stopped while gas refrigerant is supplied from the hot heat source means (1) to the stopping cold heat source means (2*b*) and the heat-radiative user-side means (3) so that the liquid refrigerant in the stopping cold heat source means (2*b*) is pushed out to the heat-absorptive user-side means (3) thereby allowing the operation of mainly absorbing heat to be continued, and the control means (C) alternately changes each of the cold heat source means (2*a*, 2*b*) between the operating cold heat source means and the stopping cold heat source means thereby successively executing the operation of mainly absorbing heat.

34. A heat transfer device according to claim 33, wherein the gas flow selecting means (8) includes: first shut-off valves (EV1-1, EV1-2) which are provided between the cold heat source means (2*a*, 2*b*) and connection points of the gas flow pipes (4*a*, 4*b*) with the gas pipe (6) and correspond to the cold heat source means (2*a*, 2*b*), respectively; second shut-off valves (EV2-1 to EV2-4) provided in the gas pipes (6*a*–6*d*) and corresponding to the user-side means (3*a*–3*d*), respectively; a plurality of connecting pipes (20) which are connected at one side thereof between the first shut-off valves (EV1-1, EV1-2) and the cold heat source means (2*a*, 2*b*) respectively and connected at the other side between the second shut-off valves (EV2-1 to EV2-4) and the user-side means (3*a*–3*d*) respectively; third shut-off valves (EV3-1 to EV3-4) provided in the connecting pipes (20) and corresponding to the user-side means (3*a*–3*d*), respectively; and check valves (CVG1, CVG2) which are provided in the connecting pipes (20) and allow only flows toward the cold heat source means (2*a*, 2*b*), respectively, and the control means (C) is configured to allow:

each of the first shut-off valves (EV1-1, EV1-2) to be closed at the transfer of liquid refrigerant from the heat-radiative user-side means (3) to the cold heat source means (2*a*, 2*b*) corresponding to the first shut-off valve (EV1-1, EV1-2) during the operation of mainly radiating heat and at the transfer of gas refrigerant from the heat-absorptive user-side means (3) to the cold heat source means (2*a*, 2*b*) corresponding to the first shut-off valve (EV1-1, EV1-2) during the operation of mainly absorbing heat, but to be open at the supply of gas refrigerant from the hot heat source means (1) to the cold heat source means (2*a*, 2*b*) corresponding to the first shut-off valve (EV1-1, EV1-2);

each of the second shut-off valves (EV2-1 to EV2-4) to be open only during the operation of radiating heat of the user-side means (3) corresponding to the second shut-off valve (EV2-1 to EV2-4); and each of the third shut-off valves (EV3-1 to EV3-4) to be open only during the operation of absorbing heat of the user-side means (3) corresponding to the third shut-off valve (EV3-1 to EV3-4).

35. A heat transfer device according to claim 33, wherein the liquid flow selecting means (9) includes: a first shut-off valve (EV4) provided at a recovery flow side part of the liquid flow pipes (5*a*, 5*b*) between the hot heat source means (1) and connection points with the liquid pipes (7*e*, 7*f*); check valves (CV1-1, CV1-2) which are provided at recovery flow side parts of the liquid flow pipes (5*a*, 5*b*) and allow only flows toward the hot heat source means (1), respectively; and second shut-off valves (EV6-1, EV6-2) provided in the liquid pipes (7*e*, 7*f*) and corresponding to the cold heat source means (2*a*, 2*b*), respectively, and the control means (C) is configured to allow:

the shut-off valve (EV4) to be open only during the operation of recovering liquid refrigerant in the cold heat source means (2*a*, 2*b*);

each of the second shut-off valves (EV6-1, EV6-2) to be open at the transfer of refrigerant from the heat-radiative user-side means (3) to the cold heat source means (2*a*, 2*b*) corresponding to the second shut-off valve (EV6-1, EV6-2) during the operation of mainly radiating heat and at the time of pushing out liquid refrigerant from the cold heat source means (2*a*, 2*b*) corresponding to the second shut-off valve (EV6-1, EV6-2) to the heat-absorptive user-side means (3); and and each of the second shut-off valves (EV6-1, EV6-2) to be closed at the supply of gas refrigerant from the hot heat source means (1) to the cold heat source means (2*a*, 2*b*) corresponding to the second shut-off valve (EV6-1, EV6-2) during the operation of mainly radiating heat and at the transfer of gas refrigerant from the heat-absorptive user-side means (3) to the cold heat source means (2*a*, 2*b*) corresponding to the second shut-off valve (EV6-1, EV6-2) during the operation of mainly absorbing heat.

36. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein a plurality of liquid receive means (25*a*, 25*b*) for storing liquid refrigerant are provided, are connected to the gas flow pipes (4*a*, 4*b*) and the liquid flow pipes (5*a*, 5*b*) through gas pipes (26*a*, 26*b*) and liquid pipes (27*a*, 27*b*) respectively and are each configured to switchably serve as charging liquid receive means for storing liquid refrigerant from a state that the storage amount of gas refrigerant is large and as discharging liquid receive means for discharging liquid refrigerant in a state that the storage amount of liquid refrigerant is large, the gas flow selecting means (8) is configured to change gas refrigerant flow between each of the gas flow pipes (4*a*, 4*b*) and the corresponding gas pipe (26*a*, 26*b*), and the liquid flow selecting means (9) is configured to change liquid refrigerant flow between each of the liquid flow pipes (5*a*, 5*b*) and the corresponding liquid pipe (27*a*, 27*b*).

37. A heat transfer device according to claim 36, wherein each of the liquid receive means (25*a*, 25*b*) is placed at a position higher than that of the hot heat source means (1), and the control means (C) is configured to control at least the gas flow selecting means (8) to execute an operation of radiating heat of the user-side means (3) in a manner that:

gas refrigerant is supplied from the hot heat source means (1) to the discharging liquid receive means (25*a*) and the user-side means (3) so that the gas refrigerant is condensed in the user-side means (3) and the liquid refrigerant condensed in the user-side means (3) is transferred to the charging liquid receive means (25*b*) by pressure difference between the cold heat source means (2) which condenses the gas refrigerant at a temperature lower than that of the user-side means (3) and the user-side means (3);

when liquid refrigerant in the charging liquid receive means (25*b*) exceeds a specified amount of storage, the control means (C) changes the charging liquid receive means (25*b*) into the discharging liquid receive means (25*b*) to execute an operation of recovering refrigerant and changes the remaining discharging liquid receive means (25*a*) into the charging liquid receive means (25*a*), whereby the supply of gas refrigerant from the hot heat source means (1) to the charging liquid receive means (25*a*) is stopped, gas refrigerant is supplied from the hot heat source means (1) to the user-side means (3) and is condensed in the user-side means (3) thereby allowing the operation of radiating heat to be continued, and gas refrigerant is supplied from the hot heat source means (1) to the discharging liquid receive means (25*b*) to equalize pressures of the hot heat source means (1) and the discharging liquid receive means (25*b*) thereby producing a flow of liquid refrigerant from the discharging liquid receive means (25*b*) to the hot heat source means (1) to recover the liquid refrigerant in the discharging liquid receive means (25*b*) to the hot heat source means (1); and the control means (C) alternately changes each of the liquid receive means (25*a*, 25*b*) between the charging liquid receive means and the discharging liquid receive means thereby successively executing the operation of radiating heat.

38. A heat transfer device according to claim 37, wherein the gas flow selecting means (8) includes: first shut-off valves (EV7-1, EV7-2) which are provided between the hot heat source means (1) and connection points of the gas flow pipes (4*a*, 4*b*) with the gas pipes (26*a*, 26*b*) and correspond to the liquid receive means (25*a*, 25*b*), respectively; and second shut-off valves (EV8-1, EV8-2) which are provided between the cold heat source means (2) and connection points of the gas flow pipes (4*a*, 4*b*) with the gas pipes (26*a*, 26*b*) and correspond to the liquid receive means (25*a*, 25*b*), respectively, and the control means (C) is configured to allow:

each of the first shut-off valves (EV7-1, EV7-2) to be closed at the transfer of liquid refrigerant from the user-side means (3) to the liquid receive means (25*a*, 25*b*) corresponding to the first shut-off valve (EV7-1, EV7-2) but to be open during the operation of recovering liquid refrigerant in the liquid receive means (25*a*, 25*b*) corresponding to the first shut-off valve (EV7-1, EV7-2); and each of the second shut-off valves (EV8-1, EV8-2) to be closed at the supply of gas refrigerant from the hot heat source means (1) to the liquid receive means (25*a*, 25*b*) corresponding to the second shut-off valve (EV8-1, EV8-2) but to be open at the transfer of liquid refrigerant from the user-side means (3) to the liquid receive means (25*a*, 25*b*) corresponding to the second shut-off valve (EV8-1, EV8-2).

39. A heat transfer device according to claim 37, wherein the liquid flow selecting means (9) includes: first check valves (CV1-1, CV1-2) which are provided between the hot heat source means (1) and connection points of the liquid flow pipes (5*a*, 5*b*) with the liquid pipes (27*a*, 27*b*) and allow only flows toward the hot heat source means (1), respectively; second check valves (CV2-1, CV2-2) which are provided between the cold heat source means (2) and connection points of the liquid flow pipes (5*a*, 5*b*) with the liquid pipes (27*a*, 27*b*) and allow only flows toward the liquid receive means (25*a*, 25*b*), respectively; a third check valve (CV4) which is provided in the liquid pipe (7) and allows only flows toward the liquid receive means (25*a*, 25*b*).

40. A heat transfer device according to claim 36, wherein the control means (C) is configured to control the gas flow selecting means (8) and the liquid flow selecting means (9) to execute an operation of absorbing heat of the user-side means (3) in a manner that:

gas refrigerant is supplied from the hot heat source means (1) to the discharging liquid receive means (25*a*) to push out liquid refrigerant in the discharging liquid receive means (25*a*) to the user-side means (3), the liquid refrigerant is evaporated in the user-side means (3) while the gas refrigerant is condensed in the cold heat source means (2), and the gas refrigerant evaporated in the user-side means (3) is transferred to the charging liquid receive means (25*b*) communicated with the cold heat source means (2) by pressure difference between the user-side means (3) and the cold heat source means (2) caused due to drop in pressure of the cold heat source means (2);

when liquid refrigerant in the charging liquid receive means (25*b*) exceeds a specified amount of storage, the control means (C) changes the charging liquid receive means (25*b*) and the remaining discharging liquid receive means (25*a*) into the discharging liquid receive means (25*b*) and the charging liquid receive means (25*a*) respectively, whereby the supply of gas refrigerant from the hot heat source means (1) to the charging liquid receive means (25*a*) is stopped while gas refrigerant is supplied from the hot heat source means (1) to the discharging liquid receive means (25*b*) to push out the liquid refrigerant in the discharging liquid receive means (25*b*) to the user-side means (3) thereby allowing the operation of absorbing heat to be continued; and the control means (C) alternately changes each of the liquid receive means (25*a*, 25*b*) between the charging liquid receive means and the discharging liquid receive means thereby successively executing the operation of absorbing heat.

41. A heat transfer device according to claim 40, wherein each of the cold heat source means (2a, 2b) is placed at a position higher than that of the hot heat source means (1), and the control means (C) is configured to control the gas flow selecting means (8) and the liquid flow selecting means (9) to execute an operation of recovering refrigerant when liquid refrigerant in the hot heat source means (1) becomes short of a specified amount of storage, in a manner that gas refrigerant is supplied from the hot heat source means (1) to the charging liquid receive means (25a, 25b) to equalize pressures of the hot heat source means (1) and the charging liquid receive means (25a, 25b) so that a flow of liquid refrigerant from the liquid receive means (25a, 25b) to the hot heat source means (1) is produced thereby recovering liquid refrigerant in the liquid receive means (25a, 25b) to the hot heat source means (1).

42. A heat transfer device according to claim 41, wherein the gas flow selecting means (8) includes: first shut-off valves (EV7-1, EV7-2) which are provided between the hot heat source means (1) and connection points of the gas flow pipes (4a, 4b) with the gas pipes (26a, 26b) and correspond to the liquid receive means (25a, 25b), respectively; and second shut-off valves (EV8-1, EV8-2) which are provided between the cold heat source means (2) and the connection points of the gas flow pipes (4a, 4b) with the gas pipes (26a, 26b) and correspond to the liquid receive means (25a, 25b), respectively, and the control means (C) is configured to allow:

each of the first shut-off valves (EV7-1, EV7-2) to be closed at the supply of liquid refrigerant from the cold heat source means (2) to the liquid receive means (25a, 25b) corresponding to the first shut-off valve (EV7-1, EV7-2) but to be open during the operation of recovering the liquid refrigerant in the liquid receive means (25a, 25b) corresponding to the first shut-off valve (EV7-1, EV7-2); and each of the second shut-off valves (EV8-1, EV8-2) to be closed at the supply of gas refrigerant from the hot heat source means (1) to the liquid receive means (25a, 25b) corresponding to the second shut-off valve (EV8-1, EV8-2) but to be open at the transfer of liquid refrigerant from the cold heat source means (2) to the liquid receive means (25a, 25b) corresponding to the second shut-off valve (EV8-1, EV8-2).

43. A heat transfer device according to claim 41, wherein the liquid flow selecting means (9) includes: a shut-off valve (EV4) provided at a recovery flow side part of the liquid flow pipes (5a, 5b) between the hot heat source means (1) and connection points with the liquid pipes (27a, 27b); first check valves (CV1-1, CV1-2) which are provided at recovery flow side parts of the liquid flow pipes (5a, 5b) respectively and each allow only a flow toward the hot heat source means (1) and the user-side means (3); and second check valves (CV2-1, CV2-2) which are provided between the cold heat source means (2) and the connection points of the liquid flow pipes (5a, 5b) with the liquid pipes (27a, 27b) and allow only flows toward the liquid receive means (25a, 25b), respectively, and the control means (C) is configured to open the shut-off valve (EV4) during the operation of recovering liquid refrigerant in the discharging liquid receive means (25a, 25b).

44. A heat transfer device according to claim 36, wherein each of the liquid receive means (25a, 25b) is placed at a position higher than that of the hot heat source means (1), and the control means (C) is configured to control the gas flow selecting means (8) and the liquid flow selecting means (9) to selectively execute:

(a) an operation of radiating heat of the user-side means in a manner that gas refrigerant is supplied from the hot heat source means (1) to the discharging liquid receive means (25a) and the user-side means (3) so that the gas refrigerant is condensed in the user-side means (3) and the liquid refrigerant condensed in the user-side means (3) is transferred to the charging liquid receive means (25b) by pressure difference between the cold heat source means (2) which condenses the gas refrigerant at a temperature lower than that of the user-side means (3) and the user-side means (3), when liquid refrigerant in the charging liquid receive means (25b) exceeds a specified amount of storage, the control means (C) changes the charging liquid receive means (25b) into the discharging liquid receive means (25b) to execute an operation of recovering refrigerant and changes the remaining discharging liquid receive means (25a) into the charging liquid receive means (25a), whereby the supply of gas refrigerant from the hot heat source means (1) to the charging liquid receive means (25a) is stopped, gas refrigerant is supplied from the hot heat source means (1) to the user-side means (3) and is condensed in the user-side means (3) thereby allowing the operation of radiating heat to be continued, and gas refrigerant is supplied from the hot heat source means (1) to the discharging liquid receive means (25b) to equalize pressures of the hot heat source means (1) and the discharging liquid receive means (25b) thereby producing a flow of liquid refrigerant from the discharging liquid receive means (25b) to the hot heat source means (1) to recover the liquid refrigerant in the discharging liquid receive means (25b) to the hot heat source means (1), and the control means (C) alternately changes each of the liquid receive means (25a, 25b) between the charging liquid receive means and the discharging liquid receive means thereby successively executing the operation of radiating heat;

(b) an operation of absorbing heat of the user-side means (3) in a manner that gas refrigerant is supplied from the hot heat source means (1) to the discharging liquid receive means (25a) to push out liquid refrigerant in the discharging liquid receive means (25a) to the user-side means (3), the liquid refrigerant is evaporated in the user-side means (3) while the gas refrigerant is condensed in the cold heat source means (2), and the gas refrigerant evaporated in the user-side means (3) is transferred to the charging liquid receive means (25b) communicated with the cold heat source means (2) by pressure difference between the user-side means (3) and the cold heat source means (2) caused due to drop in pressure of the cold heat source means (2), when liquid refrigerant in the charging liquid receive means (25b) exceeds a specified amount of storage, the control means (C) changes the charging liquid receive means (25*b*) and the remaining discharging liquid receive means (25*a*) into the discharging liquid receive means (25*b*) and the charging liquid receive means (25*a*) respectively, whereby the supply of gas refrigerant from the hot heat source means (1) to the charging liquid receive means (25*a*) is stopped while gas refrigerant is supplied from the hot heat source means (1) to the discharging liquid receive means (25*b*) to push out the liquid refrigerant in the discharging liquid receive means (25*b*) to the user-side means (3) thereby allowing the operation of absorbing heat to be continued, and the control means (C) alternately changes each of the liquid receive means (25*a*, 25*b*) between the charging liquid receive means and the discharging liquid receive means thereby successively executing the operation of absorbing heat.

45. A heat transfer device according to claim 44, wherein the control means (C) is configured to control the gas flow selecting means (8) and the liquid flow selecting means (9) to execute an operation of recovering refrigerant when liquid refrigerant in the hot heat source means (1) becomes short of a specified amount of storage during the operation of absorbing heat of the user-side means (3), in a manner that gas refrigerant is supplied from the hot heat source means (1) to the charging liquid receive means (25*a*, 25*b*) to equalize pressures of the hot heat source means (1) and the charging liquid receive means (25*a*, 25*b*) so that a flow of liquid refrigerant from the cold heat source means (2) to the hot heat source means (1) is produced thereby recovering liquid refrigerant in the liquid receive means (25*a*, 25*b*) to the hot heat source means (1).

46. A heat transfer device according to claim 45, wherein the gas flow selecting means (8) includes: first shut-off valves (EV7-1, EV7-2) which are provided between the hot heat source means (1) and connection points of the gas flow pipes (4*a*, 4*b*) with the gas pipes (26*a*, 26*b*) and correspond to the liquid receive means (25*a*, 25*b*), respectively; second shut-off valves (EV8-1, EV8-2) which are provided between the cold heat source means (2) and the connection points of the gas flow pipes (4*a*, 4*b*) with the gas pipes (26*a*, 26*b*) and correspond to the liquid receive means (25*a*, 25*b*), respectively; a third shut-off valve (EV2) provided in the gas pipe (6); and a fourth shout-off valve (EV3) provided in a connecting pipe (20) for connecting the user-side means (3) and the cold heat source means (2), and the control means (C) is configured to allow:

the first shut-off valve (EV7-1, EV7-2) corresponding to the charging liquid receive means (25*a*, 25*b*) to be closed at the transfer of liquid refrigerant from the user-side means (3) to the liquid receive means (25*a*, 25*b*) during the operation of radiating heat and at the transfer of liquid refrigerant from the cold heat source means (2) to the liquid receive means (25*a*, 25*b*) during the operation of absorbing heat;

the first shut-off valve (EV7-1, EV7-2) corresponding to the discharging liquid receive means (25*a*, 25*b*) to be open during the operation of recovering liquid refrigerant from the liquid receive means (25*a*, 25*b*) to the hot heat source means (1);

the second shut-off valve (EV8-1, EV8-2) corresponding to the discharging liquid receive means (25*a*, 25*b*) to be closed at the supply of gas refrigerant from the hot heat source means (1) to the liquid receive means (25*a*, 25*b*);

the second shut-off valve (EV8-1, EV8-2) corresponding to the charging liquid receive means (25*a*, 25*b*) to be open at the transfer of liquid refrigerant from the cold heat source means (2) to the liquid receive means (25*a*, 25*b*);

the third shut-off valve (EV2) to be open only during the operation of radiating heat of the user-side means (3); and the fourth shut-off valve (EV3) to be open only during the operation of absorbing heat of the user-side means (3).

47. A heat transfer device according to claim 45, wherein the liquid flow selecting means (9) includes: a first shut-off valve (EV4) provided at a recovery flow side part of the liquid flow pipes (5*a*, 5*b*) between the hot heat source means (1) and connection points with the liquid pipes (27*a*, 27*b*); first check valves (CV1-1, CV1-2) which are provided at recovery flow side parts of the liquid flow pipes (5*a*, 5*b*) respectively and each allow only a flow toward the hot heat source means (1) and the user-side means (3); second check valves (CV2-1, CV2-2) which are provided between the cold heat source means (2) and connection points of the liquid flow pipes (5*a*, 5*b*) with the liquid pipes (27*a*, 27*b*) and allow only flows toward the liquid receive means (25*a*, 25*b*), respectively; a second shut-off valve (EV9) provided in the liquid pipe (7); and a third shut-off valve (EV10) provided in a connecting pipe (21) for connecting the user-side means (3) with the liquid receive means (25*a*, 25*b*) through the second check valves (CV2-1, CV2-2) respectively, and the control means (C) is configured to allow:

the first shut-off valve (EV4) to be open only during the operation of recovering liquid refrigerant from the liquid receive means (25*a*, 25*b*) to the hot heat source means (1);

the second shut-off valve (EV9) to be open only during the operation of absorbing heat of the user-side means (3); and the third shut-off valve (EV10) to be open only during the operation of radiating heat of the user-side means (3).

48. A heat transfer device according to claim 36, wherein a plurality of the user-side means (3*a*–3*d*) are provided and are connected to the gas flow pipes (4*a*, 4*b*) and the liquid flow pipes (5*a*, 5*b*) through the gas pipes (6*a*–6*d*) and the liquid pipes (7*a*–7*d*) respectively in a manner capable of individual selection between an operation of radiating heat and an operation of absorbing heat, each of the liquid receive means (25*a*, 25*b*) is placed at a position higher than that of the hot heat source means (1), and the control means (C) is configured to control the gas flow selecting means (8) and the liquid flow selecting means (9) to execute an operation of mainly radiating heat in which the heat balance among all the user-side means (3*a*–3*d*) is in a heat radiative condition, in a manner that:

gas refrigerant is supplied from the hot heat source means (1) to the discharging liquid receive means (25*a*) and the heat-radiative user-side means (3) so that the gas refrigerant is condensed in the user-side means (3) and the liquid refrigerant condensed in the heat-radiative user-side means (3) is transferred to the charging liquid receive means (25*b*) by pressure difference between the cold heat source means (2) which condenses the gas refrigerant at a temperature lower than that of the heat-radiative user-side means (3) and the heat-radiative user-side means (3) and transferred to the heat-absorptive user-side means (3) by pressure difference between the heat-absorptive user-side means (3) and the heat-radiative user-side means (3);

while the gas refrigerant is concurrently evaporated in the heat-absorptive user-side means (3) and the gas refrigerant evaporated in the heat-absorptive user-side means (3) is transferred to the charging liquid receive means (25*b*) by pressure difference between the cold heat source means (2) and the heat-absorptive user-side means (3) caused due to refrigerant condensation in the cold heat source means (2);

when liquid refrigerant in the charging liquid receive means (25*b*) exceeds a specified amount of storage, the control means (C) changes the charging liquid receive means (25*b*) into the discharging liquid receive means (25*b*) to execute an operation of recovering refrigerant and changes the remaining discharging liquid receive means (25*a*) into the charging liquid receive means (25*a*), whereby the supply of gas refrigerant from the hot heat source means (1) to the charging liquid receive means (25*a*) is stopped, gas refrigerant is supplied from the hot heat source means (1) to the heat-radiative user-side means (3) and is condensed in the heat-radiative user-side means (3) thereby allowing the operation of radiating heat to be continued, and gas refrigerant is supplied from the hot heat source means (1) to the discharging liquid receive means (25*b*) to equalize pressures of the hot heat source means (1) and the discharging liquid receive means (25*b*) thereby producing a flow of liquid refrigerant from the discharging liquid receive means (25*b*) to the hot heat source means (1) to recover the liquid refrigerant in the discharging liquid receive means (25*b*) to the hot heat source means (1); and the control means (C) alternately changes each of the liquid receive means (25*a*, 25*b*) between the charging liquid receive means and the discharging liquid receive means thereby successively executing the operation of radiating heat.

49. A heat transfer device according to claim 36, wherein a plurality of the user-side means (3*a*–3*d*) are provided and are connected to the gas flow pipes (4*a*, 4*b*) and the liquid flow pipes (5*a*, 5*b*) through the gas pipes (6*a*–6*d*) and the liquid pipes (7*a*–7*d*) respectively in a manner capable of individual selection between an operation of radiating heat and an operation of absorbing heat, each of the cold heat source means (2*a*, 2*b*) is placed at a position higher than that of the hot heat source means (1), and the control means (C) is configured to control the gas flow selecting means (8) and the liquid flow selecting means (9) to execute an operation of mainly absorbing heat in which the heat balance among all the user-side means (3*a*–3*d*) is in a heat absorptive condition, in a manner that:

gas refrigerant is supplied from the hot heat source means (1) to the heat-radiative user-side means (3) and is condensed in the user-side means (3) and the liquid refrigerant condensed in the heat-radiative user-side means (3) is transferred to the heat-absorptive user-side means (3) by pressure difference between the heat-radiative user-side means (3) and the heat-absorptive user-side means (3) while gas refrigerant is supplied from the hot heat source means (1) to the discharging liquid receive means (25*a*) to push out liquid refrigerant in the discharging liquid receive means (25*a*) to the heat-absorptive user-side means (3);

the liquid refrigerant is evaporated in the heat-absorptive user-side means (3) while gas refrigerant is condensed in the cold heat source means (2), and the gas refrigerant evaporated in the heat-absorptive user-side means (3) is transferred to the charging liquid receive means (25*b*) by pressure difference between the heat-absorptive user-side means (3) and the cold heat source means (2) caused due to drop in pressure of the cold heat source means (2);

when liquid refrigerant in the charging liquid receive means (25*b*) exceeds a specific amount of storage, the control means (C) changes the charging liquid receive means (25*b*) and the remaining discharging liquid receive means (25*a*) into the discharging liquid receive means (25*b*) and the charging liquid receive means (25*a*) respectively, whereby the supply of gas refrigerant from the hot heat source means (1) to the charging liquid receive means (25*a*) is stopped while gas refrigerant is supplied from the hot heat source means (1) to the discharging liquid receive means (25*b*) and the heat-radiative user-side means (3) so that the liquid refrigerant in the discharging liquid receive means (25*b*) is pushed out to the heat-absorptive user-side means (3) thereby allowing the operation of absorbing heat to be continued; and the control means (C) alternately changes each of the liquid receive means (25*a*, 25*b*) between the charging liquid receive means and the discharging liquid receive means thereby successively executing the operation of absorbing heat.

50. A heat transfer device according to claim 49, wherein each of the liquid receive means (25*a*, 25*b*) is placed at a position higher than that of the hot heat source means (1), and the control means (C) is configured to control the gas flow selecting means (8) and the liquid flow selecting means (9) to execute an operation of recovering refrigerant when liquid refrigerant in the hot heat source means (1) becomes short of a specified amount of storage during the operation of mainly absorbing heat, in a manner that gas refrigerant is supplied from the hot heat source means (1) to the charging liquid receive means (25*a*, 25*b*) to equalize pressures of the hot heat source means (1) and the charging liquid receive means (25*a*, 25*b*) so that a flow of liquid refrigerant from the liquid receive means (25*a*, 25*b*) to the hot heat source means (1) is produced thereby recovering liquid refrigerant in the liquid receive means (25*a*, 25*b*) to the hot heat source means (1).

51. A heat transfer device according to claim 36, wherein a plurality of the user-side means (3*a*–3*d*) are provided and each of the user-side means (3*a*–3*d*) is connected to the gas flow pipes (4*a*, 4*b*) and the liquid flow pipes (5*a*, 5*b*) through the gas pipe (6) and the liquid pipes (7*e*, 7*f*) respectively in a manner capable of individual selection between an operation of radiating heat and an operation of absorbing heat, each of the liquid receive means (25*a*, 25*b*) is placed at a position higher than that of the hot heat source means (1), and the control means (C) is configured to control the gas flow selecting means (8) and the liquid flow selecting means (9) to execute:

(a) an operation of mainly radiating heat in which the heat balance among all the user-side means (3*a*–3*d*) is in a heat radiative condition, in a manner that gas refrigerant is supplied from the hot heat source means (1) to the discharging liquid receive means (25*a*) and the heat-radiative user-side means (3) so that the gas refrigerant is condensed in the user-side means (3) and the liquid refrigerant condensed in the heat-radiative user-side means (3) is transferred to the charging liquid receive means (25*b*) by pressure difference between the cold heat source means (2) which condenses the gas refrigerant at a temperature lower than that of the heat-radiative user-side means (3) and the heat-radiative user-side means (3) and transferred to the heat-absorptive user-side means (3) by pressure difference between the heat-absorptive user-side means (3) and the heat-radiative user-side means (3), while the gas refrigerant is concurrently evaporated in the heat-absorptive user-side means (3) and the gas refrigerant evaporated in the heat-absorptive user-side means (3) is transferred to the charging liquid receive means (25*b*) by pressure difference between the cold heat source means (2) and the heat-absorptive user-side means (3) caused due to refrigerant condensation in the cold heat source means (2), when liquid refrigerant in the charging liquid receive means (25*b*) exceeds a specified amount of storage, the control means (C) changes the charging liquid receive means (25*b*) into the discharging liquid receive means (25*b*) to execute an operation of recovering refrigerant and changes the remaining discharging liquid receive means (25*a*) into the charging liquid receive means (25*a*), whereby the supply of gas refrigerant from the hot heat source means (1) to the charging liquid receive means (25*a*) is stopped, gas refrigerant is supplied from the hot heat source means (1) to the heat-radiative user-side means (3) and is condensed in the heat-radiative user-side means (3) thereby allowing the operation of radiating heat to be continued, and gas refrigerant is supplied from the hot heat source means (1) to the discharging liquid receive means (25*b*) to equalize pressures of the hot heat source means (1) and the discharging liquid receive means (25*b*) thereby producing a flow of liquid refrigerant from the discharging liquid receive means (25*b*) to the hot heat source means (1) to recover the liquid refrigerant in the discharging liquid receive means (25*b*) to the hot heat source means (1), and the control means (C) alternately changes each of the liquid receive means (25*a*, 25*b*) between the charging liquid receive means and the discharging liquid receive means thereby successively executing the operation of radiating heat; and (b) an operation of mainly absorbing heat in which the heat balance among all the user-side means (3*a*–3*d*) is in a heat absorptive condition, in a manner that gas refrigerant is supplied from the hot heat source means (1) to the heat-radiative user-side means (3) and is condensed in the user-side means (3) and the liquid refrigerant condensed in the heat-radiative user-side means (3) is transferred to the heat-absorptive user-side means (3) by pressure difference between the heat-radiative user-side means (3) and the heat-absorptive user-side means (3) while gas refrigerant is supplied from the hot heat source means (1) to the discharging liquid receive means (25*a*) to push out liquid refrigerant in the discharging liquid receive means (25*a*) to the heat-absorptive user-side means (3)

the liquid refrigerant is evaporated in the heat-absorptive user-side means (3) while gas refrigerant is condensed in the cold heat source means (2), and the gas refrigerant evaporated in the heat-absorptive user-side means (3) is transferred to the charging liquid receive means (25*b*) by pressure difference between the heat-absorptive user-side means (3) and the cold heat source means (2) caused due to drop in pressure of the cold heat source means (2), when liquid refrigerant in the charging liquid receive means (25*b*) exceeds a specified amount of storage, the control means (C) changes the charging liquid receive means (25*b*) and the remaining discharging liquid receive means (25*a*) into the discharging liquid receive means (25*b*) and the charging liquid receive means (25*a*) respectively, whereby the supply of gas refrigerant from the hot heat source means (1) to the charging liquid receive means (25*a*) is stopped while gas refrigerant is supplied from the hot heat source means (1) to the discharging liquid receive means (25*b*) and the heat-radiative user-side means (3) so that the liquid refrigerant in the discharging liquid receive means (25*b*) is pushed out to the heat-absorptive user-side means (3) thereby allowing the operation of absorbing heat to be continued, and the control means (C) alternately changes each of the liquid receive means (25*a*, 25*b*) between the charging liquid receive means and the discharging liquid receive means thereby successively executing the operation of absorbing heat.

52. A heat transfer device according to claim 51, wherein the gas flow selecting means (8) includes: first shut-off valves (EV7-1, EV7-2) which are provided between the hot heat source means (1) and connection points of the gas flow pipes (4*a*, 4*b*) with the gas pipes (26*a*, 26*b*) and correspond to the liquid receive means (25*a*, 25*b*), respectively; second shut-off valves (EV8-1, EV8-2) which are provided between the cold heat source means (2) and connection points of the gas flow pipes (4*a*, 4*b*) with the gas pipes (26*a*, 26*b*) and correspond to the liquid receive means (25*a*, 25*b*), respectively; third shut-off valves (EV2-1 to EV2-4) provided in the gas pipes (6*a*–6*d*) and corresponding to the user-side means (3*a*–3*d*), respectively; a plurality of connecting pipes (10*a*–10*d*) which are each connected at one side thereof between the second shut-off valves (EV8-1, EV8-2) and the cold heat source means (2) and are connected at the other side between the third shut-off valves (EV2-1 to EV2-4) and the user-side means (3*a*–3*d*) respectively; and fourth shut-off valves (EV3-1 to EV3-4) provided in the connecting pipes (10*a*–10*d*) and corresponding to the user-side means (3*a*–3*d*), respectively, the control means (C) is configured to allow:

the first shut-off valve (EV7-1, EV7-2) corresponding to the charging liquid receive means (25*a*, 25*b*) to be closed at the transfer of liquid refrigerant from the heat-radiative user-side means (3) to the liquid receive means (25*a*, 25*b*) during the operation of mainly radiating heat and at the transfer of liquid refrigerant from the cold heat source means (2) to the liquid receive means (25*a*, 25*b*) during the operation of mainly absorbing heat; the first shut-off valve (EV7-1, EV7-2) corresponding to the discharging liquid receive means (25*a*, 25*b*) to be open at the supply of gas refrigerant from the hot heat source means (1) to the liquid receive means (25*a*, 25*b*);

the second shut-off valve (EV8-1, EV8-2) corresponding to the discharging liquid receive means (25*a*, 25*b*) to be closed at the supply of gas refrigerant from the hot heat source means (1) to the liquid receive means (25*a*, 25*b*);

the second shut-off valve (EV8-1, EV8-2) corresponding to the charging liquid receive means (25*a*, 25*b*) to be open at the transfer of liquid refrigerant from the cold heat source means (2) to the liquid receive means (25*a*, 25*b*);

each of the third shut-off valves (EV2-1 to EV2-4) to be open only during the operation of radiating heat of the corresponding user-side means (3); and each of the fourth shut-off valves (EV3-1 to EV3-4) to be open only during the operation of absorbing heat of the corresponding user-side means (3).

53. A heat transfer device according to claim 51, wherein the liquid flow selecting means (9) includes: a first shut-off valve (EV4) provided between the hot heat source means (1) and connection points of the liquid flow pipe (5) with the liquid pipes (27*a*, 27*b*); first check valves (CV1-1, CV1-2) which are provided between the hot heat source means (1) and connection points of the liquid flow pipes (5*a*, 5*b*) with the liquid pipes (27*a*, 27*b*) respectively and each allow only a flow toward the hot heat source means (1) and the user-side means (3*a*–3*d*); second check valves (CV2-1, CV2-2) which are provided between the cold heat source means (2) and connection points of the liquid flow pipes (5*a*, 5*b*) with the liquid pipes (27*a*, 27*b*) and allow only flows toward the liquid receive means (25*a*, 25*b*), respectively; a second shut-off valve (EV9) provided in the liquid pipe (7); and a third shut-off valve (EV10) provided in a connecting pipe (21) for connecting the user-side means (3*a*–3*d*) with the liquid receive means (25*a*, 25*b*) through the second check valves (CV2-1, CV2-2) respectively, and the control means (C) is configured to allow:

the first shut-off valve (EV4) to be open only during the operation of recovering liquid refrigerant from the liquid receive means (25*a*, 25*b*) to the hot heat source means (1);

the second shut-off valve (EV9) to be open only during the operation of mainly absorbing heat of the user-side means (3); and the third shut-off valve (EV10) to be open only during the operation of mainly radiating heat of the user-side means (3).

54. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein the hot heat source means (1) is configured to evaporate refrigerant by receiving an amount of heat from refrigerant for heat source circulating in a heat source-side refrigerant circuit (A), the cold heat source means (2) is configured to condense refrigerant by losing an amount of heat to the refrigerant for heat source, and the heat source-side refrigerant circuit (A) comprises:

heating heat exchange means (12) for exchanging heat with the hot heat source means (1) to give an amount of heat for evaporating refrigerant to the hot heat source means (1);

cooling heat exchange means (15) for exchanging heat with the cold heat source means (2) to take an amount of heat for condensing refrigerant from the cold heat source means (2); and heat exchange amount adjusting means (14) for giving, to the refrigerant for heat source, a difference between both the heat exchange amounts of the heating heat exchange means (12) and the cooling heat exchange means (15) during the operation of radiating heat of the user-side means (3) when the heat exchange amount of the heating heat exchange means (12) is larger than that of the cooling heat exchange means (15).

55. A heat transfer device according to claim 54, wherein the heat source-side refrigerant circuit (A) is configured in a manner that refrigerant heating means (11), the heating heat exchange means (12), expansion mechanism (13), the heat exchange amount adjusting means (14) and the cooling heat exchange means (15) are connected in this order in a manner capable of circulating refrigerant, the heat source-side refrigerant circuit (A) further comprises a bypass passage (17) which is connected at one end thereof between the expansion mechanism (13) and the heat exchange amount adjusting means (14) and at the other end between the heat exchange amount adjusting means (14) and the cooling heat exchange means (15), and the bypass passage (17) is provided with a flow control valve (18) adjustable in opening for controlling a flow rate of refrigerant flowing into the heat exchange amount adjusting means (14) according to a difference between the heat exchange amount of the heating heat exchange means (12) and that of the cooling heat exchange means (15).

56. A heat transfer device according to claim 54, wherein the heat source-side refrigerant circuit (A) is configured in a manner that refrigerant heating means (11), the heating heat exchange means (12), expansion mechanism (18*a*) and the cooling heat exchange means (15) are connected in this order in a manner capable of circulating refrigerant, the heat source-side refrigerant circuit (A) further comprises a bypass passage (17) for bypassing the cooling heat exchange means (15) and directly introducing refrigerant from the heating heat exchange means (12) into the refrigerant heating means (11), and the bypass passage (17) is provided with the heat exchange amount adjusting means (14).

57. A heat transfer device according to claim 56, wherein the bypass passage (17) is connected at one end thereof between the heating heat exchange means (12) and the expansion mechanism (18*a*) and at the other end between the cooling heat exchange means (15) and the refrigerant heating means (11), and a flow control valve (18*b*) adjustable in opening for controlling a flow rate of refrigerant flowing into the heat exchange amount adjusting means (14) according to a difference between the heat exchange amount of the heating heat exchange means (12) and that of the cooling heat exchange means (15) and for reducing the pressure of refrigerant for heat source is provided between one end of the bypass passage (17) and the heat exchange amount adjusting means (14).

58. A heat transfer device according to claim 54, wherein the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted.

59. A heat transfer device according to claim 55, wherein the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted, and the defrosting means (31) comprises:

a hot gas pipe (32) which is connected at one end thereof to a discharge side of the refrigerant heating means (11) and at the other end to the heat exchange amount adjusting means (14);

a shut-off valve (EVD1) which is provided in the hot gas pipe (32) and is opened only under defrosting operation;

a suction pipe (33) for introducing refrigerant having passed through the heat exchange amount adjusting means (14), the expansion mechanism (13) and the heating heat exchange means (12) into a suction side of the refrigerant heating means (11); and a shut-off valve (EVD2) which is provided in the suction pipe (33) and is opened only under defrosting operation.

60. A heat transfer device according to claim 56, wherein the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted, and the defrosting means (31) comprises:

a shut-off valve (EVD4) which is provided between the refrigerant heating means (11) and the heating heat exchange means (12) and is closed under defrosting operation;

a connecting pipe (33) which is connected at one end thereof between the shut-off valve (EVD4) and the heating heat exchange means (12) and at the other end to a suction side of the refrigerant heating means (11); and a shut-off valve (EVD3) which is provided in the connecting pipe (33) and is closed under defrosting operation.

61. A heat transfer device according to claim 54, wherein the refrigerant heating means is a compressor (11).

62. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein the hot heat source means (1) is configured to evaporate refrigerant by receiving an amount of heat from refrigerant for heat source circulating in a heat source-side refrigerant circuit (A), the cold heat source means (2) is configured to condense refrigerant by losing an amount of heat to the refrigerant for heat source, and the heat source-side refrigerant circuit (A) comprises:

heating heat exchange means (12) for exchanging heat with the hot heat source means (1) to give an amount of heat for evaporating refrigerant to the hot heat source means (1);

cooling heat exchange means (15) for exchanging heat with the cold heat source means (2) to take an amount of heat for condensing refrigerant from the cold heat source means (2); and heat exchange amount adjusting means (14) for taking, from the refrigerant for heat source, a difference between both the heat exchange amounts of the heating heat exchange means (12) and the cooling heat exchange means (15) during the operation of absorbing heat of the user-side means (3) when the heat exchange amount of the heating heat exchange means (12) is smaller than that of the cooling heat exchange means (15).

63. A heat transfer device according to claim 62, wherein the heat source-side refrigerant circuit (A) is configured in a manner that refrigerant heating means (11), the heating heat exchange means (12), the heat exchange amount adjusting means (14), expansion mechanism (13) and the cooling heat exchange means (15) are connected in this order in a manner capable of circulating refrigerant, the heat source-side refrigerant circuit (A) further comprises a bypass passage (17) which is connected at one end thereof between the expansion mechanism (13) and the heat exchange amount adjusting means (14) and at the other end between the heat exchange amount adjusting means (14) and the cooling heat exchange means (15), and the bypass passage (17) is provided with a flow control valve (18) adjustable in opening for controlling a flow rate of refrigerant flowing into the heat exchange amount adjusting means (14) according to a difference between the heat exchange amount of the heating heat exchange means (12) and that of the cooling heat exchange means (15).

64. A heat transfer device according to claim 62, wherein the heat source-side refrigerant circuit (A) is configured in a manner that refrigerant heating means (11), the heating heat exchange means (12), expansion mechanism (18*a*) and the cooling heat exchange means (15) are connected in this order in a manner capable of circulating refrigerant, the heat source-side refrigerant circuit (A) further comprises a bypass passage (17) for bypassing the heating heat exchange means (12) and directly introducing refrigerant from the refrigerant heating means (11) into the cooling heat exchange means (15), and the bypass passage (17) is provided with the heat exchange amount adjusting means (14).

65. A heat transfer device according to claim 64, wherein the bypass passage (17) is connected at one end thereof between the expansion mechanism (18*a*) and the cooling heat exchange means (15) and at the other end between the refrigerant heating means (11) and the heating heat exchange means (12), and a flow control valve (18*b*) adjustable in opening for controlling a flow rate of refrigerant flowing into the heat exchange amount adjusting means (14) according to a difference between the heat exchange amount of the heating heat exchange means (12) and that of the cooling heat exchange means (15) and for reducing the pressure of refrigerant for heat source is provided between one end of the bypass passage (17) and the heat exchange amount adjusting means (14).

66. A heat transfer device according to claim 62, wherein the refrigerant heating means is a compressor (11).

67. A heat transfer device comprising:

hot heat source means (1) for evaporating refrigerant through the application of heat;

colt heat source means (2) which is connected to the hot heat source means (1) through a gas flow pipe (4) and a liquid flow pipe (5) to form a closed circuit with the hot heat source means (1) and condenses refrigerant by heat radiation;

user-side means (3) connected to the gas flow pipe (4) through a gas pipe (6) and to the liquid flow pipe (5) through a liquid pipe (7);

gas flow selecting means (8) for changing gas refrigerant flow between the gas flow pipe (4) and the gas pipe (6);

liquid flow selecting means (9) for changing liquid refrigerant flow between the liquid flow pipe (5) and the liquid pipe (7); and control means (C) for controlling at least one of the gas flow selecting means (8) and the liquid flow selecting means (9) to change refrigerant flow with respect to the user-side means (3) according to an operation mode of the user-side means(3); wherein the hot heat source means (1) is configured to evaporate refrigerant by receiving an amount of heat from refrigerant for heat source circulating in a heat source-side refrigerant circuit (A), the cold heat source means (2) is configured to condense refrigerant by losing an amount of heat to the refrigerant for heat source, and the heat source-side refrigerant circuit (A) comprises:

heating heat exchange means (12) for exchanging heat with the hot heat source means (1) to give an amount of heat for evaporating refrigerant to the hot heat source means (1);

cooling heat exchange means (15) for exchanging heat with the cold heat source means (2) to take an amount of heat for condensing refrigerant from the cold heat source means (2); and heat exchange amount adjusting means (14) for giving, to the refrigerant for heat source, a difference between both the heat exchange amounts of the heating heat exchange means (12) and the cooling heat exchange means (15) during the operation of heat of the user-side means (3) when the heat exchange amount of the heating heat exchange means (12) is larger than that of the cooling heat exchange means (15), but taking, from the refrigerant for heat source, a difference between both the heat exchange amounts of the heating heat exchange means (12) and the cooling heat exchange means (15) during the operation of absorbing heat of the user-side means (3) when the heat exchange amount of the heating heat exchange means (12) is smaller than that of the cooling heat exchange means (15).

68. A heat transfer device according to claim 67, wherein the heat source-side refrigerant circuit (A) is configured in a manner that refrigerant heating means (11), the heating heat exchange means (12), expansion mechanism (13), the heat exchange amount adjusting means (14) and the cooling heat exchange means (15) are connected in this order in a manner capable of circulating refrigerant, the heat source-side refrigerant circuit (A) further comprises:

a four-way selector valve (19) which selects, during the heating operation of the user-side means (3), a heating operation position that allows refrigerant from the heating heat exchange means (12) to pass through the expansion mechanism (13), the heat exchange amount adjusting means (14) and the cooling heat exchange means (15) in this order and selects, during the cooling operation of the user-side means (3), a cooling operation position that allows refrigerant from the heating heat exchange means (12) to pass through the heat exchange amount adjusting means (14), the expansion mechanism (13) and the cooling heat exchange means (15) in this order; and a bypass passage (17) which is connected at one end thereof between the expansion mechanism (13) and the heat exchange amount adjusting means (14) and at the other end between the heat exchange amount adjusting means (14) and the four-way selector valve (19), and the bypass passage (17) is provided with a flow control valve (18) adjustable in opening for controlling a flow rate of refrigerant flowing into the heat exchange amount adjusting means (14) according to a difference between the heat exchange amount of the heating heat exchange means (12) and that of the cooling heat exchange means (15).

69. A heat transfer device according to claim 67, wherein the heat source-side refrigerant circuit (A) is configured in a manner that refrigerant heating means (11), the heating heat exchange means (12), expansion mechanism (18*c*) and the cooling heat exchange means (15) are connected in this order in a manner capable of circulating refrigerant, the heat source-side refrigerant circuit (A) further comprises a bypass passage (17) for bypassing the cooling heat exchange means (15) during the heating operation of the user-side means (3) to introduce refrigerant from the heating heat exchange means (12) into the refrigerant heating means (11) while bypassing the heating heat exchange means (12) during the cooing operation of the user-side means (3) to introduce refrigerant from the refrigerant heating means (11) into the cooling heat exchange means (15), and the bypass passage (17) is provided with the heat exchange amount adjusting means (14) and a pressure reduction mechanism (18) for reducing the pressure of refrigerant during the heating operation of the user-side means (3).

70. A heat transfer device according to claim 69, wherein one end of the bypass passage (17) is divided into a suction branch pipe (16*a*) and a discharge branch pipe (16*b*), the suction branch pipe (16*a*) is connected to a suction side of the refrigerant heating means (11) and the discharge branch pipe (16*b*) is connected to a discharge side of the refrigerant heating means (11), the suction branch pipe (16*a*) is provided with a shut-off valve (EV1) which is open during the heating operation of the user-side means (3) and is closed during the cooling operation thereof, and the discharge branch pipe (16*b*) is provided with a shut-off valve (EVO) which is closed during the heating operation of the user-side means (3) and is open during the cooling operation thereof.

71. A heat transfer device according to claim 67, wherein the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted.

72. A heat transfer device according to claim 68, wherein the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted, and the defrosting means (31) comprises:

a hot gas pipe (32) which is connected at one end thereof to a discharge side of the refrigerant heating means (11) and at the other end to the heat exchange amount adjusting means (14);

a shut-off valve (EVD1) which is provided in the hot gas pipe (32) and is opened only under defrosting operation;

a suction pipe (33) for introducing refrigerant having passed through the heat exchange amount adjusting means (14), the expansion mechanism (13) and the heating heat exchange means (12) into a suction side of the refrigerant heating means (11); and a shut-off valve (EVD2) which is provided in the suction pipe (33) and is opened only under defrosting operation.

73. A heat transfer device according to claim 69, wherein the heat source-side refrigerant circuit (A) further comprises defrosting means (31) for supplying refrigerant discharged from the refrigerant heating means (11) to the heat exchange amount adjusting means (14) to defrost the heat exchange amount adjusting means (14) when the heat exchange amount adjusting means (14) is frosted, and the defrosting means (31) comprises:

a shut-off valve (EVD4) which is provided between the refrigerant heating means (11) and the heating heat exchange means (12) and is closed under defrosting operation;

a connecting pipe (33) which is connected at one end thereof between the shut-off valve (EVD4) and the heating heat exchange means (12) and at the other end to a suction side of the refrigerant heating means (11); and a shut-off valve (EVD3) which is provided in the connecting pipe (33) and is closed under defrosting operation.

74. A heat transfer device according to claim 67, wherein the refrigerant heating means is a compressor (11).

* * * * *

UNITED STATES PATENT AND TRADEMARK OFFICE

CERTIFICATE OF CORRECTION

PATENT NO. : 6,116,035
DATED : September 12, 2000
INVENTOR(S) : Osamu Tanaka; Kazuhide Mizutani; Toru Inazuka; Takashi Matsuzaki; and Yasushi Hori It is certified that error appears in the above-identified patent and that said Letters Patent is hereby corrected as shown below:

Title page,
References Cited, Item [56], under FOREIGN PATENT DOCUMENTS add:

| | | |
|---|---|---|
| 62 238951 | 10/19/1987 | Japan |
| 05 306849 | 11/19/1993 | Japan |

Column 72, claim 9,
Line 52, after "that", change ";" to -- : --.

Column 81, claim 26,
Line 29, after "gas refrigerant is", change "is means (1) to the e" to -- is supplied from the --.

Column 96, claim 49,
Line 20, change "specific" to -- specified --.

Column 105, claim 69,
Line 25, change "cooing" to -- cooling --.

Signed and Sealed this

Twelfth Day of February, 2002

*Attest:*

*Attesting Officer*

JAMES E. ROGAN
*Director of the United States Patent and Trademark Office*